US006135781A

United States Patent [19]

Pope et al.

[11] Patent Number: 6,135,781

[45] Date of Patent: Oct. 24, 2000

[54] ELECTRICAL INTERCONNECTION SYSTEM AND DEVICE

[75] Inventors: Richard A. Pope, Austin; Thomas M. Cherney, Georgetown; David S. Hardcastle, Liberty Hill, all of Tex.

[73] Assignee: Minnesota Mining and Manufacturing Company, Saint Paul, Minn.

[21] Appl. No.: 08/870,929

[22] Filed: Jun. 6, 1997

Related U.S. Application Data

[63] Continuation of application No. 08/733,513, Oct. 18, 1996, which is a continuation of application No. 08/682,487, Jul. 17, 1996.

[51] Int. Cl.[7] ..... H01R 9/09

[52] U.S. Cl. ..... 439/59; 439/953

[58] Field of Search ..... 439/59, 79, 80, 439/953, 328

[56] References Cited

U.S. PATENT DOCUMENTS

| | | | |
|---|---|---|---|
| 1,794,777 | 3/1931 | Kliegl | 439/953 |
| 2,904,768 | 9/1959 | Rasmussen | 339/17 |
| 3,444,506 | 5/1969 | Wedekind | 339/99 |
| 3,517,803 | 6/1970 | Frompovicz et al. | 206/56 |
| 3,665,375 | 5/1972 | Thoms et al. | 339/192 R |
| 3,745,895 | 7/1973 | Brandt et al. | 95/11 R |
| 3,772,632 | 11/1973 | Rattcliff et al. | 339/17 CF |
| 4,159,158 | 6/1979 | Weldler | 339/97 P |
| 4,392,705 | 7/1983 | Andrews, Jr. et al. | 339/75 MP |
| 4,418,974 | 12/1983 | MacDougall | 439/368 |
| 4,420,215 | 12/1983 | Tengler | 339/176 R |
| 4,487,468 | 12/1984 | Fedder et al. | 339/75 MP |
| 4,619,495 | 10/1986 | Sochor | 339/176 MP |
| 4,734,045 | 3/1988 | Hawkins | 439/79 |
| 4,734,060 | 3/1988 | Kawawada et al. | 439/660 |
| 4,781,612 | 11/1988 | Thrush | 439/328 |
| 4,804,336 | 2/1989 | Miller et al. | 439/218 |
| 4,808,115 | 2/1989 | Norton et al. | 439/79 |
| 4,846,734 | 7/1989 | Lytle | 439/637 |

(List continued on next page.)

FOREIGN PATENT DOCUMENTS

| | | | |
|---|---|---|---|
| 040 783 | 12/1981 | European Pat. Off. . | |
| 144 923 | 6/1985 | European Pat. Off. . | |
| 450 770 | 10/1991 | European Pat. Off. . | |
| 459 680 | 12/1991 | European Pat. Off. . | |
| 482 669 | 4/1992 | European Pat. Off. . | |
| 544 390 | 6/1993 | European Pat. Off. . | |
| 546 679 | 6/1993 | European Pat. Off. . | |
| 564 955 | 10/1993 | European Pat. Off. . | |
| 0 682 387 A1 | 3/1995 | European Pat. Off. | H01R 23/70 |
| 676 833 | 10/1995 | European Pat. Off. . | |

(List continued on next page.)

OTHER PUBLICATIONS

Pope and Schoenbauer, "Temperature Rise and Its Importance to Connector Users," 3M Electronic Products Division, appeared in the 37th Annual Electronic Components Conference Proceedings, pp. 1–8, 1987.

*Primary Examiner*—Steven L. Stephan
*Assistant Examiner*—T C Patel
*Attorney, Agent, or Firm*—Matthew B. McNutt

[57] ABSTRACT

An interconnection providing multiple electrical interconnections at a fine pitch can be formed in a pluggable and unpluggable form using multiple connector channels and rows of contact elements in each of a plug and socket. The contacts may be a mixture of active and passive contacts. Furthermore, a contact support structure may provide improve spring characteristics in the contacts. The contacts may be formed in a number of configurations including vertical staggering, alternating or offset patterns, mulit-level tail exit designs, rotated contacts, staggered or nonalign retention features and dedicated power contacts. Anchors or permanent latches, separable latches, and polarization keys may also be utilized. Alternative embodiments may include straddlemount and attachment clip embodiments.

8 Claims, 104 Drawing Sheets

U.S. PATENT DOCUMENTS

| | | | |
|---|---|---|---|
| 4,904,212 | 2/1990 | Durbin et al. | 439/751 |
| 4,934,961 | 6/1990 | Piorunneck et al. | 439/637 |
| 4,979,903 | 12/1990 | Gosselin | 439/78 |
| 4,998,887 | 3/1991 | Kaufman et al. | 439/78 |
| 5,024,609 | 6/1991 | Piorunneck | 439/637 |
| 5,046,960 | 9/1991 | Fedder | 439/108 |
| 5,052,936 | 10/1991 | Biechler et al. | 439/60 |
| 5,137,454 | 8/1992 | Baechtle | 439/62 |
| 5,145,386 | 9/1992 | Berg et al. | 439/83 |
| 5,145,407 | 9/1992 | Obata et al. | 439/567 |
| 5,154,627 | 10/1992 | Lee | 439/326 |
| 5,181,855 | 1/1993 | Mosquera et al. | 439/74 |
| 5,188,535 | 2/1993 | Bertho et al. | 439/83 |
| 5,199,880 | 4/1993 | Arai | 439/65 |
| 5,213,514 | 5/1993 | Arai | 439/79 |
| 5,241,451 | 8/1993 | Walburn et al. | 361/785 |
| 5,263,867 | 11/1993 | Doi et al. | 439/62 |
| 5,273,460 | 12/1993 | Arai | 439/79 |
| 5,277,597 | 1/1994 | Masami et al. | 439/83 |
| 5,310,357 | 5/1994 | Olson | 439/346 |
| 5,380,225 | 1/1995 | Inaoka | 439/660 |
| 5,397,241 | 3/1995 | Cox et al. | 439/79 |
| 5,411,402 | 5/1995 | Bethurum | 439/953 |
| 5,433,616 | 7/1995 | Walden | 439/62 |
| 5,453,017 | 9/1995 | Belopolsky | 439/83 |
| 5,478,248 | 12/1995 | Mitra et al. | 439/74 |
| 5,486,115 | 1/1996 | Northey et al. | 439/108 |
| 5,509,826 | 4/1996 | White | 439/637 |
| 5,520,545 | 5/1996 | Sipe | 439/65 |
| 5,535,513 | 7/1996 | Frantz | 29/882 |
| 5,545,051 | 8/1996 | Summers et al. | 439/350 |
| 5,547,384 | 8/1996 | Benjamin | 439/79 |
| 5,561,323 | 10/1996 | Andros et al. | 257/707 |
| 5,593,311 | 1/1997 | Lybrand | 439/295 |
| 5,618,191 | 4/1997 | Chikano et al. | 439/108 |
| 5,641,290 | 6/1997 | Yagi | 439/74 |
| 5,697,799 | 12/1997 | Consoli et al. | 439/181 |
| 5,733,142 | 3/1998 | Clark | 439/79 |

FOREIGN PATENT DOCUMENTS

| | | |
|---|---|---|
| 682 366 | 11/1995 | European Pat. Off. . |
| 27 13 909 | 10/1978 | Germany . |
| 37 03 020 | 8/1988 | Germany . |
| 5-144498 | 6/1993 | Japan . |
| 7-211377 | 8/1995 | Japan . |
| 8-116145 | 5/1996 | Japan . |
| 2 165 105 | 4/1986 | United Kingdom . |
| WO 90/16093 | 12/1990 | WIPO . |
| WO 93/03513 | 2/1993 | WIPO . |
| WO 95/17025 | 6/1995 | WIPO . |

160
168
172
170a
170b
170
176
179
162
178
166

174
172
170
176
175
178

174
172
170
176
175
178

436
438
432
436
430
438

ELECTRICAL INTERCONNECTION SYSTEM AND DEVICE

BACKGROUND OF THE INVENTION

This is a continuation of co-pending application Ser. No. 08/733,513, filed Oct. 18, 1996, which is a continuation-in-part of co-pending U.S. patent application Ser. No. 08/682,487 filed Jul. 17, 1996. The entire texts and figures of the above-referenced disclosures are specifically incorporated by reference herein without disclaimer.

FIELD OF THE INVENTION

The invention relates generally to interconnection systems for use in electrical and electronic connectors, including two-piece, card edge, and wire interconnections. In particular, this invention relates to an improvement in fine pitch connectors for connecting printed circuit boards (PCB) for applications including board stacking, vertical to vertical, mother to daughter, vertical to right angle and/or straddle, and in one aspect relates to an improved connector comprising a plug and a socket each having four rows of electrical contact elements.

DESCRIPTION OF THE PRIOR ART

The art is replete with connectors for making multiple interconnections between boards, between boards and discreet wires, and between boards and flexible circuits, all of which have the goal of making the most interconnections per area of board space.

For example, board to board connectors are illustrated in PCT Application WO 93/03513 published Feb. 18, 1993 and in U.S. Pat. No. 5,380,225 issued Jan. 10, 1995. The publication illustrates a board to board interconnection of the hermaphrodicitic design wherein the connector portions have the identical shape and are mated in a single orientation to ensure proper electrical connection. Further, the solder tails of the connector portions are spaced 1 mm and each portion of the connector is formed to have a row of passive contacts (fixed contact surfaces) and a row of active contacts (movable spring contract surface). This relationship, according to the publication, reduces the required overall PCB to PCB stack height (the distance between two coupled circuit boards) because only one spring height is required. Further, since each connector has both spring contacts and fixed contacts, the spring force on the movable contacts is the same from its initial mate height until the final mate height. The movable spring contacts are deflected by the same predetermined amount regardless of the PCB to PCB stack height. The latter patent referenced above teaches the use of a connector making two rows of contacts, each row including staggered contacts. This connector however discloses the contact elements of a passive nature in the plug 1*a* and the active, flexible contacts in the jack 1. The contact elements are however all spaced and staggered to form the four rows of contacts of equal number in one connector, lengthwise thereof. Other PCB to PCB interconnections are shown in WO 90/16093 where opposed spring contacts were employed which increased the stack height.

U.S. Pat. No. 4,804,336 discloses a D-shaped connector having improved density by using staggered rows of pin contacts in the body to double the density from the normal 50 contacts to 100. As in U.S. Pat. No. 5,380,225, staggering and duplicity alone does not serve to adequately improve the density of the interconnections to be made and still reduce the stack height.

Historically, separable two-piece connectors are either of pin and socket style or ribbon style. Pin and socket connectors typically utilize a substantially straight, solid copper alloy pin of primarily round or square cross section with the tip of the pin shaped in one of many ways to provide alignment to and deflection of a mating contact. These pins are typically covered with a precious metal plating and are then installed in an injection molded housing to position and to electrically isolate each pin. They are often presented in two symmetrical rows of pins. Typically, distance between pins within a row and distance between rows of pins are equal. A socket contact can take on a wide variety of forms, but is usually contained inside a housing which receives the rows of straight pins with a shaped end feature. A socket contact is typically "active," meaning that physical changes of the dimensions, reaction forces, and internal stress levels in the contact material occur during mating with a pin. A pin contact is typically "passive," meaning that no changes, or very limited physical changes, occur during mating. One example of an active socket type is known as a "spring contact" due to the fact that it deflects during mating with a pin and reacts by providing a normal force against the pin. Spring contacts may also act to absorb variations in sizes of contacts, variations in positioning of contacts in a housing, and other variations that may occur during mating.

Ribbon based connectors typically utilize a substantially rectangular, copper alloy pin that is covered with precious metal. The ribbon systems differ from pin and sockets in that both contacts are usually rectangular in shape and each typically mates with a like contact in the flattest or longest dimension of the contact. In addition, these contacts are generally open and visible from the separable side of both connector housing halves of a mating system. Rectangular portions may also be configured on a board mount or cable mount side of a connector pin as well. Ribbon systems like pin and socket systems have in the past utilized one contact type in the socket housing and a different contact type in the plug housing. It has also been observed that some systems use the same type contact in both the plug and in the socket, but in a reverse orientation. A ribbon system may have active contacts in one housing and passive contacts in the other, or both housings may contain active contacts which mate with one another. Conventional ribbon systems have embodied two rows of contacts in a single connector housing with each row having the same number of contacts present.

A typical active (or "spring") contact has a cantilever beam design that includes a metal contact mounted in a connector housing constructed of a material such as plastic. In such a design, one end of the cantilevered spring contact is relatively free to move or deflect within the housing, while the other end of the contact is relatively fixed in the connector housing material. The point at which a contact is secured to a connector housing may be referred to as the "fixed point." When the connector housing is mated with a corresponding connector component, the free end of the cantilevered contact is deflected by contact with another contact element, such as a pin or a passive or active ribbon contact. The point where the two contact elements meet may be referred to as the "contact point." This deflection serves to induce internal stress in the active contact or contacts which, in turn, results in generation of a reaction force against the other contact. This reaction force is important, as it forces the contacts together at the contact point in such a way to enhance electrical contact and to reduce electrical resistance between the two contacts (known as "constriction resistance"). Reaction force is a function of the cross section of a contact (width and thickness), as well as its length. Most importantly, both internal stress and contact normal force are inversely proportional to distance from the contact anchoring point, or contact base.

Traditional cantilevered active spring contact designs suffer from several disadvantages. Internal stresses generated by deflection of an active spring of the cantilevered design typically diminish rapidly with distance from the base of the spring toward the end of the contact and/or the contact point. Because these internal stresses are fully utilized only at the base or fixed point of a contact, force present at the contact point is reduced as a function of distance from the contact base or fixed point, resulting in degraded electrical contact and increased constriction resistance. Constriction resistance may be a primary cause of heat generation when current flows through a connection. Heat generation in turn may cause stress relaxation in contact materials, resulting in a further decrease in contact normal force and a further increase in constriction resistance and heat generation. This may become a self-perpetuating process, in which additional heat is transferred to the surroundings and stress relaxation continues. This process may continue until a connection becomes open or until surrounding materials soften, melt, or burn.

Another disadvantage of the traditional cantilevered contact is the occurrence of plastic "creep" at the base of a deflected spring contact. As discussed above, maximum internal stresses are present at the fixed point where a deflected spring contact is anchored in a connector housing. Over time, reaction forces generated by a metal contact against a plastic housing typically causes the plastic to yield or "creep". This phenomenon may result in a shifting of the contact base and a resulting shift in the effective fixed point of the contact to a location below the original base of the contact. This phenomenon causes an increase in the effective deflection length of the contact and a corresponding reduction in the contact normal force generated by contact deflection. As described above, with decreased contact normal force may come increased contact resistance and operating temperature. Decreased contact normal force may also make the connection susceptible to shock and vibration disturbance from sources such as cooling fans and transportation motion. Finally, when deflected under stress, cantilever beam spring contacts are susceptible to permanent deflection and/or overstress. Permanent deflection of a spring contact may result in a reduction in internal stress and contact normal force. This may also contribute to an increase in constriction resistance.

Thus, a contact configuration capable of maintaining internal stress and contact normal force at a distance from the fixed point of a contact, and for an extended period of time is desirable.

U.S. Pat. No. 4,420,215 to Tengler discloses a cantilever contact configuration with a contact arm having an effective length that varies during deformation in response to a member inserted to engagement with a contacting means. The contact disclosed in Tengler has a curved or bowed shape that interacts with a linear surface of a connector housing. Among the disadvantages of the contact design disclosed in Tengler is an increased connector width required to house the profile of the shaped contact. This need for increased width is undesirable in view of the demand for increasingly miniaturized components.

An alternative approach to Tengler is shown in patent application DE 3703020, which shows a contact configuration in which a portion of a contact spring extending between a support point and a contact area is progressively shortened in the course of deflection of the contact area. In this case, the contact has a linear shape that interacts with a curved surface of a connector housing.

In addition to electrical connector contact problems, printed circuit boards which receive or engage connector products typically suffer from some degree of one dimensional bowing or two dimensional warpage/twist to them. These boards may also vary in thickness. Such nonuniformities may cause difficulties in connection configurations involving circuit boards. For example, when mounting a surface mount connector to a bowed or warped board, it may be difficult to obtain uniform and/or effective solder connections between connector compact tails and board solder pads. In addition, bowed or warped circuit boards may be difficult to align and/or insert into a card edge connector housing, decreasing the reliability of the connection. Also, connectors are generally being configured with increasing pin counts and as a result are being built longer even in the presence of higher densities. Increased connector lengths exacerbate the problem because printed circuit board bowing, warpage, and/or twisting typically worsen with increased connector length and width. Further, many connector users are migrating to more connector installations that utilize surface mount processes which do not have the benefit of long tails extending into and through holes in the board. Because surface mount configurations depend on contact between connector feet and surface pads as described above, bowing, warpage, and other variations in board surface characteristics may particularly impact connection integrity of longer, higher density surface mount connections. Finally, board attachment processes are utilizing higher and higher temperatures to fully activate solder paste to ensure that all joints are fully reflowed and these higher temperatures also increase board warpage. Because board warpage is typically caused by differences in coefficients of thermal expansion between different layers of a laminated circuit board, these higher temperatures also may increase board warpage, thereby exacerbating connection problems.

Typical card edge connector systems employ a connector housing with a cavity for receiving a card edge. A card edge typically employs a number of passive contacts and the connector housing typically contains a number of active contacts for mating with the passive contacts of the circuit board card edge. During mating of a card edge with a connector it is important that the board and connector housing contacts be aligned prior to engaging so that contacts are not damaged and proper connection is made between the two parts. In the past printed circuit boards have been provided with features, such as through holes for aligning connectors to a board. These through holes are typically engaged by latching features mounted on engagement members, such as cantilever spring or pivotally mounted moveable arms. Not only do these holes and latching members fail to provide alignment during mating of a card edge with a connector, but these mechanisms also latch a card within a connector housing by means of a force applied normal to the side of the card edge, which may tend to push a board to one side or the other of a connector housing potentially resulting in unbalanced forces being applied to the mated contacts. In addition, the cantilevered or pivotally mounted latching members may be bulky and difficult to construct. Thus, a mechanism to anchor a connector to a board despite such board nonuniformities is desirable.

In other cases, card edge connectors are constructed such that a polarization means, such as a rib, provides alignment to a slot routed in a printed circuit board. The mating portions of these connectors are typically rigid and fixed in position, therefore requiring that a clearance be provided between the polarization rib and the slot sidewalls in all conditions of feature size and placement in both parts, respectively. In addition, a typical circuit board slot feature is usually formed or placed on a printed circuit board in separate step and relative to the tooling holes. The conducting contact pads on the printed circuit board are also typically positioned in a separate step and relative to the same tooling holes. Because of the separate step, a number of tolerances and clearances are typically required in a conventional card edge connector system. These tolerances tend to be cumulative in nature, and therefore work against a fine pitch interconnection system for card edge configurations by producing mating components that result in conducting contacts which fail to, or only partially contact the border of a mating conductor pad. Furthermore, due to the additive nature of tolerances in the positioning of latching holes and contact elements on a circuit board card, these latching holes may not provide proper alignment of connector housing contacts with circuit board contacts when engaged with the latching member features. Consequently, a mechanism for properly aligning the contacts of a circuit board and mating card edge connector, and of anchoring the card edge and connector in this aligned position without exerting forces normal to the side of the circuit board is desirable.

Among other problems related to connector technology are those that arise when surface mounting a connector in a straddlemount configuration. In this configuration, conducting pads of a printed circuit board are typically positioned near the edge of the board and are usually present on both sides. When connecting a connector to a board, problems may develop in correctly positioning the conducting tails of contact elements in a lateral direction (i.e., sideways) with respect to printed circuit board edges, as well in a longitudinal direction (i.e., in and out of the board) in the direction of connector attachment.

Typically, a mechanical fastener is presented and affixed to each end of a straddlemount connector before or after solder reflow, typically performed by hot bar or by heating solder paste. Presenting mechanical fasteners in either condition increases the cost of the placement operation. There is also a cost associated with possible damage done during the assembly. In addition, typical designs of this nature rely on conducting contact tails to hold a connector on the board during handling, during solder attachment processes, and during subsequent handling afterwards. It is likely that movement or misalignment will occur in these periods. This is especially true since the board often will be placed on a conveyor which travels through an oven. In this case, a straddlemount connector typically prevents the board from being laid flat on the conveyor and thus a twisting load or torque is placed on the connector. This creates an unbalanced force arrangement on the conducting contact tail portions. The net result is that the connector can be soldered in an incorrect position (e.g., tilt or off center), or that the conducting contact tails will be soldered more on one side than on the other side. Thus a straddlemount connecting device capable of fixing a connector to a printed circuit board in a simple manner and in a way which protects contact tails from movement or misalignment during handling or manufacture is desirable. In addition, a straddlemount connection mechanism that would provide alignment of the contact tails to circuit board solder pads is particularly desirable.

Conducting tail and board attachment portions of conductors in any connector product are important as once set, they heavily constrain the manufacturing processes of a connector and the manufacturing process for assembly of the connector to a printed circuit board.

Almost all products in the electronic industry are continuously being replaced by smaller and faster products. In the case of connectors, product sizes are primarily driven by the host product which the connectors serve. This means that the conducting members are smaller (shorter, thinner, and/or narrower) and are being positioned closer together. The reduction in size of the conductors enables faster electrical signals to pass through the connector. However, more pins are usually required to enable faster performance in the connector product for grounding purposes and for creating more host product operations being done in parallel.

Electrical signals on close spaced conductors may interfere with one another. Capacitive and/or inductive coupling between two adjacent conductors may induce a noise voltage on the neighboring conductor. This unwanted noise voltage is referred to as "cross talk". Controlling and minimizing cross talk is especially important in any high frequency application. In addition, most connector applications contain many interconnection lines. In these cases, cross talk is magnified by the magnitude and number of conductors affected.

By inserting a ground path for the currents to return and hence cause the magnetic field to collapse, cross talk can be minimized. This is a common industry practice. However, even with the presence of a ground return path, electrical field coupling from a driven line to a quiet line typically occurs as a result of the symmetry involved in the connector geometry. Therefore, a tail exit design that simultaneously addresses problems of mechanical density and electrical interference is desirable. It is desirable that a tail exit design address both mechanical density and electrical design characteristics.

High frequency or high speed performance is a function of conductor sizes, materials, geometry, dielectric materials, thickness including air gaps, proximity or relative position or signal conductors to their corresponding ground, and parameters of like kind. In general, the more uniform the above parameters are throughout the entire interconnection path, including the base printed circuit board and connector embodiments, the better the high frequency performance. Cross talk aspects of high speed signaling are described above. Impedance is another important electrical parameter. Both have direct relationships and dependence on the proximity to neighboring conductor elements.

Traditionally, conducting elements are retained within an insulating housing. This is typically performed by placing one or more retention features (typically bumps or barbs) on each edge of a conducting element and forcibly inserting them into a receiving hole or pocket in the insulating housing which is intentionally smaller in size than the corresponding area of a conducting element. A pocket size may be smaller in both dimensions of width and thickness of the cross section or may be just smaller in width in comparison to the bump region of a conducting element. In either case, when a conductive element is forcibly inserted into a housing pocket, the housing is deformed. This deformation occurs since the polymer materials from which a housing is made typically has a strength on the order of 10% of the strength of the copper alloy materials typically used to construct conductive elements. Therefore, deformation in the housing occurs when the ultimate strength of the polymer material used in the insulative housing is exceeded. However, a portion of the housing material typically remains in the elastic region. Thus, elastic equilibrium exists. In addition, polymer materials typically used in the insulative housings are thermoplastics. The modulus of thermoplastics is a function of stress, temperature, and time. The net effect is that there is typically an ongoing and increasing deformation of the geometric shape of the housing pocket over a period of time which is dependent on stresses on the polymer and the temperature of the environment to which it is exposed to. This phenomena is typically referred to as "creep".

Most electrical interconnection products contain more than one conducting path. Typically these have been arranged in longitudinal rows with one or more columns. When an element having symmetrical features is inserted into a housing pocket, the tips of each bump or barb are typically aligned with the bump or barb retention features of neighboring elements. Since a retention feature typically projects from the side of each element, the closest distance between an element and its neighboring elements is typically between opposing retention features. Therefore, a connector housing is thin in this area, and when coupled with stresses induced by an intentional mechanical interference condition, it is possible to initiate an undesired crack through an insulating housing. Such a crack often occurs in a corner region of a pocket due to the stress concentration factors and or in a knit line area. Another problem posed by the close distance between the retention features of a conducting element and the retention features of its neighboring conductor elements is cross talk and impedance. As previously described these phenomena have a direct relationship and dependence on the proximity of neighboring conductor elements.

Thus a conductor or contact retention configuration that increases distance between neighboring conducting elements without sacrificing the density of a connector is desired, thereby reducing electrical and mechanical interference both between the conductor elements and the connector housing.

Traditionally, connector products have contained contacts of like kind throughout, regardless of size or shape. Given this, power has typically been delivered between printed circuit boards and other devices in electronic products by a number of smaller contacts of the same type as that used to pass higher frequency signals. As signal density in connectors increase, the size of conducting elements typically decrease, as does the ability of these elements to transfer electrical power. This is generally due to the electrical conductivity of the contact material and the smaller cross-sectional area. As a result, an increasing number of smaller contacts are required to deliver power, a fact that typically impacts the contact density.

One alternative to the above design is to provide power via a separate power connector with substantial size. Typically these connectors are referred to as "Icons" due to their height and size. Use of these Icon conductors helps alleviate contact density problems, but there is cost associated with placing two types of connectors on one board. In addition, there typically is variation in both horizontal directions, and in the tilt or "Z" direction position between the placement of the Icon and other connectors. Finally, there are typically two mating halves either mounted to another printed circuit board or other housing. This further confounds the positioning variation and typically creates an environment in which connectors mechanically interfere with each other.

Furthermore, as the size and ability of conductor elements to transfer electrical power decreases, problems associated with increased constriction resistance typically increase. In particular, smaller contact geometries may result in contacts that deform or damage more easily, and therefore are more likely to make poor contact with connection points such as solder pads. In addition, smaller contacts are more likely to be overstressed or deformed over time, decreasing contact forces and increasing constriction resistance. When a power contact makes poor connection with a solder pad, either due to misalignment or stress relaxation, heat is typically generated due to increased constriction resistance. As described above, heat generation typically induces further stress relaxation and housing creep. In addition, with power contacts a danger of fire is greater due to the amount of current being transferred through a contact area.

Thus, a power contact configuration capable of resisting deformation, maintaining alignment with solder pad connections, maintaining good electrical contact cross-sectional area and having good rigidity is desired.

To meet demands for smaller, faster, and less expensive products and to address the problems discussed above, improved fine pitched connectors are required. Current connector products do not provide an optimal solution to these opportunities despite the fact that many interconnection schemes have been explored. Therefore, there exists a need for new, high density, high pin count, and low profile electrical connectors that may also provide low cost interconnections.

SUMMARY OF THE INVENTION

The disclosed method and apparatus relate to separable interconnection systems for use in electrical and electronic connectors. These products may be used to electrically and/or mechanically connect multiple printed circuit boards and to facilitate transfer of electrical signals, power, and/or ground between the printed circuit boards.

The present invention provides an interconnection which meets the design criteria of the electronic industry. The interconnection of the present invention comprises a mating socket and plug. The socket comprises a body including a base and three parallel wall members positioned on one side of the base forming a central wall member and opposed identical side wall members and the central wall member has opposite surfaces and the side wall members have surfaces opposed to the opposite surfaces of the central wall member. Electrical contact elements are positioned along the opposite surfaces of the central wall member forming two rows of contact elements and electrical contact elements are positioned along the opposed surfaces of the side wall members forming two additional rows of contact elements. The plug comprises a body having a top wall and at least two depending spaced parallel wall members, with each wall member having opposite surfaces, and the parallel wall members being adapted to be disposed one on each side of the socket central wall member. Electrical contact elements are positioned along the opposite surfaces of the parallel wall members forming four rows of contact elements for electrical contact with the electrical contact elements positioned along the opposite surfaces of the central wall member and with the electrical contact elements positioned along the side wall members.

The interconnection of the present invention comprises a socket and a plug to permit interconnection of a PCB to a PCB, for board stacking, vertical, mother to daughter, vertical to right angle and/or straddle. The interconnection of the present invention can be coupled to the PCB in any of a number of ways, with two single rows the solder bonds could be at a spacing of 0.4 mm, or in four staggered rows with the bonds at 0.8 mm spacing, or by pin bonds at 0.8 mm spacing between solder bonds. Various connections reduce the foot print of the part and the amount of real estate used on the PCB or other.

One embodiment affords an interconnection of reduced width by having only two rows of spring contacts (active) in each part of the interconnection, narrower solder tails on the contacts outside the connector parts, notches on the part to permit the positioning of the solder tails in the parts for improved board attachment, stability, reliability against cross talk, and assuring impedance.

In one embodiment, the socket and plug form mirror images about a plane forming a longitudinal section of the socket and plug. Further, in a preferred embodiment the active contact elements of the socket and plug are cantilever mounted and each are formed with an arcuate end portion forming the contact portion which interferes with and makes electrical contact with the passive contact elements upon mating the socket with the plug.

In one embodiment, a plurity of connector channels are provided in both a socket and plug. The use of a plurality of channels allows for an increased number of contacts in a given area. Associated with the connector channels may be a row of contacts. A wide variety of combinations of the numbers of rows and channels in a plug or in an associated socket may be used. In one embodiment, a connector piece having two channels may mate with a connector piece having three channels, both pieces having four rows of contacts.

In yet another embodiment, a contact support structure is provided for interaction with an active contact. The contact support structure may take the form of any number of shapes. The contact support structure provides a surface that a spring contact may engage as the contact is being deflected. The contact support causes the effective fixed point of an active spring contact to shift toward the free end of the contact, shortening the effective length of the contact while allowing substantially the same force to be delivered through the contact using low strength materials or smaller sizes. In one embodiment, the contact support structure is formed by a curved wall in the connector housing adjacent an active contact.

The interconnection systems disclosed herein may include a mixture of active and passive contacts. An active contact generally is provided through a spring contact which may or may not utilize a contact support wall. In one embodiment the active contact includes a contact end which may be curved to engage the passive contact. A passive contact is generally a relatively stationary contact which may be relatively flat in design. The mixture of both active and passive is relatively space efficient and distributes the mechanical forces more evenly between both a socket and a plug, thus allowing for thinner housing walls, an increased contact pitch, and increased contact counts in a single connector.

The contacts in one embodiment of the interconnection system may be vertically staggered. In particular, some contacts may extend vertically higher than other contacts. In a preferred embodiment every other contact may be higher or lower than its adjacent contact, thus providing a pattern of vertically staggered contacts. Because the contacts may be staggered, as two connector pieces (or one connector piece and a board) are brought together, some contacts will mate with their corresponding connection surfaces before other contacts will. The stagger of the contacts allows for sequential mating (i.e. ground or power or signal lines to be mated in a predetermined order) and decreases the insertion force required to mate the interconnection system. When staggered contacts are used with a contact support structure, adjacent contact support structures may be vertically staggered also.

The contacts disclosed for use herein may be arranged in an alternating design. More particularly, the contacts may be arranged in separate rows on opposite sides of a housing wall in positions which are offset from the contact on the opposing side of the wall. In one embodiment the offset may be half the distance between contacts in the same row. This enables the tail portions of the contacts to be formed to the side of the connector in an alternating pattern. Such an arrangement provides benefits in electrical isolation between contacts. Mechanically, the interconnection system is more rugged and will provide addition contact support because the stress distribution from the contacts on to the wall are more evenly spread across the housing wall.

The contacts for use with the disclosed interconnection system may exit the plug or socket housing in a multi-level manner. In a particular embodiment, the contact tails exit the housing at various horizontal locations in a bi-level manner. This arrangement of the contact tail portions provides three dimensional separation with respect to any neighboring contact tail or base portion. This separation forms multiple planes by which the contact tails are routed to the board mounting position. In one embodiment, the upper most plane of contacts is formed with contacts residing in the outer most positioned row of the connector, and layering sequentially each next inner row. The tails may also exit the housing through grooves or notches which provide X-Y positioning and maintain or preserve the separation. The horizontal separation allows for wider tails and a finer pitch between adjacent contacts. The muli-level tail exits thus provide improved cross-talk, mechanical stability, power transfer and pitch characteristics.

The components of the interconnection system disclosed herein may be anchored or latched to a substrate (for example a printed circuit board) in a variety of manners. The anchoring function may be provided by extensions of a socket or plug housing which extend downward to engage the substrate. An anchor may also be utilized in a card edge connection system. The anchor may be formed in a variety of manners, including an extension piece having spring like fingers which may penetrate and engage the substrate. The anchor may straighten substrate deformaties and provide mechanical stability to protect the solder joints.

The sockets and plugs (or card edges) of the interconnection systems disclosed may include a separable latch system for inherently securing the connector components when the components are mated. The latches may be formed by a latch portion of a connector piece which may engage a slot in a card edge, though other mechanical arrangements are possible. The latch portion may have surface projections which have a spring like function when the latch portion engages the slot. The slot may include recess shapes to accept the surface projections thus accomplishing the latching function. The latches may be either conducting or non-conducting. A conducting latch may provide an electrical path for signal, power or ground transfer. The latches may be placed within the interconnection system in a manner that also provides a polarization key so that mating may only occur in one manner.

In one embodiment, one or more straddlemount clips may be provided for use with the sockets or plugs of the disclosed interconnection system. The clips may be configured to permanently or removably attach to a socket or plug connector, or may be configured as part of a socket or plug connector. Among other things, the straddlemount clips may provide three dimensional positioning of connector contact features on a designated substrate location, such as for solder attachment. The clips may be provided in a variety of configurations, including those providing directional polarization or that are keyed for selective mating of substrates with particular connector types. The clips may also be configured to shield contact features, such as contact tails attached to associated components, prior to substrate mating. The clips may also shield contact features from mechanical stress after substrate attachment.

The contacts utilized in the interconnection system disclosed herein may include contact retention features (bumbs, barps, teeth, extensions, etc.) which engage the connector housing so as to secure the contact with the housing. In one embodiment, the retention features alternate from one edge of a contact to the other edge of the contact. Thus, the distance between two contacts remains relatively constant rather than narrowing at the retention feature locations. Such an alternating arrangement provides improved electrical insulation between adjacent contacts and lessens cross-talk between contacts. Further, such alternating arrangements lessens mechanical stresses enabling a finer pitch by employing thinner walls between contacts.

The contacts of the present interconnection systems may also be formed in a rotated and non-rotated fashion. A rotated contact typically has a thickness much greater than its width. Such a contact may be formed from a stamping or blanking process rather than a bending process. Because of the greater contact thickness, the rotated contact may be mechanically stronger than non-rotated contacts. Furthermore, the relatively narrow width of a rotated contact allows for a small pitch between contacts. The rotated contacts may also be utilized in a system employing contact support structures.

In one embodiment, power contacts having a plurality of mating portions are provided. A plurality of mating portions may be provided on both separable and substrate or wire interconnection regions of a power contact for increased power transfer and reliability. The power contacts may have a "T shaped" and/or "U shaped" sections. The power contacts may be grouped together, disposed sequentially, or dispersed randomly with signal contacts within a connector component. The power contacts may also be provided in one or more power modules that may be added to the ends or end of a connector. The power contacts may be configured with sufficient size to provide mechanical retention for associated components and/or to define a connector seating plane.

BRIEF DESCRIPTION OF THE DRAWINGS

FIG. 1G is a cross sectional view of placement caps.

FIG. 89 is a perspective view of the plug of an electrical interconnection according to the present invention.

FIG. 90 is a vertical cross sectional view taken through the socket of FIG. 88 and the plug of FIG. 89 with the same disposed in position for interconnection.

FIG. 91 is a schematic view showing the foot print of the socket or plug according to the embodiment of FIG. 90.

FIG. 92 is a vertical cross sectional view of a socket and plug of a first modification.

FIG. 93 is a schematic view of the foot print of the socket or plug according to FIG. 92.

FIG. 94 is a perspective view of a passive contact element.

FIG. 95 is a perspective view of an active contact element.

DESCRIPTION OF ILLUSTRATIVE EMBODIMENTS

Figure 1:
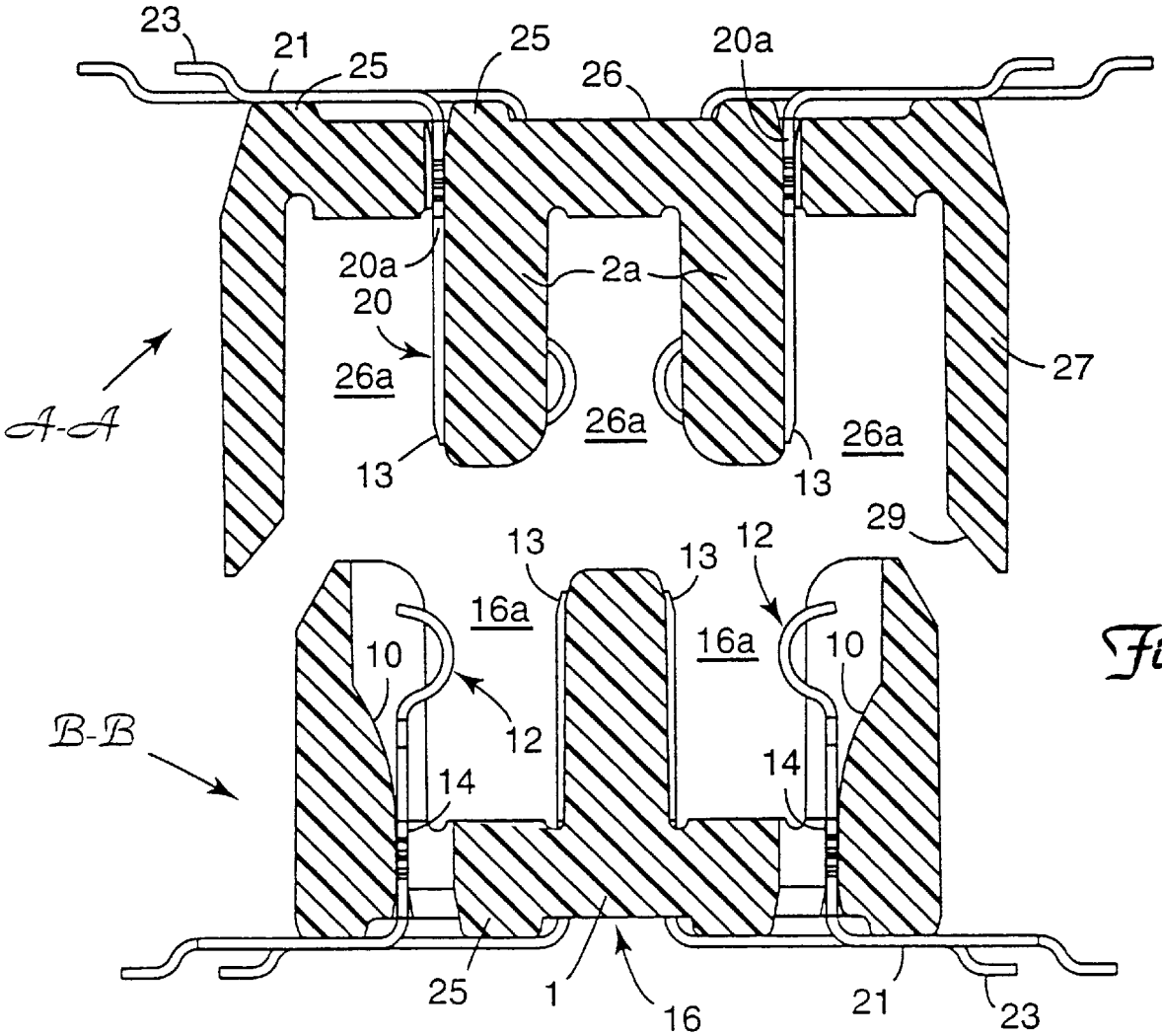
FIG. 1 is a vertical cross sectional view taken through the socket of FIG. 1A and the plug of FIG. 1B, with the same disposed in position for interconnection.
Figure 1A:
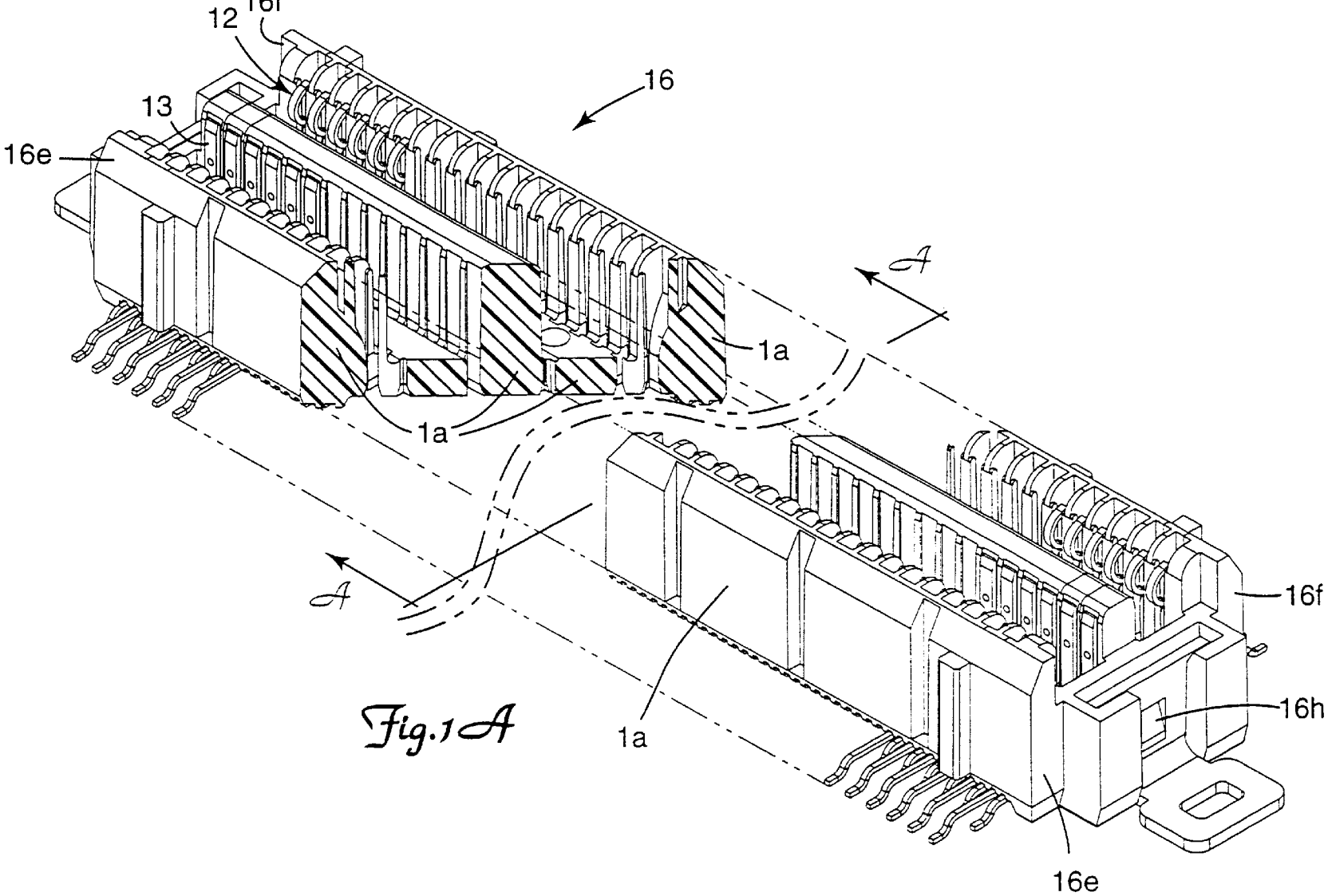
FIG. 1A is a perspective view of a socket of an electrical interconnection according to one embodiment of the disclosed method and apparatus.
Figure 1B:
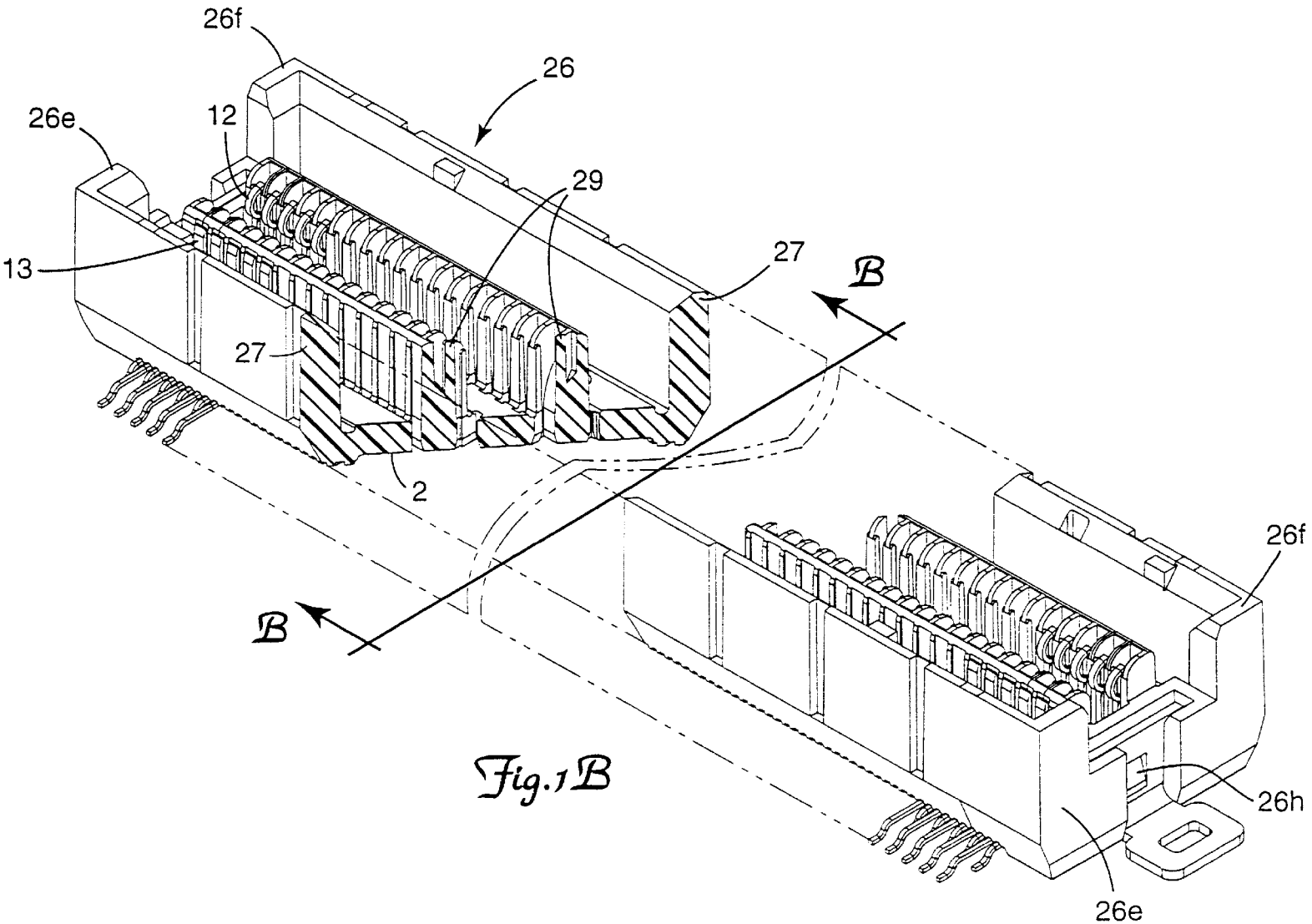
FIG. 1B is a perspective view of a plug of an electrical interconnection according to one embodiment of the disclosed method and apparatus.
Figure 1C:
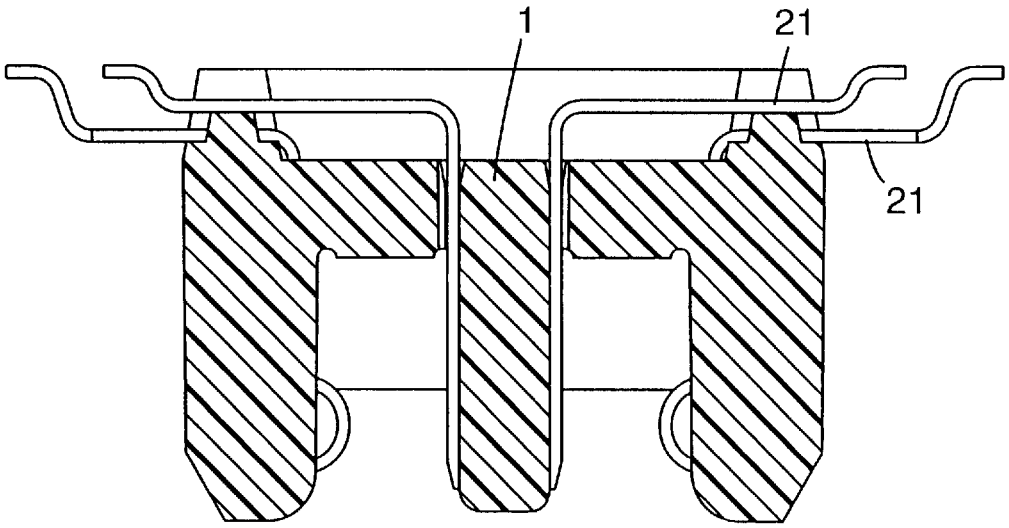
FIG. 1C is a vertical cross sectional view taken through a socket and a plug of an electrical interconnection of an embodiment of the disclosed method and apparatus having a contact tail exit configuration different from that of the embodiment illustrated in FIGS. 1A, 1B, 1, and 2.
Figure 1C:
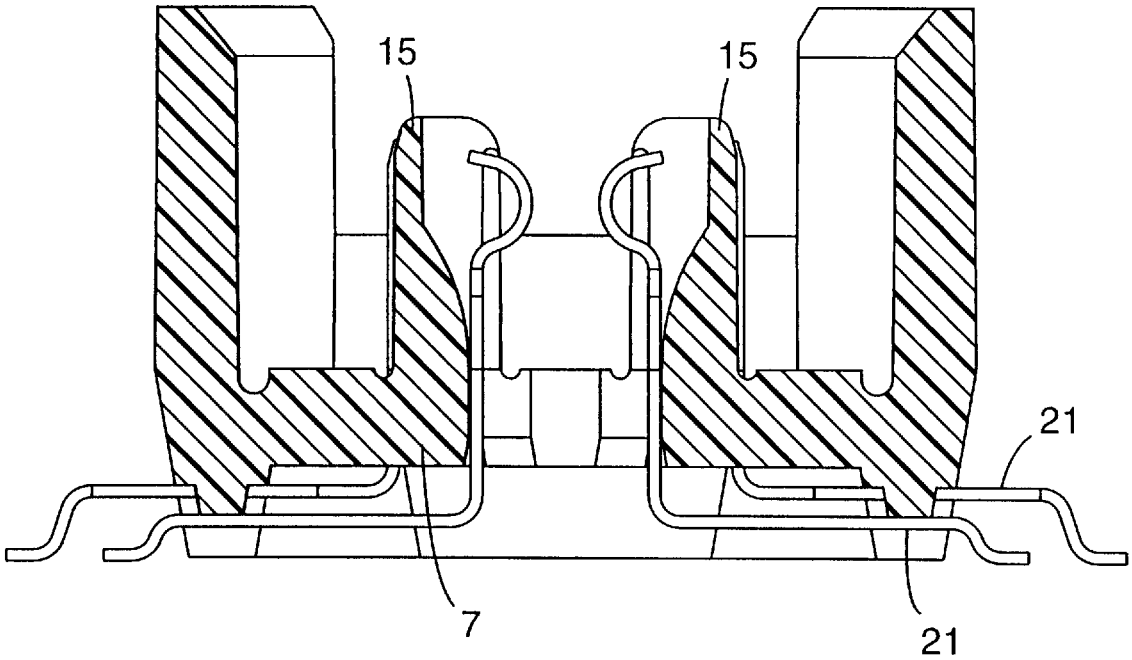
Figure 2:
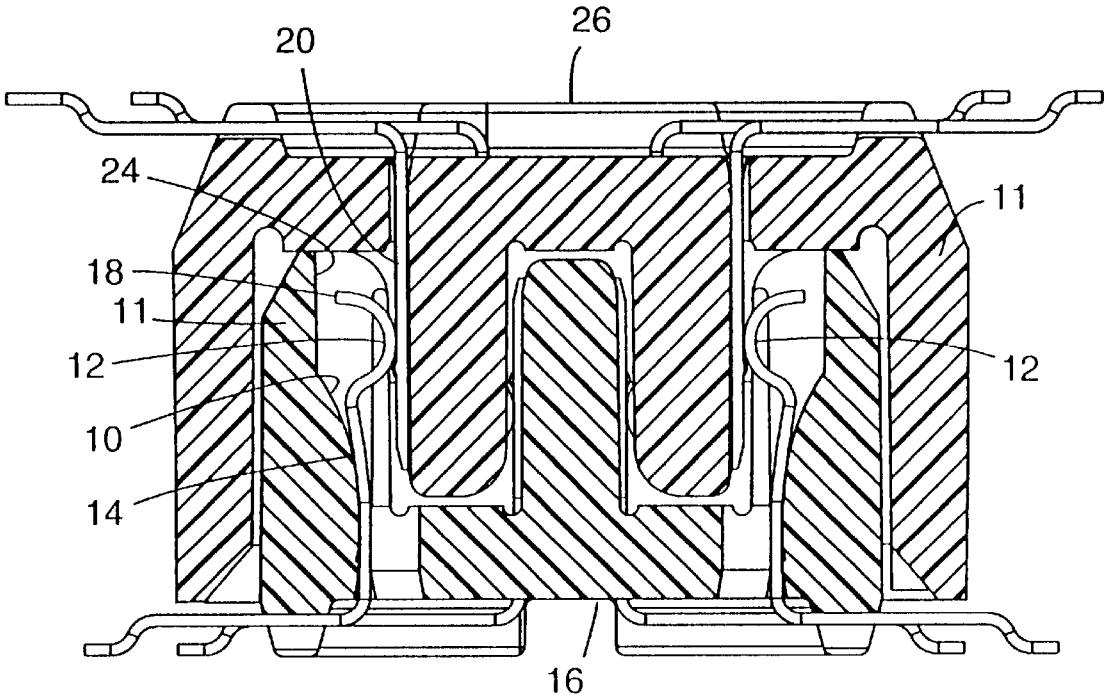
FIG. 2 is a vertical cross sectional view taken through the socket of FIG. 1A and the plug of FIG. 1B, with the same disposed in a mated condition.

As a starting point of reference, FIGS. 1A and 1B illustrate one embodiment of an interconnection system according to the disclosed method and apparatus. FIG. 1A illustrates a socket housing component 16 and FIG. 1B illustrates a mating plug housing component 26 for interconnection with socket housing 16. As illustrated in FIG. 1A, socket 16 has a housing body comprising a base 1 and three spaced parallel wall members 1*a* positioned on one side of base 1. As illustrated in FIG. 1B, plug 26 has a housing body comprising a base 2 and two wall members 2*a* in spaced parallel position to receive walls 1*a* of socket 16 and two exterior wall members forming housing shroud 27. Active contact elements 12 and corresponding passive contact elements 13 are provided within each connector housing component 16 and 26. In FIG. 1; section A—A of FIG. 1A and section B—B of FIG. 1B are presented in a position prior to connector mating. In FIG. 2, section A—A of FIG. 1A and section B—B of FIG. 1B are shown in mated position. As shown in FIG. 1, contact tails 21 are coplanar. FIG. 1C illustrates cross sectional views similar to those found in FIG. 1 except for an embodiment of the socket 16 and plug 26 apparatus having multi-level contact tails 21. The use of multi-level contact tail exit designs is discussed in more detail below.

Two-Piece Connectors Having Multiple Contact Rows and Contact Channels

Figure 1D:
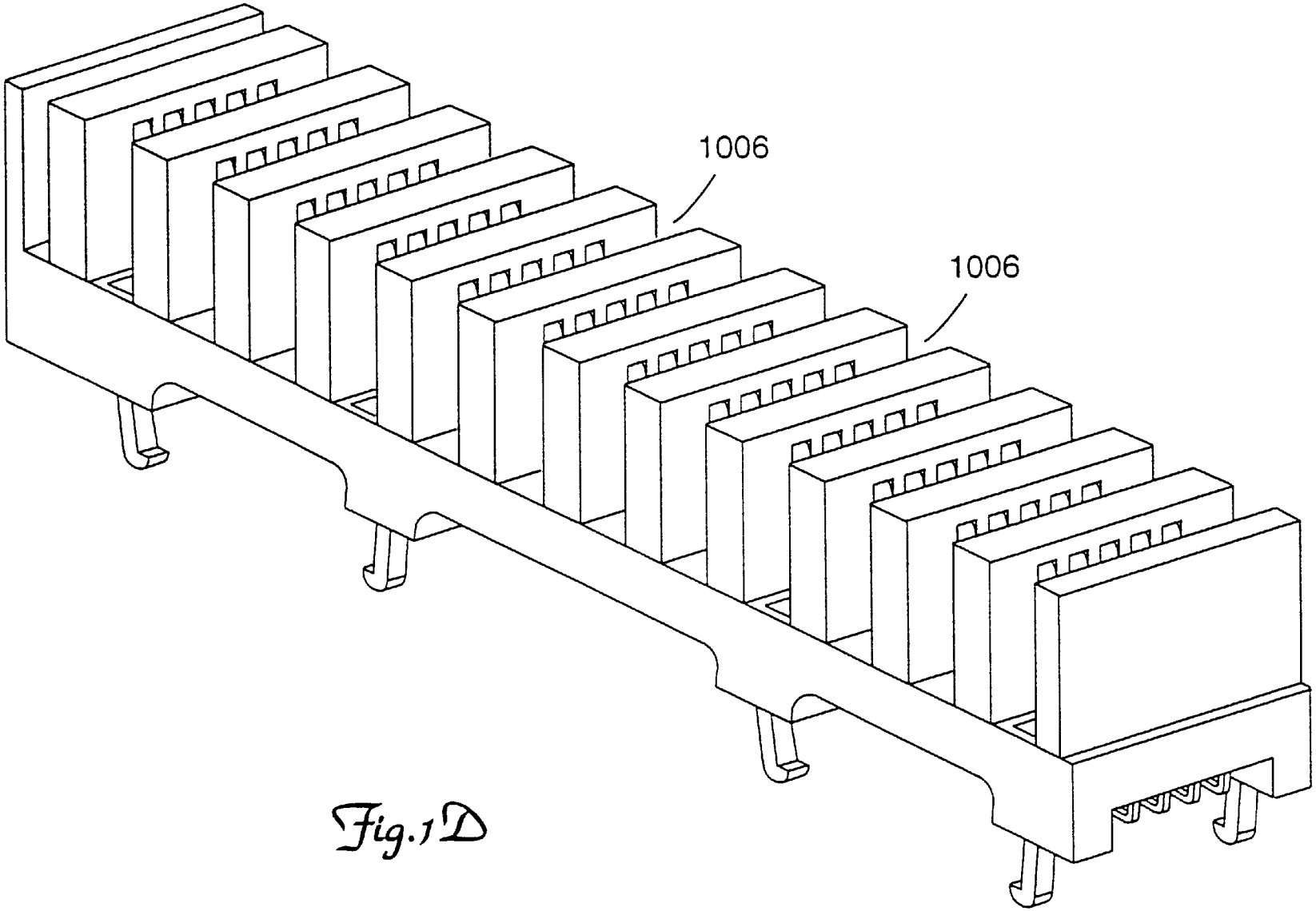
FIG. 1D is a perspective view of a plug of an electrical interconnection according to one embodiment of the disclosed method and apparatus.
Figure 1E:
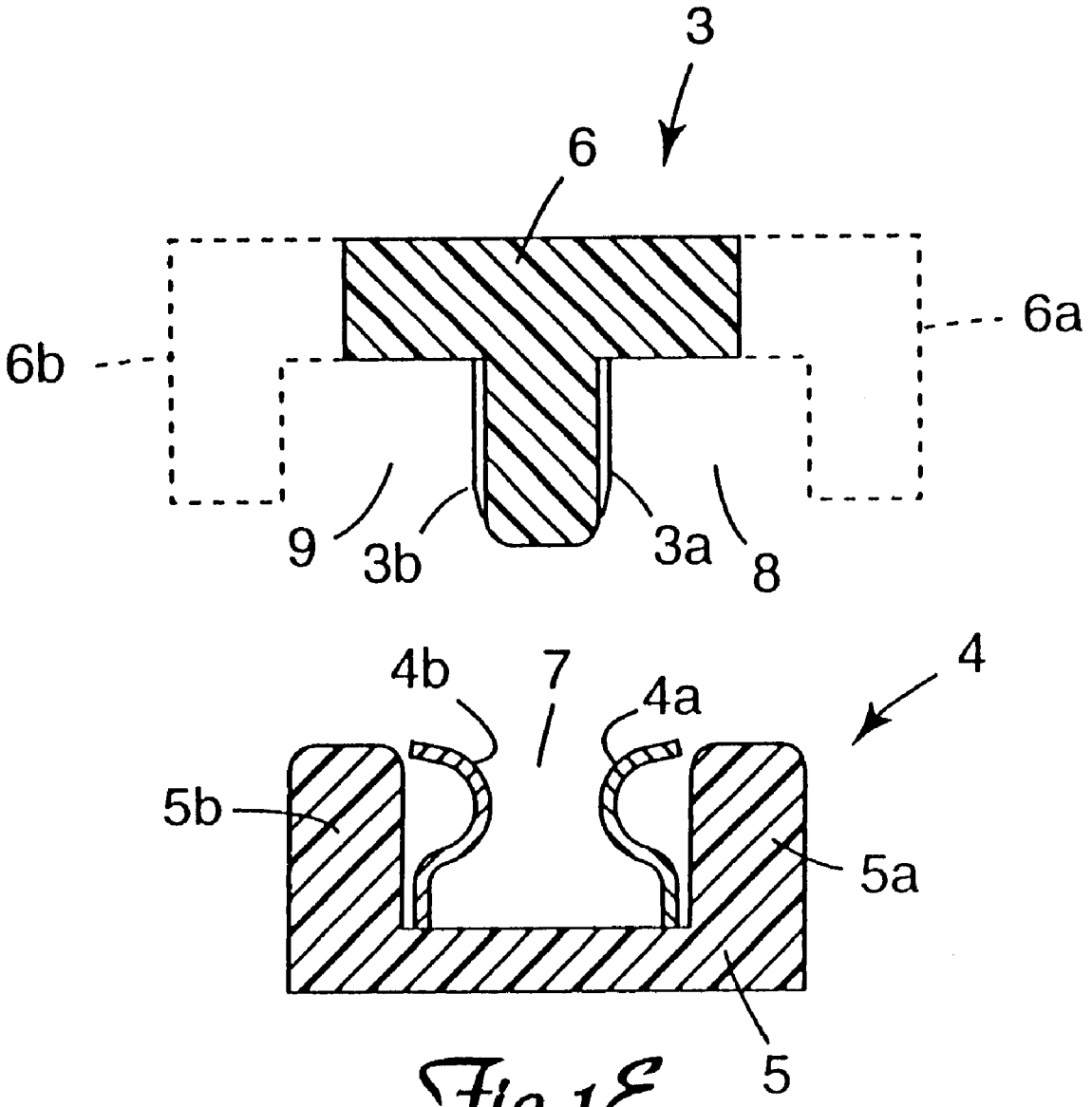
Fig. 1E (Prior Art)
FIG. 1E is a cross section of a two piece connector utilizing a T-shaped plug which inserts into a U-shaped socket.
Figure 14:
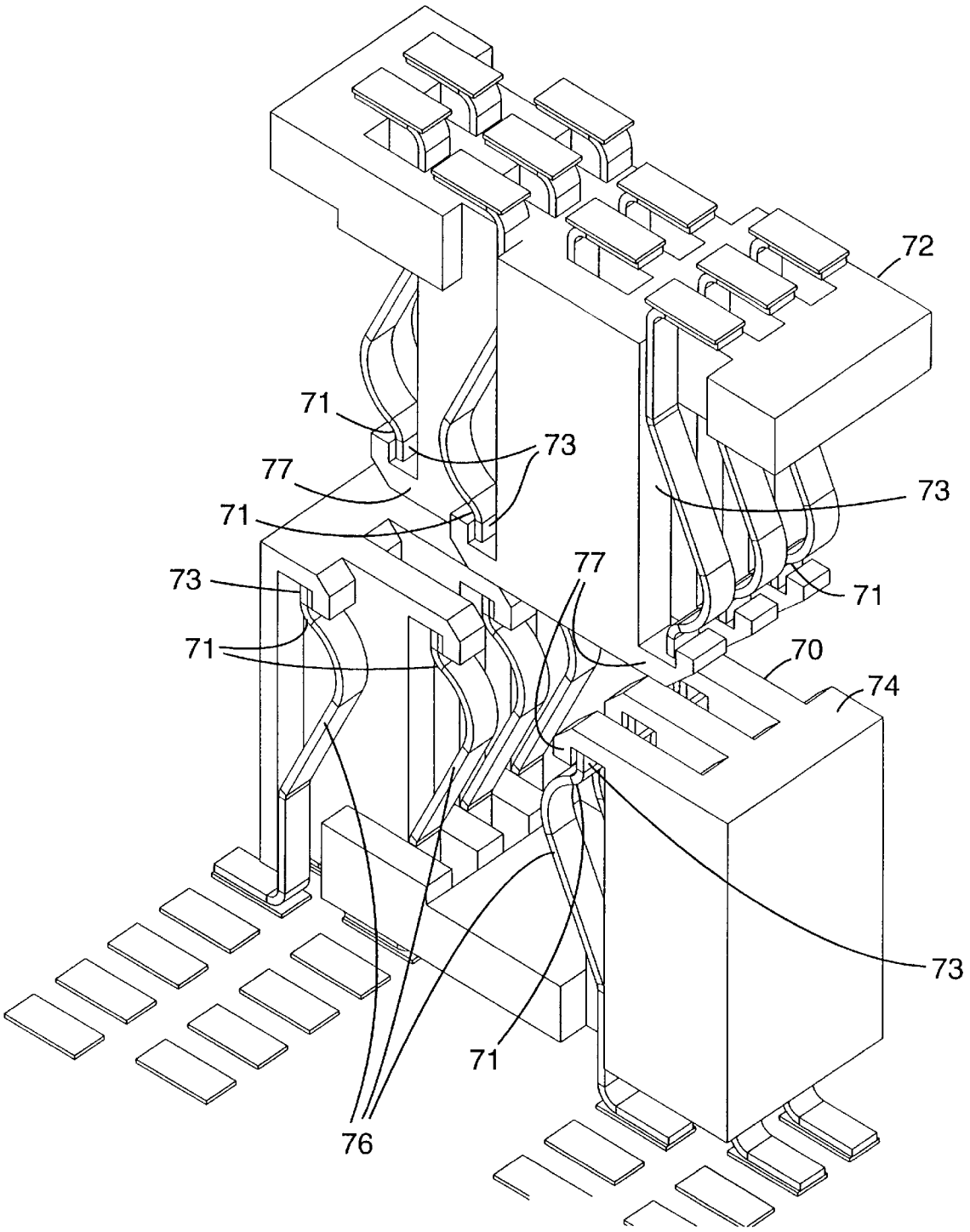
FIG. 14 is a perspective cross sectional view of a plug and socket of an electrical interconnection according to one embodiment of the disclosed method and apparatus having alternating type contacts and a single channel in which connector halves mate.

Typical two piece connectors utilize a T-shaped plug which inserts into a U-shaped socket. FIG. 1E illustrates a cross section of such a connector. As shown in FIG. 1E, a U-shaped socket 4 includes a socket housing 5 which has side housing walls 5*a* and 5*b*. The housing 5 may be rectangularly elongated such as the housings shown in FIGS. 1A and 1B. In FIG. 1E, a single connector channel 7 is formed between the side housing walls 5*a* and 5*b*. Located adjacent to each housing walls 5*a* and 5*b* is a row of contacts. One contact 4*a* and one contact 4*b* of each of the two rows of contacts are shown in the cross sectional view of FIG. 1E. The contact rows may be formed so that each contact is co-planar, or alternatively, as shown in FIG. 14 a contact row may have a line of contacts that are staggered such that every other contact of one row projects further into the connector channel 7.

The plug 3 may include a plug housing which has a central wall 6. The plug housing may also include optional outer shrouds 6*a* and 6*b* as shown by dotted lines in FIG. 1E. On either side of the central wall 6 connector channels 8 and 9 are formed. If outer shrouds 6*a* and 6*b* are utilized, the connector channels 8 and 9 may be considered enclosed channels (as would connector channel 7). If outer shrouds 6*a* and 6*b* are not utilized connector channels 8 and 9 may be considered open channels. In either case, rows of contacts 3*a* and 3*b* are formed adjacent central wall 6 adjacent to the connector channels. As with the socket 4, each row of contacts that contain contacts 3*a* and 3*b* may be a row of co-planar contacts or a row of staggered contacts such that some contacts may extend into the channels further than other contacts. Thus, as shown in FIG. 1E, an interconnection system having a socket with one connection channel and a plug with two connection channels is provided.

The interconnection system shown in FIGS. 1, 1A, 1B and 1C advantageously provide a plurality of channels for both the socket and the plug. The use of a plurality of channels allows for an increased number of contacts to be made over a given area for a connector. Thus, though conventional connectors may provide only two rows of contacts in a plug or socket, an interconnection system according to the present disclosure may utilize three, four, or more contact rows in each of the plug and socket pieces.

For example, as shown in FIGS. 1A and 1B, a plug 26 has three connector channels 26*a* and a socket 16 having two connector channels 16*a*. Further four rows of contacts (two rows of active contacts 12 and two rows of passive contacts 13) are provided in the plug 26 and likewise four rows of contacts (two rows of active contacts 12 and two rows of passive contacts 13) are provided in the socket 16. Once again the contacts within each row of contacts may be either co-planar or staggered into the connector channel regions by varying amounts.

Figure 1F:
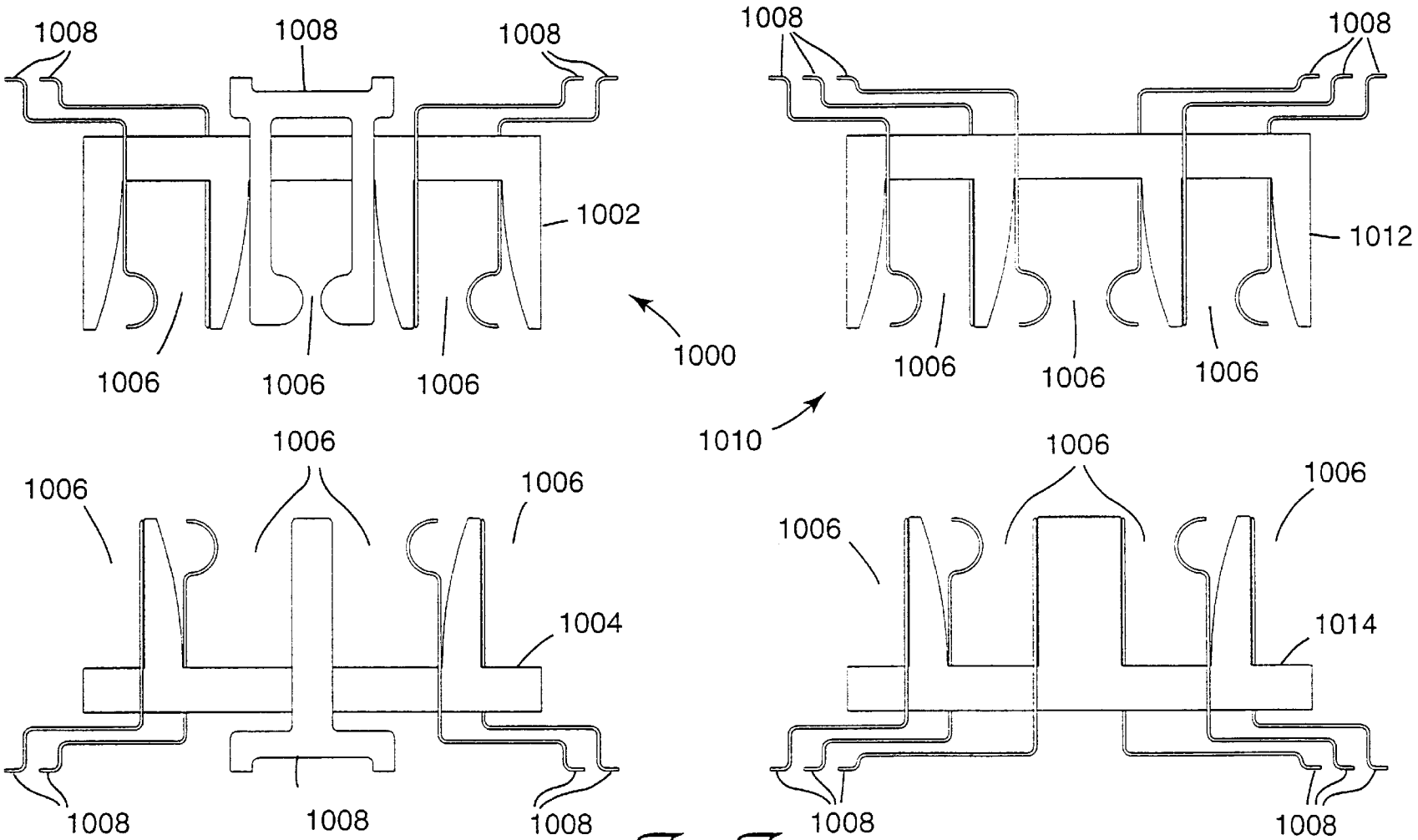
FIG. 1F illustrates cross sectional views of multi-channel two piece connectors.

The use of a plurality of connector channels for both a socket and a plug is not limited to the specific combination of active and passive contacts as shown, but may be utilized with other combinations including all active contacts. Further, though shown primarily with a two piece interconnection system having one piece with three connector channels (with four rows of connectors) mating to a second piece with two connector channels (with four rows of connectors), although combinations of a multiple number of channels in both the socket and plug may be utilized. For example, as shown in FIG. 1F two variations of multiple connector channels are shown. Interconnection system 1000 includes housing 1002 which includes three connector channels 1006 and five rows of contacts 1008 which may mate with housing 1004 which includes four connector channels and five rows of contacts 1008. Similarly, interconnections system 1010 includes housing 1012 which includes three connector channels 1006 and six rows of contacts 1008 which may mate with housing 1014 which includes four connector channels and six rows of contacts 1008. A variety of other channel and row combinations could be used including, for example, two channel pieces mating to two channel pieces, three channel pieces mating to three channel pieces, four channel pieces mating to five channel pieces, five channel pieces mating to six channel pieces, etc. For example, FIG. 1D illustrates a interconnection piece having more than 10 channels 1006. Also, many combinations of enclosed and open connector channels may be utilized. Finally, a variety of combinations of number of contact rows may also be utilized, including circumstances were one contact row of a plug may engage two rows of a corresponding socket such that an equal number of contact rows are not required in a matching socket and plug.

Contact Support Geometry

To address connection reliability problems inherent in traditional cantilevered active spring contacts, embodiments of the disclosed method and apparatus may include a connector housing having a contact support surface. FIG. 1 shows one embodiment of a convex arcuate contact support surface 10 adjacent to a non-deflected cantilevered spring contact element 12. The contact element 12 has a fixed first end 14 anchored in thermoplastic socket connector housing 16. In FIG. 2 spring contact 12 of FIG. 1 is shown deflected against arcuate support surface 10 due to contact with mating contact element 20.

Figure 3:
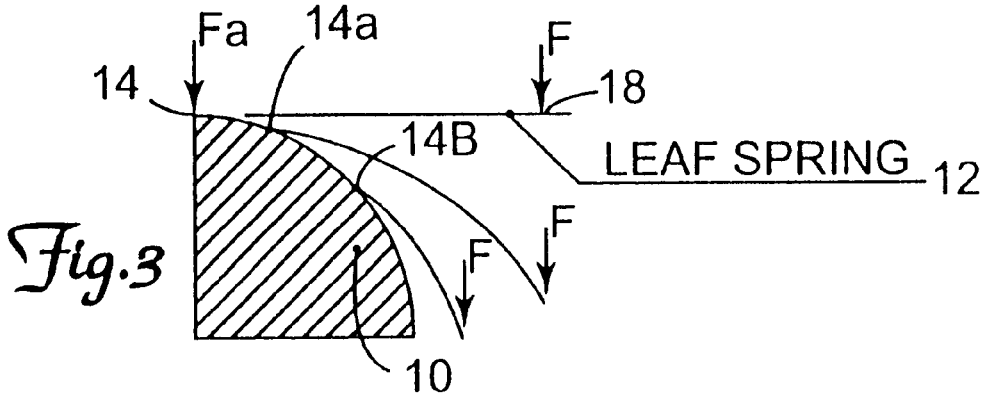
FIG. 3 is a simplified cross sectional view of a cantilever beam spring contact being deflected against an arcuate support surface of one embodiment of the disclosed method and apparatus.
Figure 4:
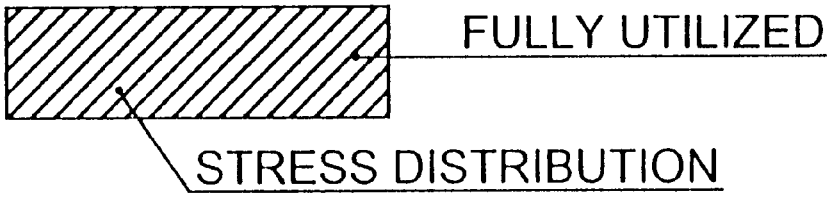
FIG. 4 is a graphical illustration of stress distribution for the deflected cantilever spring contact of FIG. 3.

In FIG. 2, interaction between the arcuate support surface and the spring contact has caused the effective "fixed point" of the spring contact to shift toward the free second end 18 of the contact. In other words, the length of spring contact existing between the outward point of spring contact/support surface interaction (the "support point") and the end of the contact has been shortened by deflection of the contact against the support surface. Thus, the effective length of the spring contact has been shortened, and the internal stress present at the second end of the contact maintained, delivering substantially the same force over a shorter distance. FIGS. 3 and 4 graphically illustrate deflection force and internal stresses as a function of position.

Figure 5:
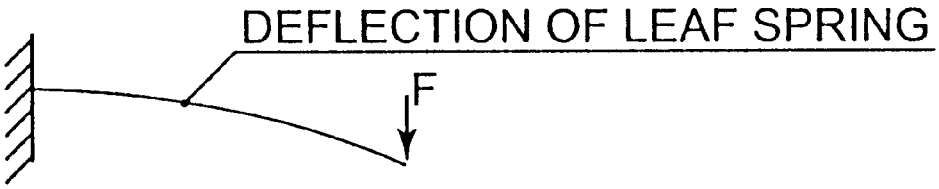
FIG. 5 is a simplified cross sectional view of an unsupported cantilever beam spring contact being deflected by contact force.
Figure 6:
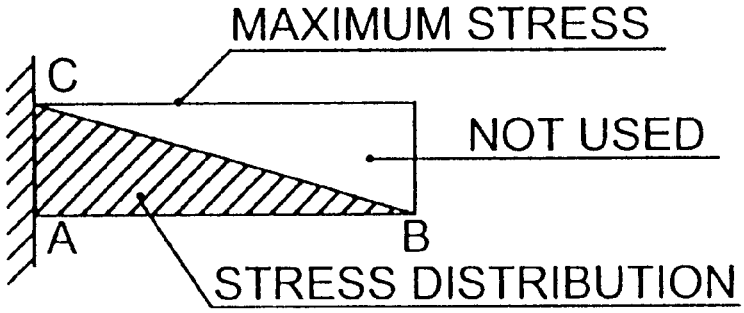
FIG. 6 is a graphical illustration of stress distribution within the deflected cantilever beam spring contact of FIG. 5.

As can be seen in FIG. 3, spring contact 12 is bent or deflected around arcuate support surface 10 by contact normal force (F). FIG. 4 illustrates internal stress distribution within the deflected spring contact of FIG. 3 as a function of position. As shown in FIG. 4, internal stress is fully utilized from the fixed end to the free end of spring contact 12, unlike stress distribution in unsupported cantilever spring contacts, as illustrated in FIGS. 5 and 6. As the spring contact 12 of FIGS. 3 and 4 is deflected against the support surface 10. The support point shifts from position 14 to position 14*a* and 14*b*, as shown in FIG. 3. Thus, an increasingly shortened deflection path is created between the support point 14 and the free end 18 of the contact. As a result, maximum contact normal force is essentially maintained at the free end 18 of the contact 12 as it is bent around the support 10. The normal force present at the fixed or anchored end of the contact also remains essentially constant as contact 12 is deflected around support 10.

Figure 2B:
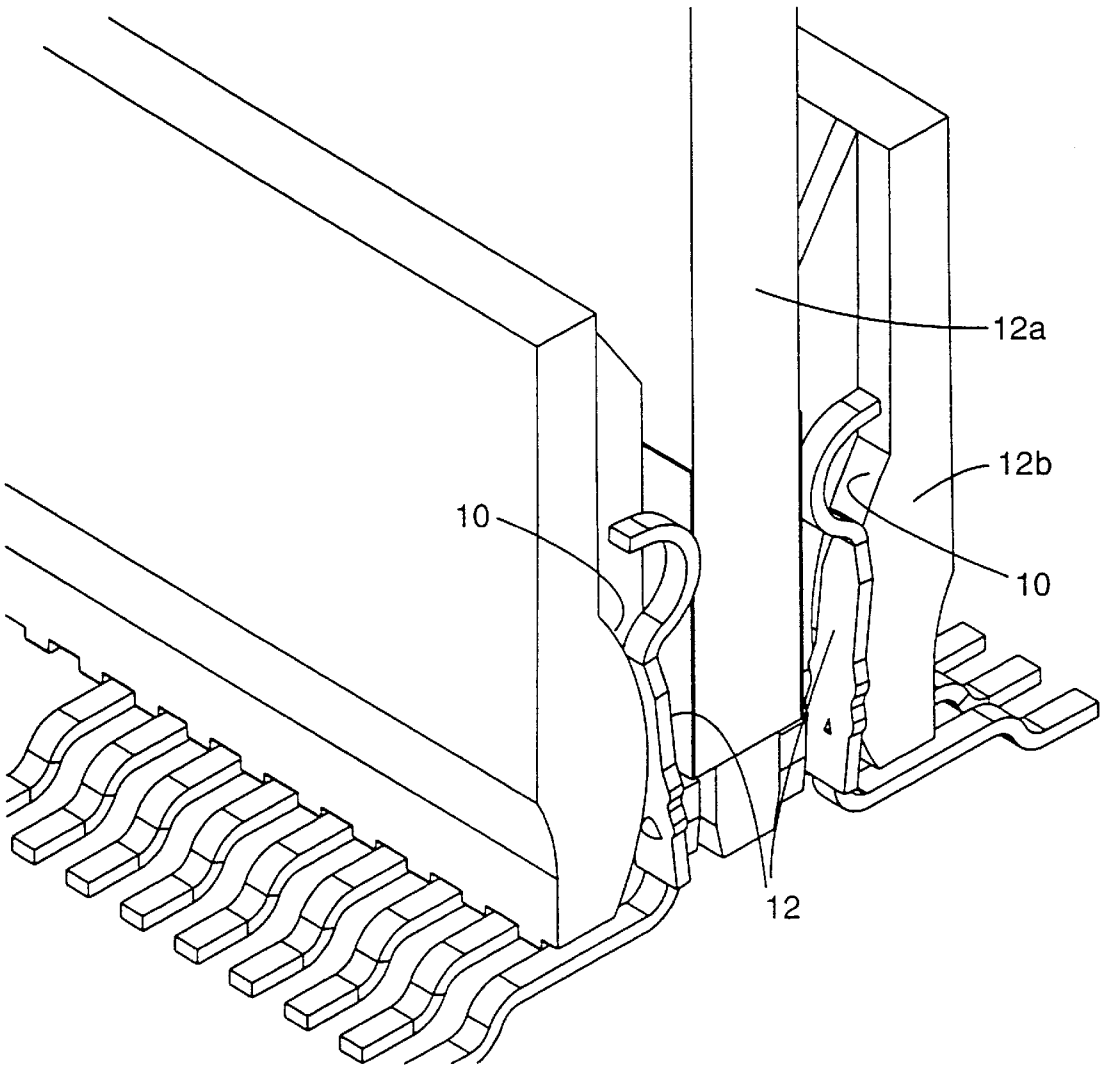
FIG. 2B is a perspective cross sectional view of a card edge connector component of an electrical interconnection according to one embodiment of the disclosed method and apparatus with the same shown disposed in mated position with a card edge.

FIG. 2 is a cross sectional view of two mated connector components showing deflection of an active spring contact 12 against a convex arcuate support structure 10. As shown in FIG. 2, two connector components are mated; however, an alternative embodiment may be utilized when connecting a printed circuit board card edge to a connector component. FIG. 2B is a similar cross sectional view of a card edge embodiment having a mated card edge 12*a* and connector component 12*b* and showing deflection of an active spring contact 12 against a convex arcuate support structure 10. In FIG. 2B, the connector component 12*b* may be referred to as a "socket" connector component, and the card edge 12*a* may serve as a "plug" component.

As shown in FIG. 2, a contact may be configured with a curved shaped contact free end 18. A displacement cavity 24 may be provided at the outward end of a support structure to accept the contact free end 18 when it is deflected. The backwall of the cavity provides a pin stop which prevents over deflection of the contact 12. Because contact normal force is essentially maintained at the free end of deflected contact 12 in FIG. 2, constriction resistance and heat generation are minimized when using this embodiment of the disclosed design. Because deflected spring contact 12 is supported by convex arcuate support surface 10, housing material "creep" and adverse effects from vibration are also minimized. The shortened deflection path between the point of support and the free end of the contact acts to provide greater contact normal force while at the same time reducing the possibility of overstressing the contact material and/or causing contact material permanent deflection. Therefore, connectors utilizing supported contacts of the disclosed design may have decreased constriction resistance, improved longevity, and greater reliability over previous connector contact designs. Other advantages of the disclosed method and apparatus may include the ability to utilize lower strength, but less costly contact material in a given application. Furthermore, because embodiments of the disclosed method and apparatus utilize a relatively straight contact arm and a contact support that is integral to the connector housing, overall connector width is essentially the same as a connector employing an unsupported cantilevered contact. This makes embodiments of the disclosed method and apparatus particularly suitable for miniaturization.

Figure 7:
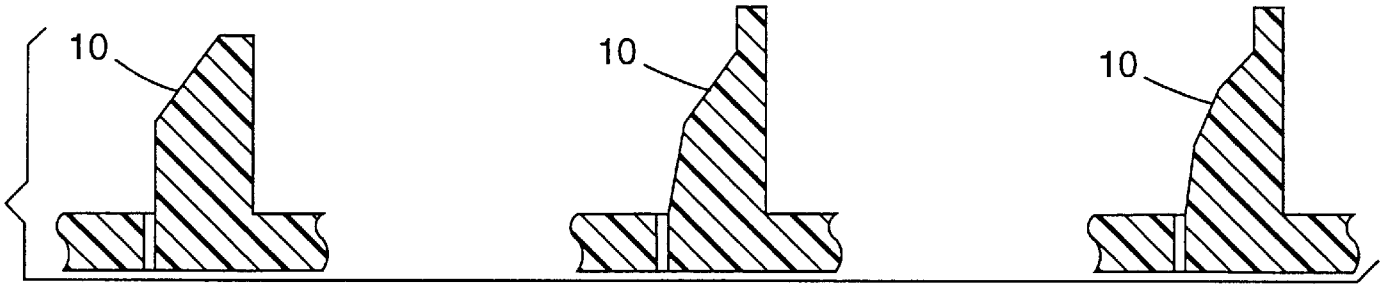
FIGS. 7, 8, and 9 shows cross sectional views of alternative embodiments that may be used as support structures.
Figure 8:
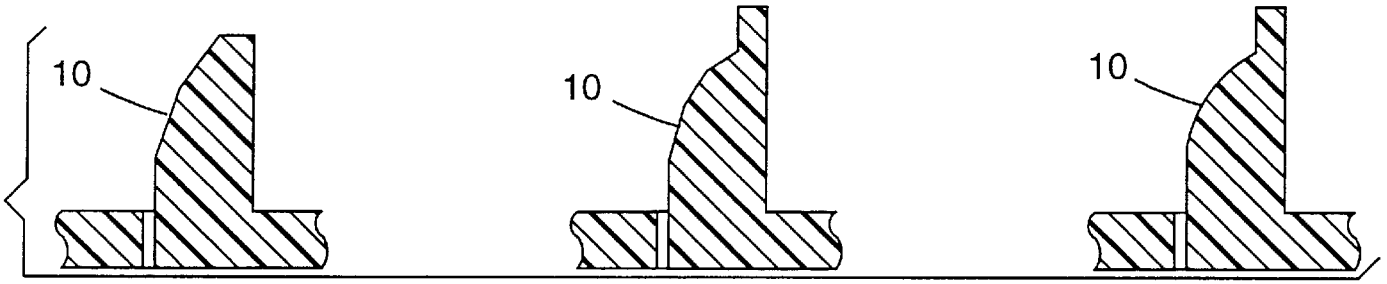
Figure 9:
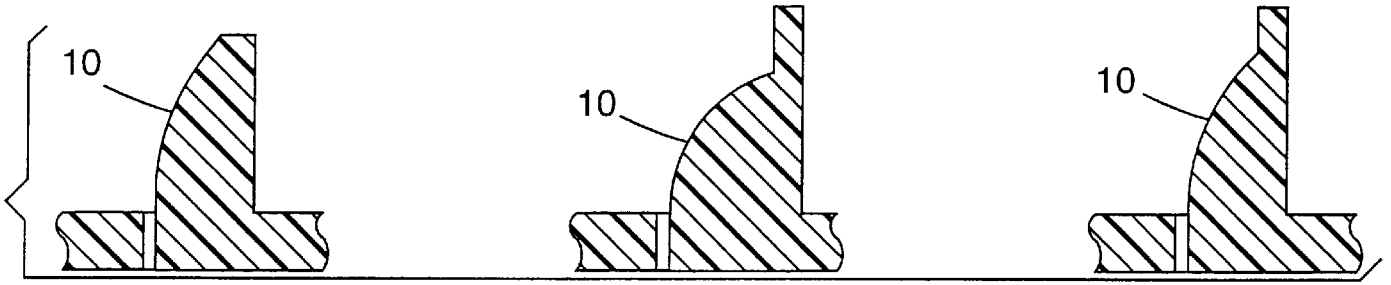

FIGS. 1, 1A, 1B, 1C and 2 illustrate an embodiment of a contact profile, contact support surface, and accompanying displacement cavity that may be successfully used with the disclosed design. Advantageously, deflection characteristics and internal stress distribution may be altered by varying support and/or contact profile geometry. Besides the convex arcuate shape illustrated in FIGS. 1 and 2, any support shape suitable for contacting and supporting a deflected contact may be employed. For example, as illustrated in FIGS. 7–9, other shapes and configurations for contact support surface 10 may be employed, including but not limited to, other arcuate shapes (such as oblong or elliptical), angled linear shapes, single points, or combinations thereof. Some specific examples (as illustrated in FIGS. 7–9) include two line segments with one segment angled and one straight, two line segments with both segments angled, three line segments with all segments angled, three line segments with one segment straight and two angled, four line segments with one straight and three angled, one line segment with one radius, two line segments and one radius, one radius, and one elliptical surface. In addition, contacts having both linear and non-linear profiles may be employed including, but not limited to those having a linear, arcuate or angled profile. For example, in one embodiment, a linear contact support structure may be employed with a contact having a cross sectional area tapering toward a free end of the contact in such a way that the effective fixed point moves toward the free end of the contact with deflection during mating.

Figure 67:
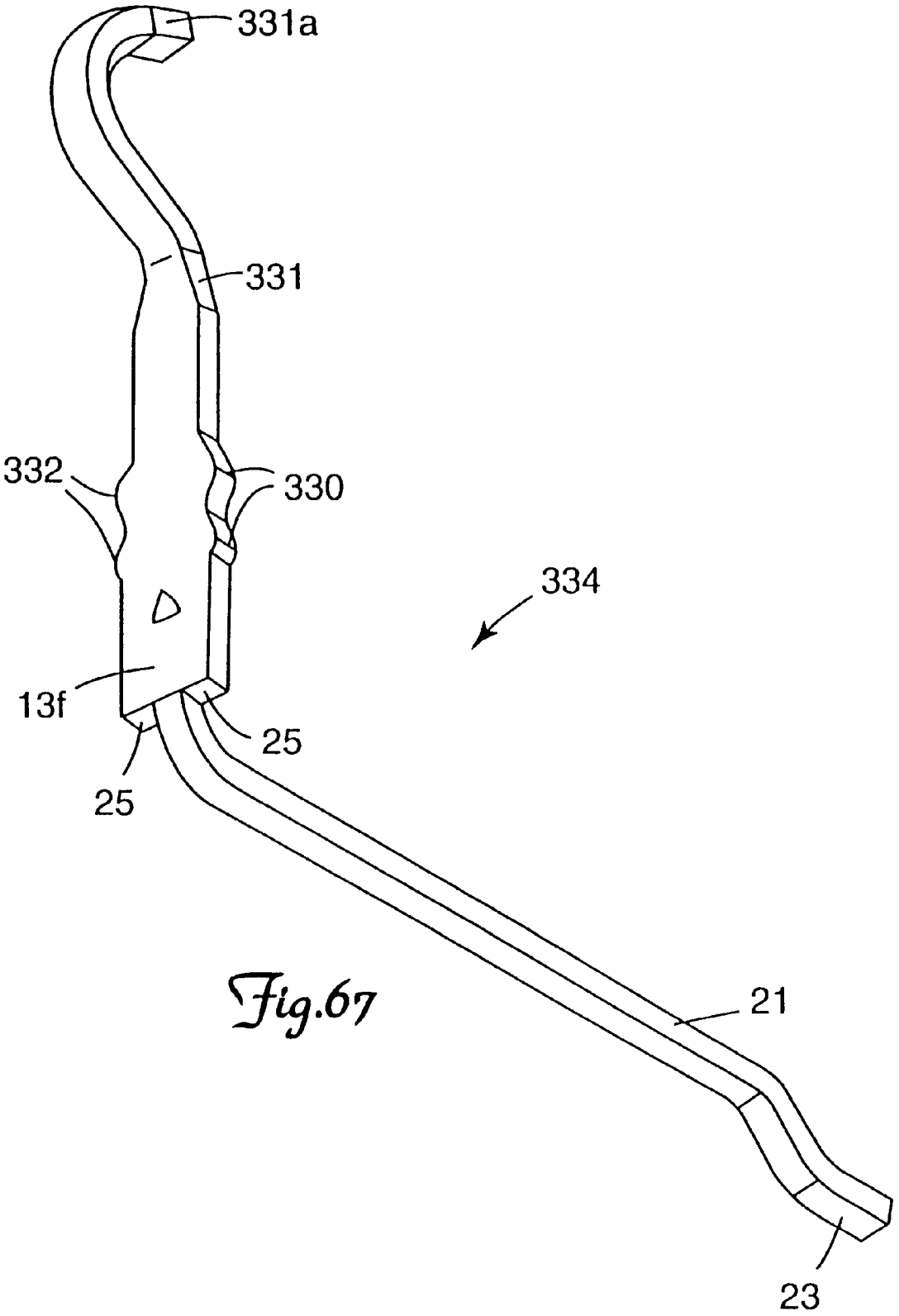
FIG. 67 is a perspective view of a contact element having alternating contact retention features according to one embodiment of the disclosed method and apparatus.

Contact ends may also be of any profile suitable for forming a contact point with another contact including, but not limited to rounded, arcuate, pointed, angled, as well as any shape disclosed in the accompanying illustrations. In addition, contacts having tapered width and/or thickness, or otherwise varying cross sectional shape may be employed. For example, FIG. 67 illustrates a contact element 334 having a tapered width section 331. In addition to the embodiment illustrated in FIG. 67, contact elements may be configured with shorter or longer taper sections and/or located in other areas of a contact (such as a tapered section that span the length of a contact from base to tip). Advantageously, by tapering width and/or thickness of a contact, contact deflection characteristics and other properties may be varied. This is possible, in part, because as the width and/or thickness of a contact is reduced, contact deflection force is decreased, and vice-versa as a contact thickness is increased. For example, a contact may be tapered to have a reduced width and/or thickness toward the contact tip 331*a* in order to reduce insertion force, therefore allowing an increased number of contact elements in an interconnection system. Therefore, contact deflection force may be synergistically optimized by combining a tapered contact with contact support geometry of the disclosed method and apparatus. In this way benefits of contact support geometry (reduced creep, reduced stress relaxation, thinner contacts, etc.) may be realized without the necessity of increasing connector insertion force. By tapering a contact to have a larger width and/or thickness toward the contact tip, contact deflection force (and therefore, connector insertion force), may be increased, if so desired. Variable and/or multiple contact taper sections are also possible, to achieve multiple zones of varying deflection force. Finally contact width may be tapered in such a way to interact geometrically with contact support geometry of the disclosed method and apparatus, such that changes in effective length of a contact may be varied, for example, to occur more rapidly or less rapidly as a function of deflection.

Likewise, a displacement cavity may be of any suitable geometry for accepting a shaped contact end, or may not be necessary where sufficient clearance exists without the presence of a cavity. In addition, a contact support structure of the disclosed design may be constructed of any material suitable for providing support to a deflected contact. For example, the same material as the associated connector housing (such as plastic or ceramic) may be employed, or a support structure may be constructed of a different material than the connector housing. Finally, benefits of the contact support structure of the disclosed method and apparatus may be obtained with connector configurations employing active contacts that mate with other active contacts, as well as in those configurations where active contacts mate with passive contacts.

Vertically Staggered Contact Element Configuration

For both card edge and two piece connector applications, it is often desirable to utilize staged or sequential mating of conducting elements. Staged/sequential mating generally refers to placement of conducting elements such that all conducting elements do not mate simultaneously, but rather, as two connectors are brought together some conducting elements engage before others engage. For example, sequential mating of conductor elements may be needed for completing ground, signal, and/or power circuits in specific order. Sequential mating also tends to lower the maximum insertion force required for mating because only a portion of contact element peaks are being engaged at one time. Therefore, in one embodiment of the disclosed method and apparatus shown in FIG. 10, the spring member and/or wiping portions of a connector/s are vertically staggered, as are the associated contact supports. This vertically staggered configuration is illustrated with aid of hidden lines in FIG. 11. As shown in FIG. 11, two levels of contact spring elements are present, upper contact spring elements 30 and lower contact spring elements 32. Also present, are two levels of contact supporting structures, upper level contact supporting structures 34, and lower level contact supporting structures 36.

Figure 10:
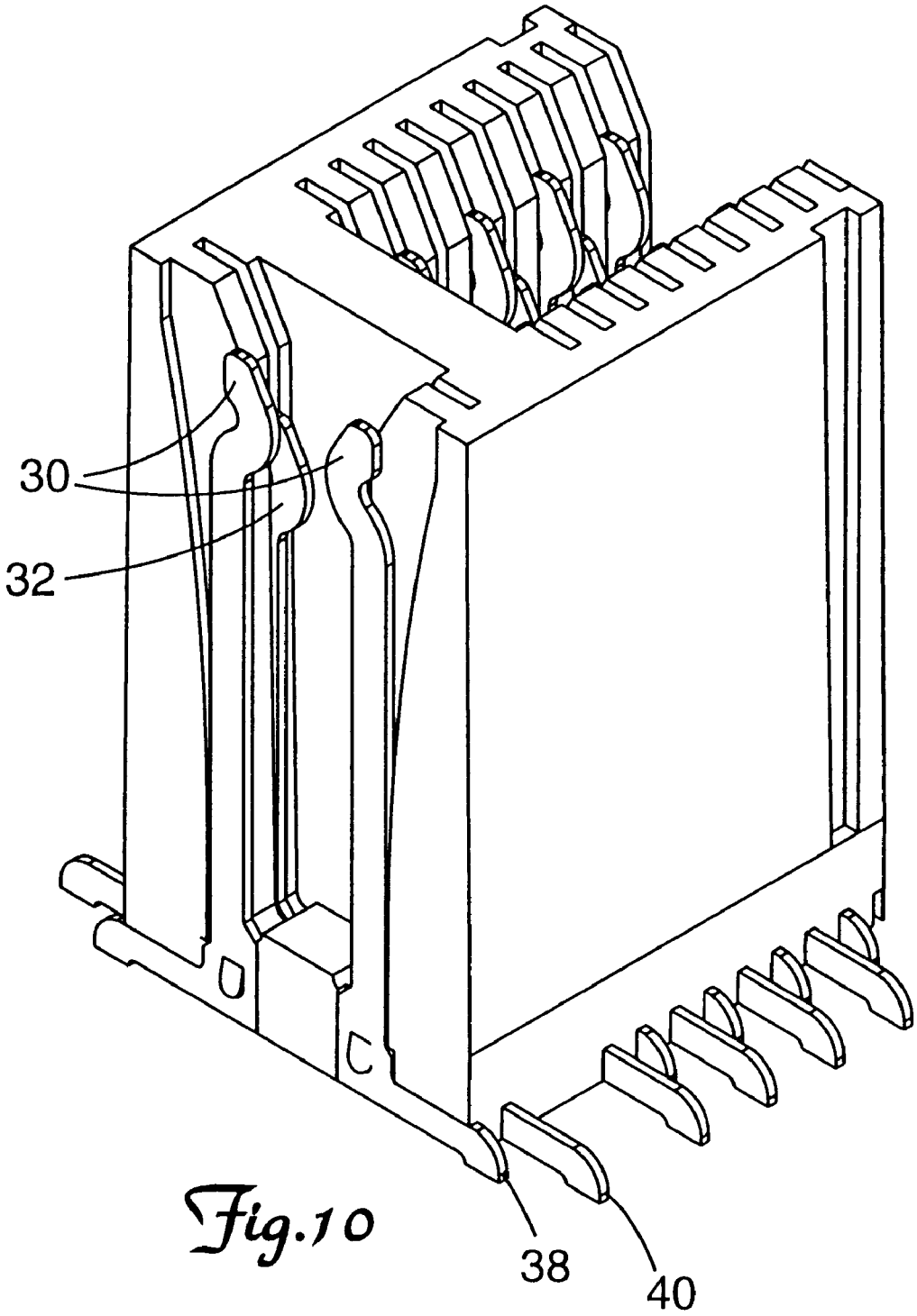
FIG. 10 is a perspective cross sectional view of a connector housing of one card edge embodiment of the disclosed method and apparatus having vertically staggered contact elements and horizontally staggered tail portions.
Figure 11:
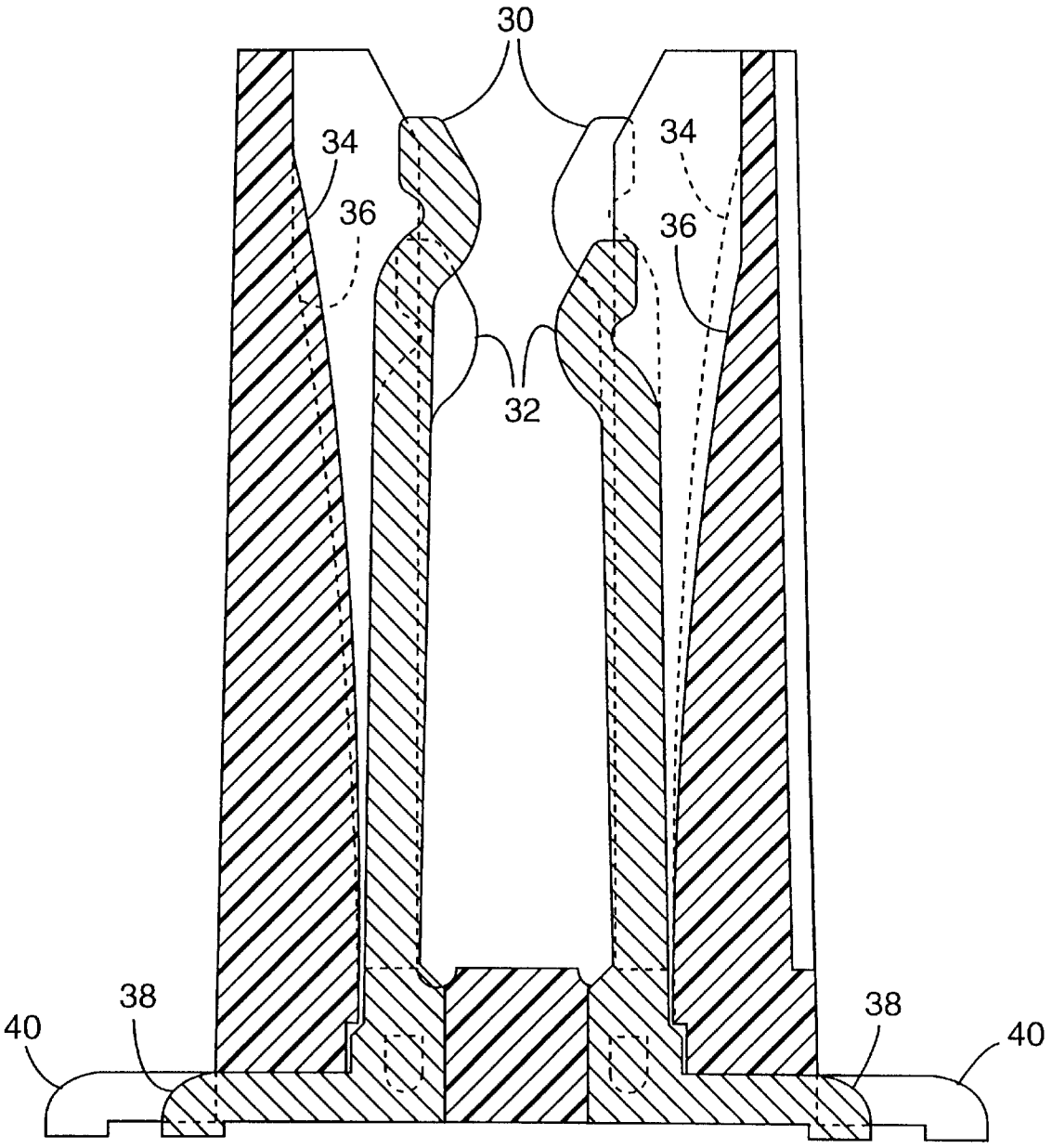
FIG. 11 is a vertical cross sectional view taken through the connector housing of FIG. 10.
Figure 12:
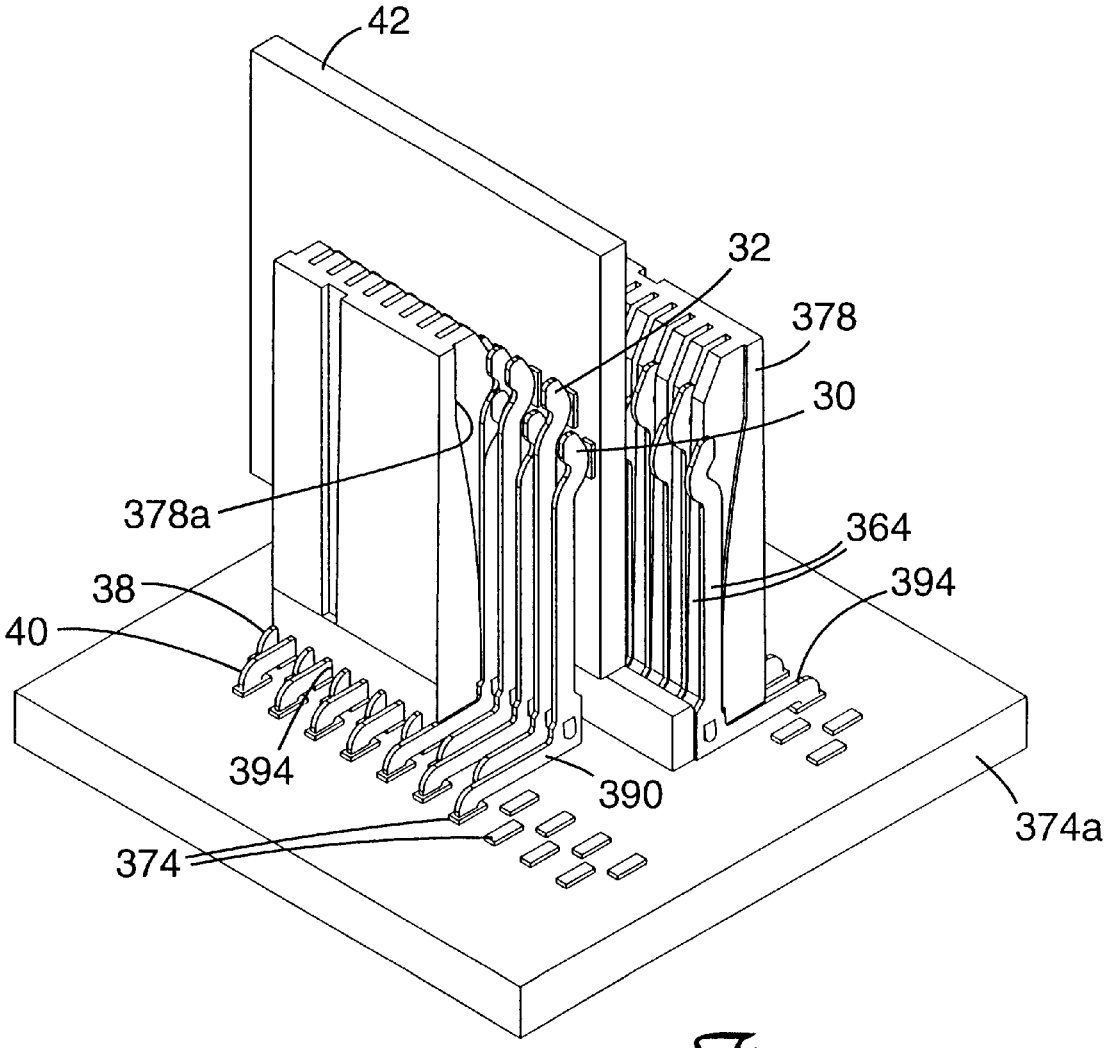
FIG. 12 is a cross sectional perspective view of the connector housing of FIGS. 10 and 11 with the same shown in a mated position with a card edge and mounted on a printed circuit board.

It should be noted that vertically staggered connector configurations will typically employ a horizontal stagger of upper contact tail portions 38 and lower contact tail portions 40 as shown in FIGS. 10–12. Horizontal staggering enables the physical and electrical lengths of the interconnection paths to be the same regardless of position in the connector. In line with this, FIG. 10 shows a vertically and horizontally staggered card edge embodiment. FIG. 12 also shows a vertically and horizontally staggered card edge embodiment, this time with mating printed circuit board 42 inserted. Although FIGS. 10–12 illustrate the vertically staggered contact concept in use with a card edge embodiment having rotated contacts, it will be apparent with benefit of the present disclosure that the vertically staggered contact/supporting structure combination may be used with other types of mating systems including, but not limited to a standard style card edge or two-piece connector system. In addition, benefits of the vertically staggered contact embodiment may be realized with virtually any type of cantilevered spring contact having a variety of cross sectional profiles including, but not limited to, "ribbon" type contacts.

Alternating and Horizontally Staggered Contact Designs

Figure 13:
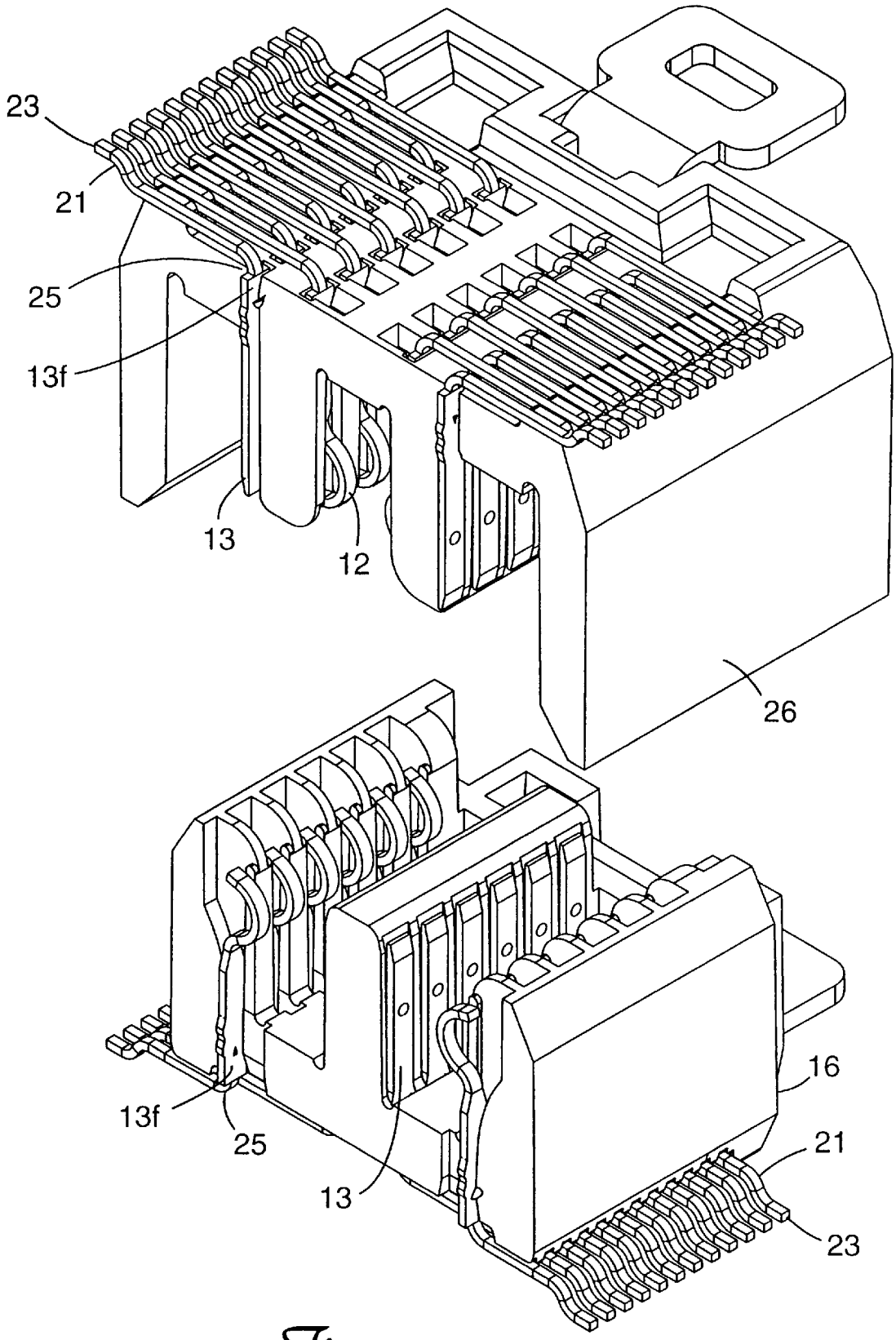
FIG. 13 is a perspective cross sectional view of a plug and socket of an electrical interconnection of one embodiment of the disclosed method and apparatus having alternating active and passive type contacts.
Figure 16:
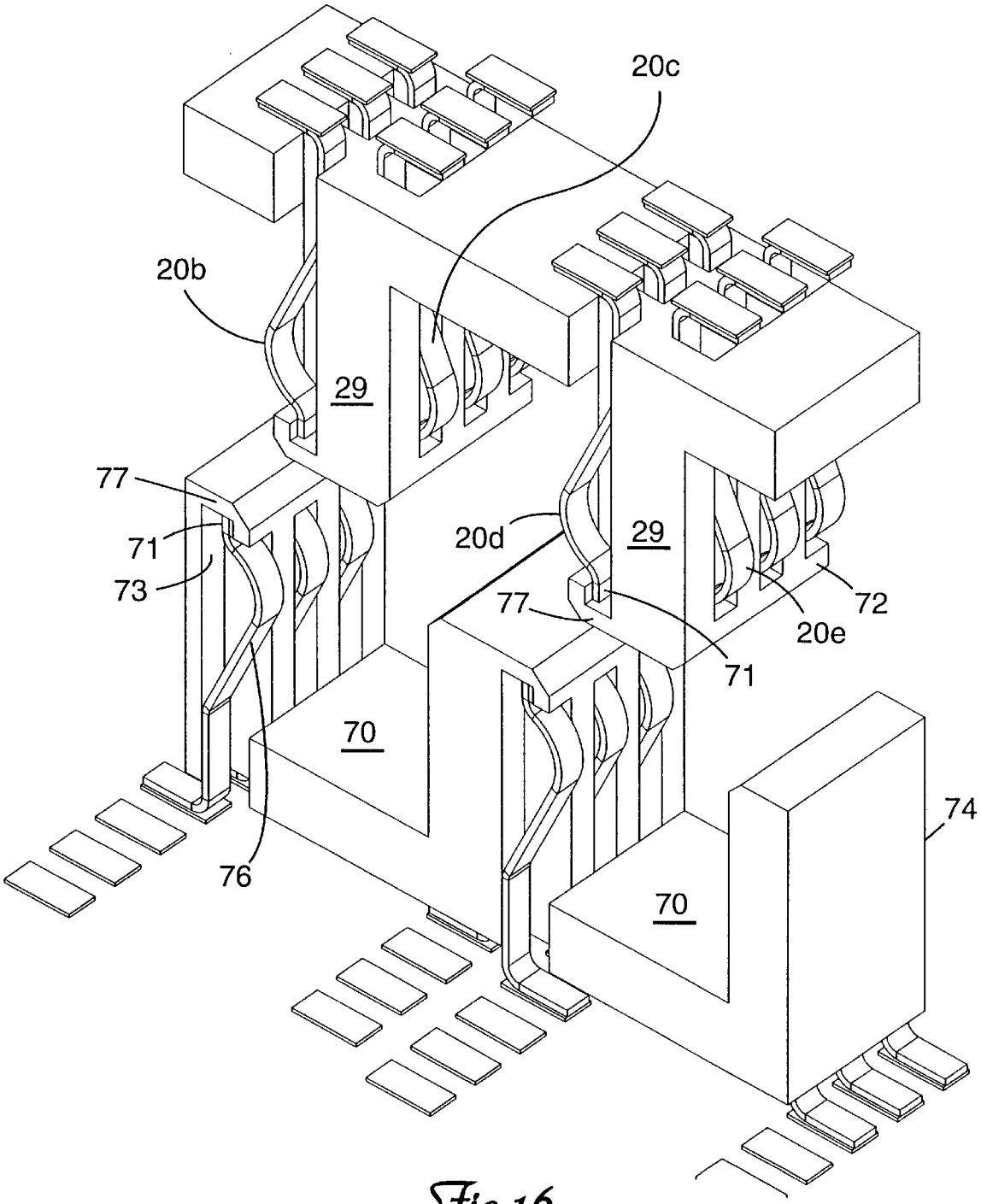
FIG. 16 is a perspective cross sectional view of a plug and socket of an electrical interconnection according to one embodiment of the disclosed method and apparatus having alternating type contacts and two channels in which connector halves mate.
Figure 16A:
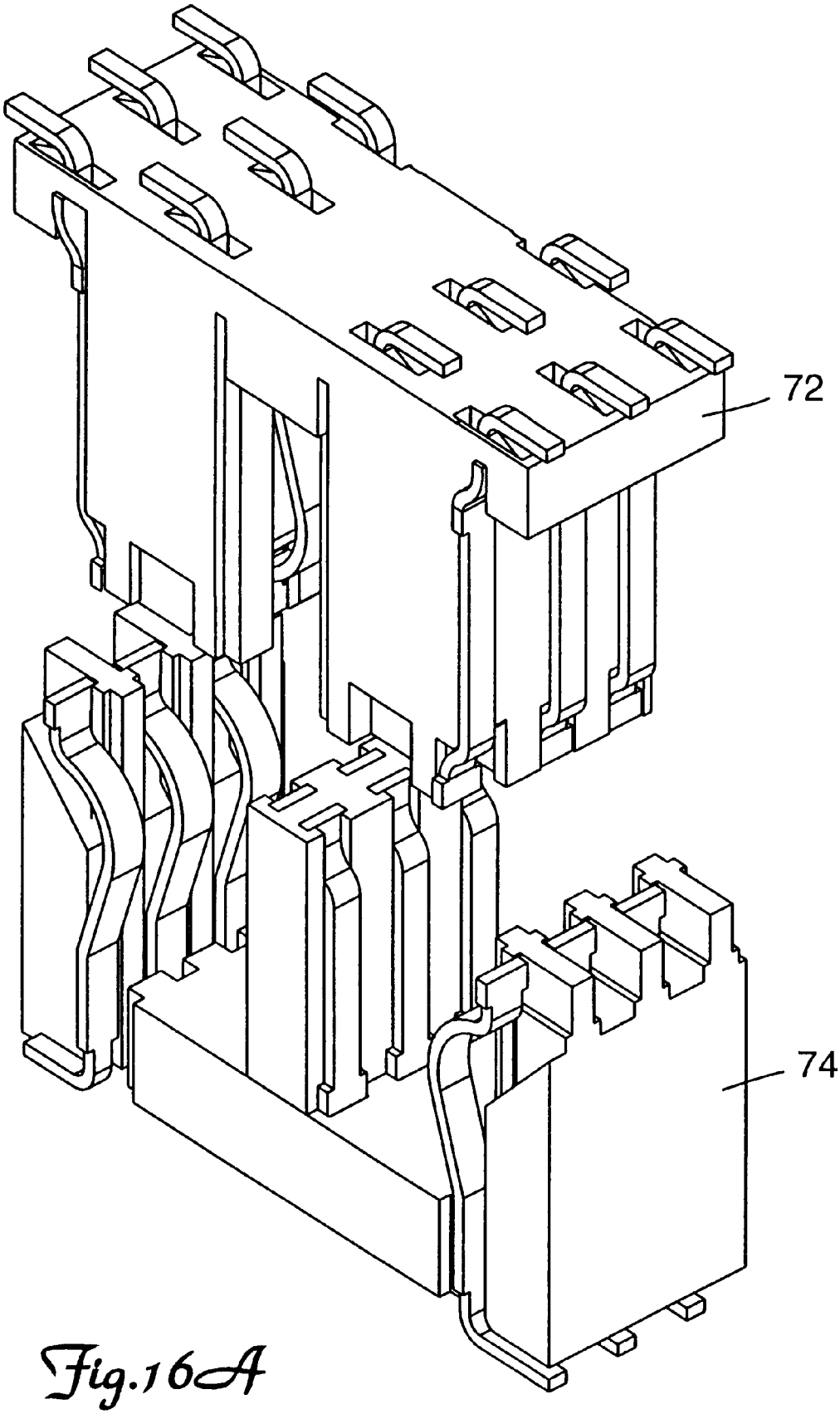
FIG. 16A is a perspective cross sectional view of a plug and socket of an electrical interconnection according to one embodiment of the disclosed method and apparatus having alternating mixed passive and active contacts and two channels in which connector halves mate.
Figure 16B:
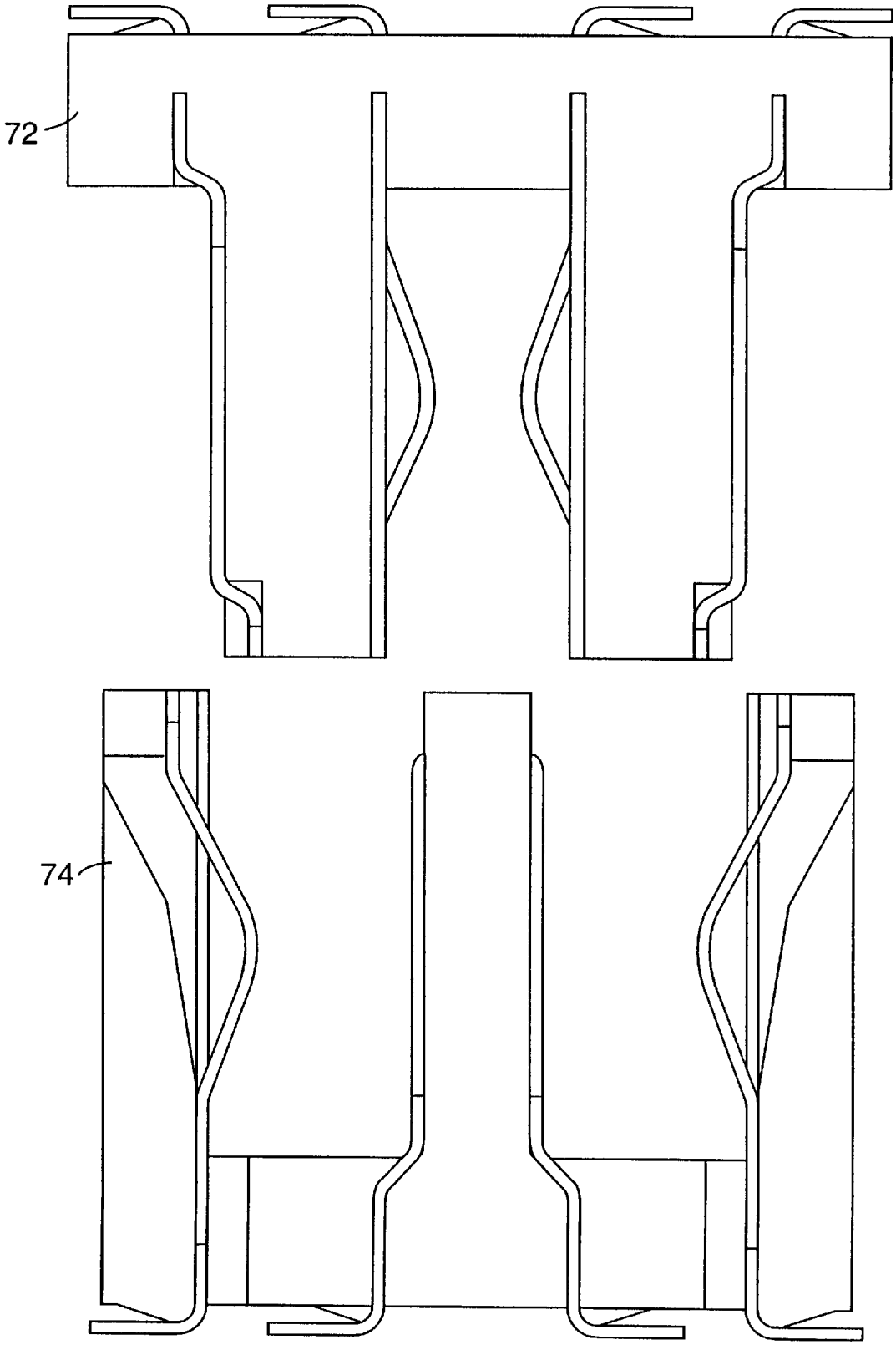
FIG. 16B is a vertical cross sectional view of the electrical interconnection embodiment of FIG. 16A.
Figure 17:
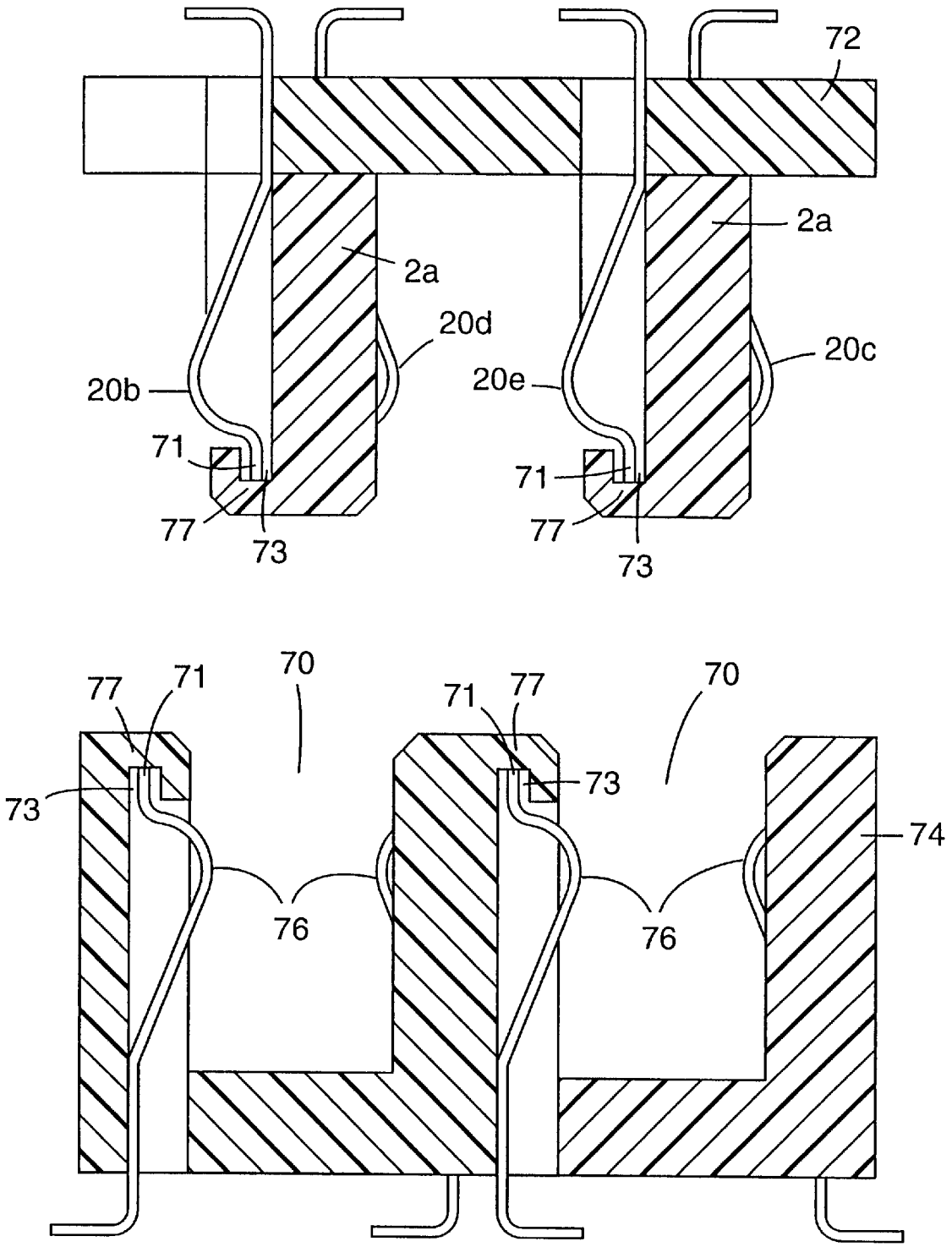
FIG. 17 is a vertical cross sectional view of the electrical interconnection embodiment of FIG. 16.

Embodiments of the disclosed method and apparatus may be practiced using offset ribbon type contacts, and/or other types of contacts, such as rotated contacts. FIG. 1 shows one alternating contact embodiment in which contacts alternate in lateral position on opposite sides of wall members 2*a* of plug housing component 26. This alternation is evidenced by visibility of the bases of end passive contacts 20*a* and non-visibility of the bases of end active contacts positioned on opposite sides of center walls 2*a* when viewed in the same side cross sectional plane of FIG. 1. FIGS. 13 and 14 illustrate another alternating contact embodiment in perspective and cross sectional views, respectively. In FIGS. 16 and 17, contacts 20*b* and 20*c* positioned on outer sides of center walls 2*a* of plug housing 72 may be seen to be laterally offset from contacts 20*d* and 20*e* positioned on inner sides of walls 2*a,* respectively. Contacts 20*d* may also be seen to be laterally offset from contacts 20*e* in the embodiment of FIGS. 16 and 17. However, contacts 20*d* and 20*e* may be alternatively configured to be on the same centerline as may all contacts 20*b*–20*e* in other embodiments.

Figure 22:
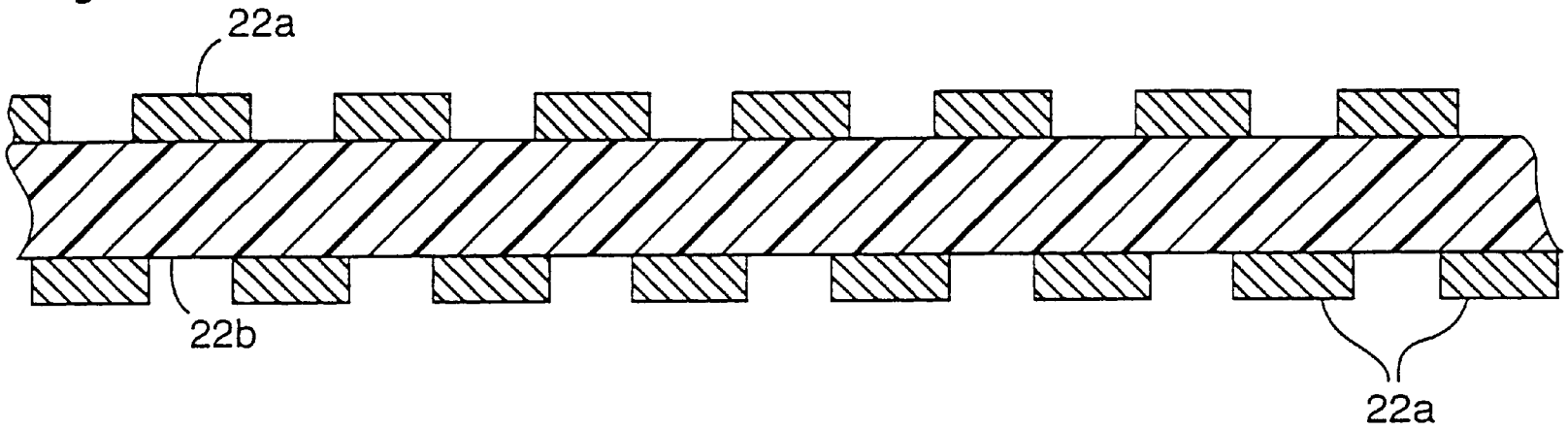
FIG. 22 is a horizontal cross sectional view of the contact pattern of an offset ribbon contact tail configuration according to one embodiment of the disclosed method and apparatus.
Figure 23:
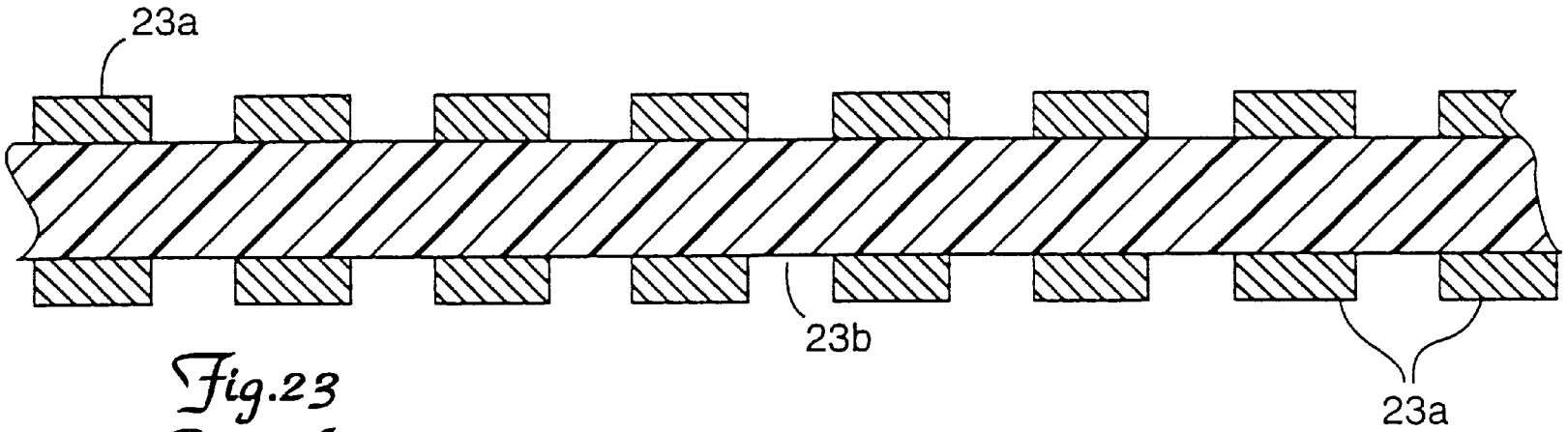
Fig.23 Prior Art
FIG. 23 is a horizontal cross sectional view of a conventional ribbon contact tail configuration.

FIGS. 22 and 23 show horizontal cross sectional views of contact patterns of an offset ribbon tail configuration of the disclosed method and a conventional pattern of the prior art, respectively. In FIG. 22 contacts 22*a* may be seen to be disposed in offsetting relationship on opposite sides of connector center wall 22*b,* thereby forming an alternating contact embodiment. In contrast, FIG. 23 illustrates a conventional contact configuration of the prior art in which contacts 23*a* may be seen to be disposed directly opposite each other on opposing sides of connector center wall 23*b*. In the manner illustrated, alternating contacts may be disposed on opposite sides of connector walls in any number of connector configurations, for example on connectors having more than one channel and/or walls, and disposed on each half of a mating connector component combination.

FIG. 13 is a perspective cross sectional view of one embodiment of an unmated two piece connector according to the disclosed method and apparatus. The connector embodiment illustrated in FIG. 13 is a ribbon system in which both plug 26 and socket 16 housings contain four rows of alternating active and passive type contacts. In this configuration, the center rows of both plug 26 and socket 16 typically contain one additional or one fewer contact per row over the exterior rows which surround them. This offset or alternating contact configuration allows construction of a finer pitch, higher density, and higher pin count connector products, as described below.

Figure 33:
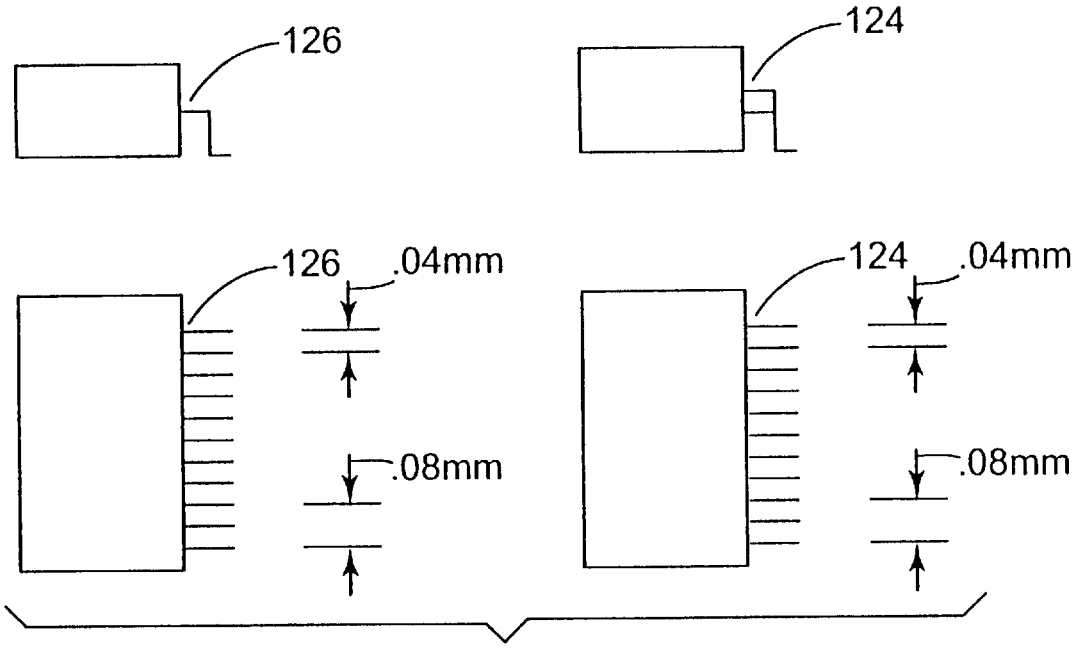
FIG. 33 shows simplified horizontal and vertical views of electrical interconnection components according to two embodiments of the disclosed method and apparatus having in-line and multi-level tail designs configured in a one row tail configuration.
Figure 33A:
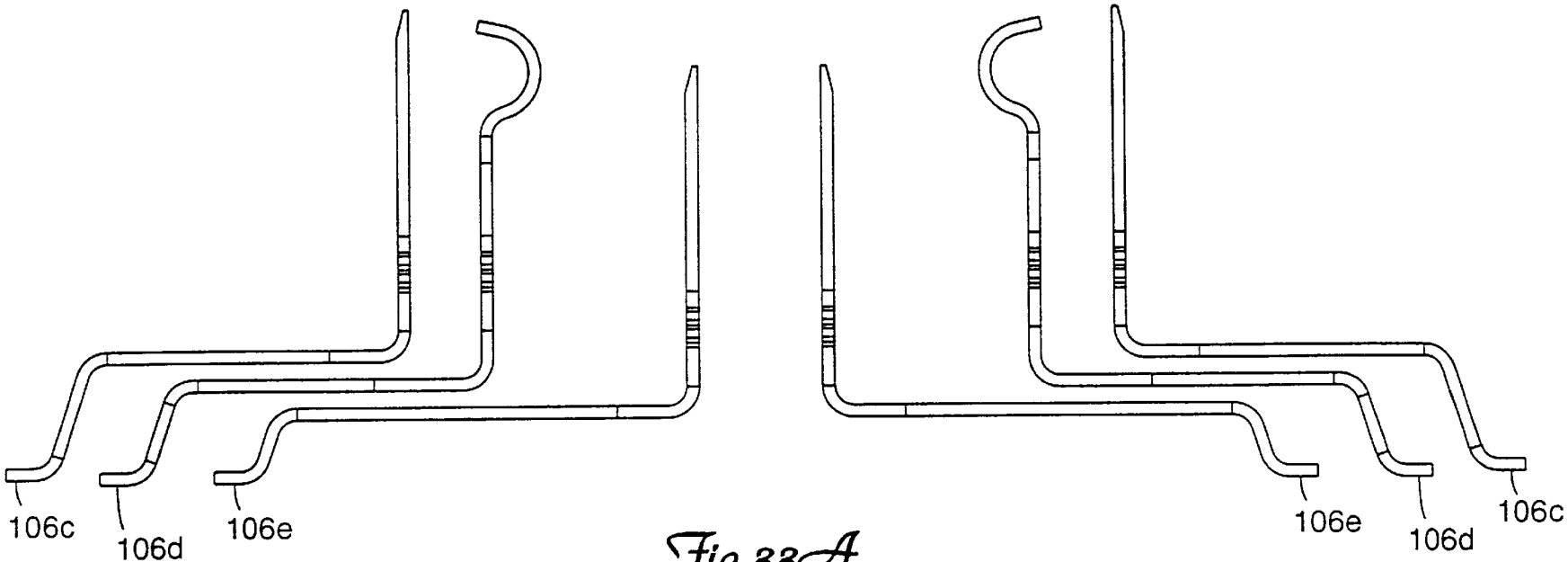
FIG. 33A is a cross sectional view illustrating spatial arrangement of a tri-level tail exit design according to one embodiment of the disclosed method and apparatus.

FIG. 1 is a cross sectional representation of an alternating contact design. Although this embodiment utilizes connectors having four rows of contacts, the alternating contact design may be practiced in a variety of other configurations having greater or fewer number of rows of contacts, for example, six rows of contacts as illustrated in FIG. 33A. In addition, FIG. 1 also illustrates a connector plug having an optional housing shroud 27 with an alignment notch 29. It will be understood with benefit of the present disclosure that the method and apparatus of the present invention may be successfully practiced without housing shroud 27. However, housing shroud 27 is typically employed for many reasons, including to provide pin protection, component alignment, mechanical stability, rigidity, resistance to longitudinal component bow or twist, and/or to provide polarization during connector mating. Additionally, keyed shrouds may be utilized to allow selective mating only between specific types of plugs and sockets.

Among the advantageous features offered by the embodiments illustrated in FIGS. 1 and 13 are the mixture of active 12 and passive 13 contacts, and the offset or alternation of these contacts. The mixture of active and passive contacts provides a density increase over existing methods and designs by providing greater space and materials utilization which may lead to a lower applied cost. This is in part because relatively flat passive contacts take up less space than relatively bowed (or otherwise shaped) active spring contacts. By mixing active and passive contacts, mechanical and thermal expansion stresses are distributed equally on both connector housings 16 and 26. This results in superior system reliability and allows an increased connector housing link, translating into a higher pin count potential. In addition, this configuration provides improved uniformity of electrical path length through the connector housing, leading to greater electrical performance of a system, regardless of position in the connector (meaning row 1 vs. row 2 vs. row 3 vs. row 4). Therefore, the mixture of active and passive contacts provides density, pin count, mechanical performance, electrical performance, reliability, and cost benefit improvements (such as a improvements in the amounts and types of metals utilized).

The second feature provided by the embodiments illustrated in FIGS. 1 and 13 is the offset or alternating contact pattern. This alternating contact pattern provides advantages in the assembly of very fine pitch connector systems. As shown in FIGS. 13 and 67, the contact tail 21 and surface mount foot 23 of the systems may be centered on contact base 13*f* providing a measurable area or land 25 (for assembly equipment) on each side of the contact tail 21 for which assembly equipment may locate and press a contact into a housing. With a contact tail 21 centered on all contacts 12 and 13 and the contact bases 13*f* offset one-half contact position between an inner row and outer row, the surface mount foot portion 23 of an inner row contact may pass between the contact base area 13*f* of the neighboring outer row contacts and exit to the board as shown in FIGS. 1 and 13. Therefore, the resulting board attachment process and circuit routing may be simplified. It will be understood with benefit of the present disclosure that in addition to those embodiments illustrated, alternating contact patterns may be employed without mixed active and passive contacts.

Finally, as may be seen in FIGS. 1, 1C and 2, interior walls 15 of plug housing 26 may be manufactured thinner than corresponding exterior walls 11 of socket housing 16. This is made possible in the illustrated embodiment by offsetting mating forces created by deflection of active plug contacts 12 against contact support structures 10 located on interior sides of interior walls 15 of plug housing 26, and by contact of active socket contacts 12 against contact support structures 10 located on interior sides of interior walls 15 of plug housing 26, and by contact of active socket contacts 12 with passive plug contacts 13 located on exterior sides of interior walls 15 of plug housing 26. Accordingly, thickness of interior walls 15 of plug housing 26 may be dictated only by need for dielectric insulating capacity and contact support structure geometry, allowing further reduction in connector dimensions. Such an advantage is not possible with conventional non-alternating contact designs which may require metal housings or special support features for connector integrity. Nor would such an advantage be fully realized using conventional cantilever beam spring contacts without the presence of contact support structures 10. This is because conventional active contacts are unsupported and therefore not capable of transferring a reactive force to counterbalance forces acting on passive contacts 13 therefore, for example, requiring wall 15 to be thicker.

The offset or alternating contact configuration of the disclosed method and apparatus provides increased contact support over conventional contact configurations having the same effective contact pitch. In addition to structural and mechanical advantages, this alternating contact configuration provides superior electrical isolation from adjacent contacts in the mating area and in the tail exit area, resulting in more reliable electrical performance with increased dielectric withstanding strength, insulation resistance, and the like, in addition to providing high speed performance.

Figure 15:
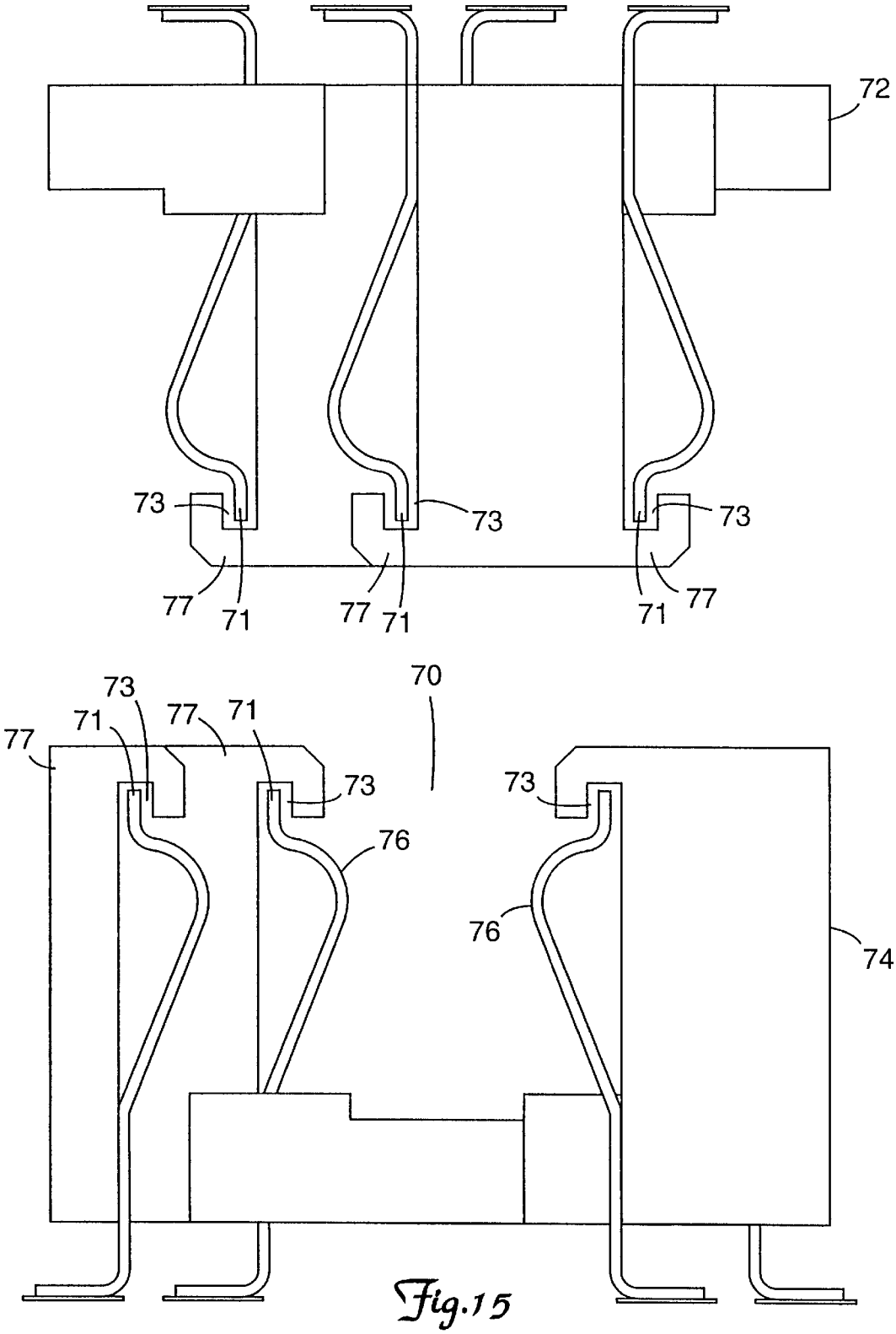
FIG. 15 is a vertical cross sectional view of the electrical interconnection embodiment of FIG. 14.

The contact elements may be disposed within a connector housing in a variety of different ways. For example, FIGS. 14 and 15 disclose a contact configuration having one major grove or channel 70 in which connector halves 72 and 74 mate, while FIGS. 16 and 17 illustrate another embodiment having two major groves or channels 70 in which connector halves 72 and 74 mate. In FIG. 14, contacts 76 are horizontally staggered along each sidewall of one major mating channel 70 as shown in cross sectional view in FIG. 15. By contrast, in FIG. 16 contacts 76 alternate within each channel 70 in an alternating manner as previously described, as shown in cross section view in FIG. 17. Advantageously, in both alternating and horizontally staggered contact configurations, a mixed contact arrangement of passive and active contacts may be utilized (as illustrated in FIGS. 16A, 16B, 18, and 19).

It will also be understood with benefit of the present disclosure that a horizontally staggered contact configuration (such as that illustrated in FIGS. 14 and 15), and an alternating configuration (such as that shown in FIGS. 16 and 17) may each be employed in a variety of different connector configurations in addition to those illustrated. For example, horizontally staggered contact arrangements may be employed with connector components having differing numbers of channels and/or with connector components that also employ alternating contact designs. Among the many possible ways that horizontally staggered and alternating contact configurations may be combined are as separate contact configurations disposed on separate channel sidewalls, or as a "hybrid" mixture in which horizontally staggered contacts located on one side of connector wall are deployed in an alternating contact arrangement with other horizontally staggered contacts disposed on the opposite side of the same connector wall.

Figure 19:
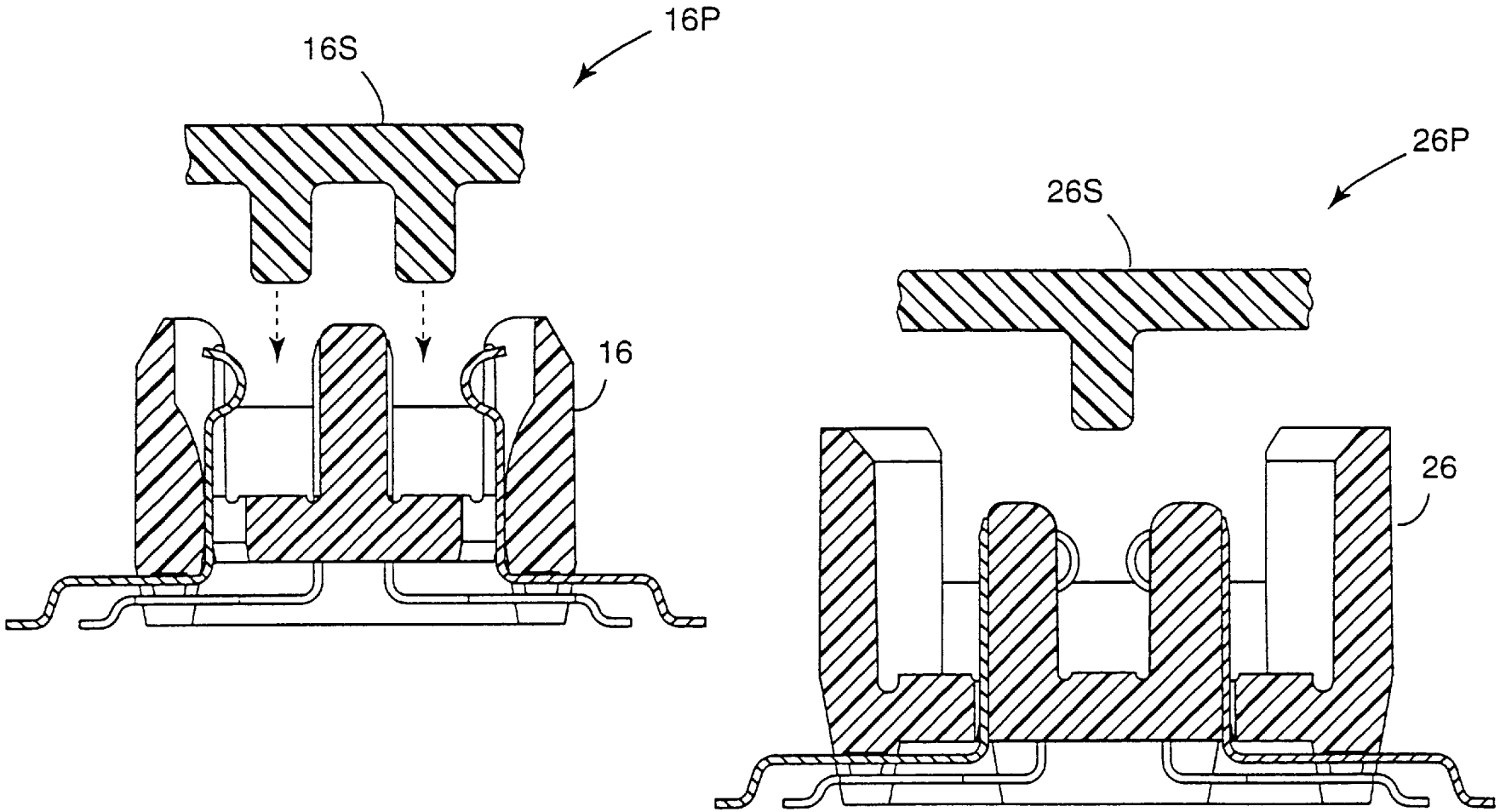
FIG. 19 is a perspective cross sectional view of a plug and socket of an electrical interconnection according to one embodiment of the disclosed method and apparatus having a mixed contact arrangement of passive and active contacts in an alternating contact configuration and having two channels in which connector halves mate.
Figure 18:
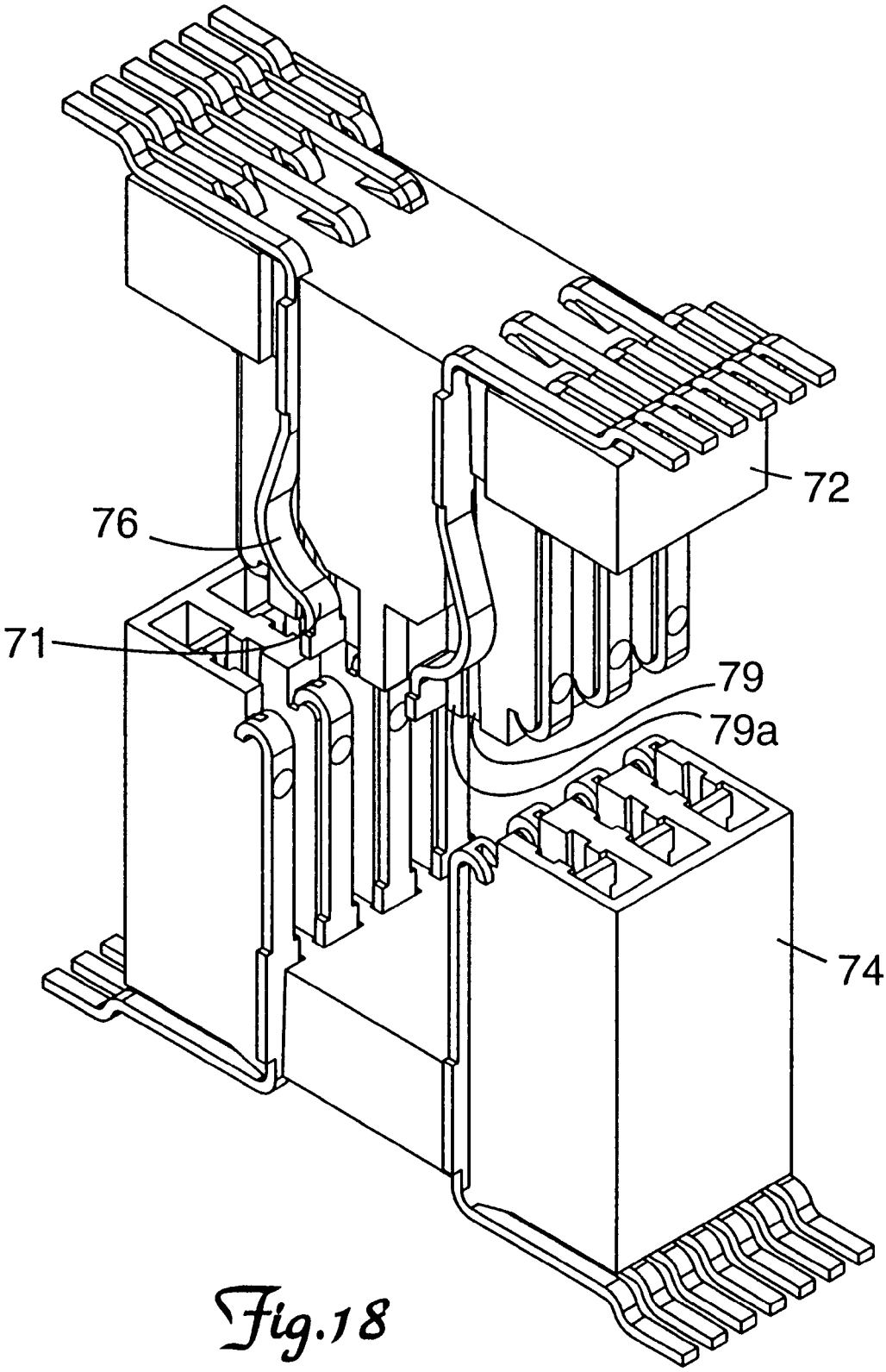
FIG. 18 is a perspective cross sectional view of a plug and socket of an electrical interconnection embodiment of the disclosed method and apparatus having a mixed contact arrangement of passive and active contacts in alternating configuration and a single channel in which connector halves mate.
Figure 19:
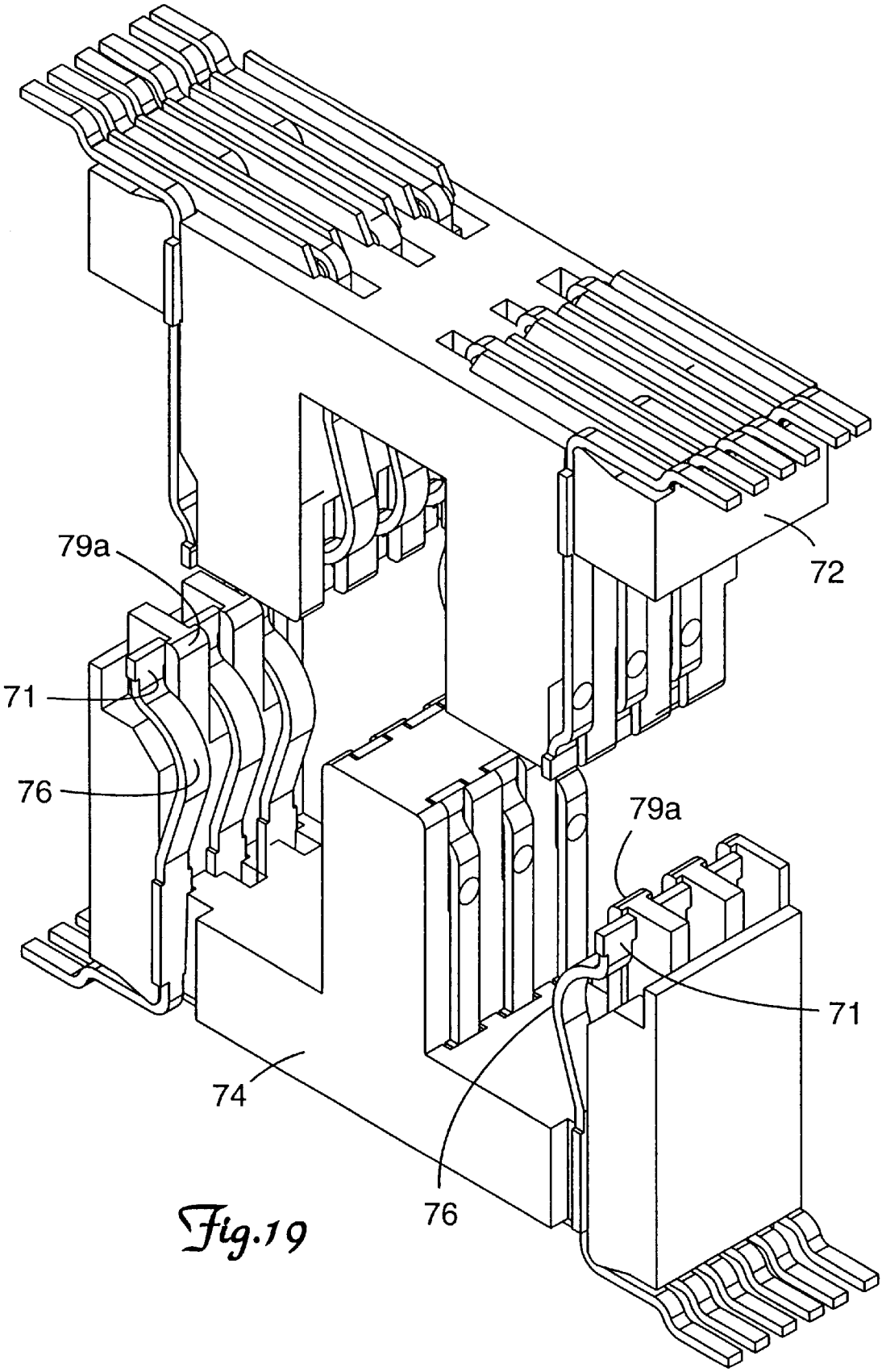
Figure 21:
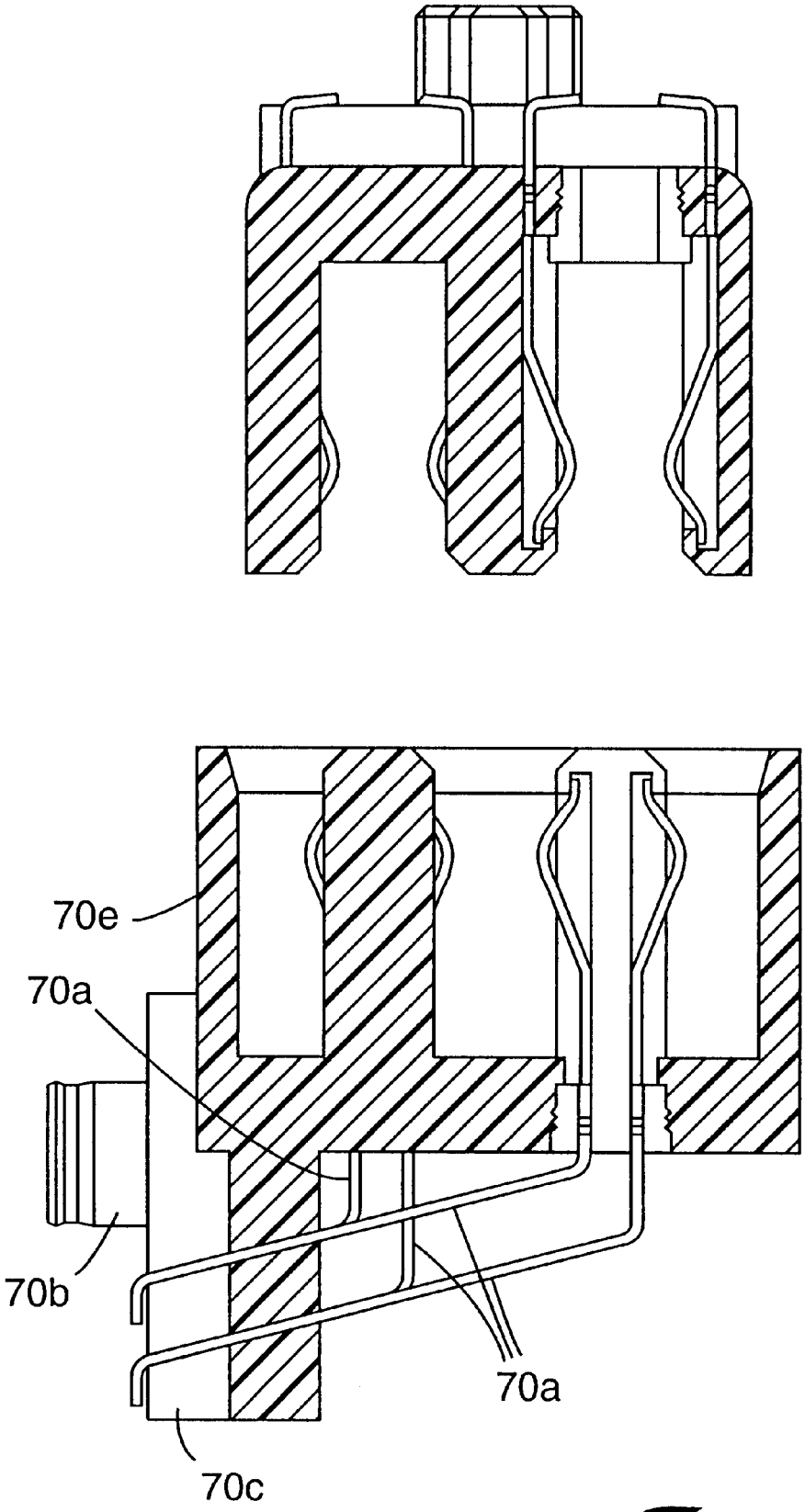
FIG. 21 is a cross sectional view of another embodiment of the disclosed method and apparatus.

FIGS. 14, 15, 16 and 17 illustrate connector designs in which the contacts are loaded from the bottom, and FIGS. 16A, 16B, 18 and 19 illustrate connector designs in which contacts are loaded from the top or separable side. It will be understood with the benefit of this disclosure that very similar connector designs are possible in which the contacts are loaded from the bottom, such as that shown in FIG. 13. It should be noted that FIGS. 13, 18, and 19 illustrate contact support configurations with an arcuate support surface as previously described. It will be understood with the benefit of this disclosure that the alternating contact designs may be successfully practiced with or without the support. Illustrating just one of many other possible connector housing and contact element embodiments, FIG. 21 shows a connector component 70*e* having contact tails 70*a* configured in a right angle tail exit design for connection with board 70*c*. In FIG. 21, connector component 70*e* is secured to board 70*c* by means of anchor post 70*b*.

Figure 20:
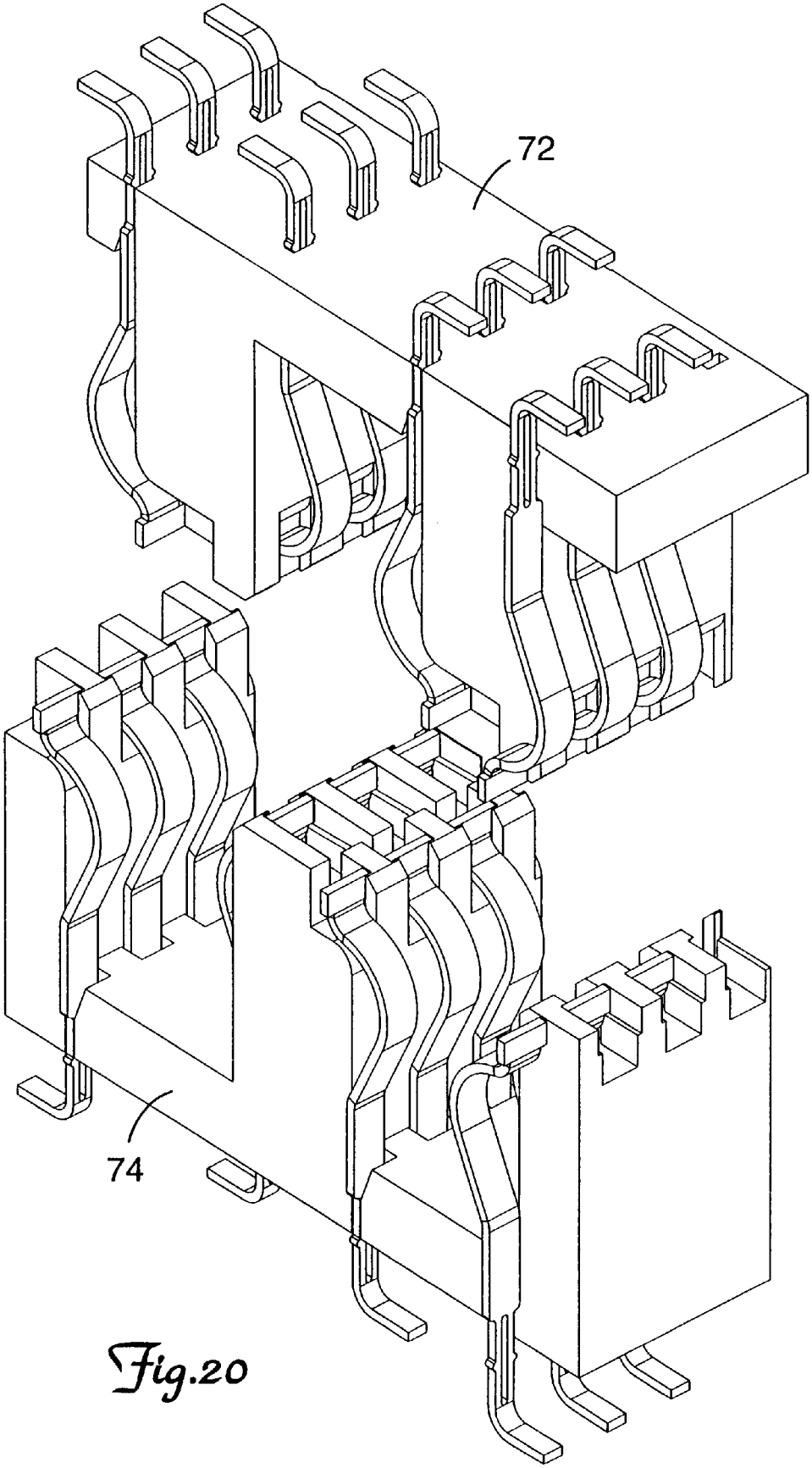
FIG. 20 is a perspective cross sectional view of a plug and socket of an electrical interconnection according to one embodiment of the disclosed method and apparatus having an alternating contact configuration and having two channels in which connector halves mate.

In the embodiments illustrated in FIGS. 14–17, each contact tip 71 is configured with a stepped or bent shape that is "buried" or "captured" within a corresponding housing notch 73 formed in connector halves 72 and 74 by a closed cavity end or molded cap 77. By so capturing contact tips 71 in notches 73, contact alignment is preserved, and contact tips 71 are constrained and prevented from deflecting or moving into channels 70 where contacts 76 may become bent or crushed during connector mating. In FIGS. 18, 19 and 20 an alternative way of protecting and aligning contact tips according to another embodiment of the disclosed method and apparatus is illustrated. In this embodiment contacts 76 have "T-shaped" contact tips 71 that contact or interact with a raised area or ledge 79*a* disposed on housing cavity walls 79 in such a way that contact tips 71 are substantially constrained, protected, and aligned without the type of cap 77 shown in the embodiments of FIGS. 14, 15, 16 and 17. FIGS. 16, 16A, 18 and 19 show "T-shaped"

contact tips 71 and mating cavity ledges 79*a* in connector embodiments not having contact support structures. However, this configuration is typically and advantageously used with embodiments of the disclosed method and apparatus having contact support structures. Not only does the absence of cavity caps allow the creation of a shorter and more compact connector housing, but also simplifies molding by eliminating the need to create a cavity cap. This is particularly advantageous with regard to connector housings having contact support structures because limitations of matching equipment typically prevent the formation of support structure shapes when caps are present.

It will be understood with benefit of the present disclosure that a contact tip and corresponding cavity wall and ledge shape may be of other geometries suitable for protecting and aligning the contact tip including, but not limited to T-shapes having other dimensions and L-shapes that interact with only one cavity wall.

Tail Design

Figure 24:
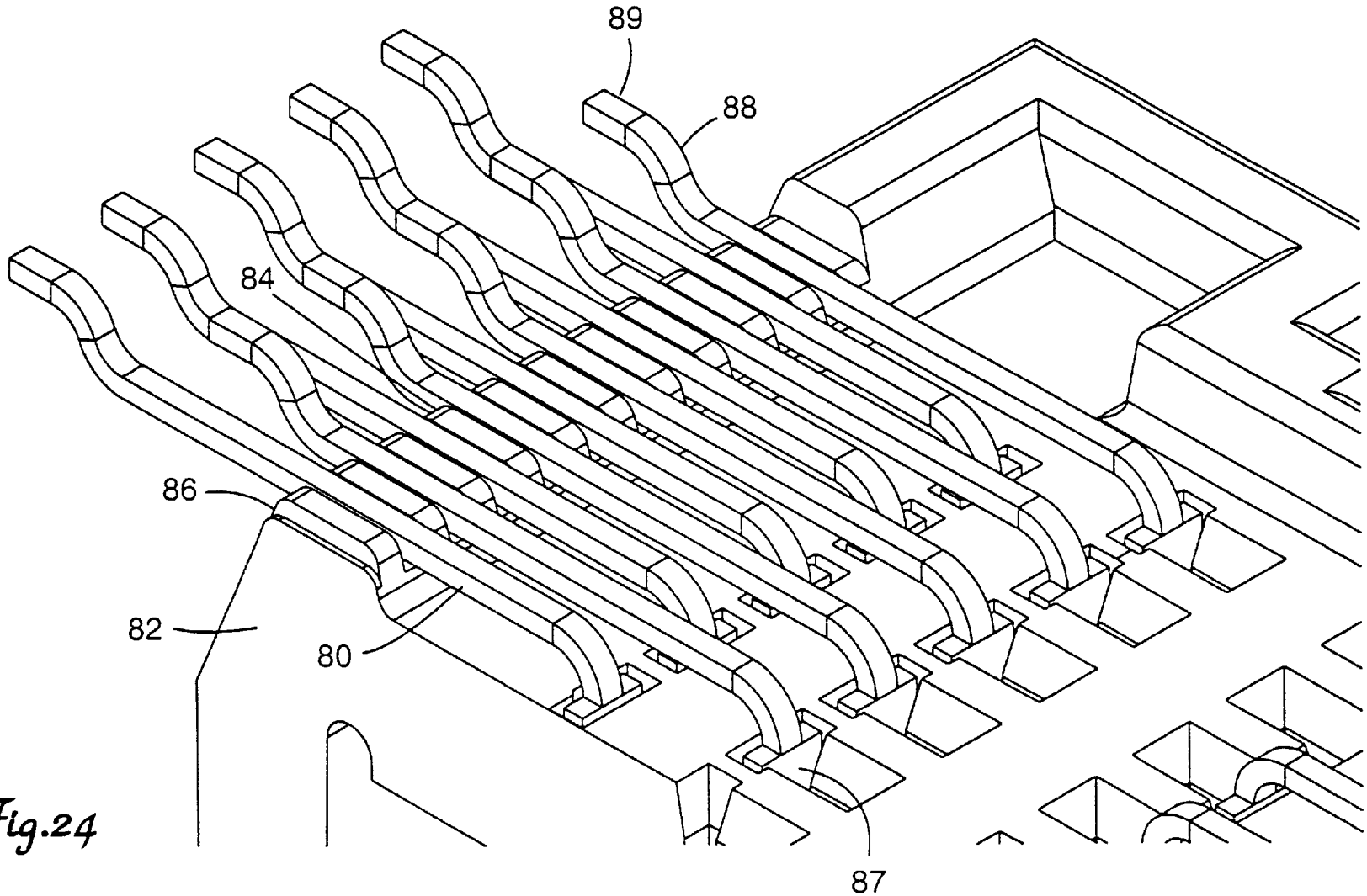
FIG. 24 is a perspective cross sectional view of an electrical interconnection component according to one embodiment of the disclosed method and apparatus having contact tails passing through a plurality of positioning notches in a "in-line tail" design.
Figure 25:
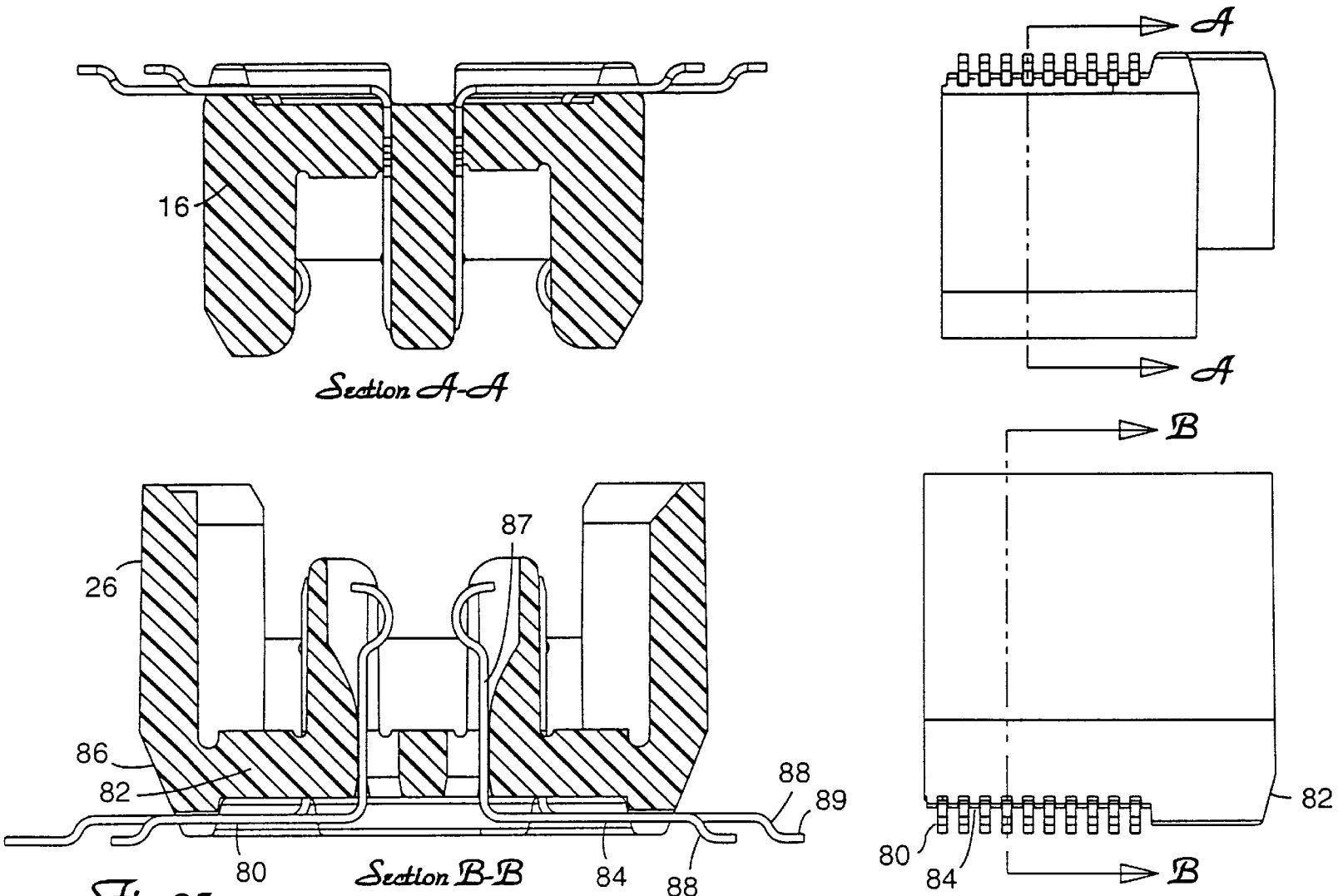
FIG. 25 shows side and vertical cross sectional views of a plug and socket component according to one embodiment of the disclosed method and apparatus, including positioning notches.
Figure 25A:
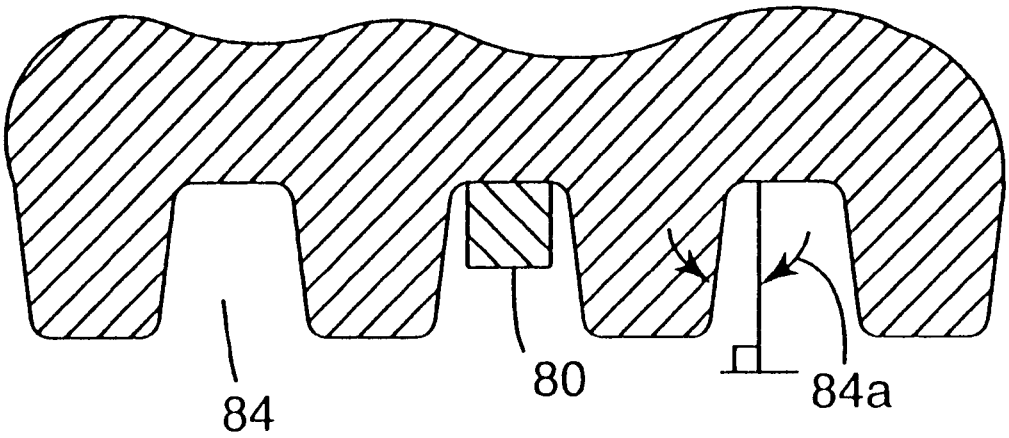
FIG. 25A is a horizontal cross sectional view of a contact tail member and positioning notch design according to one embodiment of the disclosed method and apparatus.
Figure 25B:
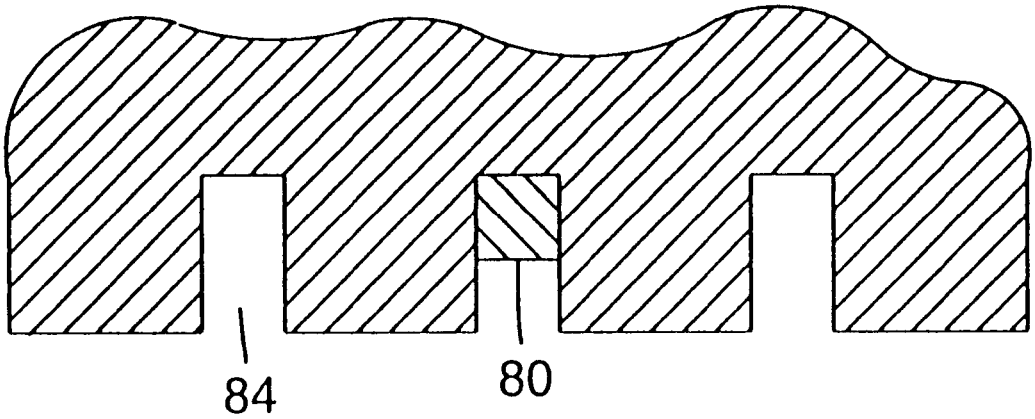
FIG. 25B is a horizontal cross sectional view of a contact tail member and positioning notch design according to another embodiment of the disclosed method and apparatus.

The disclosed interconnection systems and designs may be practiced with connectors having a variety of tail exit configurations. These configurations may include configurations having positioning notches for aligning and/or retaining contact tails. In the embodiment illustrated in FIGS. 24 and 25, contact tails 80 are all coplanar for a distance parallel to the connector base 82 and remain such as they pass through a plurality of positioning notches 84 toward the edge of the insulating housing or body 86 in what may be referred to as an "inline tail" design. Positioning notches 84 may also be configured as grooves, slots, openings, recesses, passages, teeth, or the like. Each positioning notch 84 receives a corresponding conducting contact feature 80 as shown in FIGS. 24 and 25. Each positioning notch 84 may have a substantially parallel side with a taper, draft, or angle 84*a* as shown in FIG. 25A and may be present on each connector component 16 and 26. When present, taper 84*a* is for injection molding notch features 84 into a housing sidewall, and for providing a lead-in feature for a conducting tail portion 80 that will facilitate alignment and entrance of the tail portion 80 into notches 84. FIG. 25B illustrates and alternative embodiment having notches 80 that lack taper 84*a*. Once a conducting tail member 80 is inserted into a corresponding notch 84, the notch 84 is designed to hold the tail member 80 in a desired position during shipping and until the connector is attached to a printed circuit board.

Allowing the use of positioning or retention notches discussed above, is a stepped surface mount ("SMT") tail configuration illustrated in FIGS. 24 and 25. This configuration enables a retention notch 84 to be created on the housing to receive, hold, and align a surface mount contact during transportation. As shown in connector component sections A—A and B—B of FIG. 25, a flat portion 89 may be provided that is designed to supply increased strength for the solder joint of a surface mount contact. A "step" 88 may be supplied that serves to provide an opening or clearance between the connector housing and the printed circuit board in which material remnants from the board attachment process may be cleaned away following physical soldering of a connector to a board. The step 88 enables a substantial solder heel to be formed during the soldering process on the outermost portion of the radius nearest the board. A solder fillet will typically be formed during the soldering process on the sides and end of the flat portion 89 on the stepped tail. In one embodiment of the disclosed method and apparatus, the angle between the contact base 87 and the contact tail 80 may be formed at less than a 90° interior angle. In this case, when a contact is assembled into a housing, the contact tail 80 will be aligned to the notch 84 on the connector sidewall and will be held there via an upward pressure created by a cantilever force resulting from interference with the connector housing 82 which acts to mechanically open the angle between the contact base 87 and the contact tail 80 to about 90° during the assembly process. Once a contact tail 80 is engaged into a positioning notch 84, the strength of the surface mount foot portion is substantially increased and the lateral and longitudinal positioning (i.e., in the X-Y position between adjacent contacts and along the axis of the contact tail) is more likely to be preserved. The vertical positioning of a contact tail 80 may be controlled by varying the seating depth of a contact base 87. Using this method, a completely planar set of contacts may be provided, thereby increasing the capability of a board attachment.

Advantageously, when the alternating contact embodiment of the disclosed method and apparatus is combined with a step SMT tail design centered in a positioning notch, three dimensional packaging of the contacts in a manner which expands the distance between an adjacent contact tail and solder joint is enabled. The net effect is that solder bridging is substantially minimized.

Figure 26:
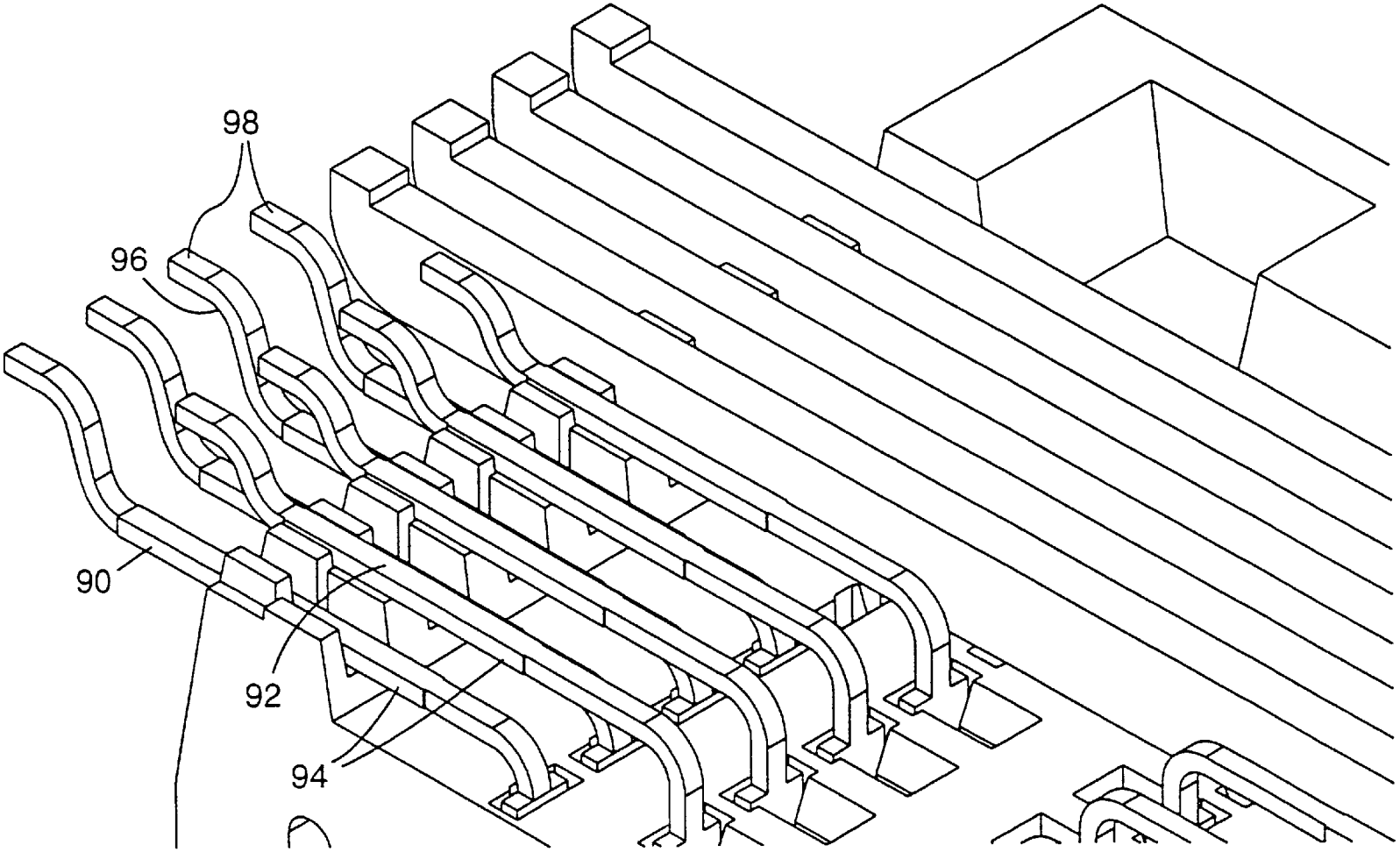
FIG. 26 is a perspective cross sectional view of one component of an electrical interconnection according to the disclosed method and apparatus having contact tails which pass through a plurality of positioning notches in a "multi-level tail" configuration.
Figure 27:
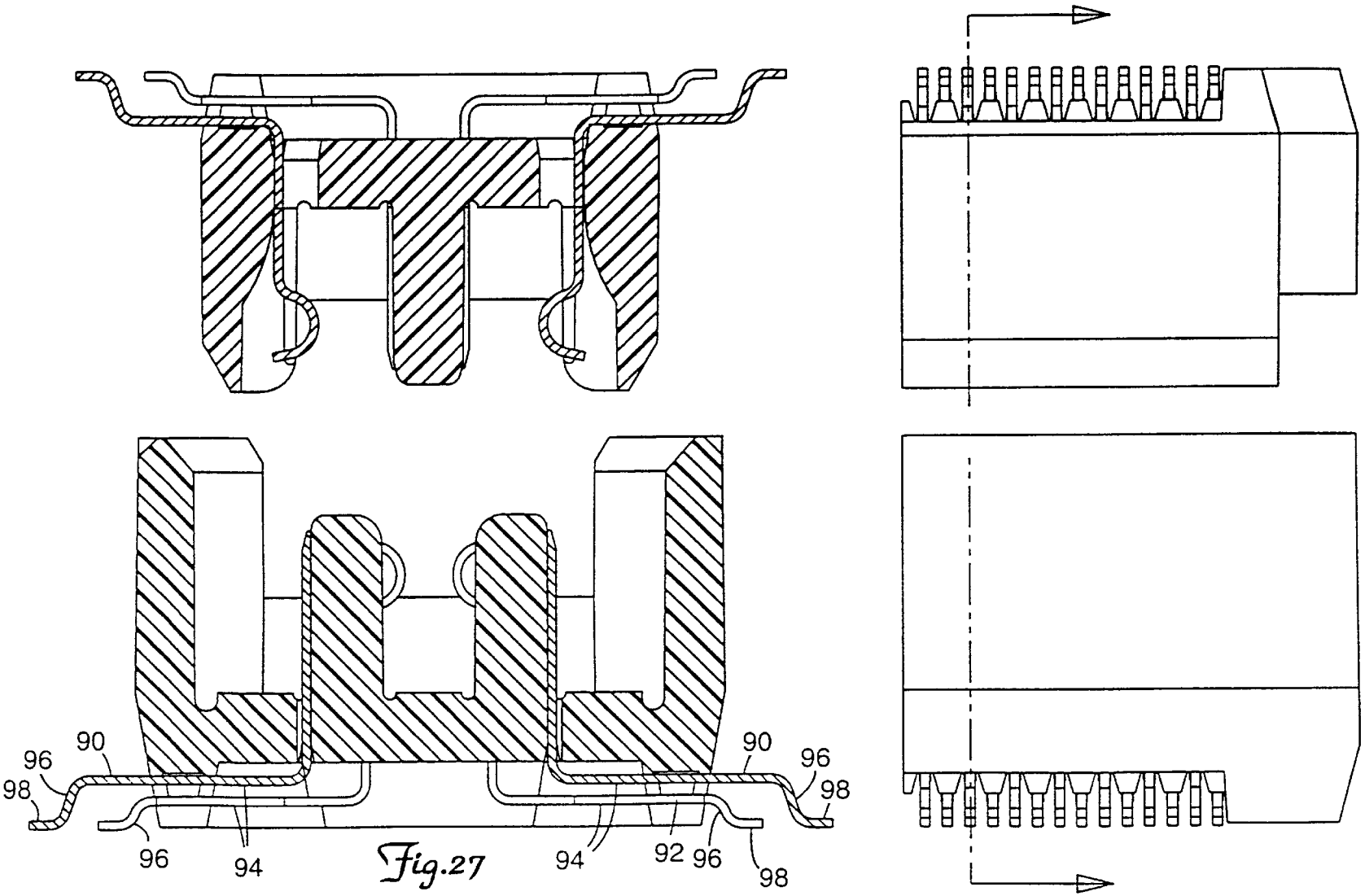
FIG. 27 shows side and vertical cross sectional views of the electrical interconnection component embodiment of FIG. 26, including positioning notches.

In the practice of the disclosed method and apparatus, a "multi-level tail" design embodiment may also be employed with or without the stepped tail design to achieve high interconnection density and to provide other benefits, such as structural integrity and signal clarity. A multi-level tail design also offers increased manufacturing process capability with respect to contact stamping and forming operations while at the same time maintaining a relatively low profile and low total product cost. As an example, a "bi-level tail" embodiment is illustrated in FIGS. 26 and 27, in perspective and cross sectional views, respectively. In this embodiment, two layers of electrically conducting tails are provided, an upper tail layer 90 and a lower tail layer 92, thus providing the "bi-levels." As shown in FIGS. 26 and 27, each of these layers are disposed substantially parallel to one another. In the bi-level tail embodiment illustrated in FIGS. 26 and 27, each bi-level tail is conducting and has a generally planar portion 94 coupled to a stepped surface mount foot portion 96 which also has a generally planar portion 98. Although the planar portions 94 of the conductors 90 and 92 are illustrated to be planar with one another, they may be adjusted using the method described above for "stepped contact" designs.

Figure 28:
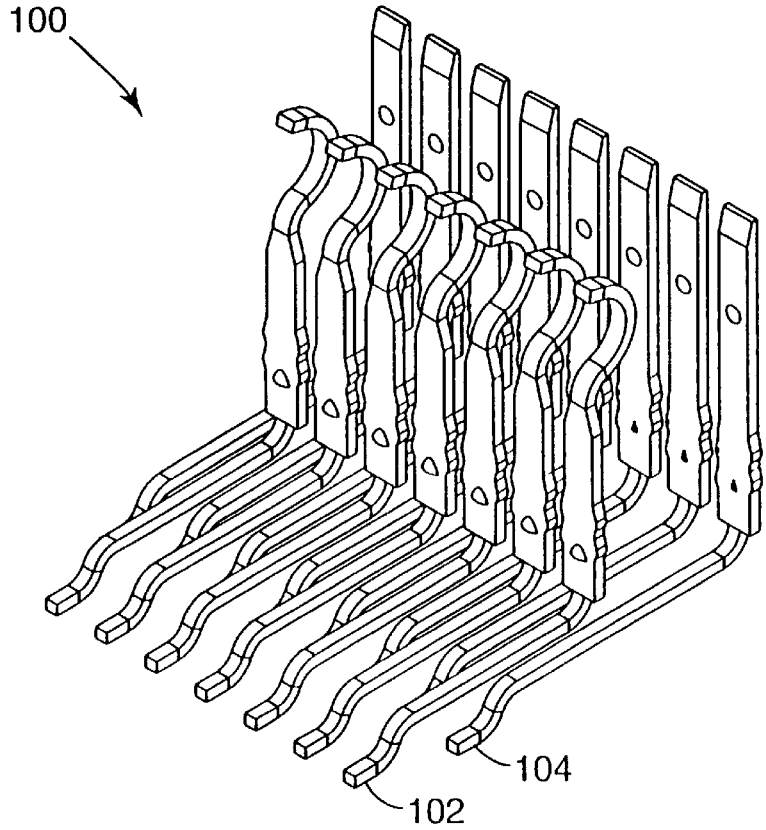
FIG. 28 is a perspective cross sectional view showing spatial arrangement of contacts and contact tails according to two embodiments of the disclosed method and apparatus having in-line and multi-level tail configurations respectively.
Figure 28:
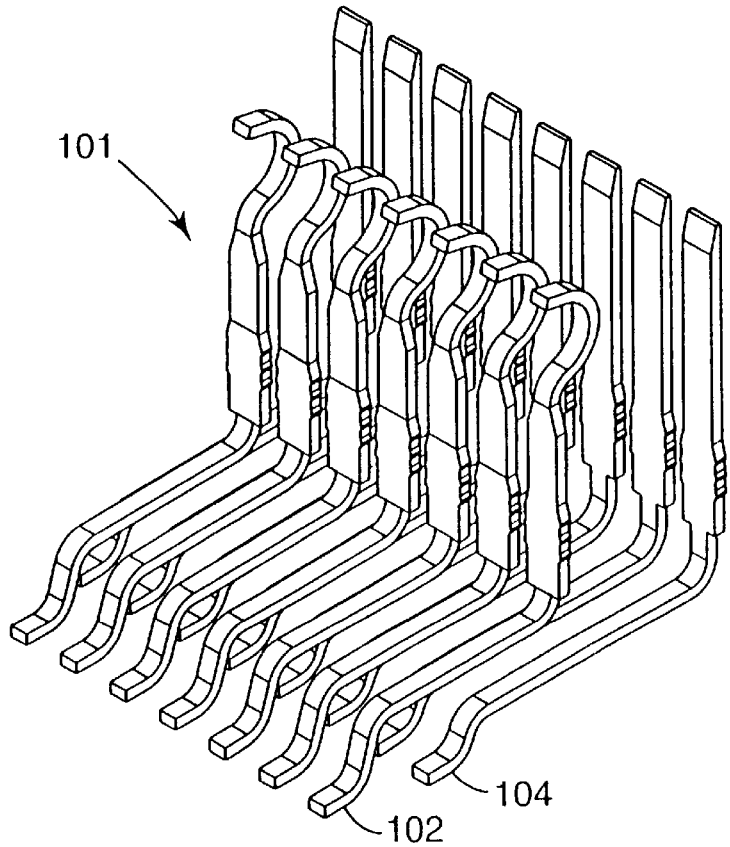

FIG. 28 illustrates a comparison of an in-line tail design 100 and a multi-level tail design (bi-level in this example) 101. As shown in FIG. 28, both inline tail configuration 100 and bi-level tail configuration 101 have longitudinally adjacent tails 102 and 104. However, the bi-level tail 102 configuration increases separation between adjacent contacts due to both longitudinal and vertical separation. Although the overall height may be increased in comparison with the inline tail embodiment 100, the separation created by the bi-level tail design 101 substantially reduces cross talk between conducting tail portions. Added clearance provided by the bi-level tail embodiment 101 also allows increased tail width which, in turn, increases current capacity and cooling. In addition, increased tail width allows the tails to be mechanically stronger and the manufacturing process capability to be increased.

Figure 29:
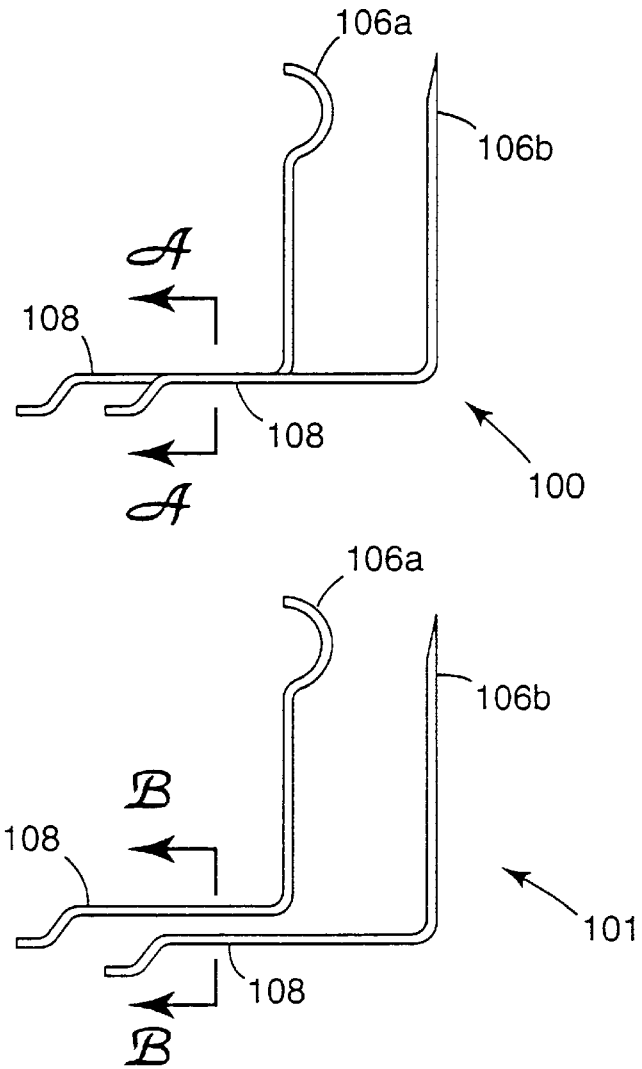
FIG. 29 shows vertical and horizontal cross sectional views illustrating spatial arrangement of in-line and multi-level contact tail exit designs according to two embodiments of the disclosed method and apparatus.
Figure 29:
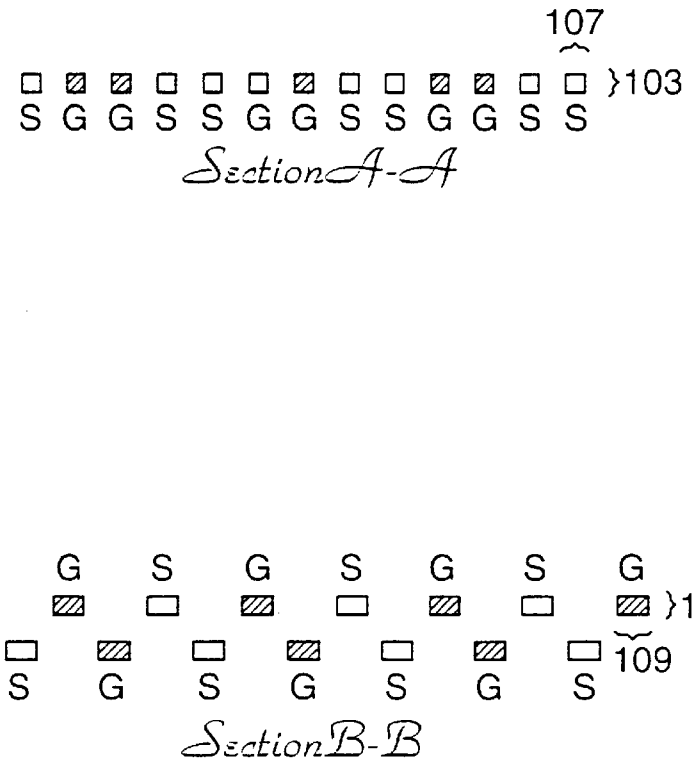

As mentioned above, the bi-level tail invention achieves reduction in cross talk by providing contact tail row separation. Assuming a one ground to one signal ratio for comparing inline to bi-level tail configurations, FIGS. 28 and 29 illustrate lines tail exit designs for inline 100 and bi-level 101 tail designs respectively. In these figures, ground lines are depicted with a label of "G" and signal lines are depicted with a label of "S". FIG. 28 shows standard inline tail geometry 100 in perspective view and FIG. 29 shows contacts 106*a* and 106*b*, and planar tail portion 108 in cross section. In these figures, ground lines are depicted with a label of "G" and signal lines are depicted with a label of "S". The ground and signal tail designations herein are merely illustrative and which tails are signal lines or ground lines may vary.

Figure 30:
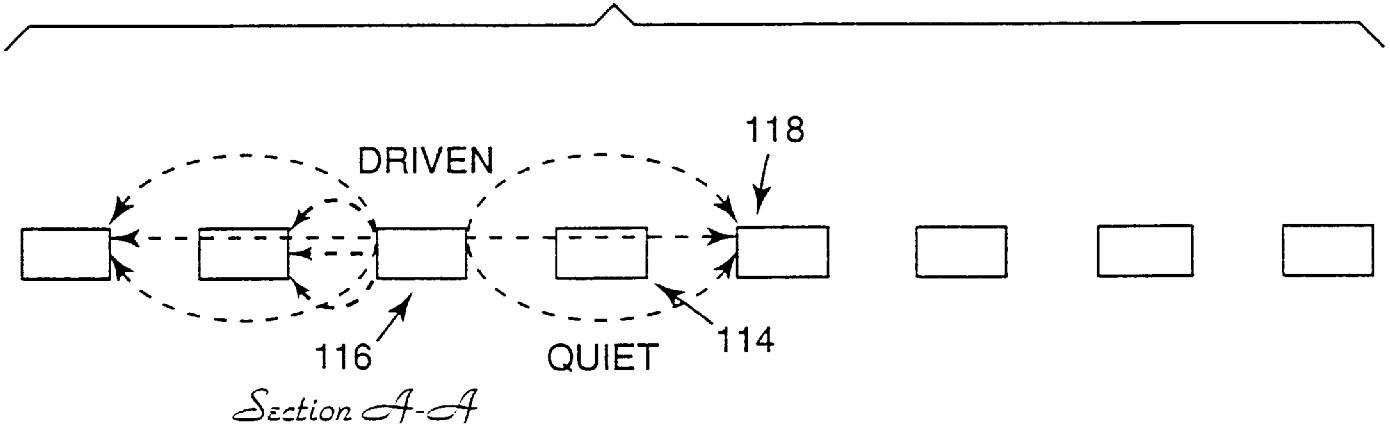
FIG. 30 is a planar cross sectional view of the in-line tail exit configuration according to the embodiment of FIG. 29 with electric field distribution lines illustrated.
Figure 31:
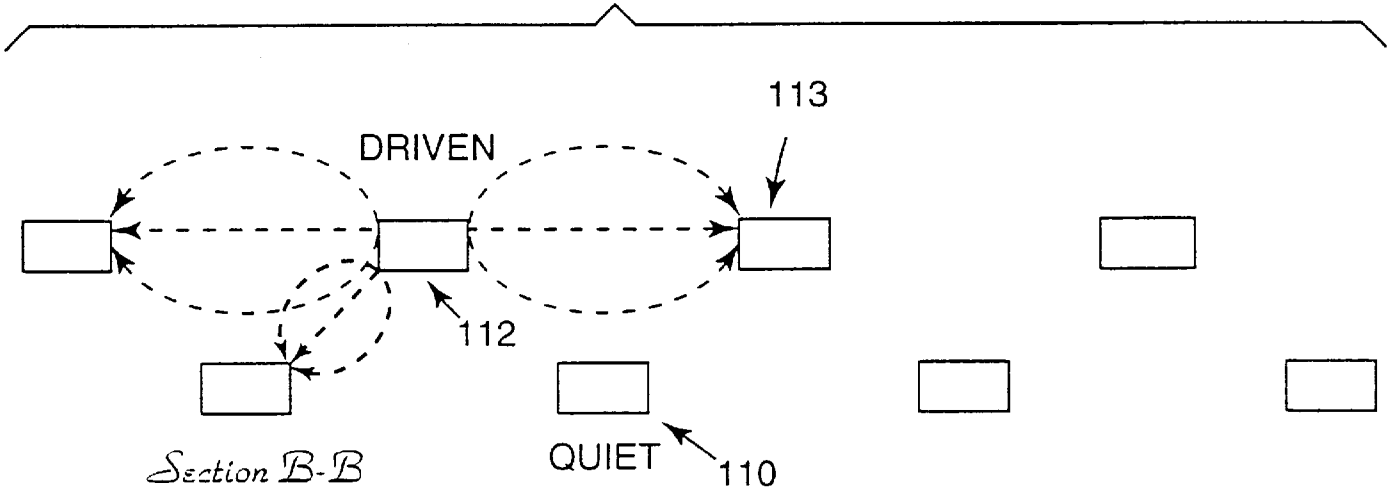
FIG. 31 is a planar cross sectional view of the multi-level tail exit configuration of the embodiment of FIG. 29 with electric field distribution lines illustrated.

FIGS. 30 and 31 represent Sections A—A and B—B of FIG. 29, respectively, and include electric field distribution lines for a GGSSGG arrangement to illustrate cross talk effects for both inline and bi-level tail configurations. As shown in FIG. 30, in an inline tail configuration, a quiet line 114 may be positioned directly between a driven line 116 and a ground line 118, creating a potential for cross talk between the driven and quiet lines as shown. This is a typical result of a quiet line 114 being positioned directly between a driven line 116 and the next nearest ground 118. In this regard, section A—A shows a resulting electric field distribution for a GGSSGG arrangement.

However, as shown in FIG. 31, in a bi-level tail configuration, a quiet line 110 adjacent to a driven line 112 is not positioned directly between the driven line 112 and its next-nearest ground 113, reducing the potential for cross-talk. Additionally, in the bi-level tail embodiment of FIG. 31, distance between quiet lines 112 and driven lines 113 is greater than that provided by an inline tail configuration, further reducing the potential and/or magnitude of cross talk. It should be noted that contact tails connected to contacts 106*a* positioned toward the exterior of a connector housing are typically positioned on an upper contact tail row and contact tails connected to contacts 106*b* positioned toward the interior of a connector housing are typically positioned on a lower contact tail row as shown in FIG. 29. This configuration maximizes separation between contact tails because upper contact tail members are not "crossed" (or located on the same horizontal plane at a corresponding vertical position) at any point by lower contact tail members.

As shown in the sectional views of FIG. 29, thickness of an inline conducting tail element 103 is typically equivalent to the thickness of a bi-level conducting tail element 105. However, the geometry of a bi-level tail configuration allows for a bi-level tail member width 109 that is greater than an inline tail member width 107. As such, the cross sections of bi-level tail members 101 may be constructed to have more area and to be more rectangular (and less square) in shape than the cross sections of inline tail members 100.

Figure 29A:
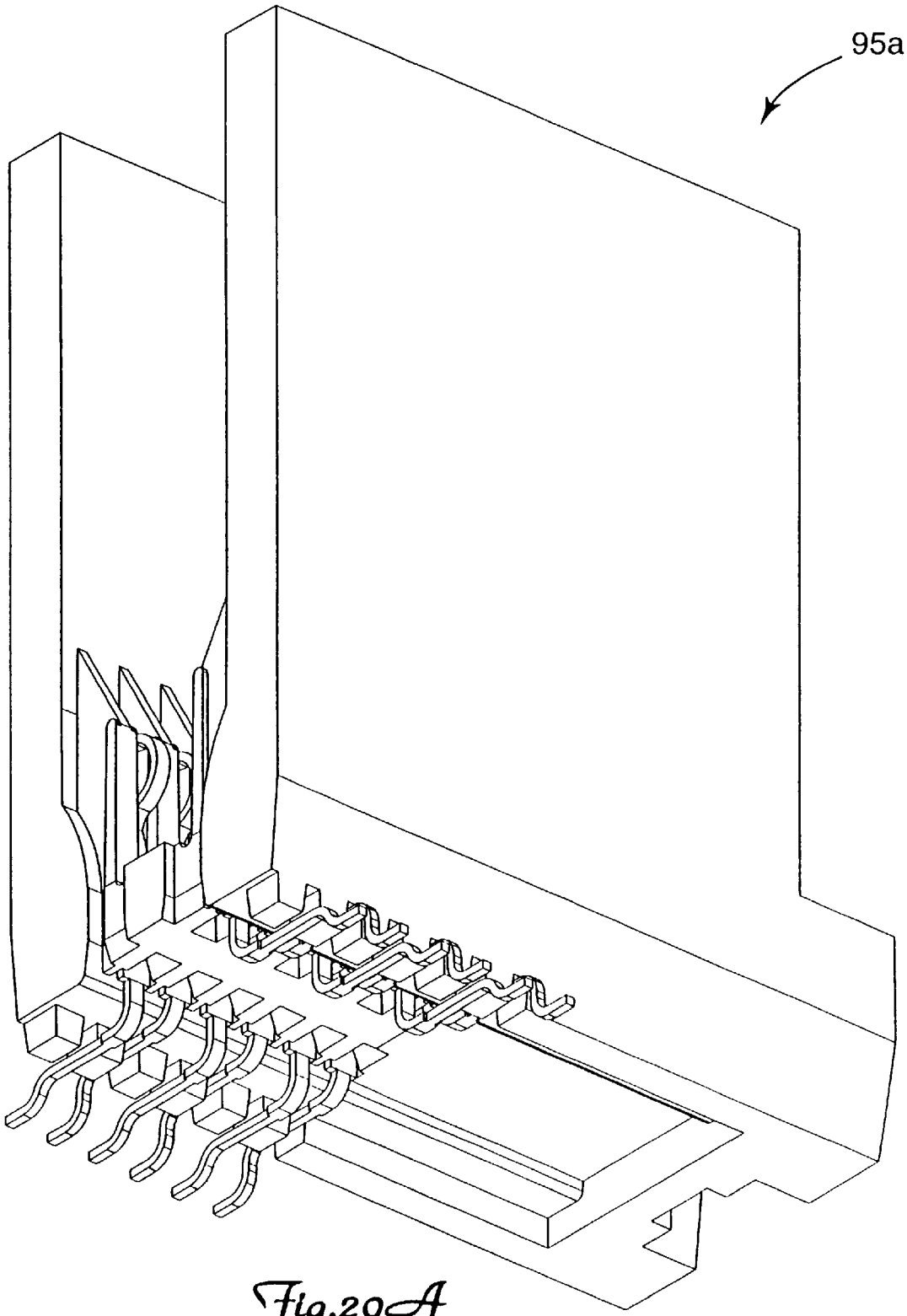
FIG. 29A is a perspective cross sectional view of a card edge connector according to one bi-level tail embodiment of the disclosed method and apparatus.
Figure 29B:
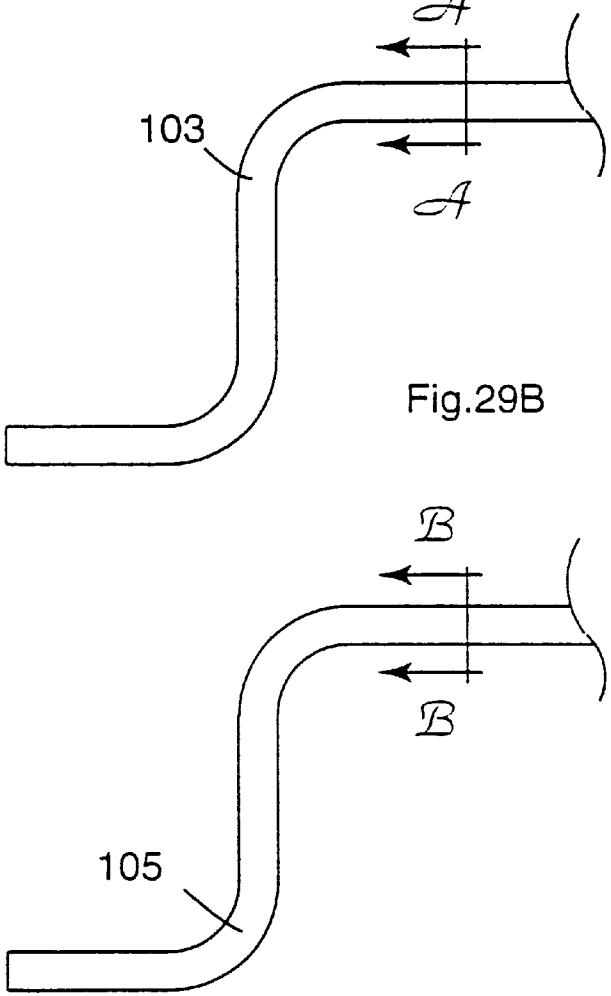
FIG. 29B is a cross sectional views of a typical inline tail member and a bi-level tail member according to one embodiment of the disclosed method and apparatus.
Figure 29B:
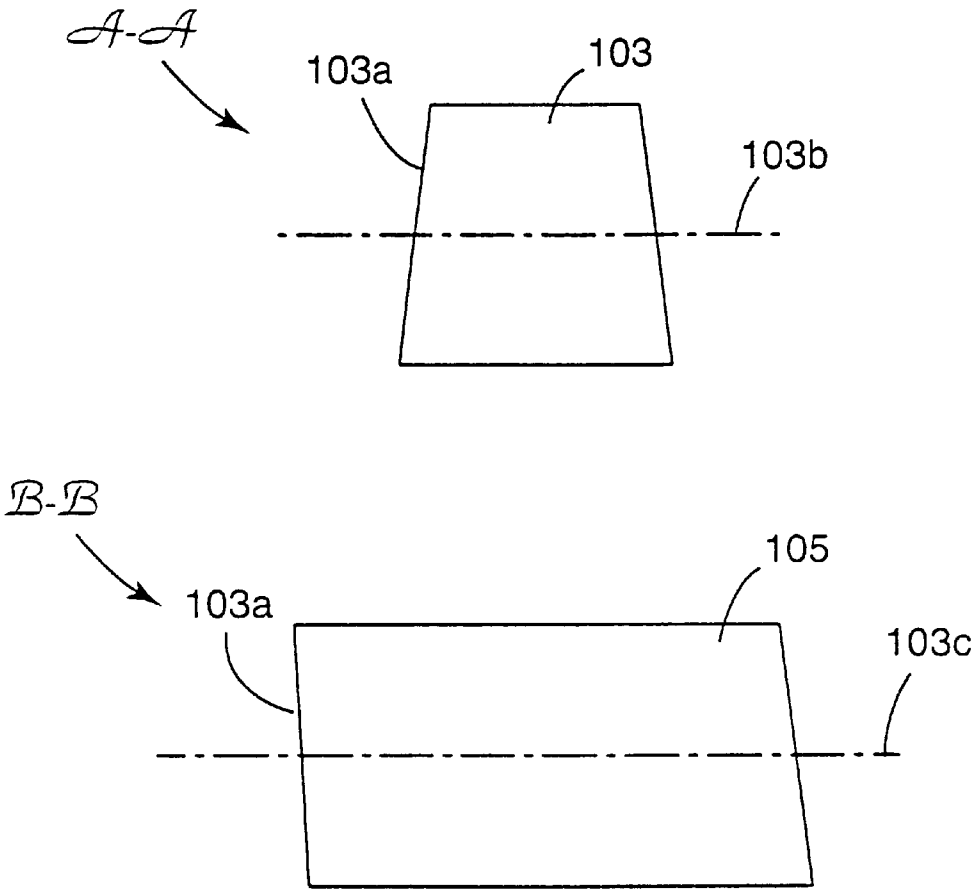

Among the advantages made possible by greater tail member width is increased tail member cross sectional area. Such an increase in cross sectional area enhances a tail member's ability to transfer electric current. In addition, greater tail member with helps achieve a rectangular cross section that may improve consistency and bend formability of tail sections. This is because a rectangular cross section may create a more clear and unchanging neutral axis around which a bend occurs. As shown in FIG. 29B, the edge effect from a blanking or stamping process imparts an inclined shape to each tail element longitudinal side edge 103*a*. It is believed that this edge effect is a function of the absolute size, material hardness, etc. of a conductor. It is also believed that the edge effect becomes substantially non-linear as the aspect ratio (feature width/feature thickness) becomes nearer to and drops below 1.0. For example, with a substantially square cross section (i.e., with an aspect ratio near 1.0) as is typically found in an inline tail configuration, the neutral axis 103*b* is not clearly identified nor is it repeatable from part to part and lot to lot. Therefore, inline tail member bends may not be consistent or repeatable. However, in a bi-level tail design having a more rectangular cross section, the edge effect is minimized and the neutral axis 103*c* typically well defined. Therefore bi-level tail member bend formability is typically much more repeatable and consistent. This provides for higher yields in the factory processes, and a more coplanar product. Although not shown, tail member width may be optionally configured large enough so that upper row tail members vertically "overlap" lower row tail members if so desired, a configuration not possible with inline tail designs.

It should be noted that previously mentioned contact support embodiments of the disclosed method and apparatus also may be used to enhance or increase a contact and tail member width/thickness ratio over unsupported contact designs by virtue of relatively thinner contact geometries that may be used to achieve an equivalent contact normal force. If so desired, a multi-level tail embodiment may be combined with a contact support embodiment to create a contact configuration with a particularly enhanced or increased width/thickness ratio.

The increased conductor tail width made possible by the bi-level tail embodiment offers the advantage of making the conducting tails more rigid. This increased rigidity helps minimize damage due to handling. Increased tail width also lowers electrical resistance of a contact, thereby reducing lead inductance, and enabling greater electrical power transfer. Increased separation of the tails in the bi-level tail embodiment also enhances power handling capability since the bi-level configured conductors are able to transfer heat better than conductors configured in an inline tail configuration or in previous tail geometry designs. In addition, larger tail separation provides fewer opportunities for solder bridging to occur between adjacent contacts. Although FIGS. 26–29 illustrate a two piece multi-row, ribbon style connector design embodiment having a bi-level tail embodiment configuration, it will be understood with benefit of this disclosure that the disclosed multi-level tail embodiment may be practiced in combination with any other multi-row product design including, but not limited to, straddlemount connector embodiments such as that shown in FIG. 62A card edge embodiments such as that shown in FIG. 29A. For example, a card edge connector 95*a* having a bi-level tail configuration is illustrated in FIG. 29A. Furthermore, in addition to bi-level tail embodiments, other multi-level tail configurations may be employed, for example a tri-level tail configuration as shown in FIG. 33A with three tail rows 106*c*, 106*d*, and 106*e*. In a similar manner, other multi-level tail configurations would also be possible with larger number of rows of contact tails.

Figure 32:
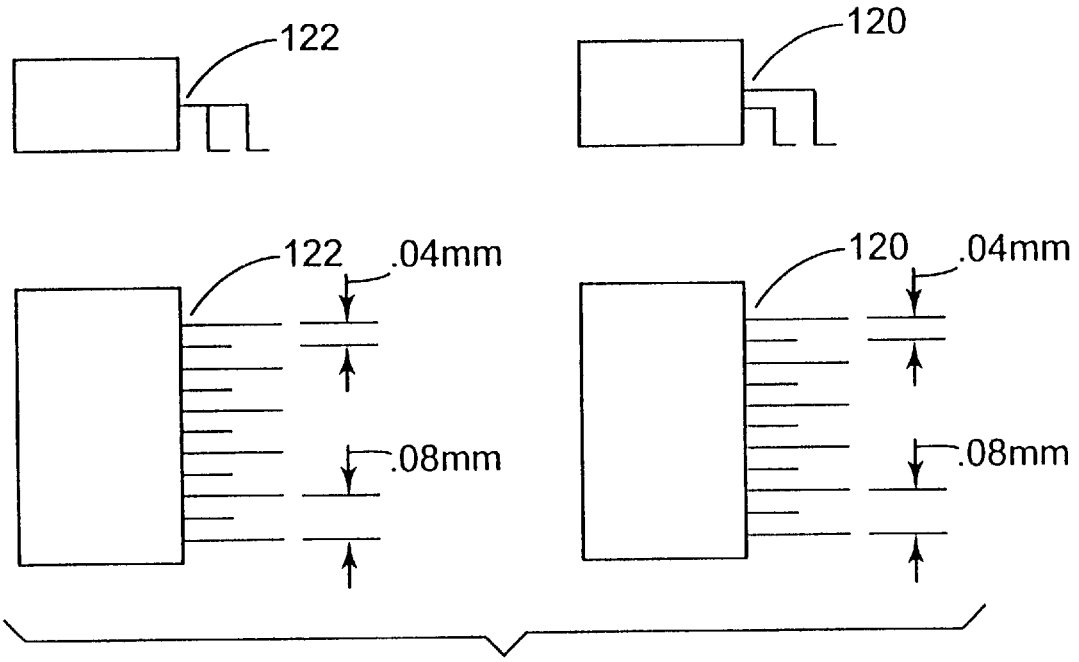
FIG. 32 shows simplified vertical and horizontal views of electrical interconnection components according to two embodiments of the disclosed method and apparatus having in-line and multi-level tail designs configured in a two row tail configuration.
Figure 34:
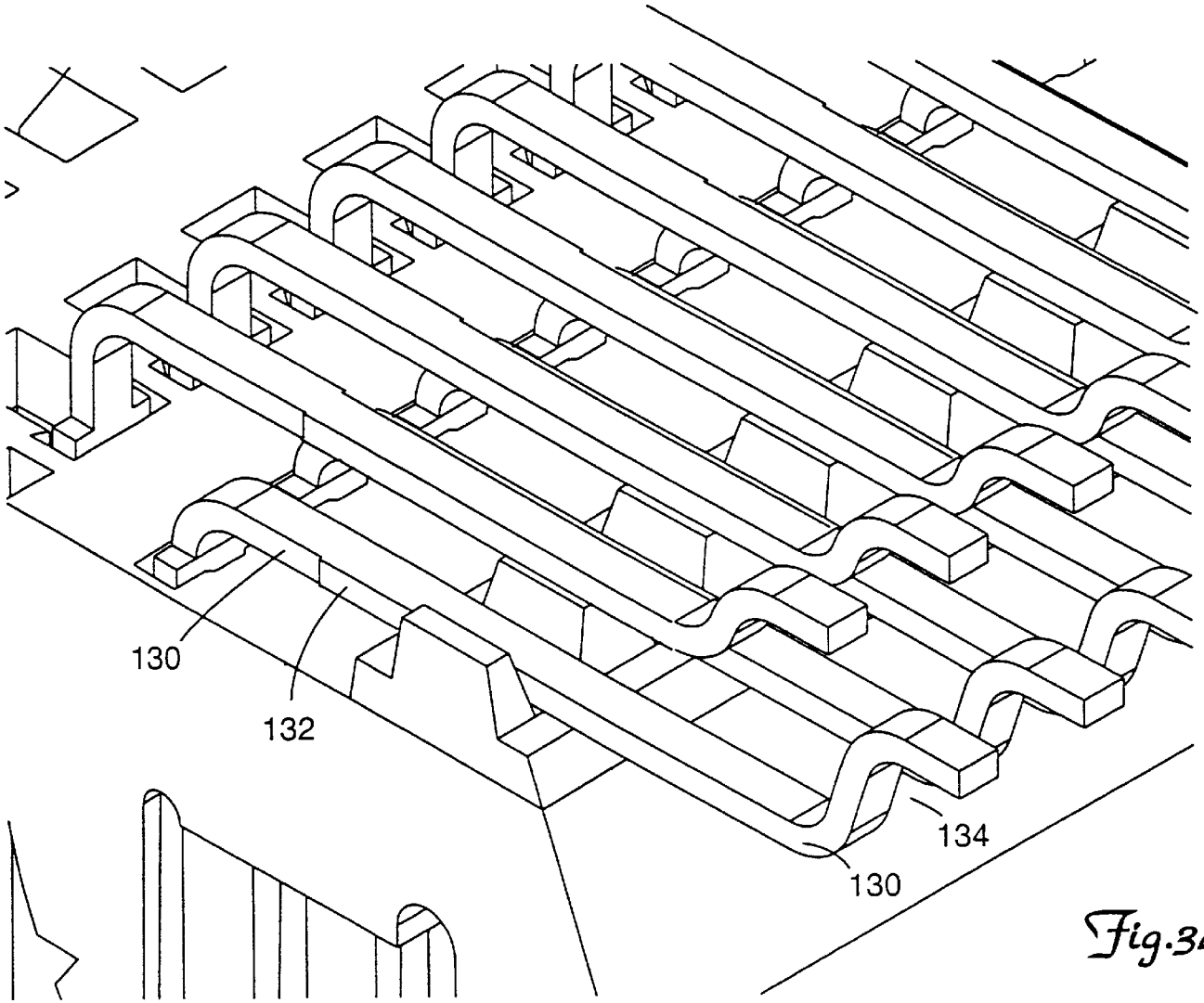
FIG. 34 is a perspective view of a component of an electrical interconnection device according to one embodiment according to one embodiment of the disclosed method and apparatus having multi-level tail configuration and showing positioning notches.

As discussed above and as further shown in FIG. 32, bi-level 120 and inline 122 tail embodiments of the disclosed method and apparatus may be practiced with connector embodiments using a two row tail configuration. Additionally, both bi-level 124 and inline 126 tail embodiments may also be practice in a one row tail configuration as shown in FIG. 33. A combination stamping process is typically used when practicing the bi-level embodiment in a one row configuration, thereby creating necked down sections 130 in conducting tail portion 132 as shown in FIG. 34.

Figure 35:
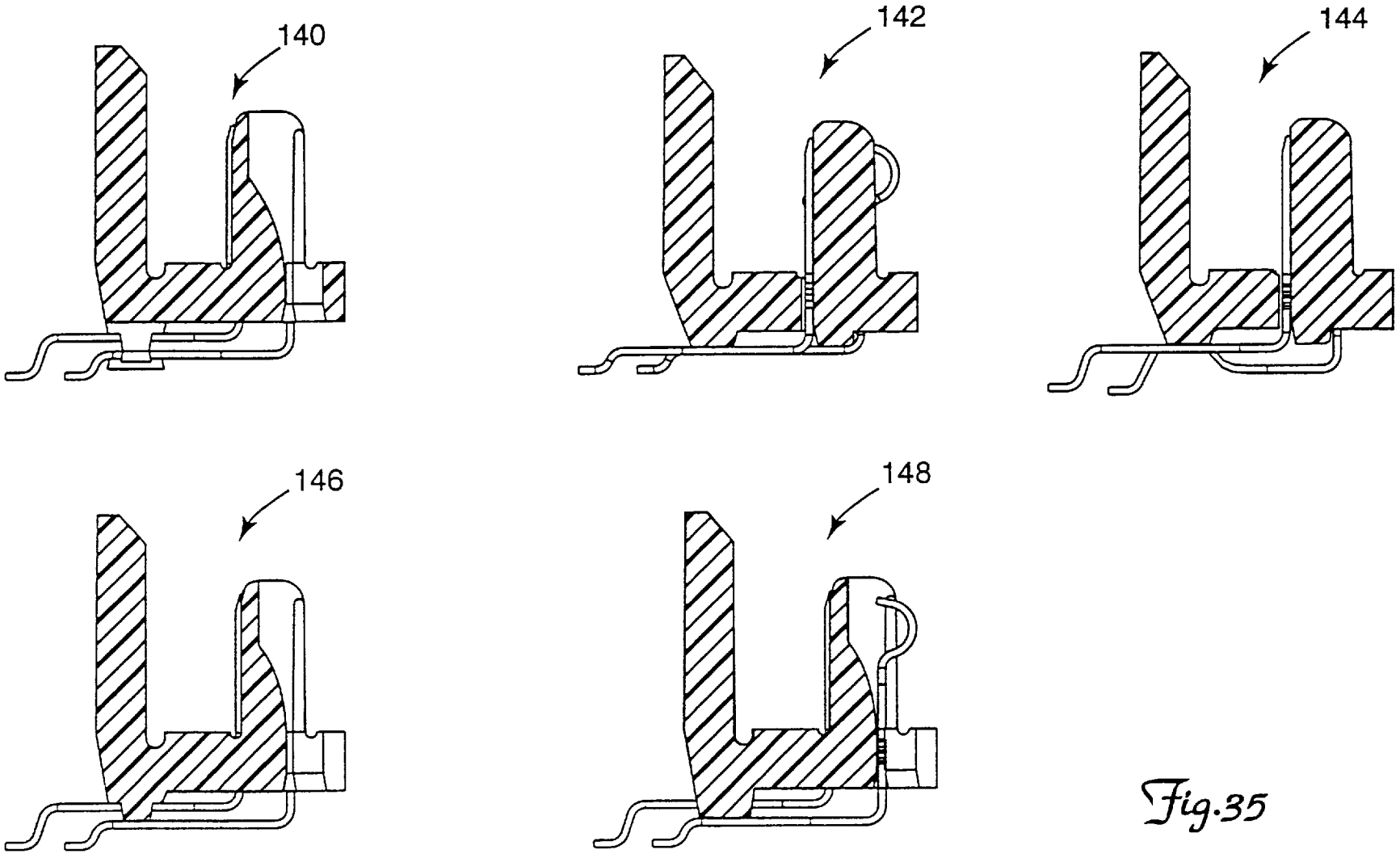
FIG. 35 shows vertical cross sectional views of components of an electrical interconnection system according to five embodiments of the disclosed method and apparatus having a bi-level configuration with a cap, an in-line plastic bi-level lead, a bi-level configuration with no cap present, a bi-level configuration with lead guides, and an in-line configuration.
Figure 36:
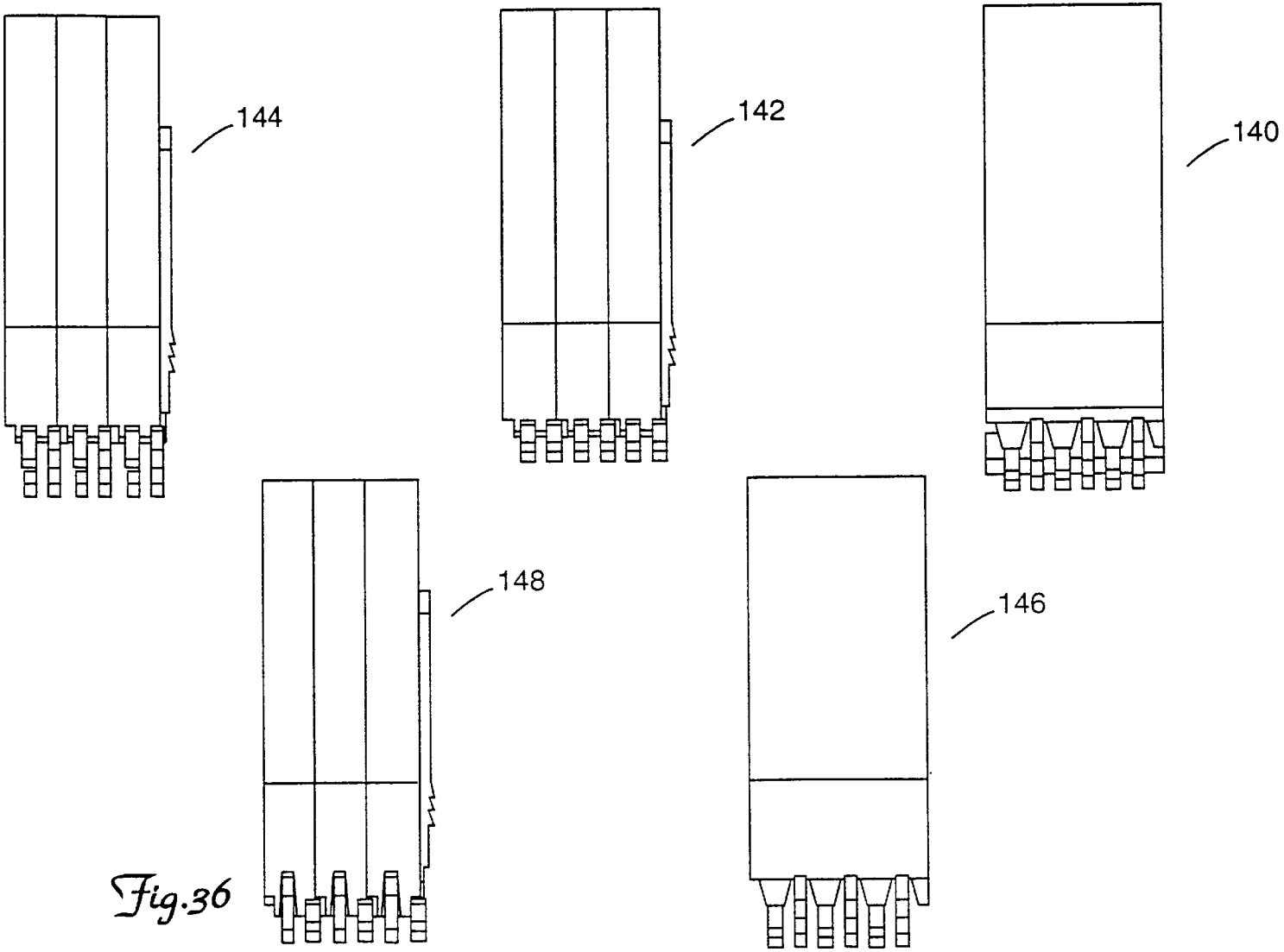
FIG. 36 shows side cross sectional views of the component configurations of FIG. 35.

FIG. 35 illustrates cross sectional views of just a few of the many possible bi-level tail embodiments that may be successfully practiced with the disclosed method and apparatus. These embodiments include a bi-level configuration 140 having a cap, an inline plastic bi-level lead 144, a bi-level configuration 146 with no cap present, and a bi-level configuration 148 with lead guides. Also shown for comparison purposes is an inline tail configuration 142. More particularly, shown in FIG. 26 is a bi-level configuration with no cap, with no adhesive, but with lead guides as shown in FIG. 35, element 148. These lead guides are essentially small notches placed and positioned on the hill portion between the larger notches which house the upper tail row. FIG. 35, element 146 shows the bi-level configuration as in element 148 but without the small notches within the notch so to say. Element 140 has an injection molded cap portion which is separate to the insulative housing. The cap portion has the inverse notch pattern on it to completely trap the tail in position, essentially eliminating all degrees of freedom. The cap is typically assembled after the tails are placed in the notches. Element 142 is the inline configuration. Element 144 is a partial bi-level configuration utilizing the same insulative housing as would the complete inline configuration. The cross talk in element 144 would typically be improved over the inline case 142, but may not be as good in this regard as elements 140, 146, and 148. However, element 144 has the advantage over 140, 146, and 148 in that it typically requires a lower profile. In element 144, the tail width is required to be the same as the inline case 142 so that the full bi-level advantage can not be exercised. FIG. 36 shows side views of the tail configuration of each embodiment shown in FIG. 35. Although not illustrated it will be understood with the benefit of the present disclosure that both the inline and bi-level tail embodiments may be practiced without tail positioning notches.

Figure 36A:
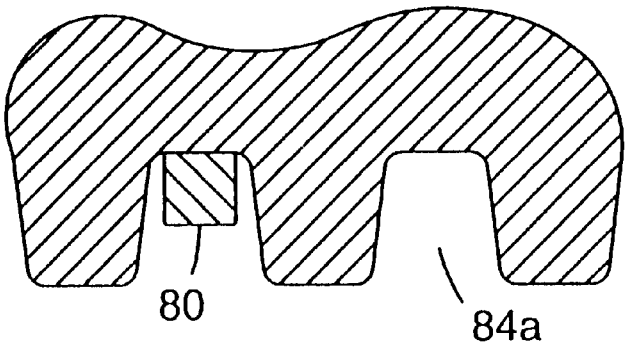
FIG. 36A is a horizontal cross sectional view of a contact tail member and positioning notch design according to one embodiment of the disclosed method and apparatus.
Figure 36B:
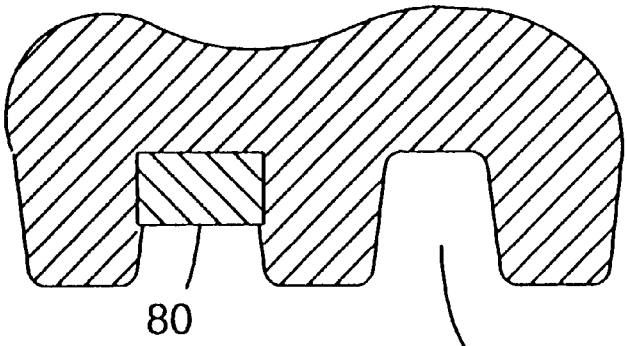
FIG. 36B is a horizontal cross sectional view of a contact tail member and positioning notch design according to another embodiment of the disclosed method and apparatus.

Not shown in FIGS. 35 and 36 is the use of an adhesive which may be employed to hold the conducting tail portions securely in an aligned position and/or in the positioning notches. Any adhesive method suitable for securing the tails may be used including, but not limited to curing of a thermoset adhesive or by re-melting a thermally active (thermoplastic) adhesive. In an additional embodiment, an undersized notch 84*a* may be provided to create a mechanical interference between a conducting tail member portion 80 and the notch 84*a* as shown in FIG. 36A. Alternatively, an oversized tail member portion 80 may be provided to achieve the same interference effect with notch 84*a* as shown in FIG. 36B. This mechanical interference serves to provide a retention means for the final degree of freedom.

It will be understood with benefit of this disclosure that a variety of positioning notch configurations may be employed with a variety of different types of contact tails and tail exit designs. For example, positioning notches may take the form of multiple or singular dimpled, half-cylindrical, half-moon, pyramidal, or trapezoidal projections. Among the types of contact tails that may be employed with positioning notches of the disclosed method and apparatus are ribbon, rotated, bent pins, and steps. Positioning notches may be successfully employed with any conventional contact design, or with other designs as well as an alternating or offset contact configuration as described above.

In addition to those configurations illustrated, bi-level and inline embodiments of the disclosed method and apparatus may also be practiced in a plated through hole ("PTH") product embodiment.

Figure 36C:
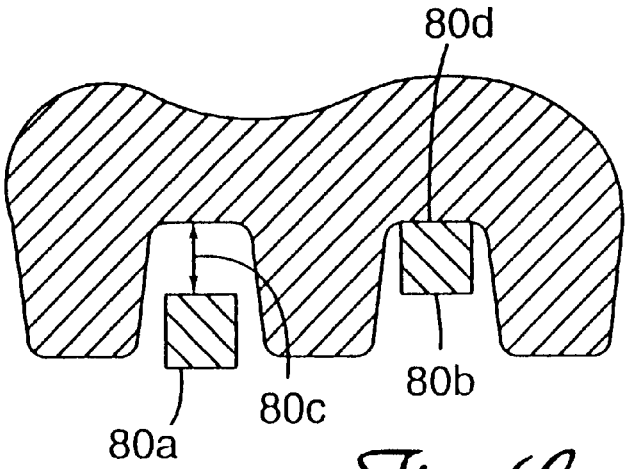
FIG. 36C is a horizontal cross sectional view of a contact tail member and positioning notch design according to another embodiment of the disclosed method and apparatus.
Figure 36D:
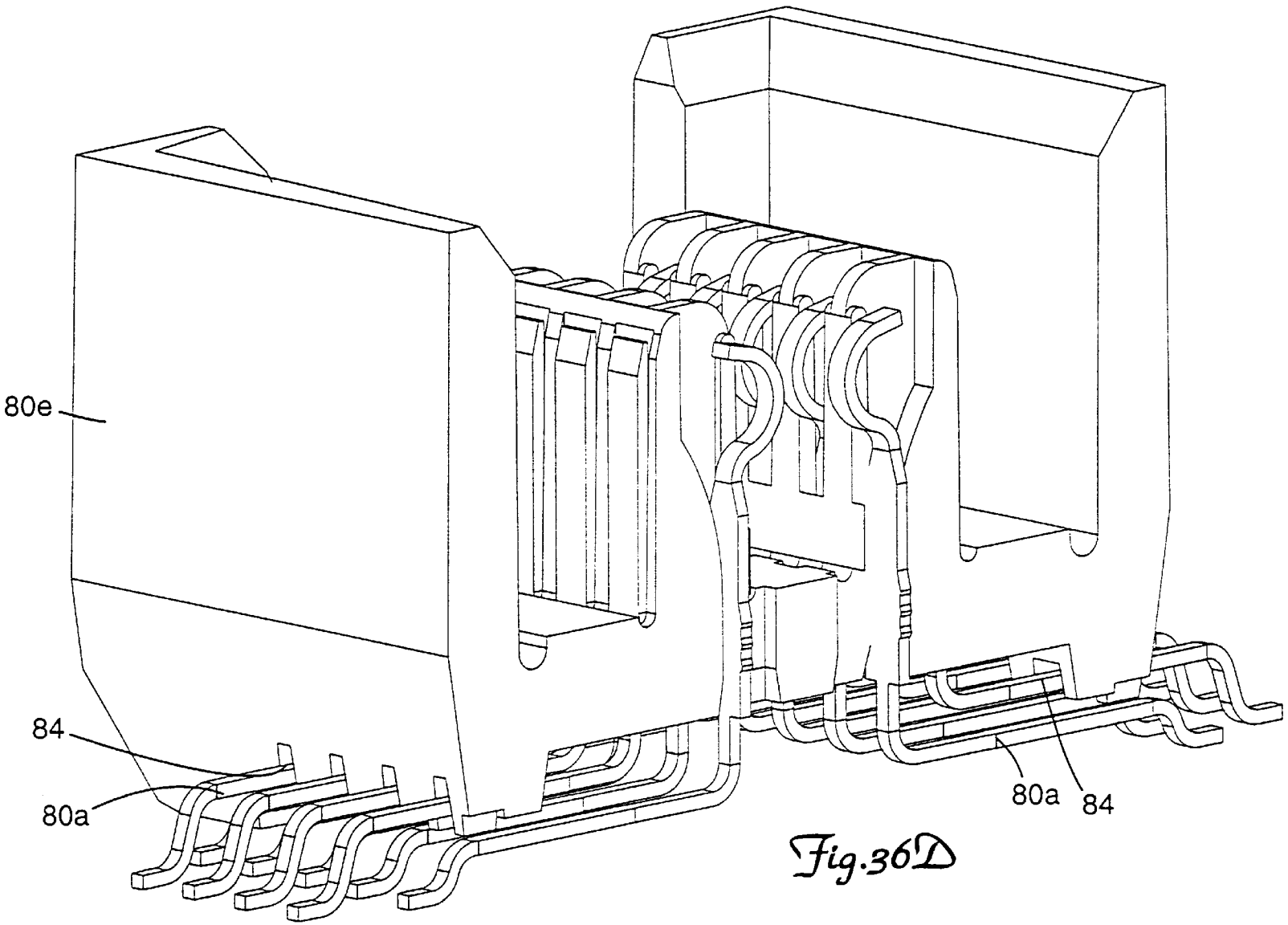
FIG. 36D is a perspective cross sectional view of a connector component according to one embodiment of the disclosed method and apparatus.

As shown in FIGS. 36C and 36D, a conductor tail member/positioning notch design may be configured in a "floating" embodiment if so desired (i.e., such that the tail member 80*a* is free to move up and down within a notch 84, thus creating a gap, in a direction normal to a printed circuit board as indicated by arrow 80*c* in FIG. 36C). In such an embodiment, floating tail members 80 are capable of absorbing additional board bow or warpage and of providing a positive normal force between a stepped surface mount foot and a solder pad. Either tail design (inline or multi-level) may enable a conductor tail floating condition. In such a case, the floating tail portions 80*a* may move in a positioning notch during placement of the connector on the board before soldering as shown in FIG. 36C. FIG. 36C also shows floating tail member 80*b* after placement and engagement with a radiused surface 80*d* of notch 84.

In alternative embodiments, notches 84 may be elongated in shape such that a conducting tail portion does not engage the radiused portion 80*d*. In such embodiments, conductor tail members 80*a* remain in a floating condition and provide a cantilever spring function which may absorb board warpage effects, thereby maintaining contact between contact tail member feet and board solder pads. In such embodiments, planarization of contact tails may depend to a greater extent on the accuracy of the internal bend (or angle) between a contact base and a contact tail (which is typically about 90 degrees), and on any placement method which may be used to place a connector onto a board.

Typically, an internal bend between a contact base and a contact tail varies in angle and in vertical position relative to a connector housing over time and as a function of seating depth within a connector housing. This variation may be aggravated by typically employed contact tail bending processes in which an entire row of tails is simultaneously bent. Therefore, it is often difficult to achieve a uniform angle or radius between individual contact bases and contact tails over an entire row of contacts. A planarization process may be employed to address these variations. In such a process, seating depth of each contact is individually adjusted until contact feet portions of all contacts are substantially coplanar. When a floating contact tail embodiment is employed, variation in contact angles and positioning must be accounted for by the floating distance, and by careful preparation and maintenance of the position and size of the angle between a contact base and a contact tail member. In addition, many placement machines typically employed set connector components onto circuit boards relatively lightly or with a slight downward force. When used with a floating tail member embodiment, it is typical to manually mount a connector on a circuit board or to employ a machine that exerts enough downward force to balance upward forces generated on a connector housing by the floating cantilever beam contact tail members.

Anchor/Permanent Latch Embodiment

Figure 37:
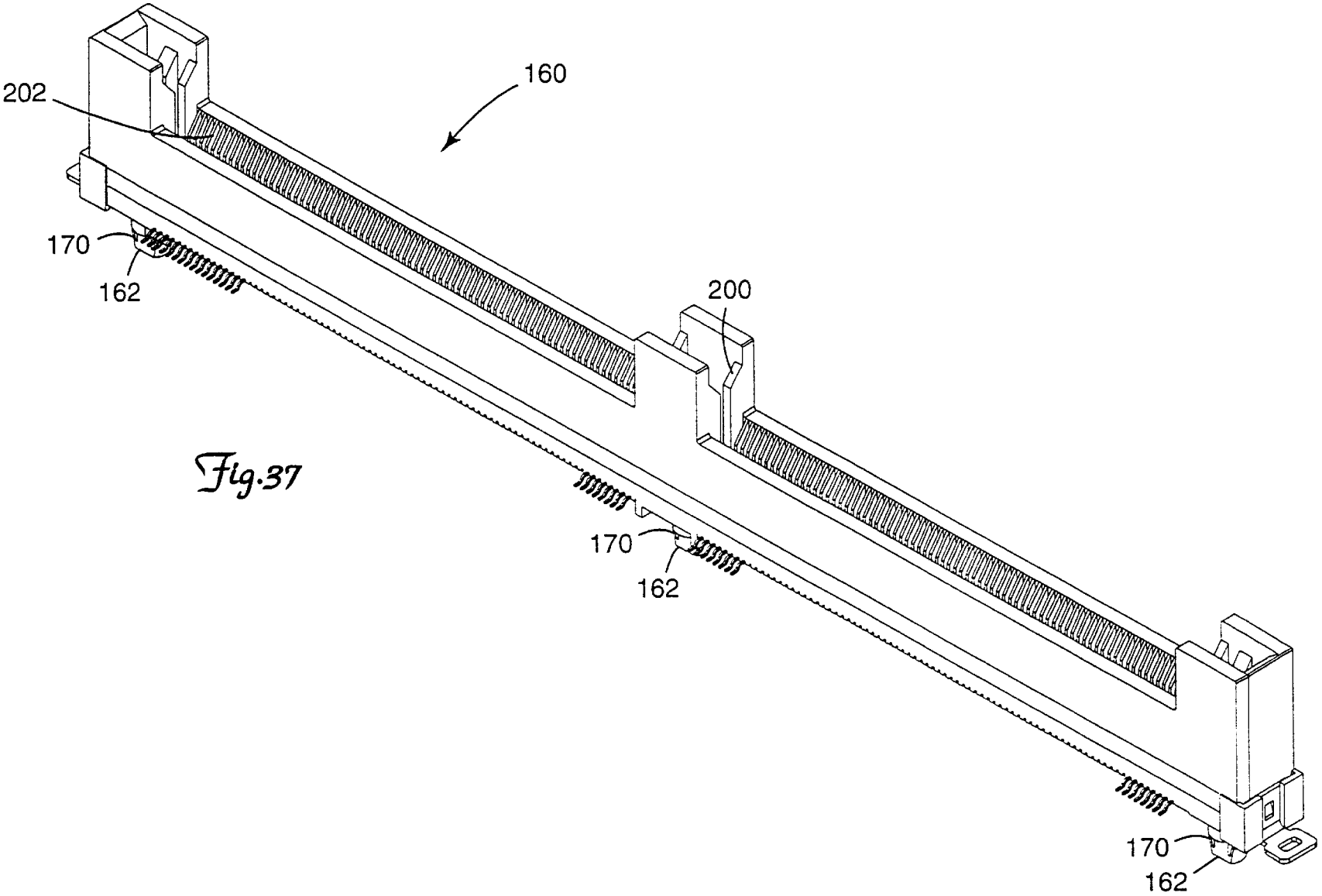
FIG. 37 is a perspective cross sectional view of a card edge connector component of an electrical interconnection system according to one embodiment of the disclosed method and apparatus having three anchor structures disposed on the component housing for anchoring the connector to a printed circuit board.
Figure 38:
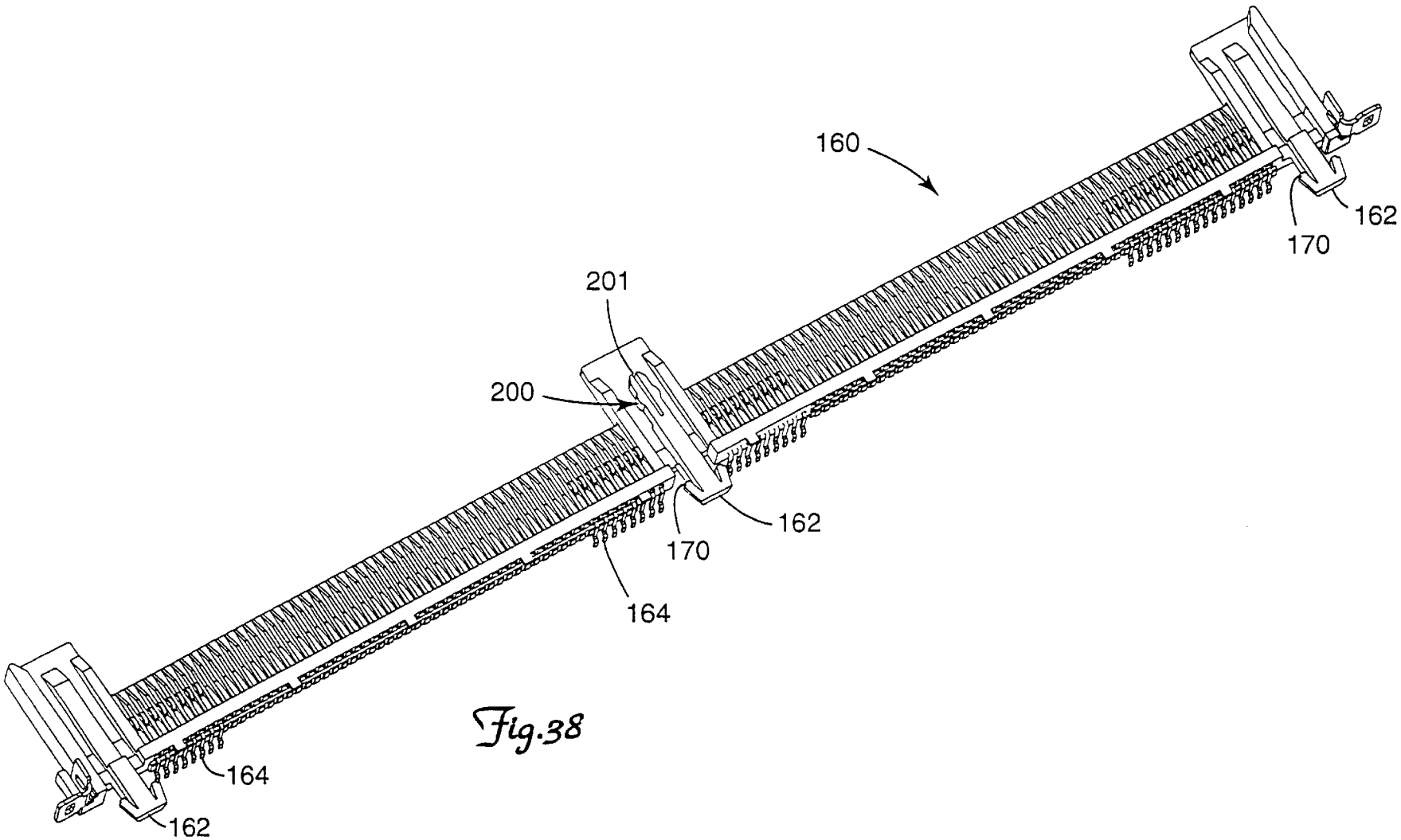
FIG. 38 is a perspective cross sectional view of the connector component embodiment of FIG. 37.
Figure 39:
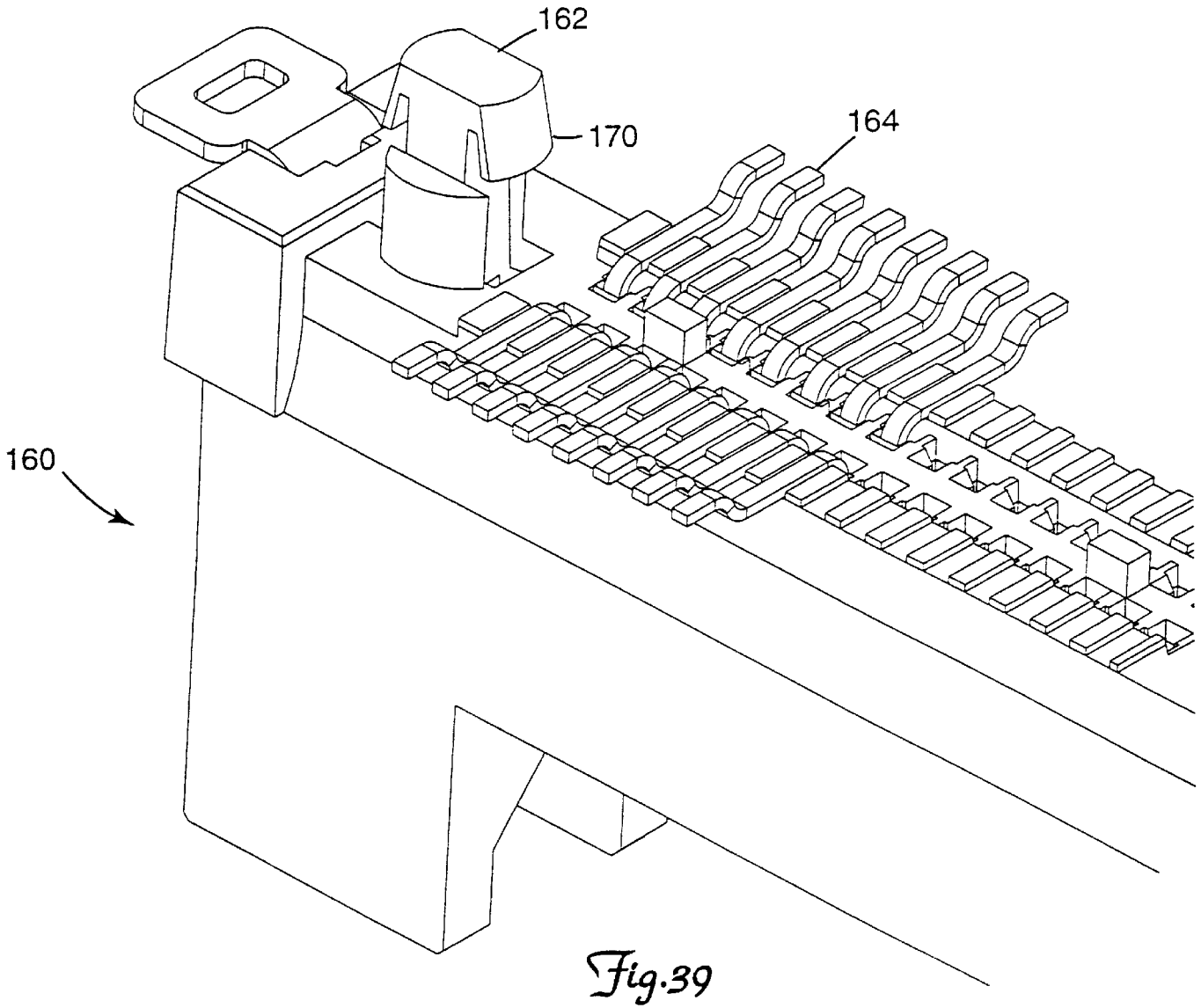
FIG. 39 is an enlarged perspective view of one end of the board attachment side of the card edge connector housing embodiment of FIGS. 37 and 38 showing one anchor structure in more detail.
Figure 40:
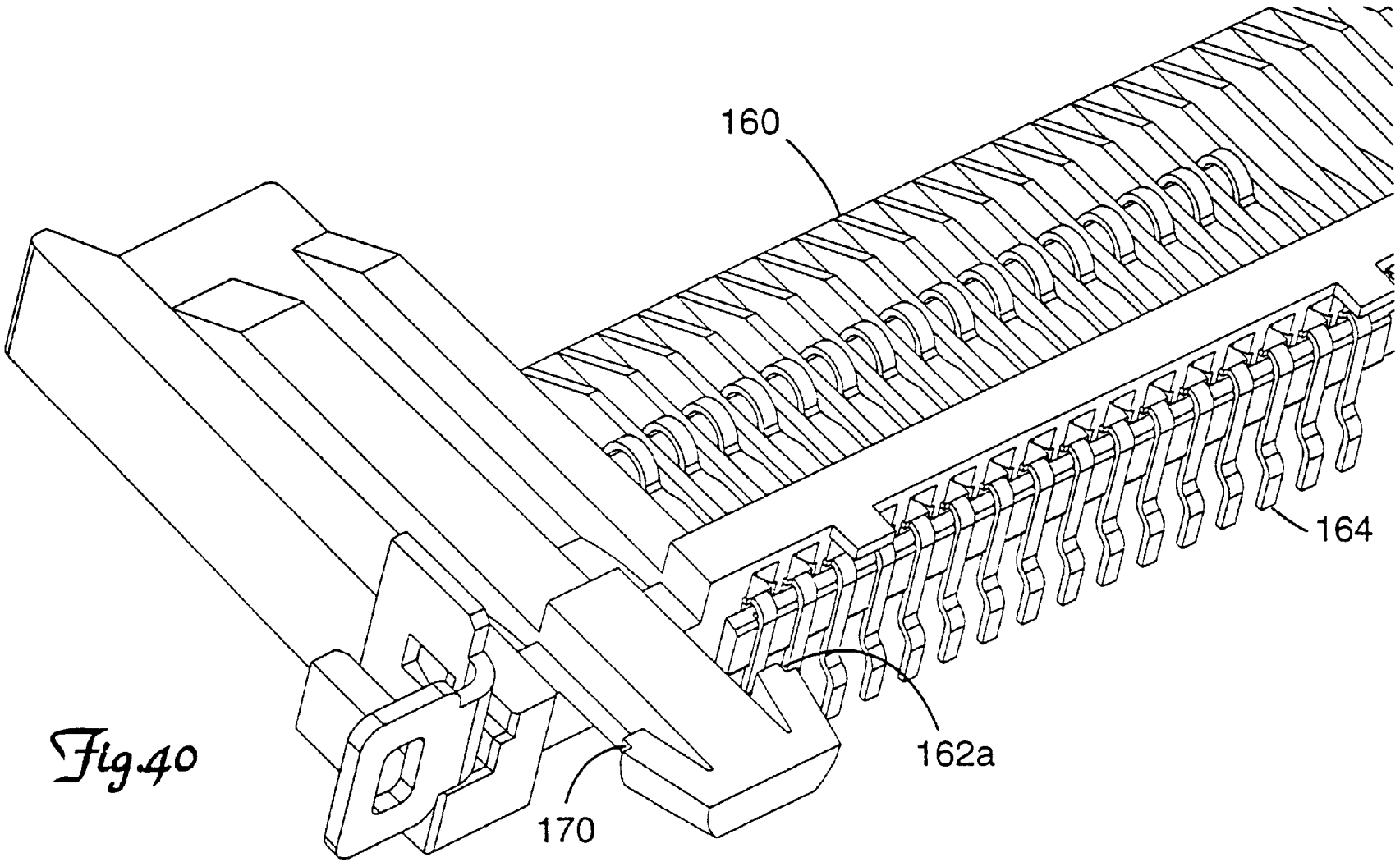
FIG. 40 is an enlarged cross sectional view of an anchor structure positioned on the board attachment side of the card edge connector housing embodiment of FIGS. 37 and 38.

One embodiment of the disclosed method and apparatus provides an anchoring system for such applications as anchoring a plug or socket in two-piece connector systems or for anchoring a card edge connector to a printed circuit board for example before, during, and after solder reflow as shown in FIGS. 37, 38 and 39. When used with printed circuit boards, the anchor system is intended to straighten printed circuit boards with either concave or convex bow or warpage so that contact tails of a joined connector product engage the board to which it is being attached, for purposes of accommodating differences in thickness variation. In one embodiment, anchor structures become permanent mechanical latches upon completion of a soldering process and serve to eliminate or minimize mechanical stress on solder joints (either SMT or PTH) induced by among other things, handling, shock, mating, unmating, or vibration. FIG. 40 shows one anchor structure embodiment in cross sectional view on the board attachment side of a card edge connector product.

FIG. 37 shows a perspective view of a card edge connector housing 160 having one embodiment of an anchor structure 162. FIG. 38 shows a cross sectional view of the card edge connector housing 160 of FIG. 37. As may be seen in FIGS. 37 and 38, connector housing 160 has three anchor structures 162 disposed on the base of the connector housing adjacent to contact tails 164. FIG. 39 is an enlarged perspective view of one end of the board attachment side of the card edge connector housing 160 of FIGS. 37 and 38, showing one anchor structure 162 in more detail. Likewise, FIG. 40 shows an enlarged cross sectional view of an anchor structure 162 positioned on the board attachment side of the card edge connector housing 160.

Figures 41, 42, 47:
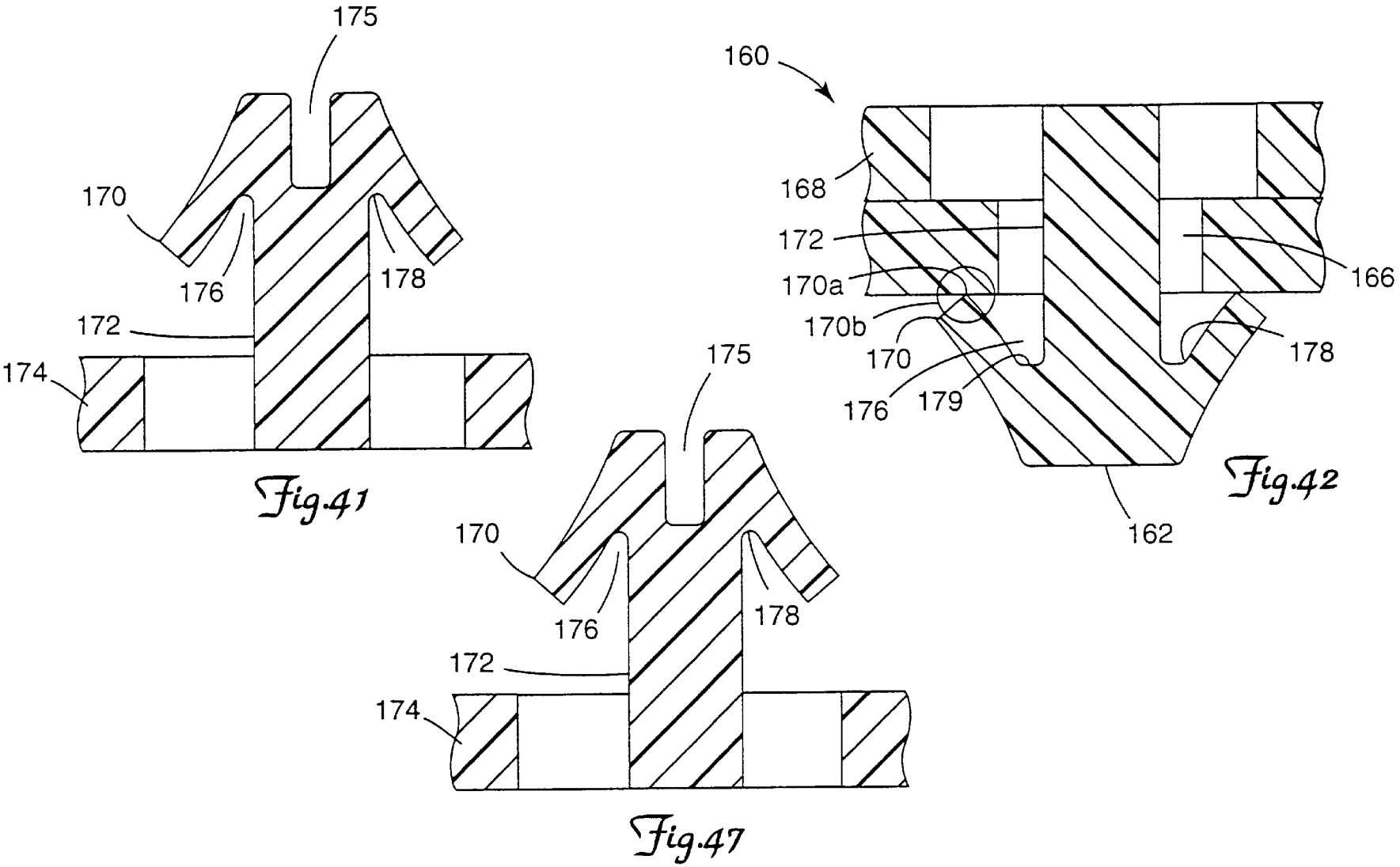
FIG. 41 is a vertical cross sectional view of an anchor structure attached to a connector housing according to one embodiment of the disclosed method and apparatus.
FIG. 42 is a vertical cross sectional view of an anchor structure attached to a connector housing and engaged in a printed circuit board according to one embodiment of the disclosed method and apparatus.
FIG. 47 is a cross sectional view of an anchor structure according to one embodiment of the disclosed method and apparatus showing typical dimensional ranges.
Figure 43:
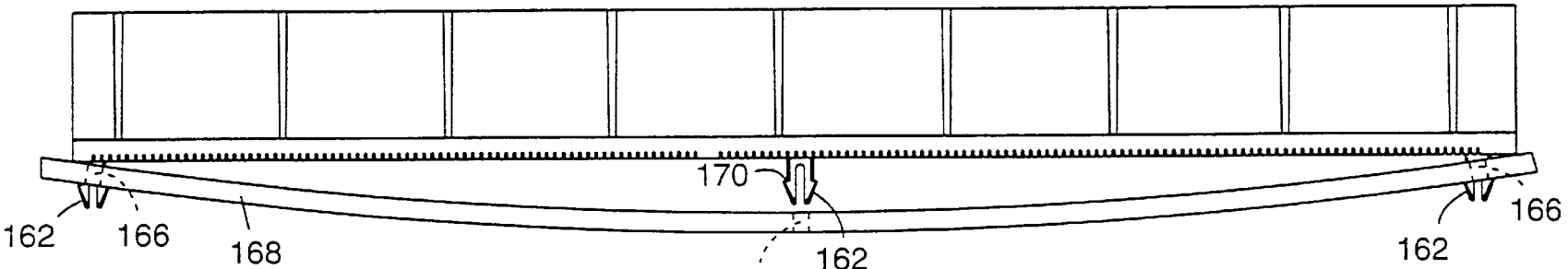
FIG. 43 is a side view of a connector housing having three anchor structures according to one embodiment of the disclosed method and apparatus and showing two anchor structures engaged with a printed circuit board having an exaggerated concave condition.

In the illustrated embodiments, anchor structures are shown in a configuration that is molded as part of a connector housing to minimize product cost. However, an anchor structure may also be manufactured separately and then assembled to the connector housing. In addition, an anchor structure may be of the same or different material as an attached connector housing. For example, an anchor structure may be manufactured of plastic, metal (such as cartridge brass, alloy "CA260"). However, by molding an anchor structure as part of a connector housing, tolerances may be reduced for fine pitch surface mount contacts. As shown in FIG. 41, a typical anchor structure of the present embodiment is designed such that there are at least two cantilevered spring fingers 170 at an end of a post 172 protruding below the connector base 174. In a typical embodiment, cantilevered fingers 170 are disposed on opposite sides of post 172, as shown. Although there may be as few as one finger disposed on one side of a post, there is no theoretical limit to the number of fingers which may be present. In fact, depending on location of an anchor structure and whether or not it is molded as part of a connector housing, a completely conical or bullet shape may be employed to form, in essence a continuous spring finger around a post.

In the embodiment illustrated in FIG. 42, an anchor structure 162 attached to a connector housing 160 may be engaged in a printed circuit board 168 by entering, passing through, and exiting an anchor opening or hole 166 formed in the printed circuit board 168. Although an anchor structure and corresponding anchor opening are typically circular in geometry, it will be understood with the benefit of the present disclosure that either or both of these components may have any other geometry suitable for mating an anchor structure to an anchor opening disposed in a circuit board including, but not limited to, oval, oblong, square, rectangular, trapezoidal or uneven shapes. It will also be understood with benefit of the present disclosure that when circular shaped anchor and opening geometries are employed, there is not a specific orientation of spring fingers required for mating a connector housing to a circuit board unless constrained by a hosting product design. It should also be noted that once inserted and secured in an anchor opening, the spring fingers of the anchor provide additional and increasing strength during separation or when being handled due to the cantilever beam function. This additional strength provides for increased overall ruggedness and/or toughness.

Figure 49:
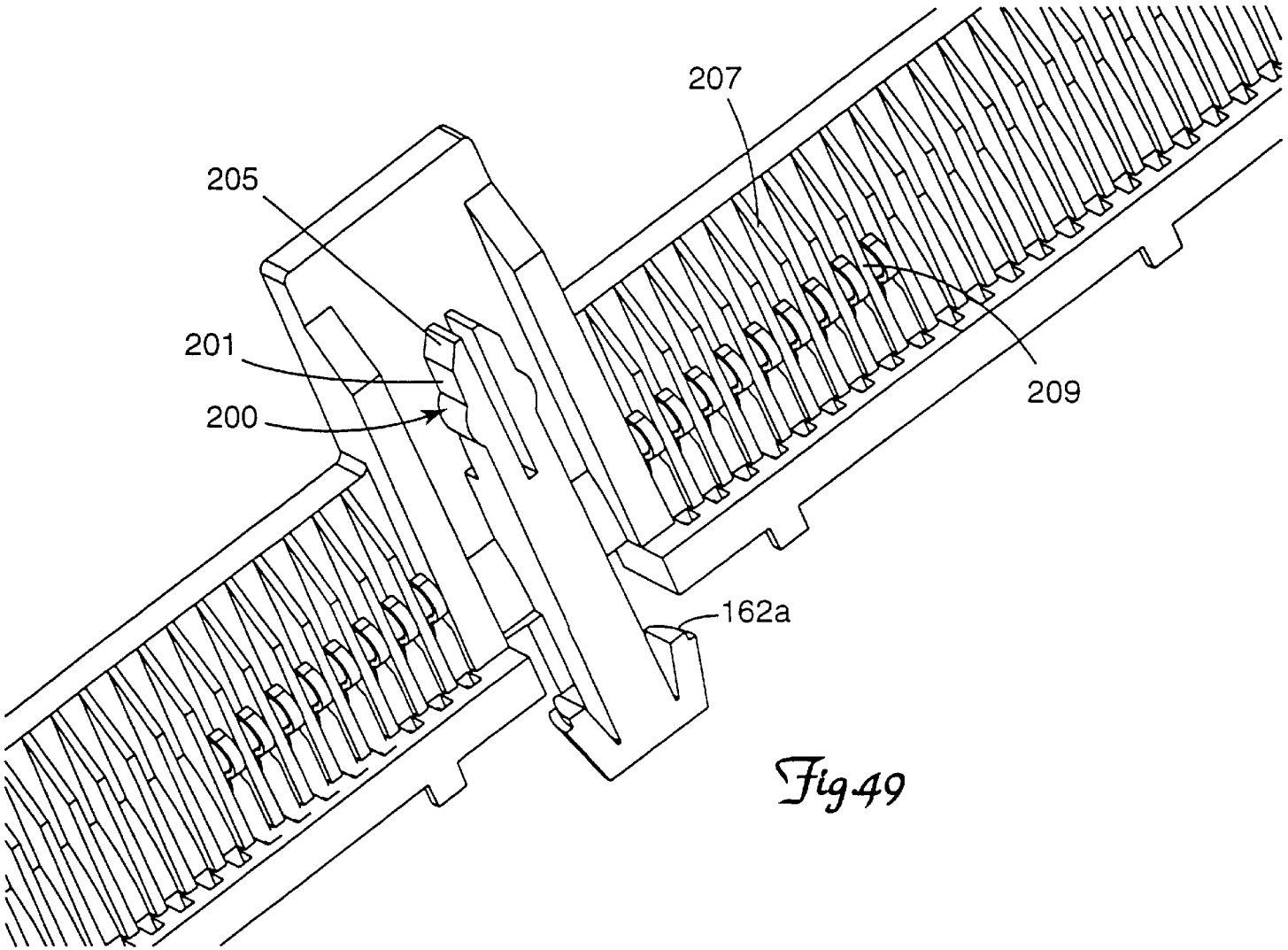
FIG. 49 is a perspective cross sectional view of a card edge connector component having a separable latch mechanism and anchor structure according to one embodiment of the disclosed method and apparatus.

In embodiments of the disclosed method and apparatus, the tips of anchor structure cantilevered spring fingers 170 may be configured to seat against a circuit board surface in a manner parallel to (or flat against) the board surface when fully inserted or engaged in a circuit board anchor opening as shown in FIGS. 37–40 and FIGS. 43–46. Alternatively, cantilevered spring fingers 170 may be configured to seat against a circuit board surface in a manner in which the tips point into a circuit board as shown in FIG. 41, 42, and 47. In FIG. 42, tips 170*a* of cantilever spring fingers 170 are shown seated in "pointed in" fashion against circuit board 168 within circles 170*b*. When configured to mate with a board in "pointed in" fashion, the fingers will typically be compressed or deformed during the mating process, providing additional tolerance absorption and tight fit. Among possible spring finger surface embodiments for use with either flat or pointed in spring finger surfaces are cantilevered spring fingers having a "stepped" profile 162*a*, as best shown in FIGS. 40 and 49. Besides the step configuration pictured, a step feature may also be positioned anywhere else on a finger surface, including toward the post side of an anchor structure finger. In addition a spring finger may have more than one step disposed on its surface. Finally, it will be understood with benefit of this disclosure that tips of spring fingers 170 may have rounded, rather than squared off surfaces as shown in the accompanying illustrations. In fact due to manufacturing limitations, a rounded surface may be more typical.

Figure 44:
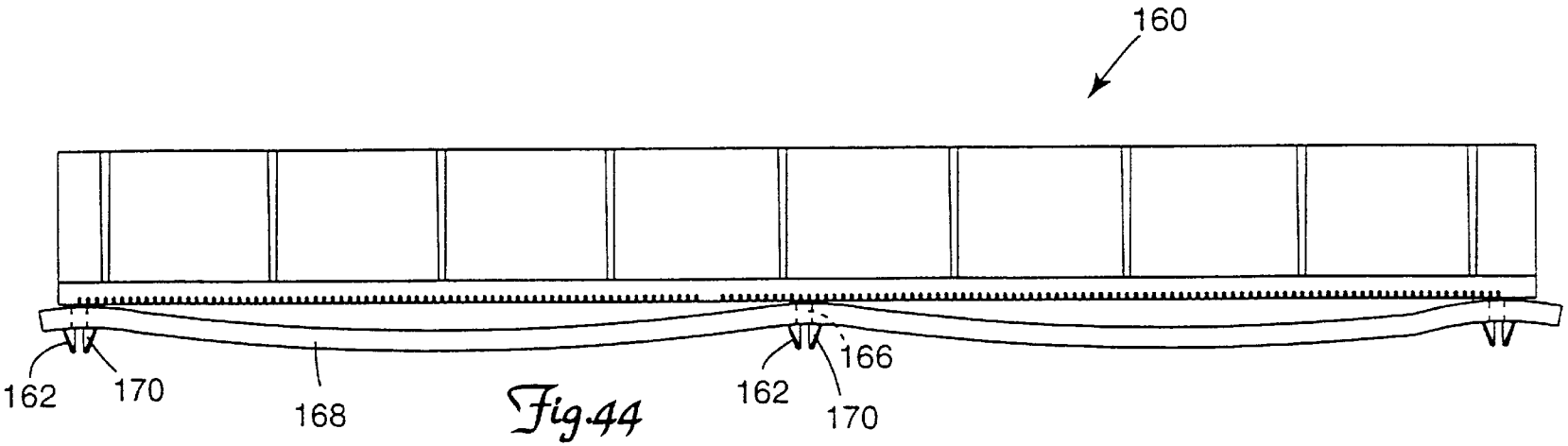
FIG. 44 is a side view of a connector housing having three anchor structures according to one embodiment of the disclosed method and apparatus showing all three anchor structures engaged with a printed circuit board having an exaggerated concave condition.
Figure 45:
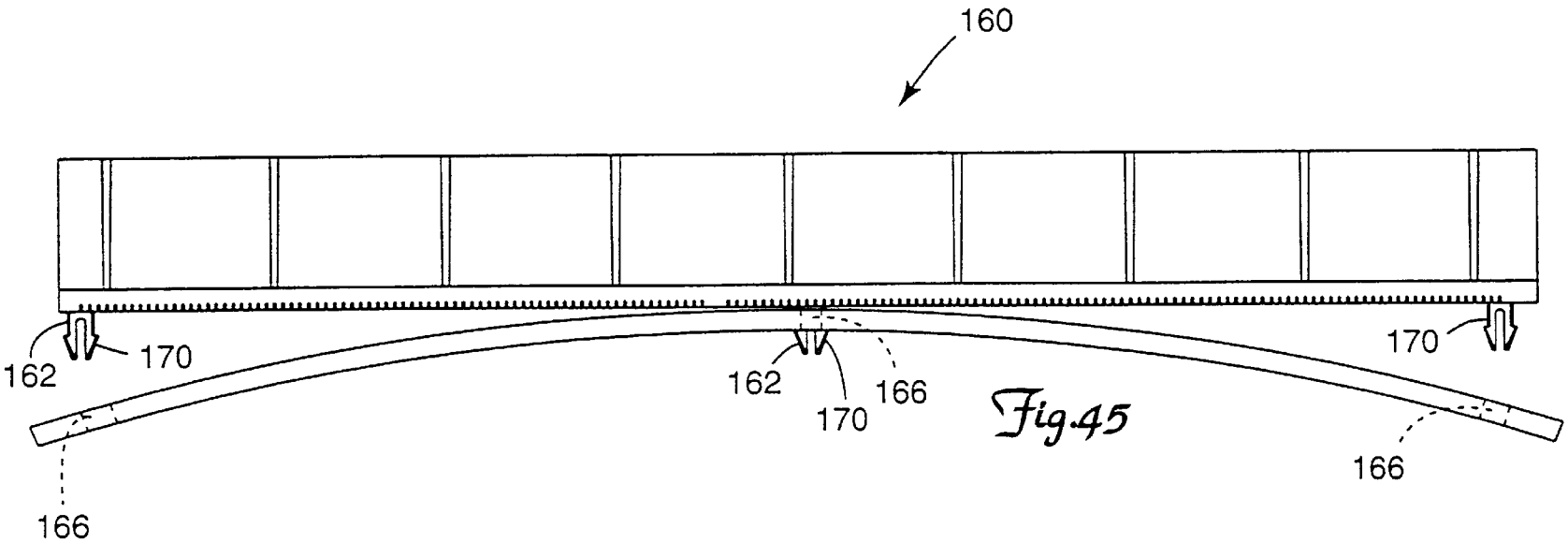
FIG. 45 is a side view of a connector housing having three anchor structures according to one embodiment of the disclosed method and apparatus showing one anchor structure engaged with a printed circuit board having an exaggerated convex condition.
Figure 46:
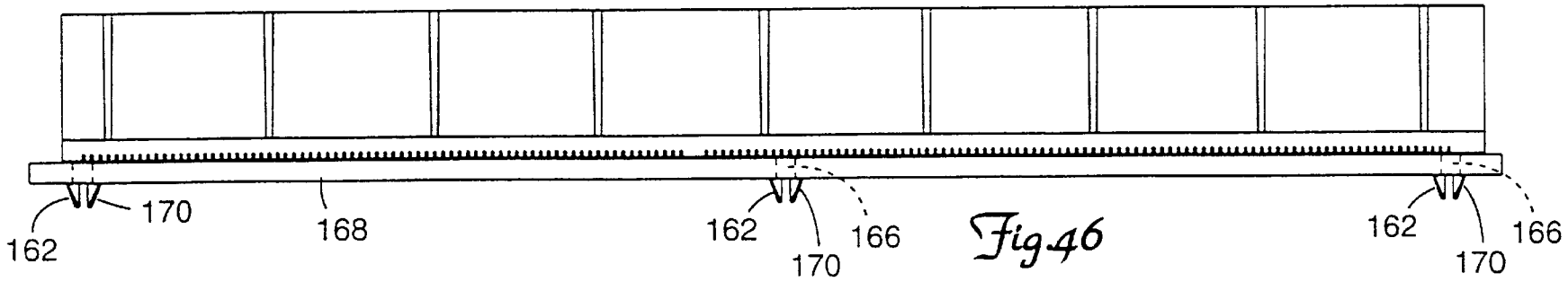
FIG. 46 is a side view of a connector housing having three anchor structures according to one embodiment of the disclosed method and showing engagement of all three anchor structures with the printed circuit board of FIG. 45 having an exaggerated convex condition.

It is not uncommon for printed circuit boards to be uneven in some manner (concave, convex, or a mixture of both). Typically, board unevenness ranges from about 0.0 inch/inch to about 0.010 inch/inch. This unevenness is typically a result of manufacturing laminated boards consisting of laminated layers, and may cause connection uniformity problems between connector tails and corresponding solder connections on an uneven board. This problem may be more typical and acute with surface mount solder pad connections than plated through hole configurations which may be able to absorb some bow and warpage, and may be especially aggravated with longer connection lengths. FIGS. 43–46 illustrate engagement of the anchor structure/connector housing combination of FIGS. 37–40 with a circuit board. For purposes of simplicity, these attachments show only a circuit board and a housing, but do not show the presence of contact tails. Advantageously, anchor structures allow a connector to be attached to an uneven (concave, convex, or both) printed circuit board in such a way that connector contact tails make substantially uniform contact with corresponding solder pads disposed on a circuit board surface. In this way quality of surface mount connections may be increased at the same time connector lengths are increased. 43 shows a printed circuit board 168 with an exaggerated concave condition prior to full engagement of anchor structures 162 into corresponding holes 166 present in circuit board 168. FIG. 44 shows an exaggerated tolerance bow remaining in board 168 when it is in a fully engaged condition. FIG. 45 shows a printed circuit board 168 with an exaggerated convex condition prior to full engagement of anchor structures 162 into corresponding holes 166 present in circuit board 168. FIG. 46 shows a fully engaged condition of the convex board of FIG. 45. In each of the illustrated instances, the mating process of the anchor structure and corresponding anchor holes is intended to pull the surface mount (SMT) contacts into a positive mating condition with corresponding solder paste deposited on the pads of the printed circuit board. It should be noted that the relationship between connector contact tails and board solder pads of a mated connector and board combination may depend on the deflection of a printed circuit board. In some cases, there may be an interaction force on the solder pad generated by the deflection of the conductor feet and tails. In other board conditions, the conductor feet may be above the pad and laying in the solder paste.

As shown in FIGS. 41 and 42, anchor structure embodiments of the disclosed method and apparatus typically include a void 176 between a post 172 and spring fingers 170 having a bottom curved portion or a radius 178 and an optional flat portion 179 present as shown in FIGS. 41 and 42, respectively to accommodate tool strength and wear. This may be true whether the anchor structure is molded or stamped. In addition, either of the embodiments of FIGS. 41 or 42 may have a hole or slot 175 as shown in FIG. 41 for purposes of coring out plastic and maintaining section sizes so that any shape changes as a result of the molding process may be minimized.. Among other things, a slot 175 would serve to create a substantially common thickness in all wall sections and help minimize differences in cooling rates during manufacture so that sections of an anchor structure 162 cool relatively evenly and do not bow, warp or shrink substantially. A hole or slot 175 is typically configured to about 1/3 of the diameter of a post 172 and is typically tapered or conical in shape. FIG. 47 shows a typical embodiment of an anchor structure/connector housing embodiment of the disclosed method and apparatus. FIG. 47 also shows typical dimensional ranges of such an embodiment. However, with continued miniturization of electronic components, anchor structure embodiments with smaller dimensions may become more typical.

Figure 48:
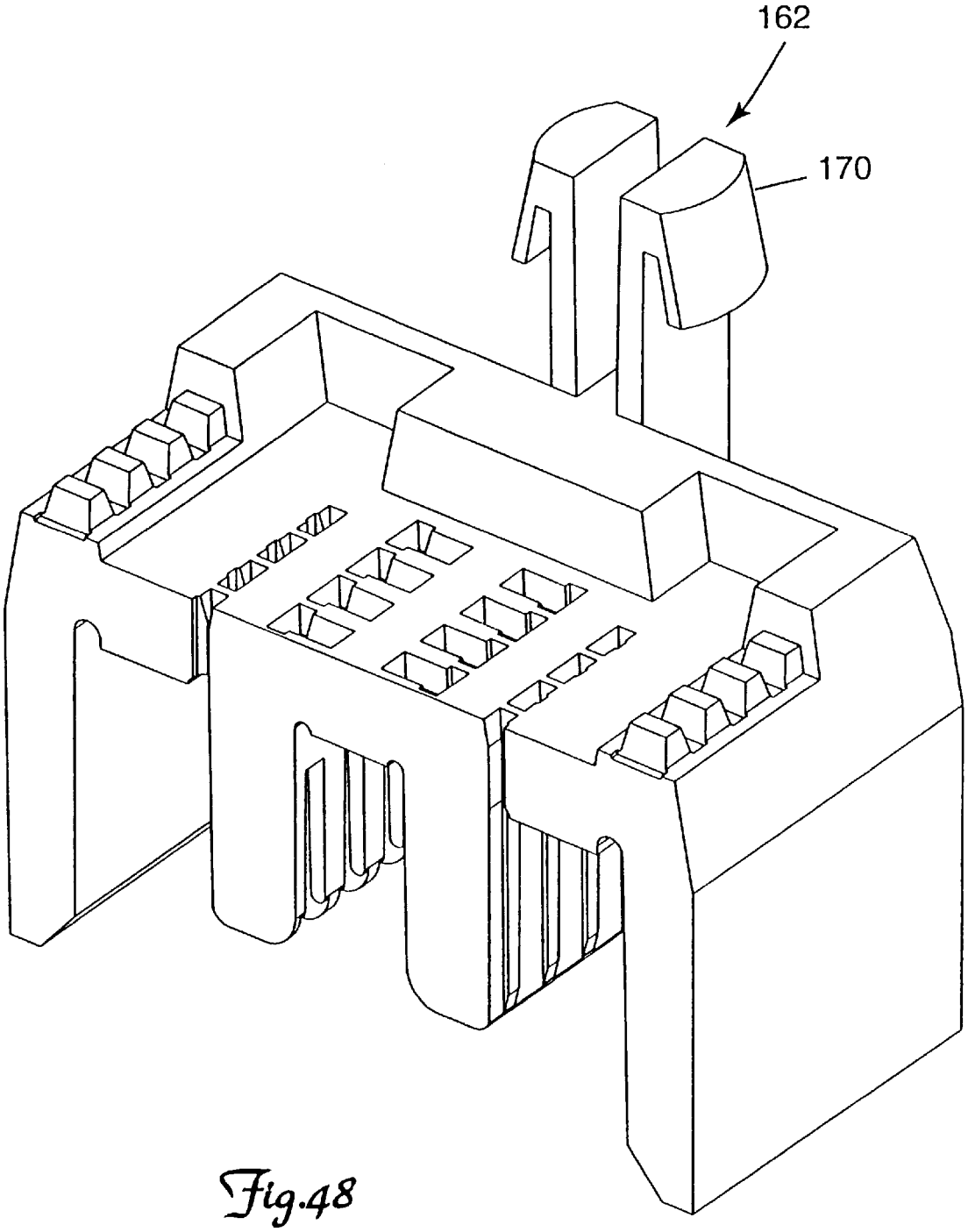
FIG. 48 is a perspective cross sectional view of an electrical interconnection component having an anchor structure according to one embodiment of the disclosed method and apparatus.

In surface mount embodiments of the anchor system, a plastic placement pin or pins is typically present on a connector base for positioning the contacts to the pads. In addition, the anchor system embodiment may be used to provide polarization between a connector and a circuit board by, for example, utilizing a larger anchor on one end and a smaller anchor on the other end, or by utilizing multiple anchors with an unequal distance between each anchor as shown in FIGS. 43–46. As described above, an anchor structure may be utilized with card edge connectors or alternatively with a two-piece connector embodiment as shown in FIG. 48. In addition to the aforementioned embodiments, it may be advantageous to place anchor structures on other types of component structures employed with printed circuit boards. One such example would be an external support structure, frame, or card guide to support a printed circuit board disposed perpendicular, parallel, or in any angled configuration relative to a mother board. Such a component or structure would typically be positioned on an end of a connector or, in the alternative, may be external to it.

Polarization Key And Separable Latch System

In a further embodiment of the disclosed method and apparatus, a separable latch mechanism 200 may be provided as illustrated in FIGS. 37, 38 and 49. This embodiment is directed toward addressing problems associated with alignment and retention of fine pitch connectors and printed circuit boards. It is typically employed with card edge connector installations, but may be successfully utilized with other types of installations, such as two piece connector systems. In addition, it may be combined with any of the embodiments of the disclosed method and apparatus discussed previously. The latch mechanism may serve to latch a connector to a card edge and may also be configured to perform a polarization function so that the connector and card edge may be mated in only one manner.

In the embodiment illustrated in FIG. 37, a card edge connector has a cavity 202 which is designed to receive and mate with an edge portion of a printed circuit board. In the center of cavity 202, there is shown a separable latch mechanism 200. This separable latch feature 200 is further illustrated in cross sectional detail in FIGS. 38, 49, and 50, and consists of a center rail or rib 204 bisected by a slot 206 to form two cantilevered spring members 208, and having positioning profiles 210 with tapered leading edges or alignment notches 205. Also shown is cross sectional detail is an optional lead in rail or rib 212 that is typically employed for purposes of alignment, polarization, and/or strengthening a connector housing by tying two connector housing halves together. Alternatively, or in addition to lead in rail 212, center rail 204 may be configured to have a lead in extension 201, as pictured in FIGS. 38 and 49. In either case, when lead in rail 212 is employed, a gap 203 typically separates center rail 204 from lead in rail 212, as shown in FIG. 50.

A latch mechanism 200 may be positioned partly or entirely above a cavity 202 such as the one shown in FIG. 37. In the practice of this embodiment, a separable latch mechanism 200 is designed to mate with a receiving slot 220 and profile recess configuration 222 in a printed circuit board 224 as shown in FIGS. 50–53. Although separable latch mechanism embodiments have been illustrated in a location disposed midway between two ends of a connector housing and card edge, it will be understood with benefit of the present disclosure that a separable latching mechanism may be placed in a position offset from the centerline of a card edge and/or connector housing to provide positive polarization for mating of a connector and card edge in a only one manner. Further, more than one latch mechanism may also be utilized.

Figure 50:
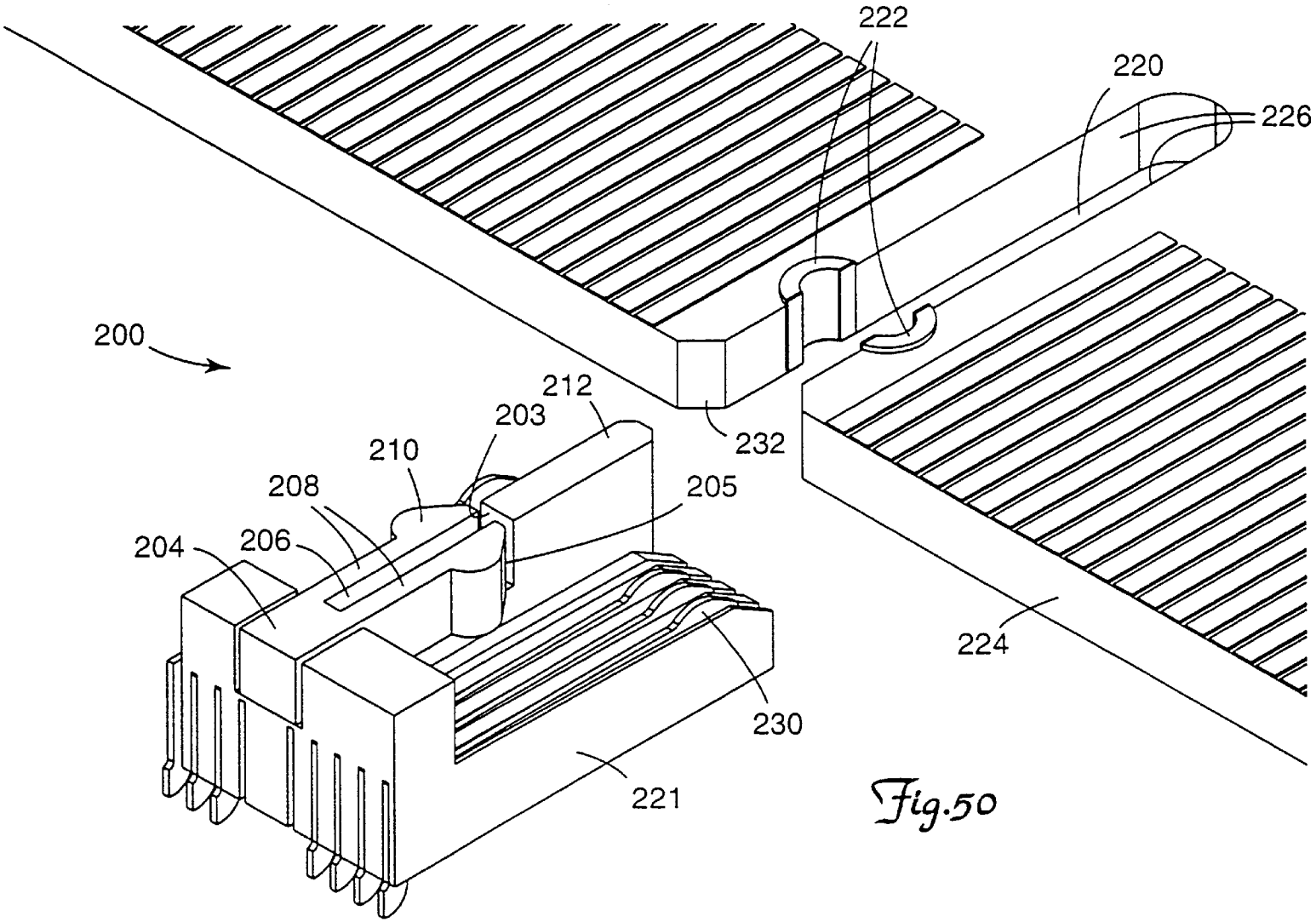
FIG. 50 is a perspective cross sectional view of a card edge connector component having a connector latch portion and a printed circuit board having a corresponding receiving slot and profile recesses with the same disposed in position for interconnection.
Figure 51:
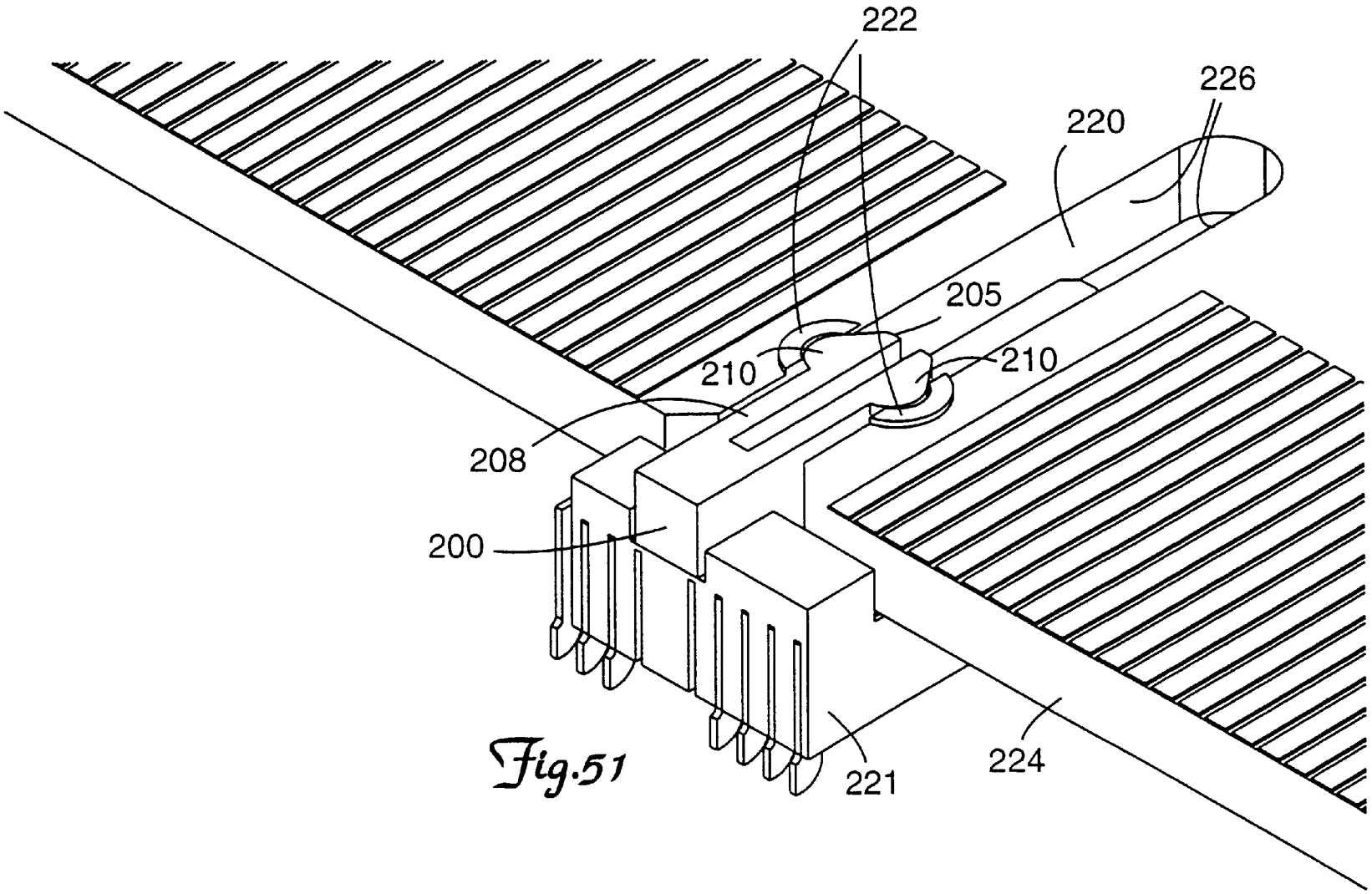
FIG. 51 is a perspective cross sectional view of the connector housing and printed circuit board of FIG. 50 showing the same disposed in mated condition.
Figure 52:
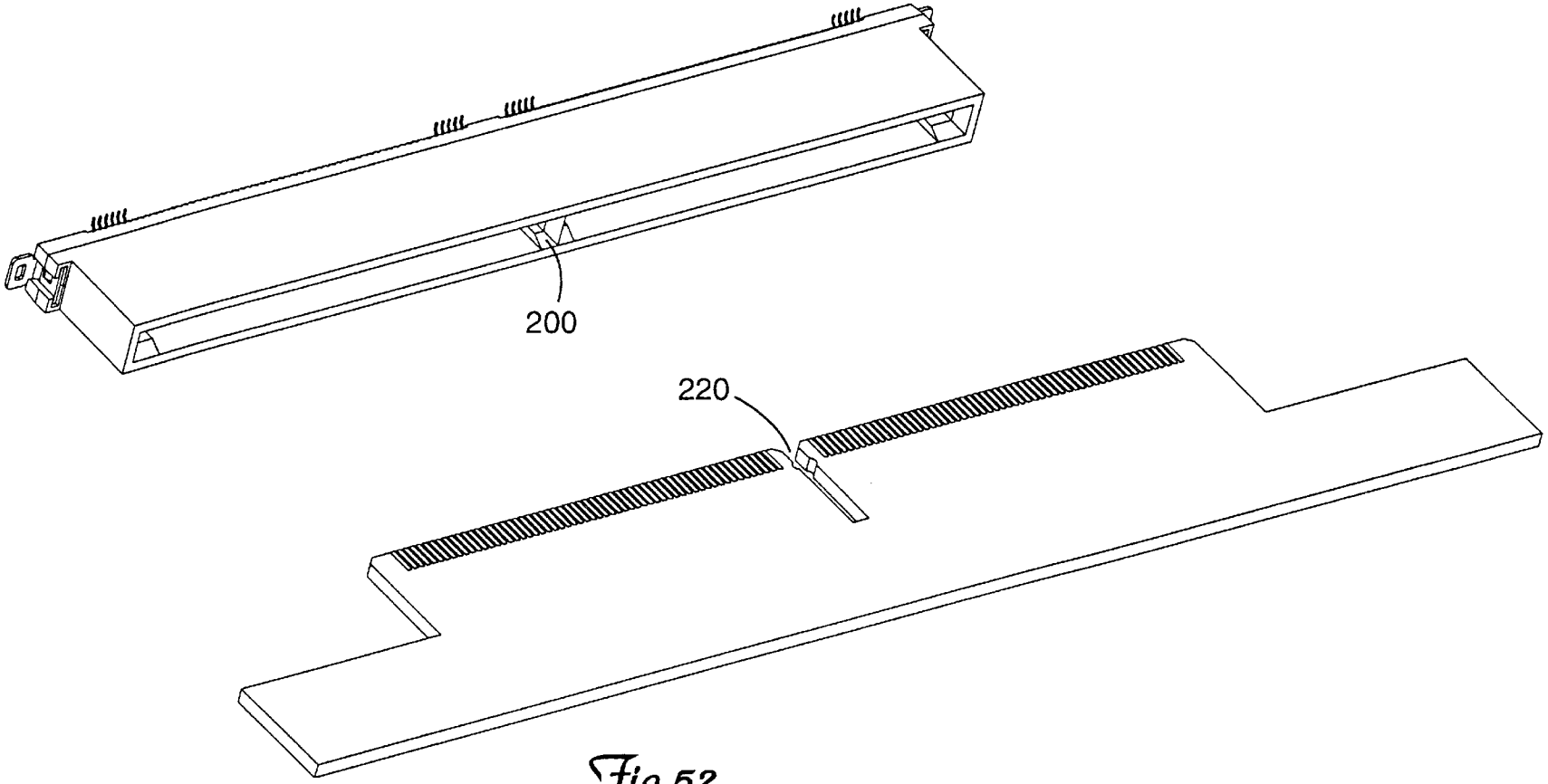
FIG. 52 is a perspective view of a card edge connector housing and a printed circuit board having a separable latch configuration according to one embodiment of the disclosed method and apparatus and showing the same disposed in position for interconnection.
Figure 53:
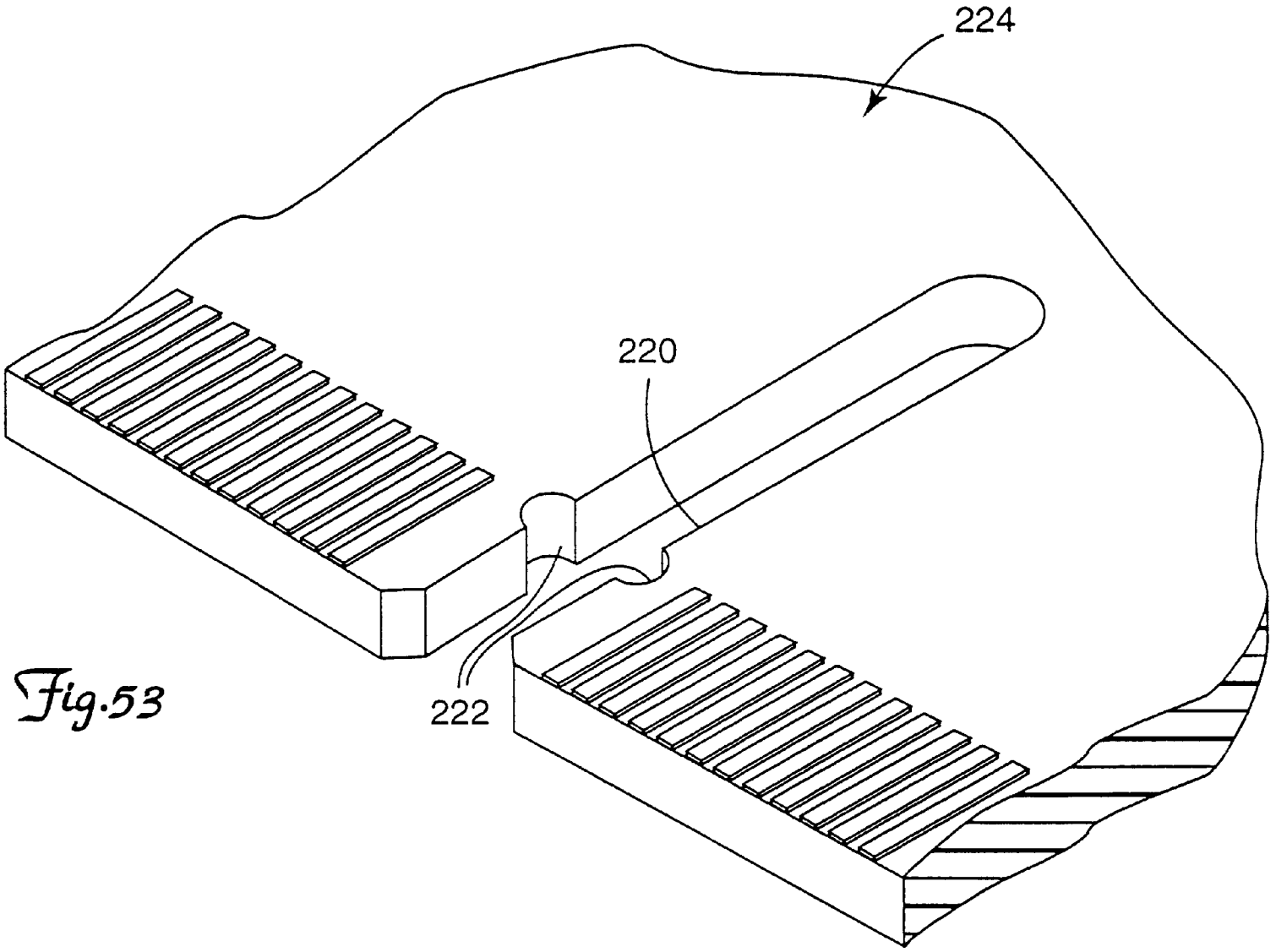
FIG. 53 is an enlarged perspective view of a printed circuit board having a receiving slot and profile recess configuration according to one separable latch embodiment of the disclosed method and apparatus.

As illustrated in FIGS. 50 and 51, when using a polarization key and separable latching system, a connector latch portion 200 may engage and provide alignment between a board 224 and a connector body 221 prior to any engagement of multiple conducting contact elements 230 housed in connector body portion 221. In the mating process, strengthening rail or rib 212 is first guided into receiving slot 220 by alignment notches 232. As board 224 and connector body 221 are further engaged, positioning profiles 210 (in this case, in the form of radiuses or bumps with tapered leading edges 205) make contact with alignment notches 232. When this occurs, positioning profiles 210 and integral cantilevered spring members 208 begin to deflect inward into the space created by slot 206. As mating continues, positioning profiles 210 slide further into receiving slot 220 and are compressed further by printed circuit board slot sidewalls 226. Upon mating, the radiuses or bumps of positioning profiles 210 attached to compressed spring members 208 bear against and slide along positioning slot sidewalls 226 in circuit board 224 until they expand and seat into circular profile recesses 222 present in slot sidewalls 226, these profiles being of complementary shape to the positioning profiles 210. In the seated condition, latched cantilevered spring members 208 continue to be deflected toward the latch center, providing positive alignment and increased retention over time. The latch system components of the present embodiment are designed to firmly and securably retain the connector housing to the separable printed circuit board. However, the retention force of the latch members may be overcome, and the mating pair separated. Additional benefits provided by the latching system mechanism of the present embodiment include an audible click and/or a tactile feel that is provided to signal full engagement upon mating of the components.

Although symmetrical and radially arcuate positioning recesses 222 and corresponding radially arcuate positioning profiles 210 are depicted, other embodiments of positioning recesses and profile shapes may be employed including, but not limited to oval, oblong, elongated, elliptical, half-diamond, angular shaped, etc. It is also possible to have multiple profile shapes longitudinally disposed on one set of cantilevered spring fingers 208. Positioning recesses and profiles may also be non-symmetrical in shape, for example configured in a spring-like "shepherd's hook" shape or a one sided shape that serves to provide polarization. Some embodiments may have a single cantilevered spring finger, single profile, and/or single recess on one side of a center rail and/or positioning slot. In addition, alternative embodiments to a resilient cantilevered spring design may also be employed for providing seating or mating forces, for example by using any suitable compressible and/or resilient structural design or materials. In addition, a strengthening rail may be absent or disposed on a different plane than associated positioning profiles as illustrated in FIGS. 50 and 51 and/or may be combined with other features of the present disclosure, such as an anchor structure, as shown in FIG. 49. A receiving slot and strengthening rail combination may also be configured with polarization features, such as grooves, channels, and/or other geometrical features.

The latch receiving configuration in a printed circuit board may be fabricated during standard board fabrication processing. During processing, the placement of a centerline for positioning profiles (e.g., radiuses) on a connector housing, as well as a centerline for a profile recess or hole positioned in a receiving slot on a printed circuit board are typically important. However, width and tolerance of each are not typically critical due to the compression mating characteristics of positioning profiles. These profiles typically deflect and thereby change overall latch shape by design during mating within a receiving slot and profile recesses. In a typical embodiment, there exists clearance between the edges of a receiving slot in a card and exterior walls of a center rail and/or strengthening rail of a connector housing latch portion.

Figure 54:
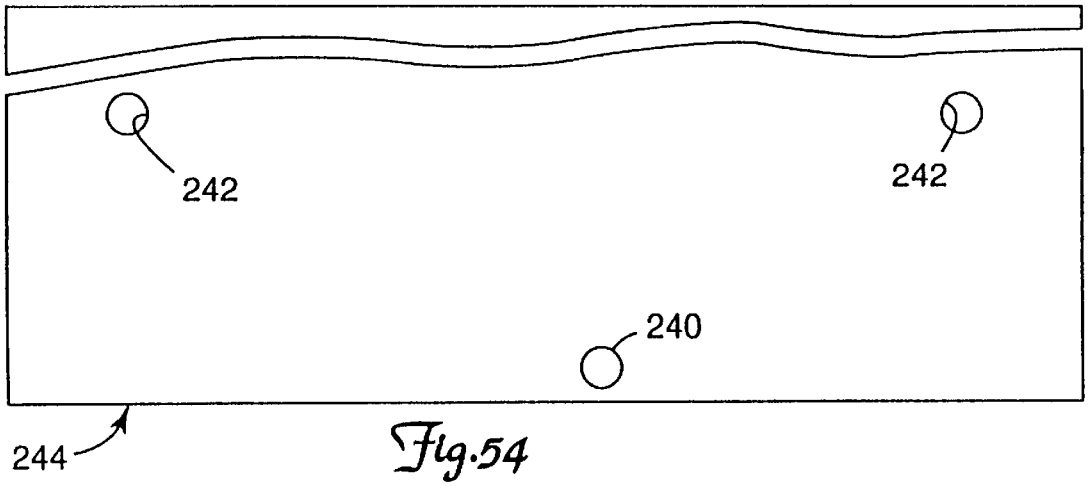
FIG. 54 is a simplified side view of a printed circuit board with tooling holes and a latch opening disposed therein according to one embodiment of the disclosed method and apparatus.

One embodiment for constructing a receiving portion of a separable latch system on a printed circuit board is discussed with reference to FIGS. 54–56. In the first drilling operations of a printed circuit board, any plated or non-plated through holes, and all tooling holes are typically drilled to position a card in the X and Y direction, thereby establishing a datum relative to the tooling holes. At the same time, a latch or positioning opening 240 is typically drilled into a printed circuit board 244 as part of the same datum. If possible, opening 240 is typically of the same diameter as any tooling holes 242 to minimize variation as shown in FIG. 54. In this way, the datum is established relative to the tooling holes latch opening on one side of a card. Therefore, by making a positioning opening 240 as part of the same process as tooling holes 242, a positioning opening becomes part of the original card datum, and potential for variation problems in subsequent operations and/or manufacturing steps performed by other parties is minimized. However, opening 240 may be of any size suitable size for a separable latch mechanism, and be formed at any time within a card or board manufacturing process if so desired.

Figure 55:
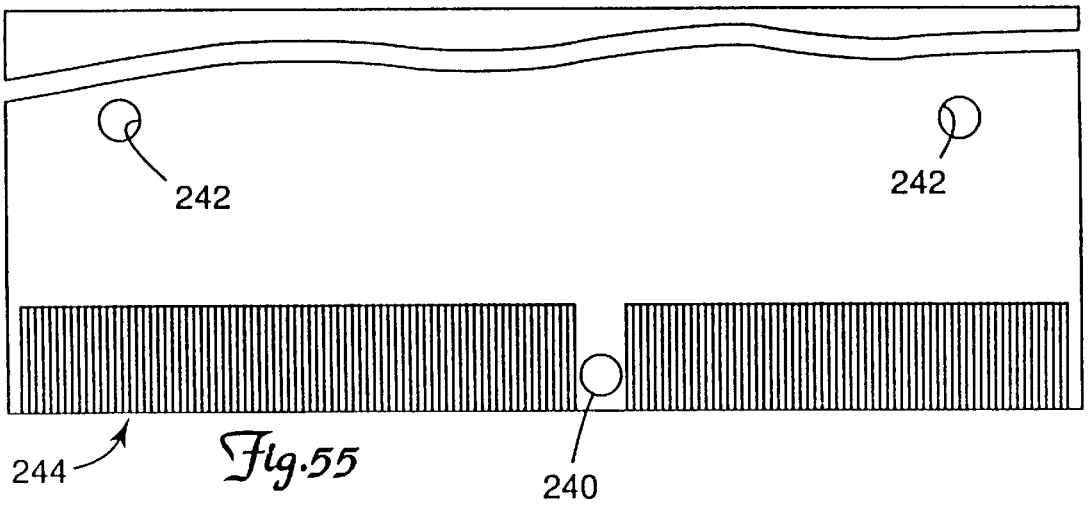
FIG. 55 is a simplified side view of the printed circuit board of FIG. 54 showing the circuit board with contacts disposed thereon according to one embodiment of the disclosed method and apparatus.
Figure 56:
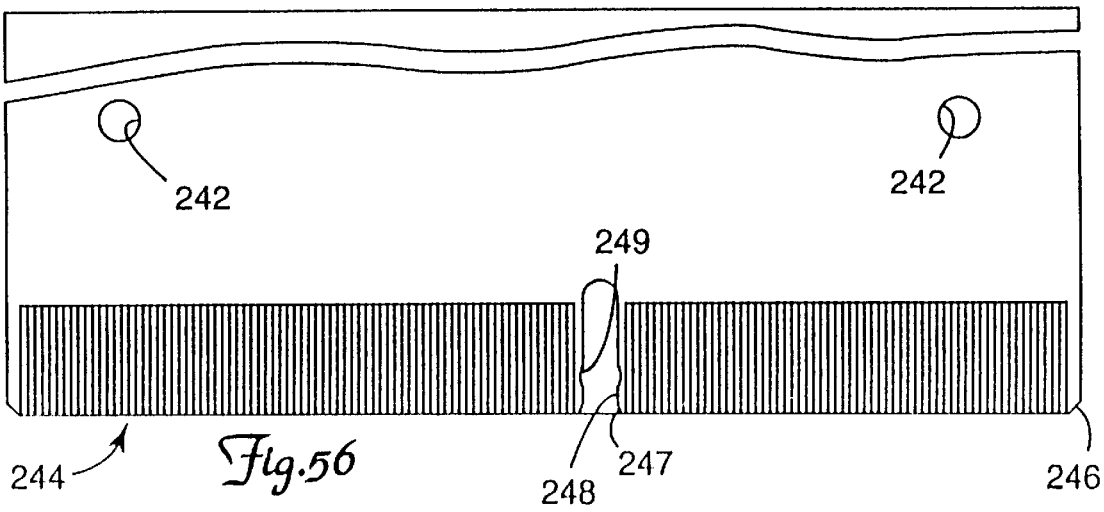
FIG. 56 is a simplified side view of the printed circuit board of FIGS. 54 and 55 showing the printed circuit board following routing of a receiving slot, board edges, and alignment notches according to one embodiment of the disclosed method and apparatus.

Following these steps, the board fabrication is typically completed using standard processes (such as photolithography, laminating, plating, etc.) to yield an in-process board configuration as shown FIG. 55. Then a routing process may be performed. As illustrated in FIG. 56, during such a routing process, board edges 246 and a receiving slot path 248 are typically routed. A receiving slot path 248 is typically formed so that it is substantially centered on the first drilled latch or positioning opening 240. Upon completion, first drilled latch opening 240 is opened up to receiving slot 248, thereby completing receiving slot 248 and forming profile recesses 249 and alignment notches 247 on printed circuit board 244 as shown in FIG. 56. Though one manner of forming profile recesses has been described, it will be recognized that many different methods may be utilized.

In typical card edge connector configurations, the need for mating tolerances (due to routing variations, etc.) is addressed by creating oversizing connector housings and polarization slots so that a gap exists between an edge of a card and an end of a connector, and a gap exists between a polarization slot and a polarization rib. However, these gaps and tolerances may allow a mated card to shift or be seated in such a way that card edge contacts and connector contacts don't line up properly, reducing contact area and increasing potential for cross talk between contacts. Advantageously, by reducing the number of required tolerance variables, the above-described latching system embodiment overcomes typical limitations of a card edge connector system, resulting in a fine pitch connecting system in which substantially all conducting contacts essentially fully contact corresponding conducting pads within the respective borders of these pads. This is accomplished, in part by cantilever spring members 208 that serve to center (rather than bias to one side) positioning profiles 210 within profile recesses 222 and thereby ameliorate potential for mounting a connector in an "off center" fashion due to built-in polarization/positioning slot oversize tolerance. Additionally, by drilling a positioning opening 240 as part of a tooling hole process, any dimensional variations that may affect card/connector mating due to subsequent steps, for example positioning slot routing, are greatly minimized. Finally, when compressed, cantilever spring members 208 act to prevent further movement of a mated card and connector relative to each other.

In the present embodiment, proper positioning of a card and connector during mating typically is achieved using a combination of a latching system mechanism and a card guide system resident in the end product cabinet. Such a card guide system typically receives the width of a circuit board into an internal connector slot width to thereby provide a positioning constraint in a third axis (separate from the dual axis positioning of the latch system embodiment). Typically, there will be by design a clearance between a connector and a card in all cases since these are not deformable or movable bodies. Any rotation of the printed circuit board when fully mated in the card edge connector is very minimal since the clearance is typically about 0.005 inch and the card width is on the order of about 3 to about 5 inches.

Figure 57:
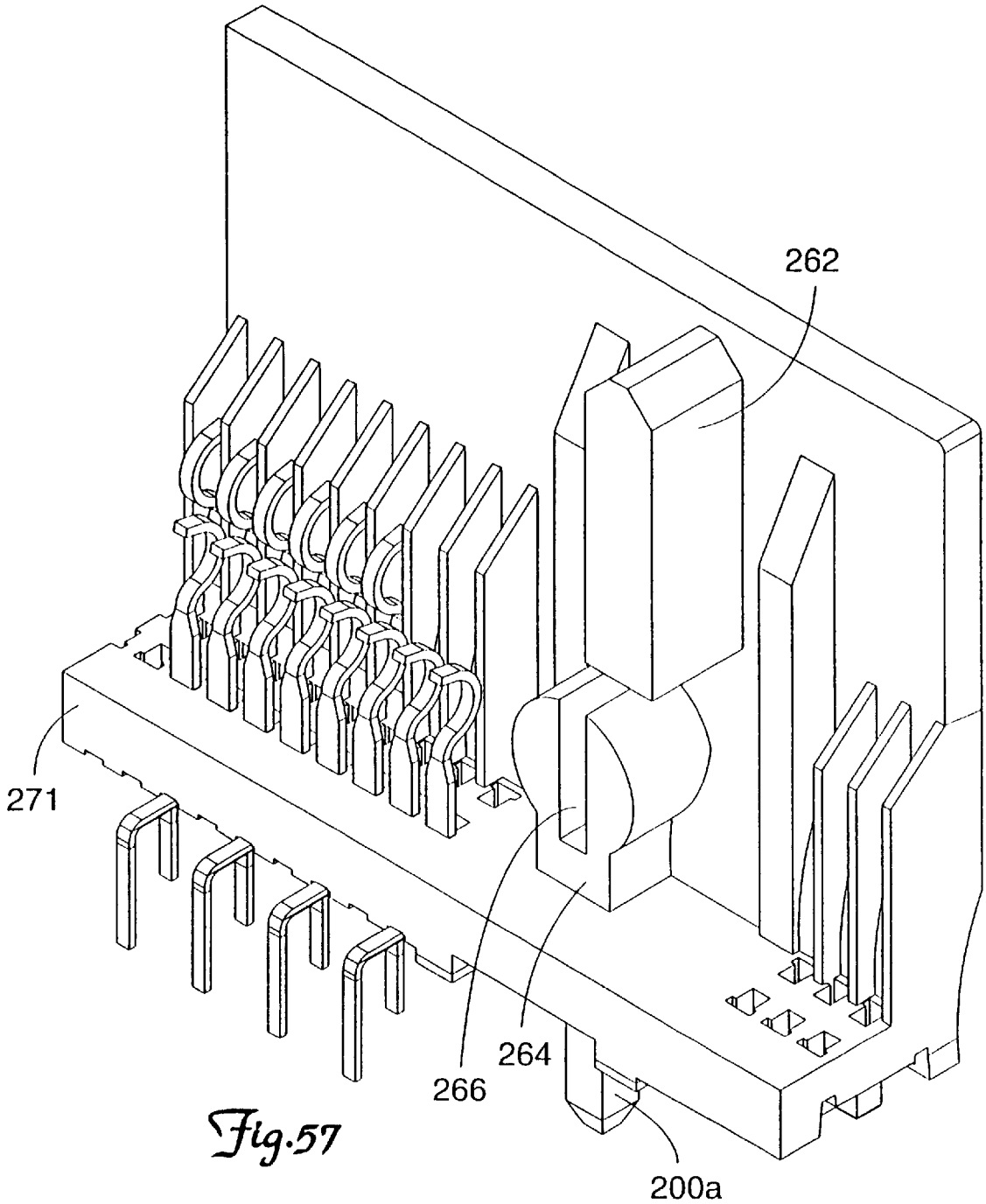
FIG. 57 is a perspective cross sectional view of a one millimeter pitch card edge connector having a conducting separable latch mechanism according to one embodiment of the disclosed method and apparatus.
Figure 58:
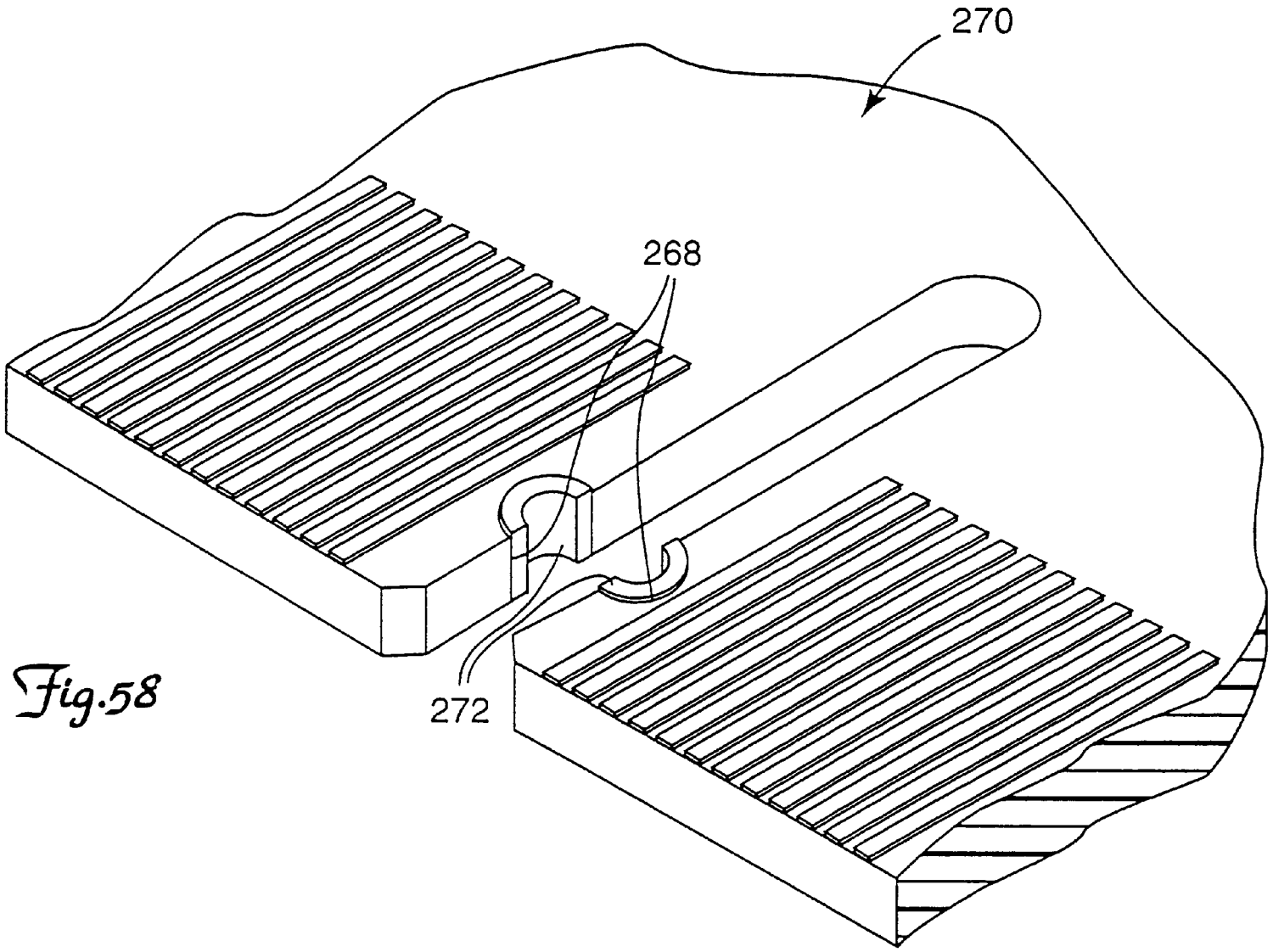
FIG. 58 is a perspective view of a printed circuit board having conducting latch profile recesses according to one embodiment of the disclosed method and apparatus.

Advantageously, in addition to the mechanical features, advantages, and benefits discussed above, one embodiment of the separable latching system may be directed toward electrically connecting a printed circuit board to another printed circuit board directly or as part of an electrical path through the latching system of a connector. FIG. 57 shows a cross section through a 1 mm pitch card edge connector and illustrates one such embodiment including an alignment, polarization, and contact protection feature/strengthening rail 262 disposed above a conducting latch mechanism 264. In this embodiment the positioning profiles 266 of latch portion 264 is conducting (typically gold plated), as are profile recesses 268 (typically gold plated also) in the printed circuit board 270 as shown in FIG. 58. In such an embodiment, profile recess conductors 272 may be electrically connected to a single layer and/or to multiple conducting layers, strips or wires disposed within or on an associated printed circuit board. In the illustrated embodiment, profile recesses 268 are configured to have a profile recess conductor 722 in the form of a plated conducting through hole. Positioning profiles 266 may be part of a latch portion 264 constructed of a conductor such as for example a copper alloy, steel, aluminium alloy and/or may be plated with a conducting material, such as gold. Conducting latch portion 264 typically has a conducting contact pin 200*a* that may be connected to a corresponding contact within a connector, circuit board, or other connecting means. Conducting contact pin 200*a* is typically cover plated with tin/lead solder composition. Alternatively, latch portion 264 may be connected to one or more buried or surface conducting layers, strips, or wires disposed within or on separable latch portion 264. Although positioning profile 266, profile recesses 268 and/or latch portion 264 may be plated with gold as mentioned above, it will be understood with benefit of the present disclosure that other suitable conducting materials, such as copper electroplated with nickel and tin/lead or gold, may be used. Other embodiments may be possible including the use of a conducting sleeve.

Figure 59:
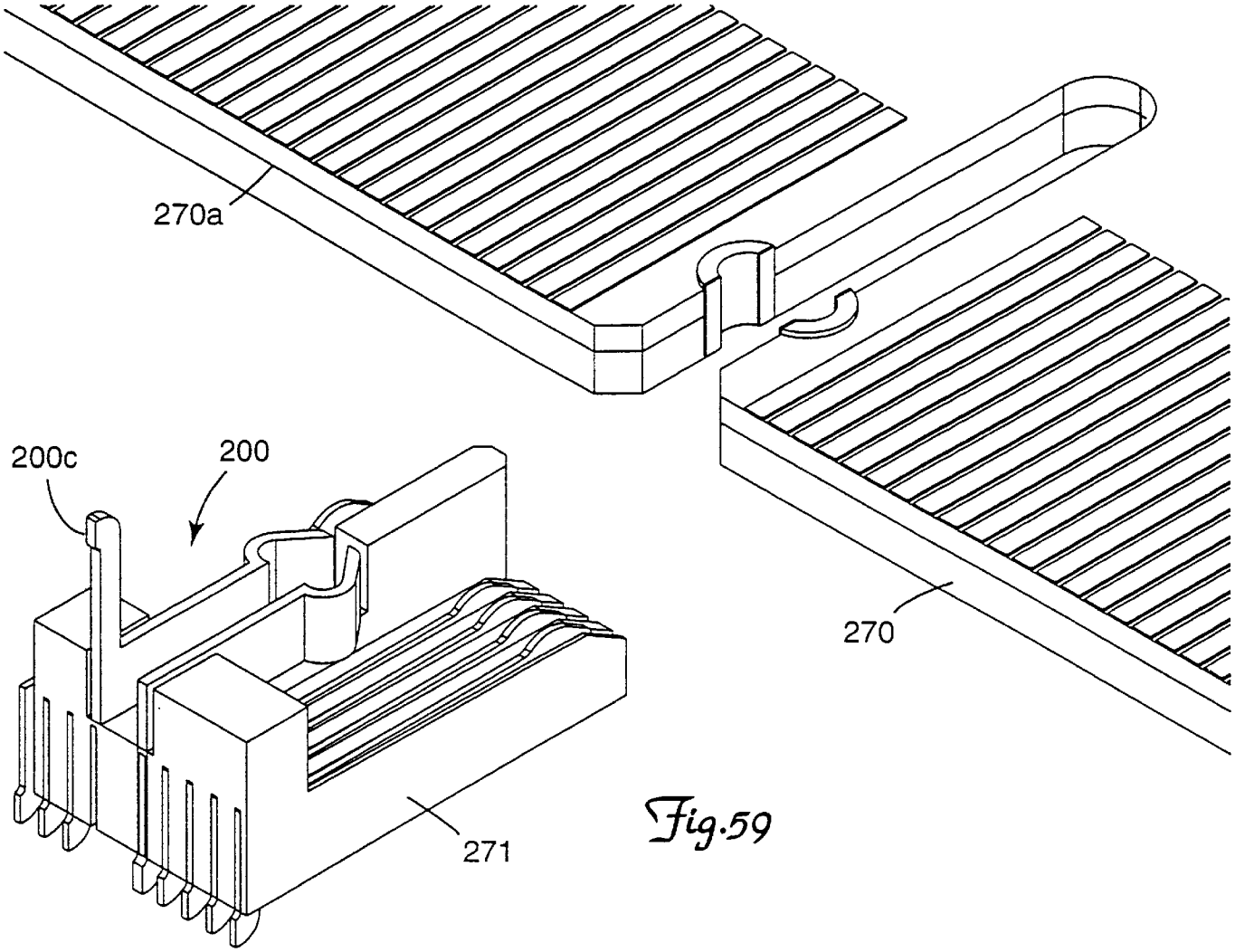
FIG. 59 is a perspective cross sectional view of a card edge connector and corresponding card edge configured according to one conducting latch embodiment of the disclosed method and apparatus with the same disposed in position for interconnection.
Figure 60:
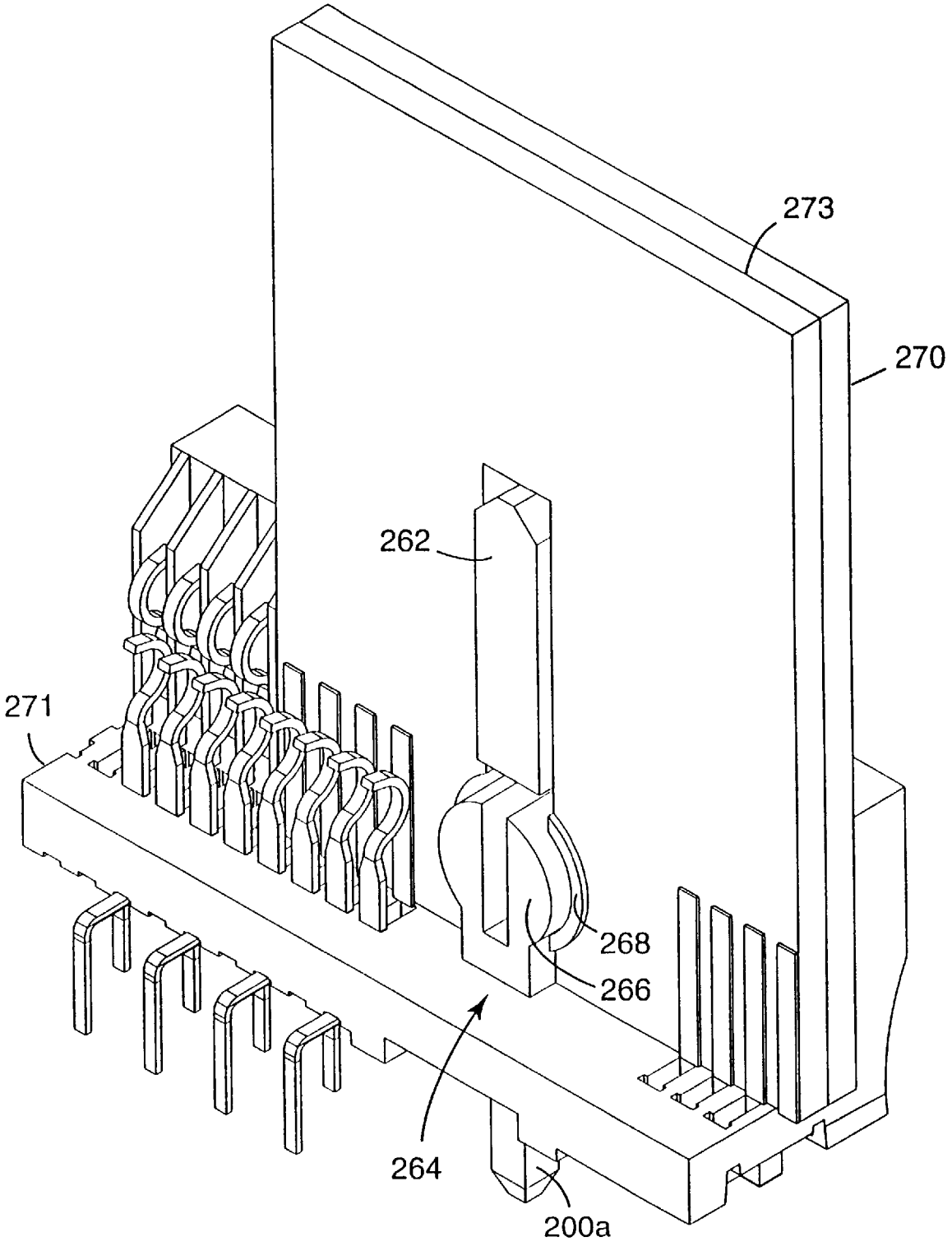
FIG. 60 is a perspective cross sectional view of a connector housing and printed circuit board according to one conducting separable latch embodiment of the disclosed method and apparatus with the same disposed in mated position.

Among benefits provided by a conducting latch embodiment of the disclosed method and apparatus is that power, signal, or ground connections may be made to or from a printed circuit board 270 (for example to an inner layer 270*a* of a printed circuit board 270) through conducting latch mechanism 200 and conducting contact tail 200*c* as shown in FIG. 59. Such a signal may be one required for technical operation or be used as a "proprietary key" for proper functioning of an associated circuit or electrical component system. A conducting latch 264 having conducting profiles 266 mated with conducting recesses 268 in a printed circuit board 270 on a 1 mm card edge connector 271 is shown via a sectional view in FIG. 60. Also shown in FIG. 60 is a conducting inner layer 273 disposed within printed circuit board 270 and electrically connected to conducting recesses 268.

Figures 59A, 59B, 59C:
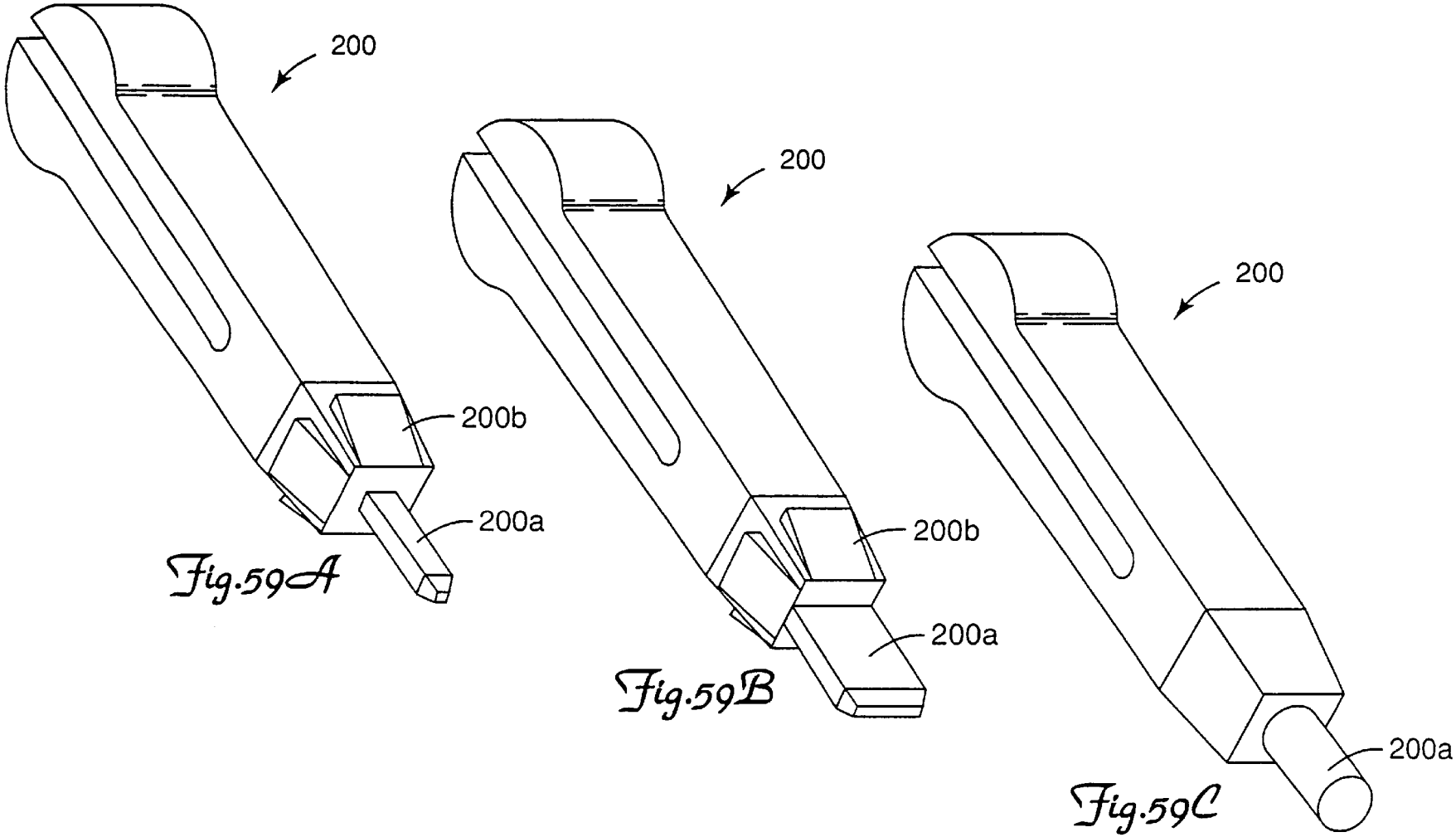
FIG. 59A is a perspective view of a conducting separable latch mechanism according to one embodiment of the disclosed method and apparatus.
FIG. 59B is a perspective view of a conducting separable latch mechanism according to another embodiment of the disclosed method and apparatus.
FIG. 59C is a perspective view of a conducting separable latch mechanism according to another embodiment of the disclosed method and apparatus.
Figure 59E:
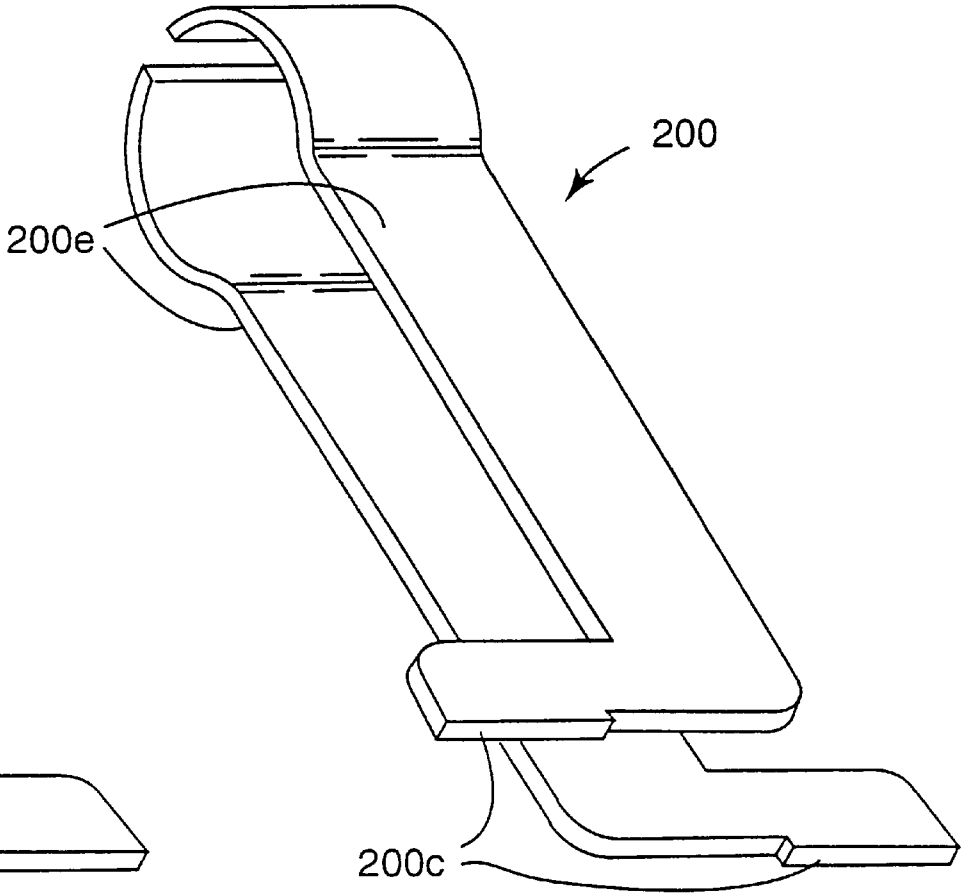
FIG. 59E is a perspective view of a conducting separable latch mechanism according to another embodiment of the disclosed method and apparatus.
Figure 59D:
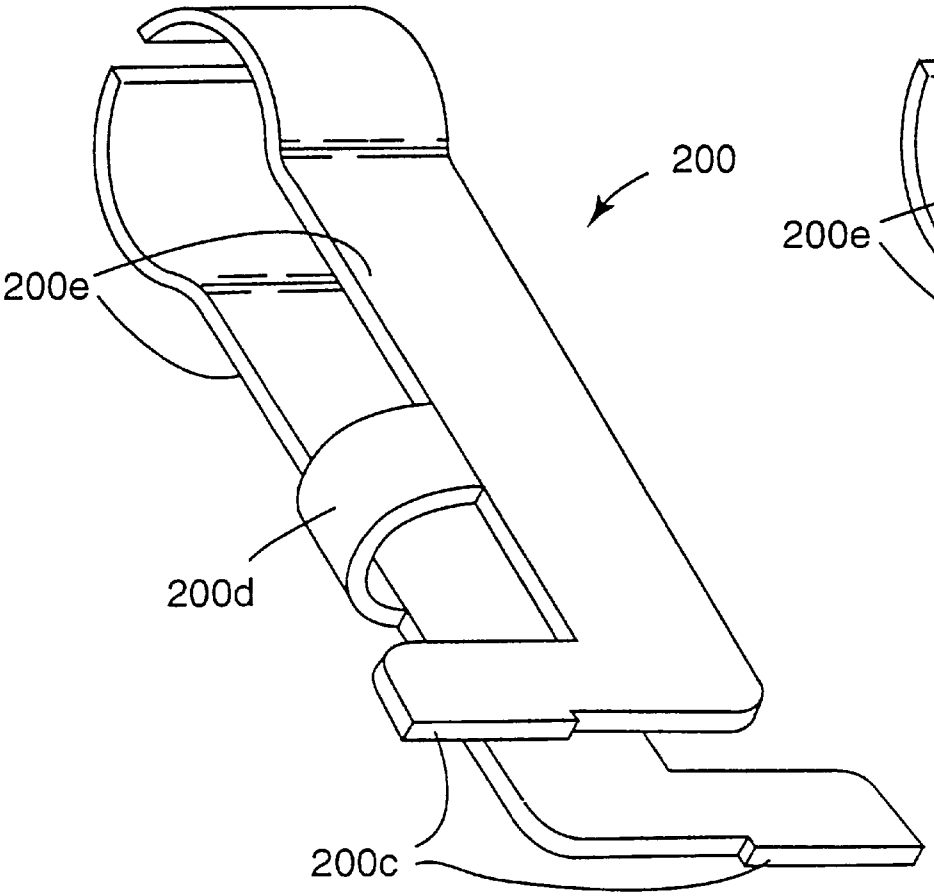
FIG. 59D is a perspective view of a conducting separable latch mechanism according to another embodiment of the disclosed method and apparatus.

As explained for non-conducting separable latch embodiments, a conducting profile recess/positioning profile combination may have many suitable shapes and configurations, including those described above for non-conducting embodiments. Examples of five different embodiments of a conducting separable latch mechanism 200 of the disclosed method and apparatus are shown in FIGS. 59A–59E. Each of the embodiments in FIGS. 59A–59C are constructed of a solid piece of conducting material, in accordance with those conducting latch embodiments mentioned previously. However, latch mechanisms 200 FIGS. 59A–59C may also be hollow in construction. In addition, the depicted embodiments in FIGS. 59A–59C each have a contact pin feature 200*a* designed for mating and establishing electrical connection with a corresponding plated through hole or other suitable type of contact located in, for example, a connector body. FIGS. 59A and 59B also have retention features or swages 200*b* for securing latch mechanism 200 in a connector body or other housing. FIGS. 59D and 59E illustrate separable latch embodiments having flat ribbon-like spring elements 200*e*, with each spring element 200*e* having a separate contact tail 200*c* for making electrical connection with corresponding surface mount or other suitable electrical contacts. In FIG. 59D, spring elements 200*e* are connected or tied together with "U-shaped" cross member 200*d*. It will be understood with benefit of this disclosure that other retention features (such as raised dimples), contact pin (such as square, angular, oblong, or irregular) and contact tail designs (such as stepped) suitable for mating and establishing connection with, for example, a connector body and corresponding electrical contacts may also be employed. It will also be understood that each of the above described latch mechanism embodiments may also be successfully employed, in part or entirety, in non-conducting separable latch mechanism configurations.

In addition, a conducting separable latch system embodiment of the disclosed method and apparatus may have more than one conductive path. For example, each of the conducting recess halves 268 and positioning profile halves 266 shown in FIG. 60, may complete a separate circuit path when a latch system embodiment is engaged. This may be possible, for example, by electrically connecting each profile recess half 268 to a separate conducting layer or layers within or on an associated circuit board 270, for example, by etching back a conductive layer (such as a copper layer) so that it is not present or exposed at a profile recess surface adjacent a portion of a separable latch mechanism to which the layer is not intended to be connected. In similar fashion, each positioning profile half 266 may be electrically connected to separate circuit paths within an associated connector 271. This may also be accomplished with embodiments such as those shown in FIGS. 59D and 59E by, for example, connecting contact tails 200*c* to separate circuit paths and providing a non-conductive cross member 200*d* in the embodiment of FIG. 59D. In embodiments 59A–59C, latch mechanism 200 may be configured to carry more than one signal from multiple positioning profile elements by, for example, by providing conducting pin 200*a* with a coaxial conducting and insulating material design, or by insulating contact pin 200*a* from the remainder of a conducting latch mechanism body to provide multiple contact points and signal paths. Although a two conductive path embodiment is described above, additional conductive paths through a separable latch mechanism of the disclosed method and apparatus are also possible, for example, by further segregating portions of profile recesses and positioning profiles into separate portions insulated from one another. In turn, these separate portions may be electrically connected to separate circuit paths within an associated board and connector, respectively.

Figure 60A:
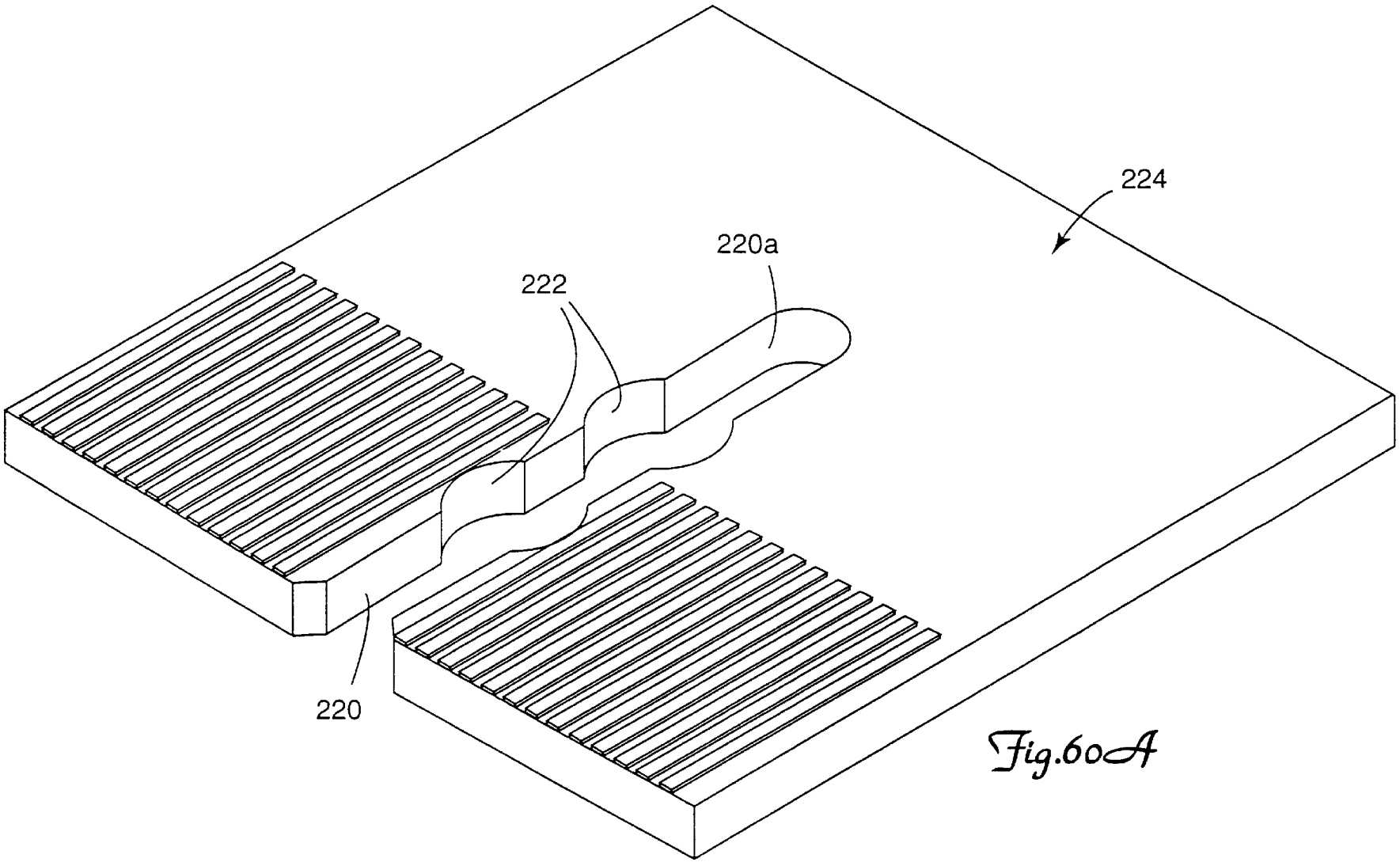
FIG. 60A is a perspective view of a circuit board configured with a receiving slot and dual profile recesses according to one embodiment of the disclosed method and apparatus.

Embodiments of the polarization key and latching system of the disclosed method and apparatus may be used in circumstances of blind mating, and are compatible with plated through hole or surface mount product configurations. These embodiments may be practiced with a single latching system on a connector, or multiple latching systems may be employed on a connector with any desirable combination of non-conducting and conducting latch systems. In this regard, multiple separable latch mechanisms and recesses may be employed, either on the same lateral axis (i.e., several latch mechanisms mating in recesses disposed within one positioning slot) or located in different lateral positions along a connector/card edge interface. In either case, multiple latch mechanisms may be conducting, non-conducting, or a mixture thereof. As an example, FIG. 60A illustrates one embodiment of a circuit board having a single receiving slot 220 with two profile recesses 222. In this embodiment, neither, one, or both profile recesses 222 may be conductive according to any of the embodiments previously described. Profile recesses 222 may be configured to receive a single separable latch mechanism in multiple positions (in which case each position may provide a separate circuit path if so desired), or to receive dual separable latch mechanisms simultaneously. Receiving slot extension 220*a* may be included to provide space for receiving a strengthening rail and/or clearance for allowing multiple position mating of a single separable latch mechanism, as described above. It will be understood with benefit of the present disclosure that a circuit board may be configured with more than two profile recesses in a similar manner.

Figure 60B:
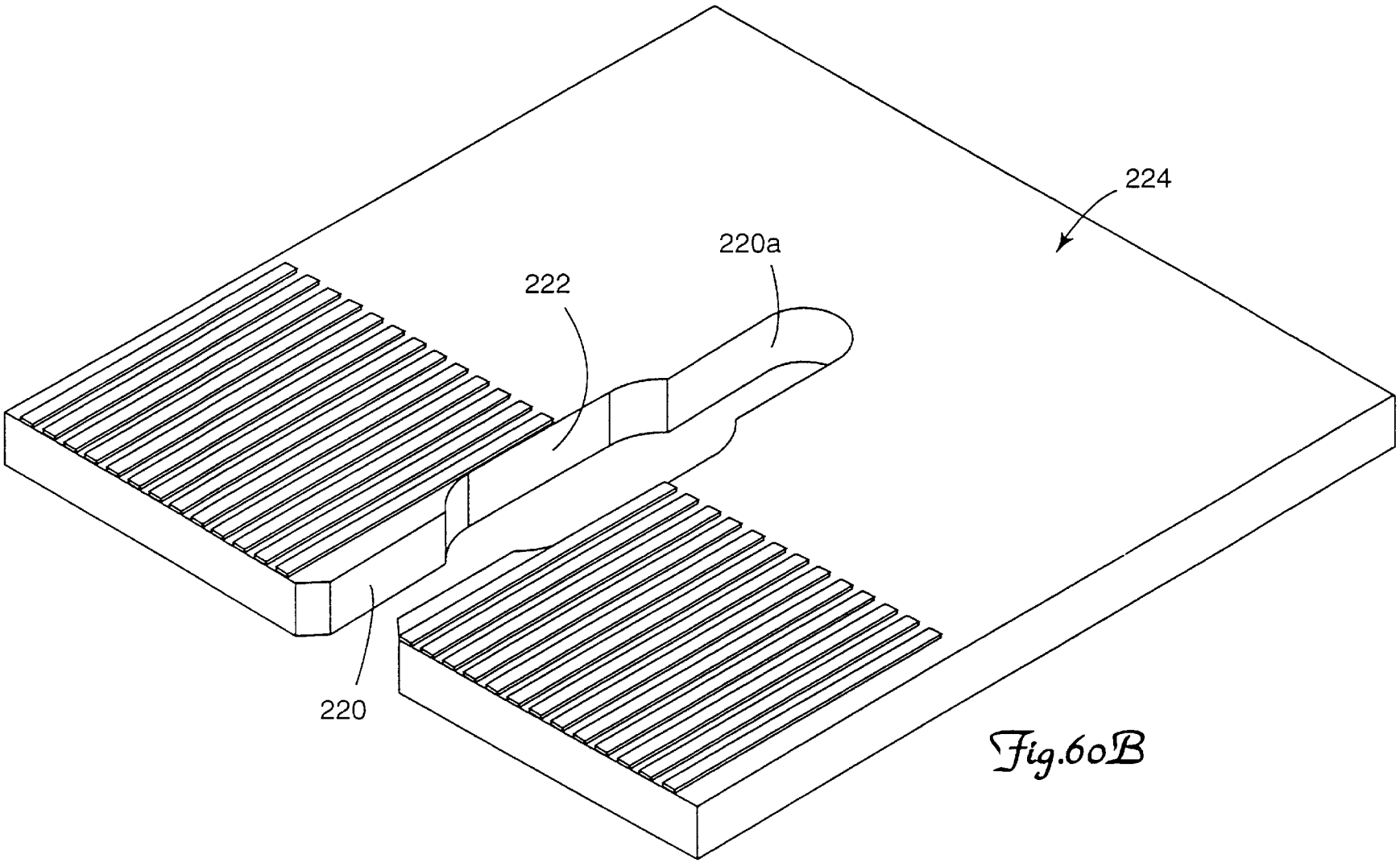
FIG. 60B is a perspective view of a circuit board configured with an oblong profile recess and extended receiving slot according to one embodiment of the disclosed method and apparatus.
Figure 60C:
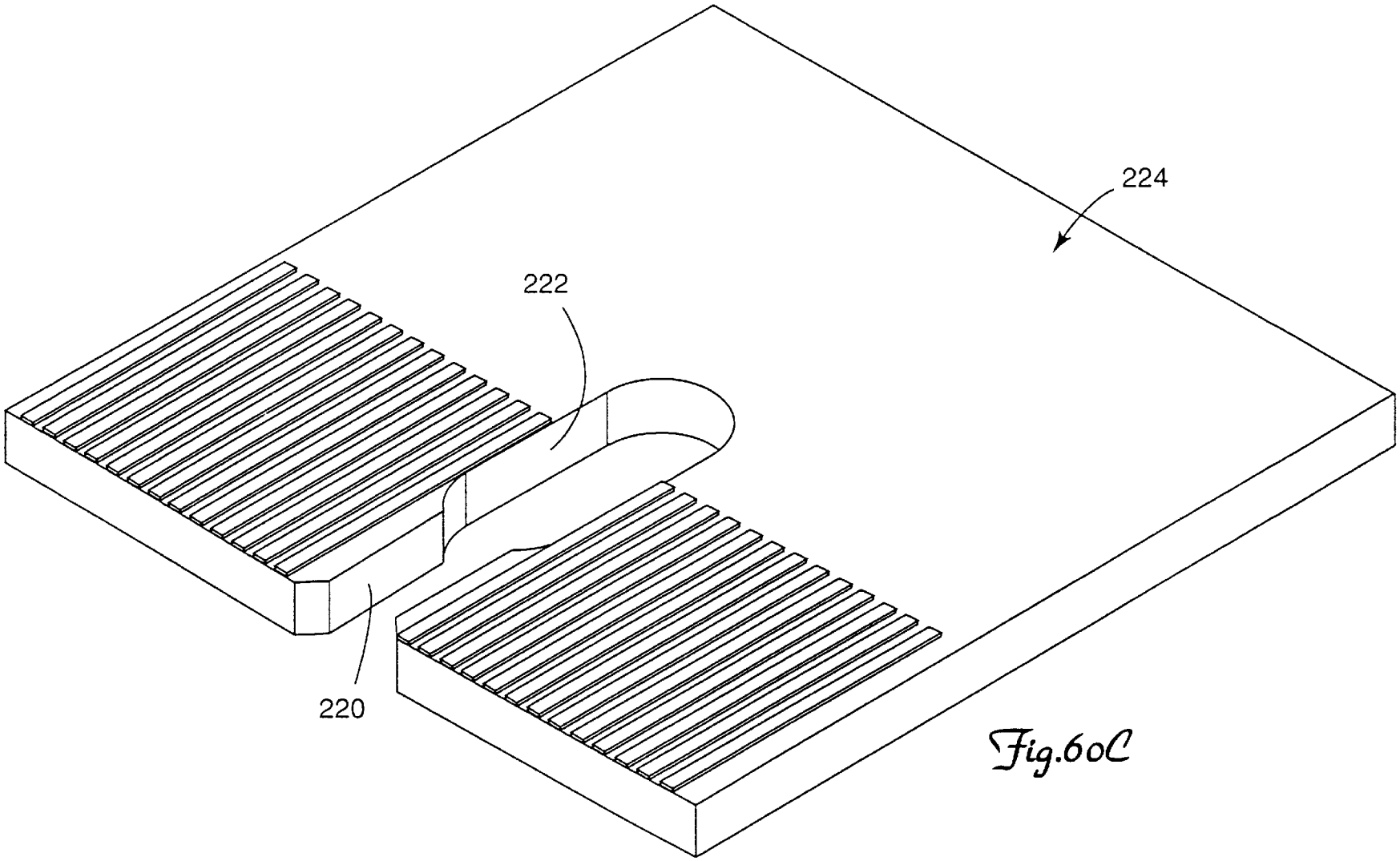
FIG. 60C is a perspective view of a circuit board configured with an oblong profile recess according to one embodiment of the disclosed method and apparatus.
Figure 60D:
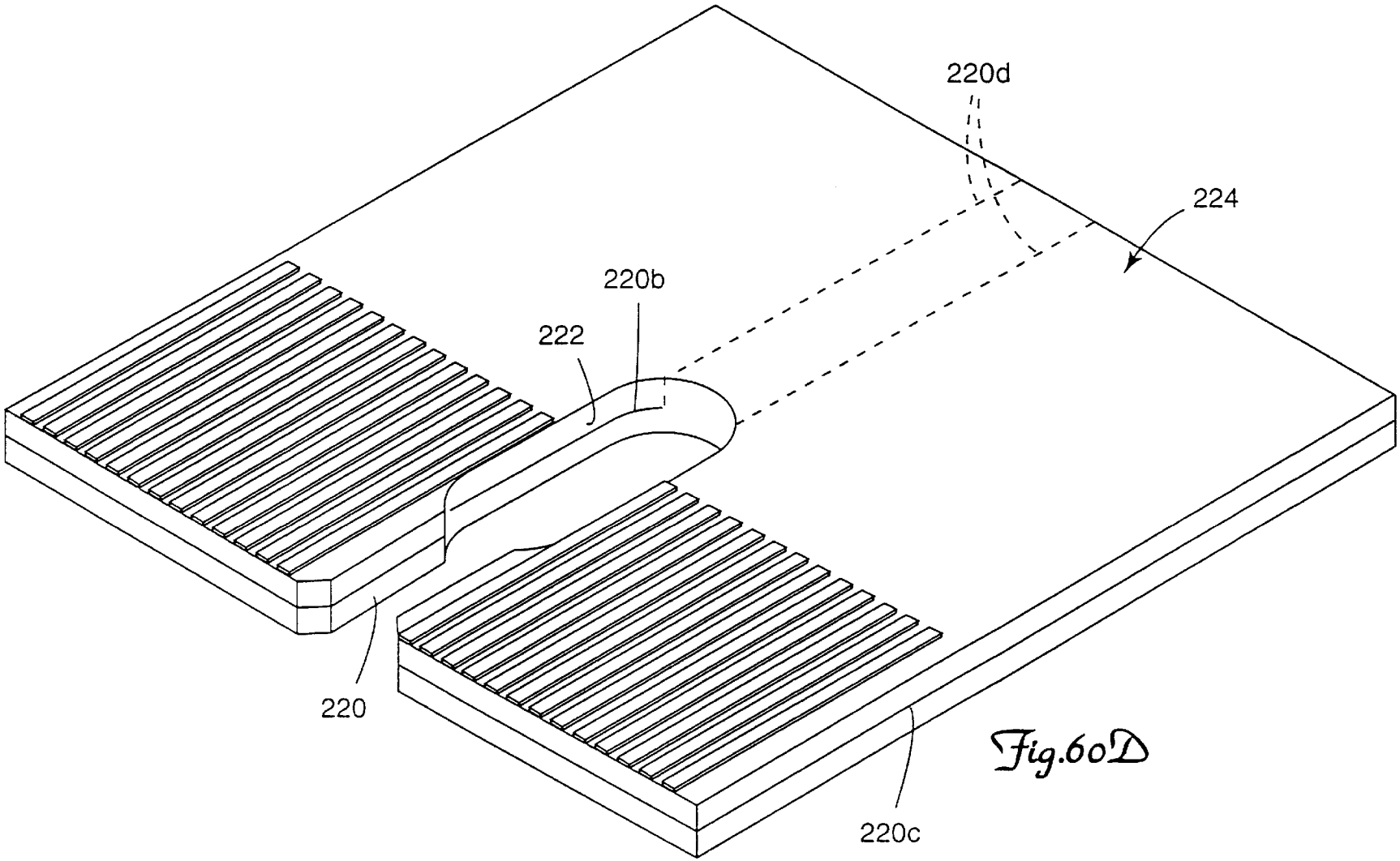
FIG. 60D is a perspective view of a circuit board configured with an oblong profile recess and buried conductive layers according to one embodiment of the disclosed method and apparatus.

Just a few of many other receiving slot/profile recess embodiments possible using the disclosed method and apparatus are illustrated in FIGS. 60B–60D. FIG. 60B illustrates a circuit board 224 with an oblong profile recess 222 having an extended receiving slot portion 220*a*. Oblong profile recess 222 may be used, for example, to mate with positioning profiles of similar oblong shape, or to provide tolerance for mating with a positioning profile or multiple positing profiles having a rounded shape, such as those previously described. In the latter case, a mated profile/recess connection may be designed to be slidably adjustable throughout a working range (which may serve to complete different circuit paths if so desired) while mated if so desired. In addition, profile recess 222 may be routed prior to, or in an operation separate from drilling of tooling holes. FIG. 60C illustrates an embodiment similar to that shown in FIG. 60B, but without an extended receiving slot portion 220*a*. FIG. 60D illustrates an embodiment similar to that shown in FIG. 60D having conductive layers 220*b* and 220*c* disposed within circuit board 224. As shown, conductive layers 220*b* and 220*c* may be exposed in receiving slot 222 to allow contact with corresponding positioning profiles of a mated separable latch mechanism, such as that shown in FIG. 59E. Dashed lines 220*d* indicate borders of conducting layers 220*b* and 220*c*. It will be understood with benefit of the present disclosure that receiving slot 222 may be plated with a conductive material to enhance contact conductive layers 220*b* and 220*c*, and that other a real geometries of layers 220*b* and 220*c* may be employed, as well as a single conducting layer disposed in a portion or throughout circuit board 224. It will also be understood that more than two conductive layers may be disposed within a circuit board, in single and/or multiple plane arrangements (i.e., with respect to the plane of the circuit board), and in combination with single or multiple latching mechanisms. In the latter case, multiple latching mechanisms may be configured to complete separate circuits with separate portions of multiple layers within a circuit board so that, for example, two latching mechanisms and two conductive layers may provide eight different signal paths.

Finally, as shown in cross section in FIG. 49, ramp elements 207 may be employed in a card edge connector housing with or without a separable latch mechanism 200. Ramp elements 207 and ribs 209 (with T-shaped portions) are positioned on each half of a connector housing to straddle a printed circuit board as it enters a connector housing. As such ramps 207 and ribs 209 help straighten out and align a printed circuit board as it enters a connector. Ramp elements 207 and ribs 209 may have geometries other than that illustrated in FIG. 49, such as having different angles or curved lead-in features.

Alternative methods for polarization may be utilized. For example, with reference to FIGS. 1A and 1B, polarization may be provided for by sizing the housings of the socket 16 and plug 26 such that the socket and plug may mate in only one direction. More particularly, ends 26*e* of plug 26 may be thicker than the plug ends 26*f*. and likewise the ends of socket 16 may have end extensions 16*f* on one side of the socket which are missing from the ends 16*e* of the other side of the socket. In this manner, the socket and plug may mate such that plug ends 26*e* join socket ends 16*e* and plug ends 26*f* join socket ends 16*f*; however mating in the opposite manner will not occur because of the sizing differences. Thus, polarization may be inherently provided by the size and shape of the connector housings.

Although discussed above in relation to card edge embodiments, a separable latch system may also be employed with two piece connector systems in a similar manner as described above. For example, a separable latch mechanism having positioning profiles may be integrated into the housing of a socket connector and a corresponding receiving slot with profile recesses integrated into a mating plug connector. Of course, it will be understood with benefit of the present disclosure that a latch mechanism with positioning profiles may be alternatively integrated into the housing of a plug connector and a corresponding receiving slot with profile recesses integrated into the housing of a mating socket connector.

Straddlemount Embodiments

Figure 62:
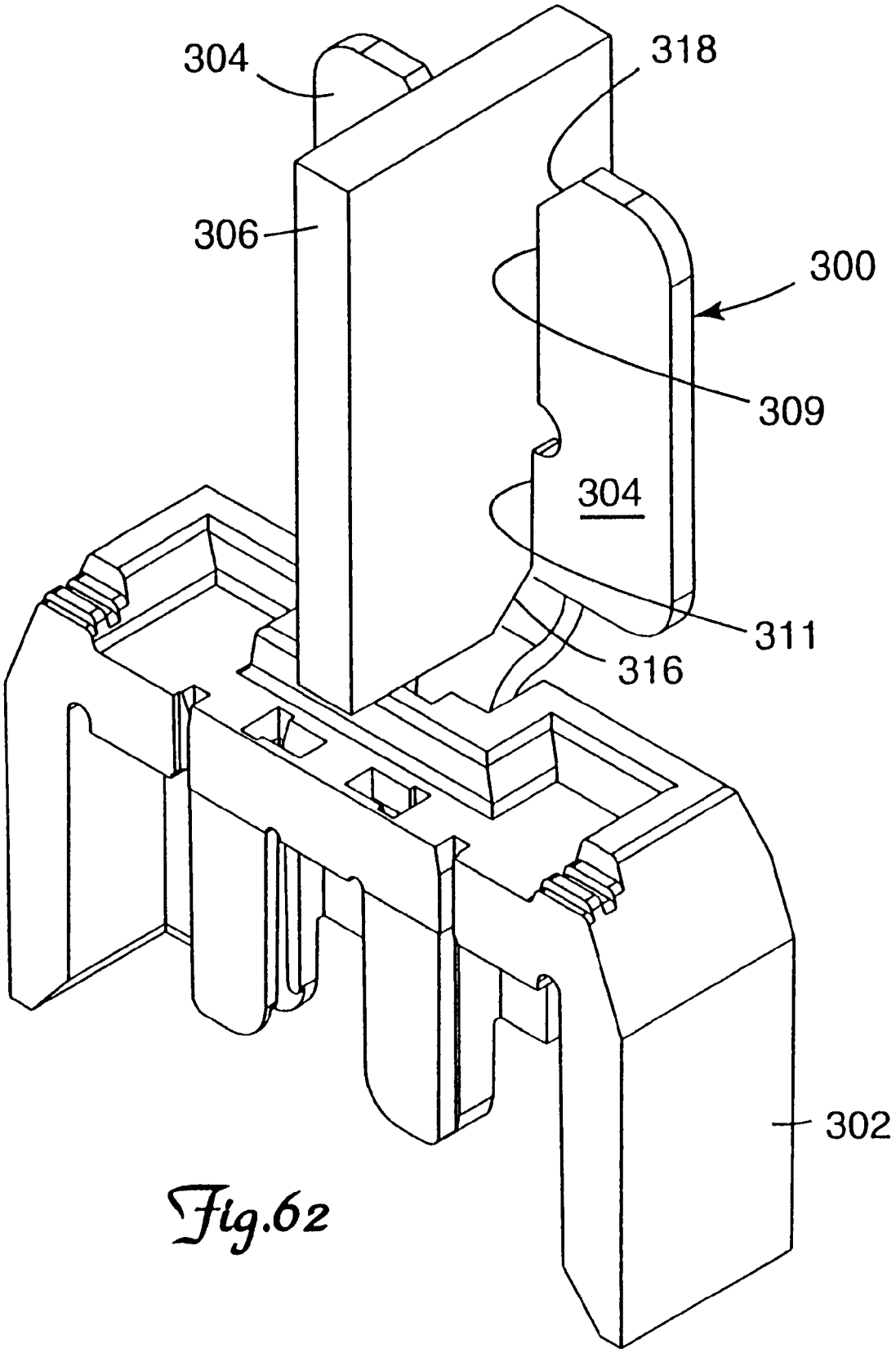
FIG. 62 is a perspective cross sectional view of a connector housing with an attached straddlemount clip engaged with a printed circuit board according to one embodiment of the disclosed method and apparatus, with typical dimensions indicated.
Figure 62A:
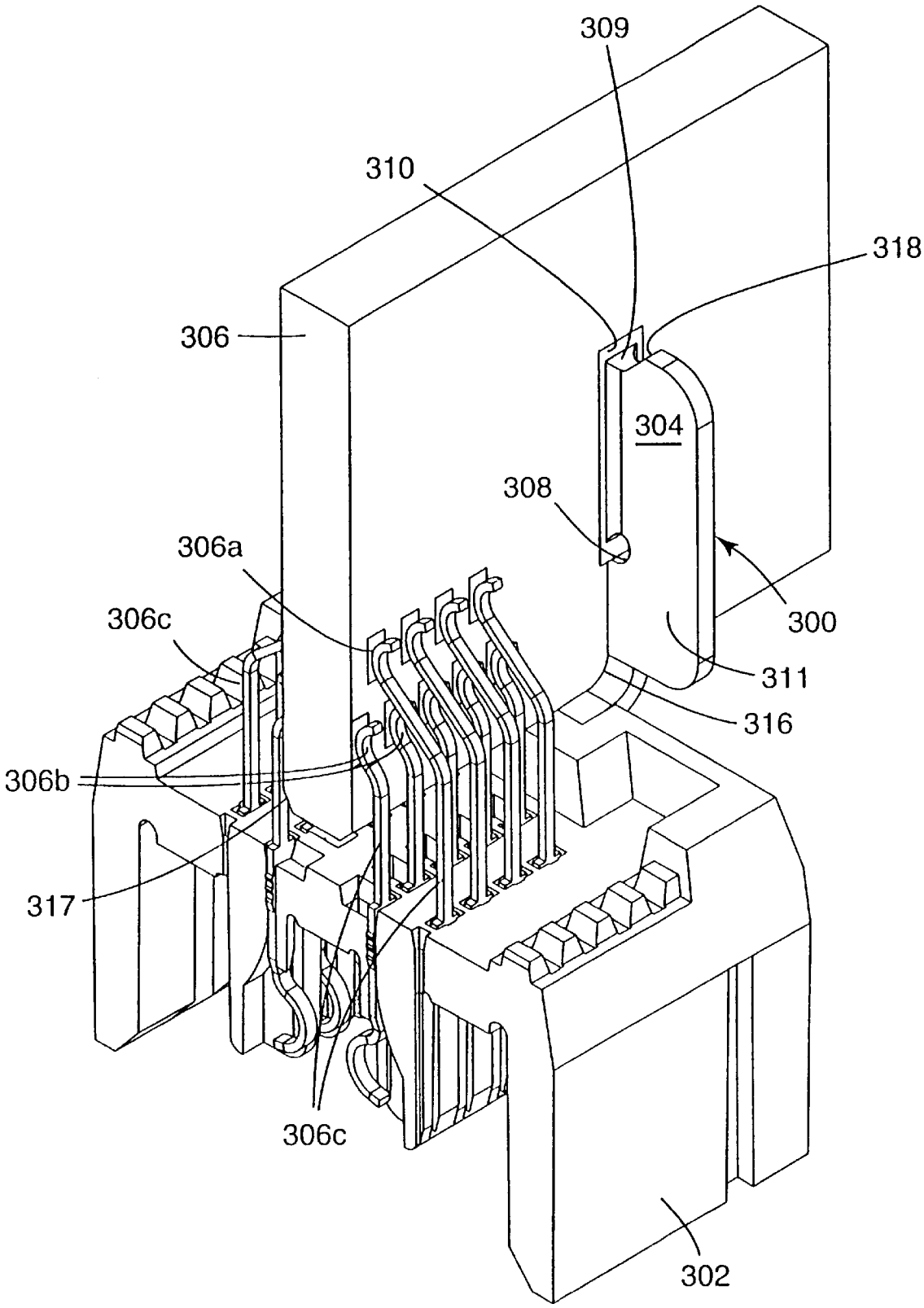
FIG. 62A is a perspective cross sectional view of a connector housing similar to the embodiment shown in FIG. 62.

In a straddlemount embodiment of the disclosed method and apparatus, such as that illustrated in FIG. 62A, conducting pads 306*a* of a printed circuit board 306 are typically positioned near the edge of the board and are usually present on both sides. In this embodiment, a connector housing 302 has contact tails 306*c* having contact feet 306*b* that are configured to "straddle" board 306 and make contact with pads 306*a* as shown in FIG. 62A. An attachment clip 300 installed integral to connector housing 302 may be employed to likewise "straddle" board 306 for positioning and stabilizing board 306 relative to connector housing 302 so that connections between contact feet 306*b* and pads 306*a* may be made.

One embodiment of the disclosed method and apparatus is a straddlemount attachment clip that substantially overcomes limitations of traditional straddlemount connector attachment structures. This straddlemount attachment clip embodiment may be surface mountable and may be used in such a way so as to substantially prevent undesirable mechanical forces from stressing solder joints or small cross section contact tails. In straddlemount configurations of the present embodiment, contacts 300*b* are described and positioned in a connector housing 302 such that a receiving opening 300*a* is created as shown in the embodiment illustrated in FIG. 64. Opening 300*a* is typically sized such that it causes mechanical mating with each side of a printed circuit board upon insertion of the board into receiving opening 300*a* or vice-versa. Upon insertion, contact or conductor tails 300*c* are mutually displaced/deflected by the printed circuit board which is typically larger than opening 300*a*.

Figure 61:
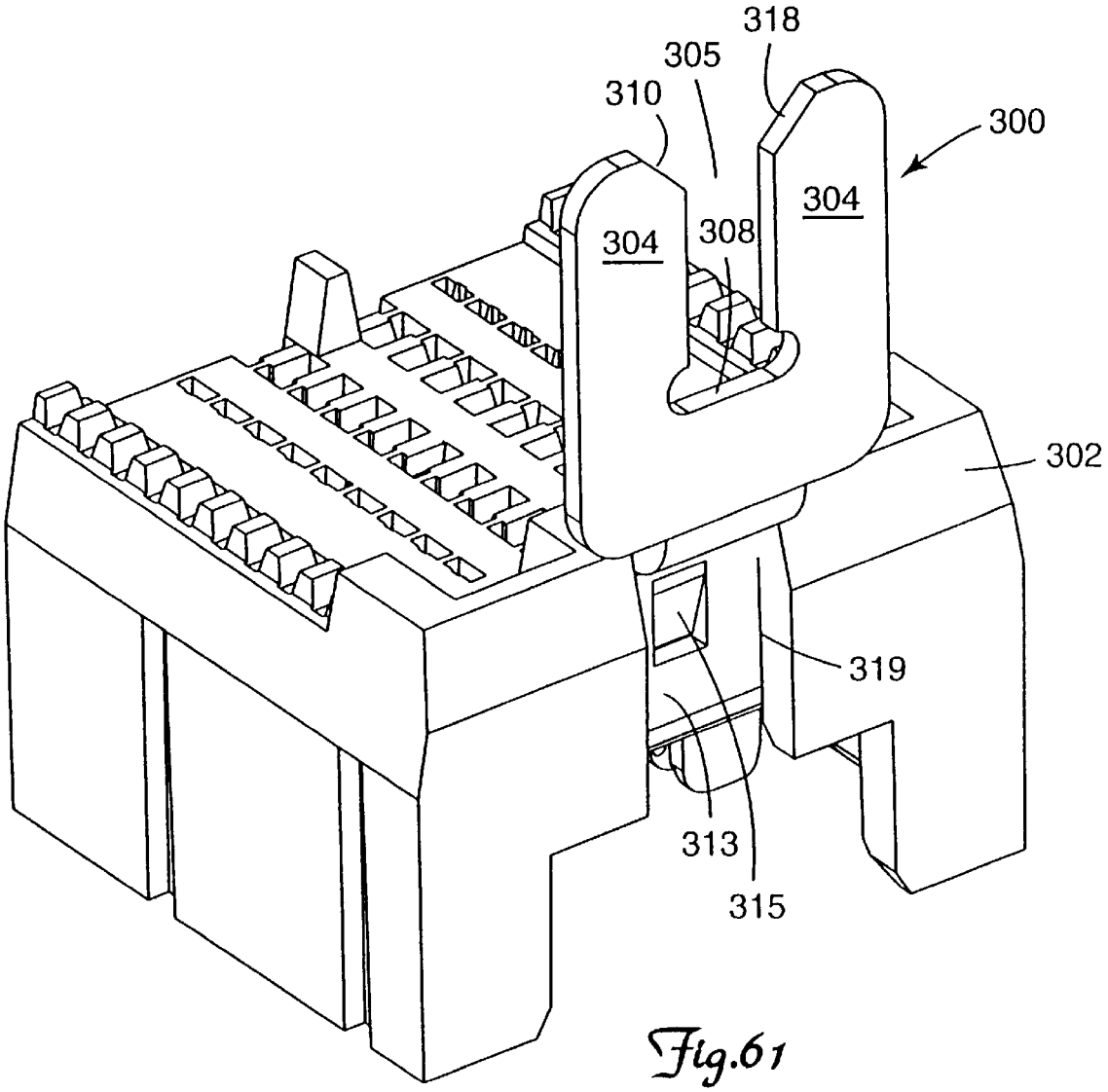
FIG. 61 is an enlarged perspective view of a connector housing with an attached straddlemount attachment clip according to one embodiment of the disclosed method and apparatus.

In practice, a straddlemount attachment clip 300 of this embodiment may be permanently latched into a connector housing 302, as shown in FIG. 61. In one embodiment, the portion of a clip designed to provide the attachment means is formed by spring fingers constructed with a "U" shaped portion 304 as shown in FIG. 61. As shown in FIG. 62A, the edge of this "U" shaped portion 304 may be configured to extend beyond the boundary of the formed SMT contact feet 306*b* for protecting contact tails 306*c* from handling damage, both in the package and while on the board.

FIG. 62A illustrates a straddlemount attachment clip 300 of the disclosed method and apparatus employed with a straddlemount connector housing 302 employing a multi-level tail configuration, in this case bi-level tails 306*c*. As shown in FIG. 62A, spring fingers 304 of the "U" shaped portion are designed to be engaged with a printed circuit board 306 such that circuit board 306 penetrates the channel 305 formed between spring fingers 304. When so engaged, spring fingers 304 provide a spring force normal to board 306 which may be used to retain connector 302 in position on board 306 and thereby protect connection integrity until, for example, a soldering process has been completed. For example, once engaged, spring fingers 304 may be secured to board 306 by soldering or other suitable securing means, such as adhesive. Because no extra steps or mechanical and/or multi-piece connections are required to secure the straddlemount clip to a printed circuit board, mounting of a straddlemount connector to a circuit board is greatly simplified over processes associated with conventional designs. Advantageously, "U" shaped spring fingers 304 also serve to allow for and absorb differences in board thickness, which are currently prevalent in the industry, both within lots and between lots. Board thickness differences are also prevalent between different circuit board designs and manufacturers.

As shown in FIG. 62A, base surface 308 of "U" channel 305 formed between spring fingers 304 may provide a mechanical stop for positioning board 306 when engaging connector 302, thus positioning conducting contact tails 306*c* with reference to board 306. U channel base surface 308 may also provide a mechanism for absorption of mating forces while at the same time preventing stress on solder joint 309 between attachment clip 300 and printed circuit board 306. FIG. 62 indicates typical dimensions for one embodiment of the type indicated.

Figure 63A:
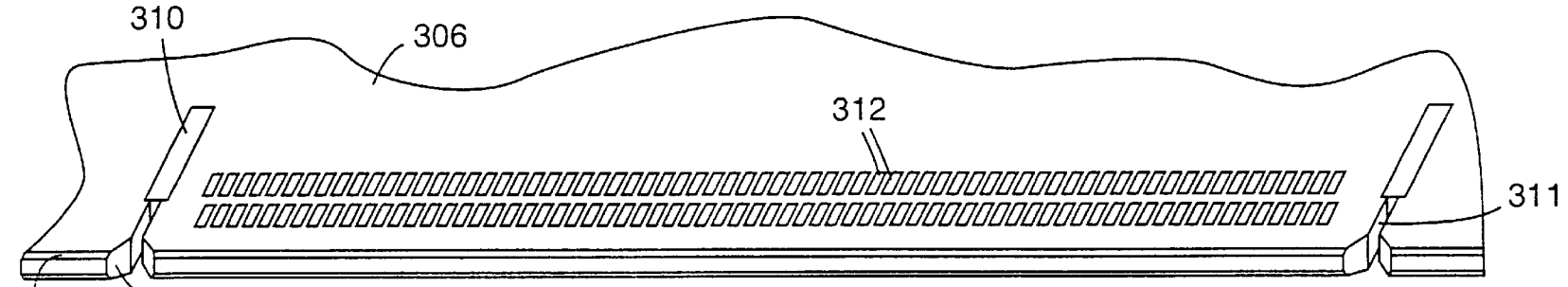
FIG. 63A is a perspective view of the printed circuit board embodiment of FIG. 63.
Figure 63:
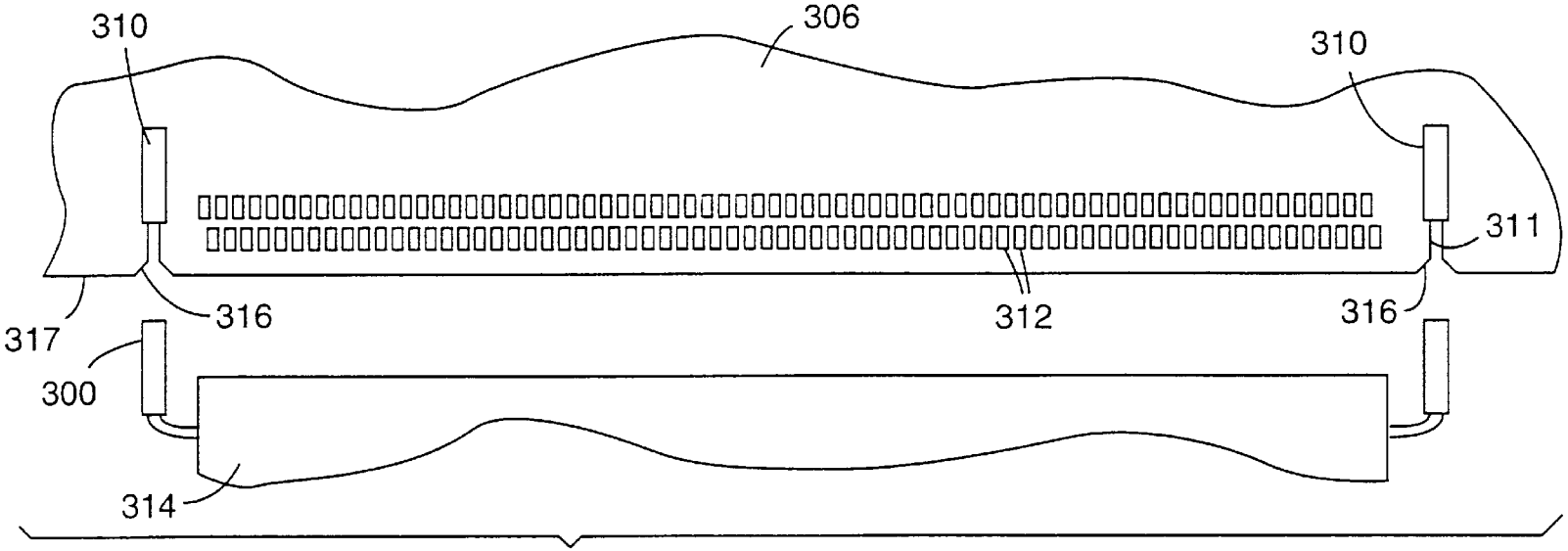
FIG. 63 is a simplified side view of a connector housing with attached straddlemount attachment clips and a printed circuit board configured to receive the straddlemount attachment clips according to one embodiment of the disclosed method and apparatus with the same disposed in position for interconnection.

One embodiment of a printed circuit board portion 306 configured to receive straddlemount attachment clips 300 is shown in FIG. 63. As illustrated, board 306 has a solder pad 310 as well as an accompanying slot 311 routed into and perpendicular to the edge of board 306 bounding each side of conducting contact pads 312 which are designed to receive corresponding conducting contact tail elements. In such a configuration, slots 311 may be used to provide alignment in the third dimension between a straddlemount connector 314 and printed circuit board 306. Solder pads 310 may be used to form solder joints 309 between spring fingers 304 and circuit board 306, as shown in FIG. 62. Although not illustrated, polarization of a straddlemount connector to a printed circuit board may be accomplished by providing individual slots and corresponding attachment clips with different respective widths and/or depth. FIG. 63A illustrates the circuit board embodiment of FIG. 63 in perspective view.

Figure 64:
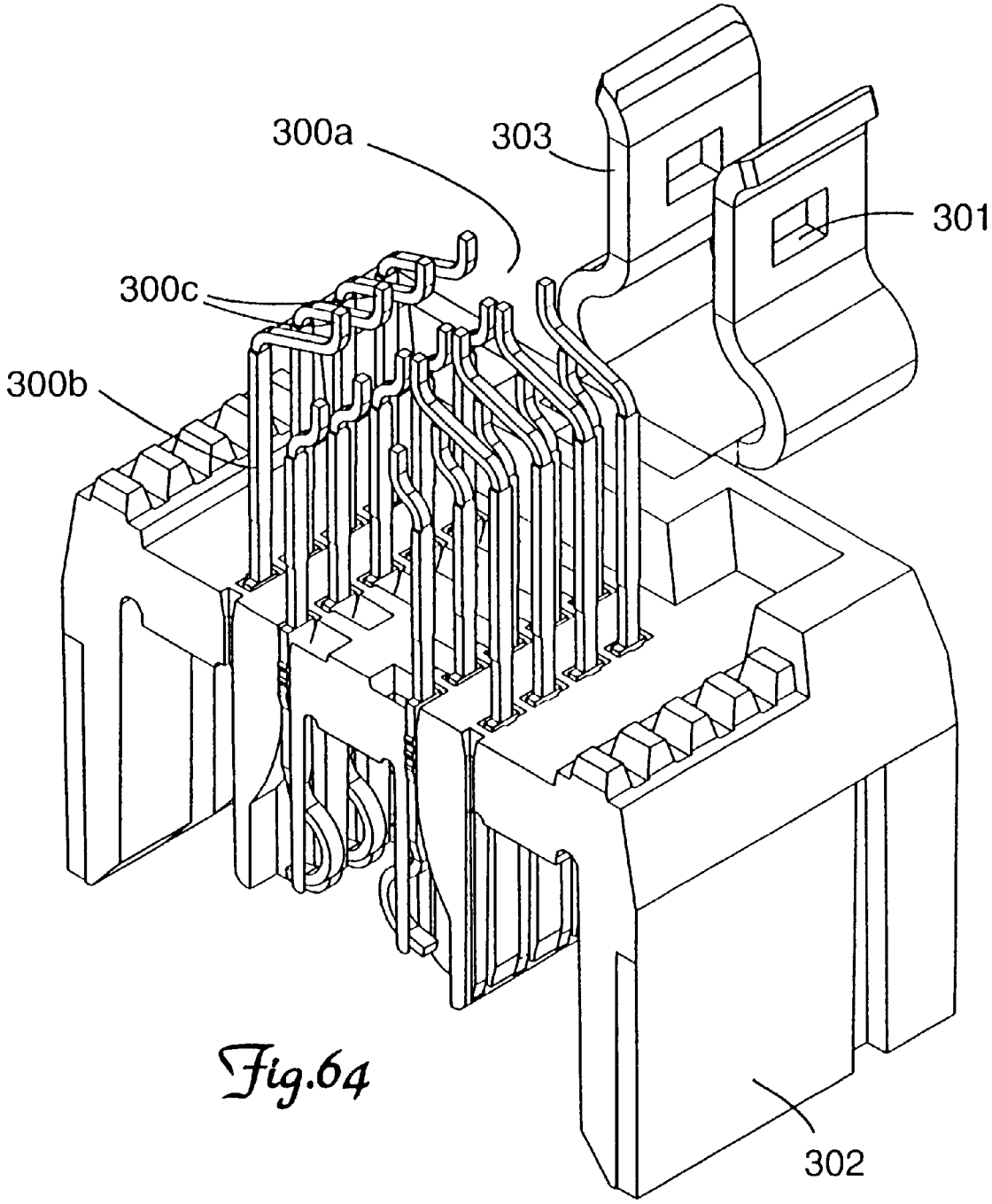
FIG. 64 is a perspective cross sectional view of a connector housing and an attached straddlemount attached clip according to another embodiment of the disclosed method and apparatus.
Figure 65:
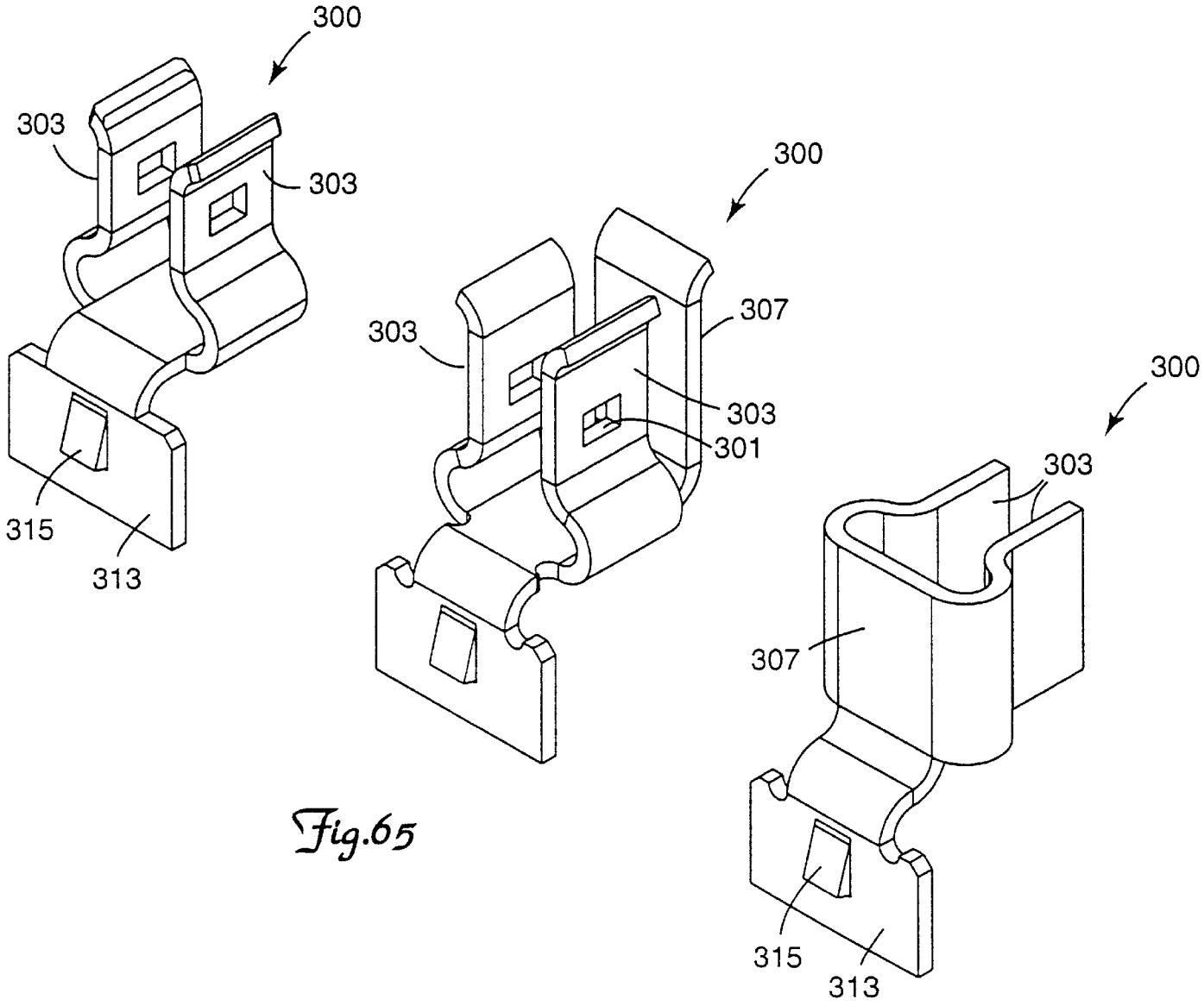
FIG. 65 shows perspective views of three possible straddle mount attachment clip embodiments of the disclosed method and apparatus.

FIGS. 64 and 65 illustrate other possible embodiments of the straddlemount attachment clip having relatively wide spring finger elements that may be soldered or otherwise secured to circuit board as previously described. As shown in FIG. 65, a positioning wall 307 designed to interact with a circuit board edge may be provided for providing alignment and orientation with a circuit board. In straddlemount clip embodiments shown in FIGS. 64 and 65, a groove or notch feature 301 may be provided for engaging a corresponding feature on a printed circuit board for purposes of alignment, or for creating an area for additional solder fill. Feature 301 may also be a raised area capable of receipt into a corresponding groove or notch within a circuit board for similar reasons.

Any other alignment features or combination of alignment features suitable for aligning a straddlemount clip to a circuit board may also be employed. In the alternative, no alignment features may be used. In addition, a straddlemount attachment clip may have any structure suitable for straddling a circuit board may be employed.

Typically, a straddlemount attachment clip according to the present embodiment is fabricated from a copper alloy (such as CA260) and plated with Tin/Lead over a Nickel base. Such a metal clip provides a dense and redundant retention mechanism. Straddlemount attachment clips of the disclosed method and apparatus may also be constructed of any other materials suitable for retaining a printed circuit board including, but not limited to metals, plastics, ceramics, or mixtures thereof. Particular metals which may be utilized include other phosphor bronzes, beryllium copper, nickel silvers, steels, etc.

Just a few of the many possible embodiments of straddlemount attachment clip 300 of the disclosed method and apparatus are depicted in FIGS. 64 and 65. In addition to these embodiments, any variation of U shape structure suitable for retaining a circuit board coupled with any means or structure suitable for attaching the U-shaped structure to a circuit board may be employed. Furthermore, a configuration having only one spring finger (or U-shape half) soldered or otherwise connected to a circuit board may also be used and/or a configuration having a narrow channel extending below the base surface 308 of a U channel 305 to provide additional spring action.

As illustrated in FIGS. 62, 63, and 63A, optional alignment notches 316 and lead in features 317 that assist and/or enable deflection of "U" shaped spring fingers 304 are typically provided by a routed edge of printed circuit board 306. However, a suitable lead in feature 318 may also be provided on tips of each spring finger 304.

Figure 66:
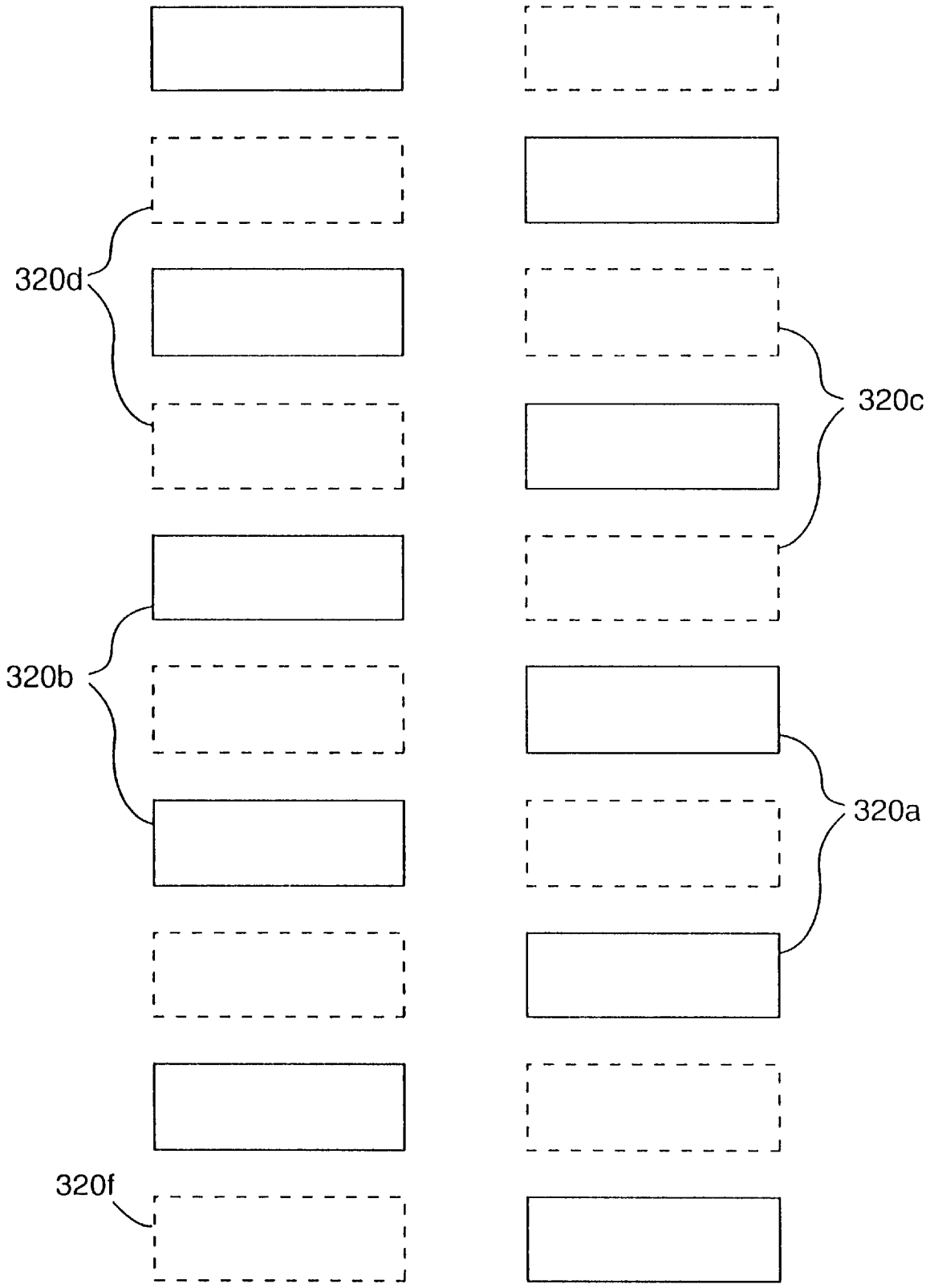
FIG. 66 is a horizontal cross sectional view of an alternating contact foot print configuration according to one straddle mount attachment embodiment of the disclosed method and apparatus.

Typically, contact footprints of a connector having a straddlemount attachment embodiment are symmetrically disposed on each side of a printed circuit board. However, an alternating contact footprint configuration for attachment to printed circuit boards may be created. FIG. 66 shows a side cross sectional view of an alternating contact footprint embodiment that may be employed, for example, with a connector having a four row contact element configuration. In FIG. 66, contact footprints 320*a* and 320*b* are located on the front side (or visible near side) of a circuit board 320*f* and are illustrated with solid lines. Contact footprints 320*c* and 320*d* are located on the back (or hidden far side) of the board 320*f*. This embodiment may be created, for example, by directing contacts typically found on a first side, row 1 to a row 2 position, and those typically found on row 2 to a row 1 position, thereby creating a pad arrangement as shown in FIG. 66.

Advantageously, the embodiment of FIG. 66 may enable better routing on multilayer boards, for example, by allowing through holes for connections to a straddlemount connector to be placed with relatively minimum difficulty. In other words, a circuit board may be configured such that conductive layers within the board are present only opposite those alternating pads where a connection is desired, thereby allowing a conductive hole to be placed through the board opposite any given pad without interfering with conductive layers selectively connected to other pads. Therefore, the need for drilling selectively shallow holes opposite solder pads to avoid undesired connections is potentially eliminated.

Finally, as shown in FIGS. 61, 62, 64 and 65, straddlemount clip embodiments of the disclosed method and apparatus may be configured to be used in the same connector housing embodiments as are surface mount or through-the-board clips. One way this is made possible is by using attachment ears 313 with retention features 315. In one embodiment, attachment ears 313 are sized to be slidably received in corresponding recesses 319 disposed in connector housing 302, and retention feature 315 sized to be securely received in a corresponding notched recess in housing 302 (shown as features 16*h* and 26*h* in FIGS. 1A and 1B respectively). A wide variety of other retaining mechanisms including, for example, surface mount retaining devices and through-the-board anchoring devices may also be configured with attachment ear 313 and/or retention feature 315 to allow the same connector housing design to be used interchangeably with a variety of different devices. It will also be understood with benefit of the present disclosure that other designs of attachment ears 313, retention features 315, and recesses 319 may be employed to secure retaining devices to a connector housing, as well as entirely different designs, such as "snap in" anchors, etc.

Figure 68:
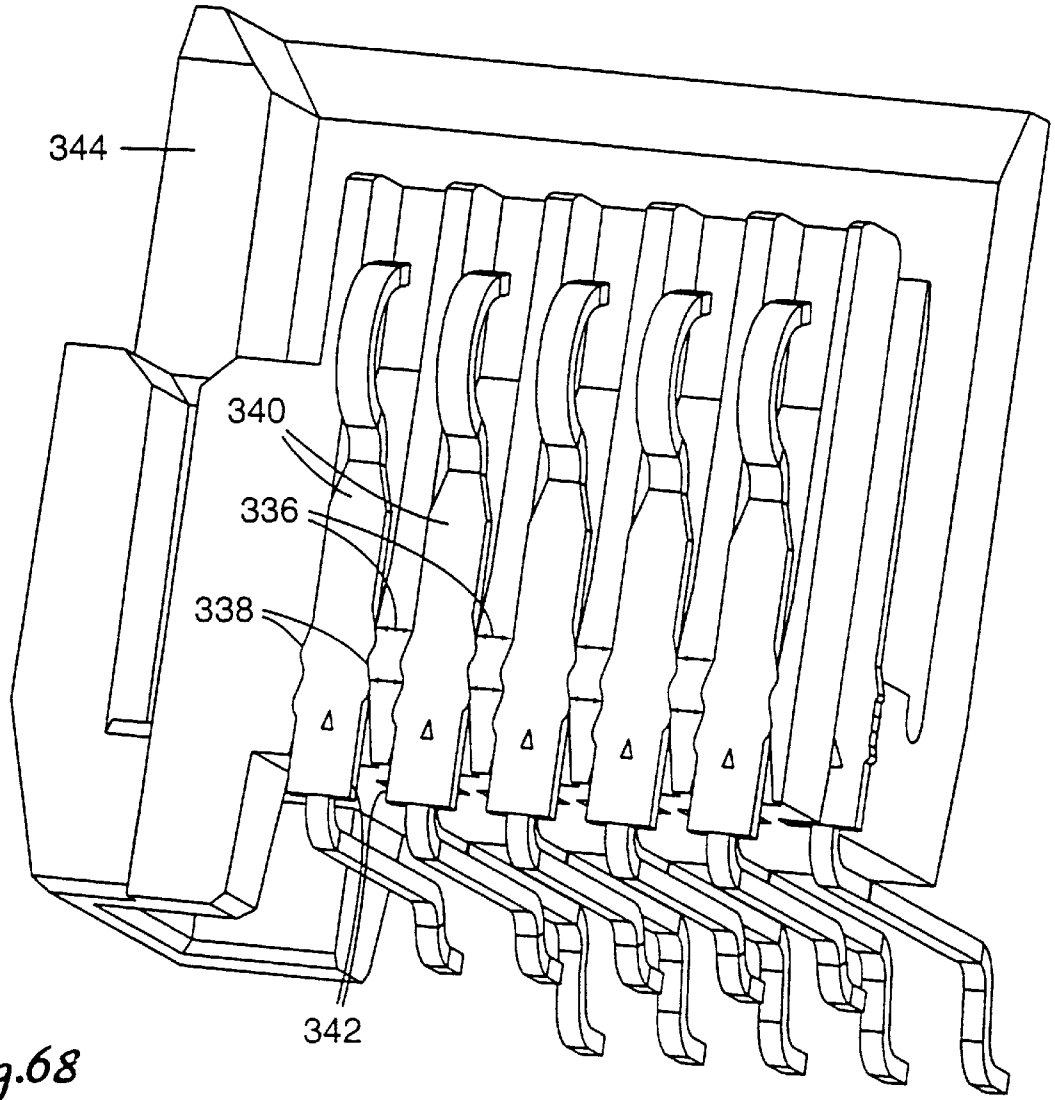
FIG. 68 is an enlarged perspective cross sectional view of a connector housing having contact elements with alternating contact retention features according to one embodiment of the disclosed method and apparatus.
Figure 68A:
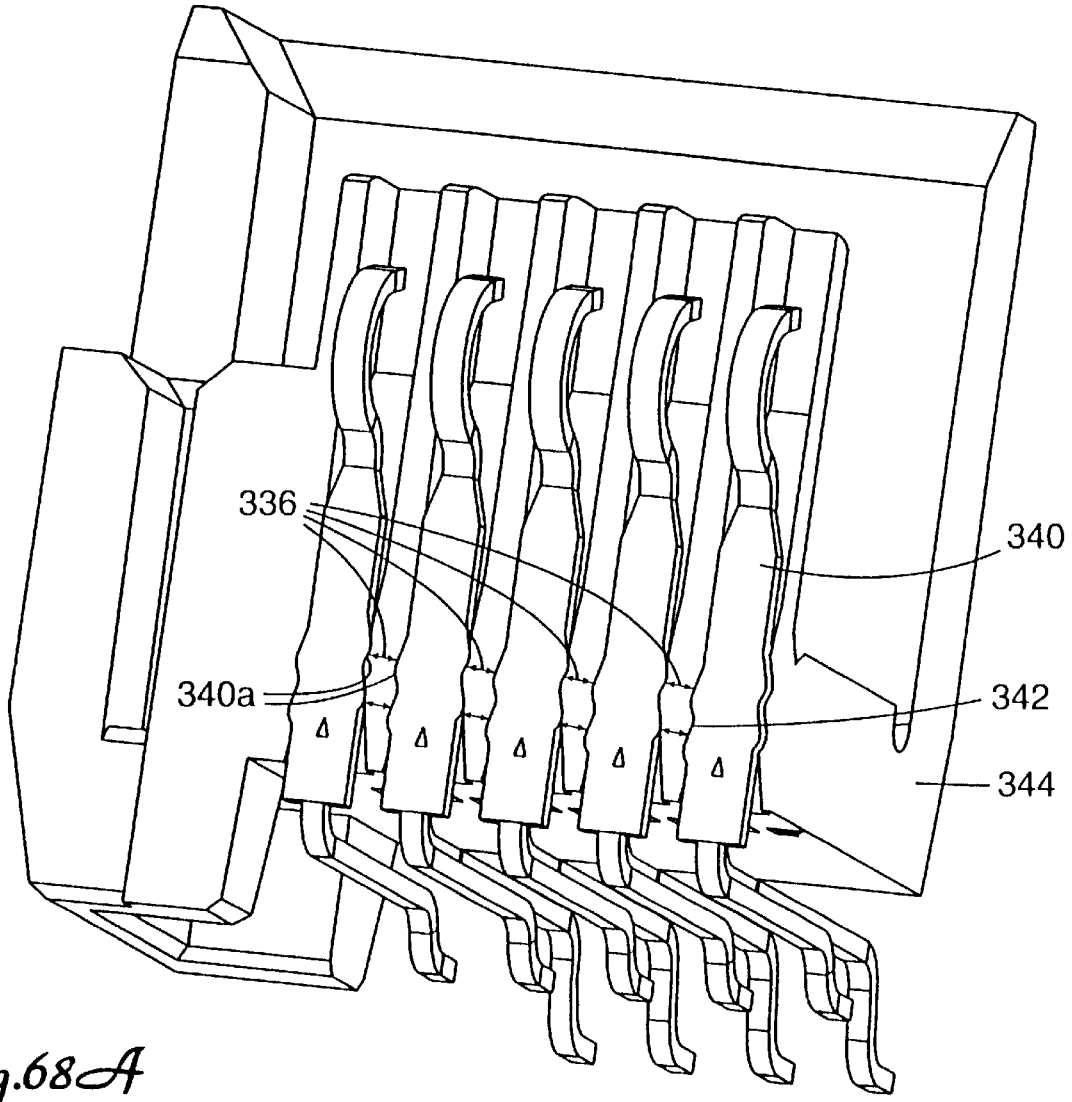
FIG. 68A is an enlarged perspective cross sectional view of a connector housing having contact elements with conventional contact retention features according to one embodiment of the disclosed method and apparatus.

Contact Retention Features Contact elements are typically anchored within a connector housing with retention features that are configured in the shape of "bumps" or "barbs." As shown in FIG. 68A, conventional retention features are typically formed into the sides or edges of a contact 340 at a location near its base (in this case, a "two bump" arrangement). These retention features are designed for insertion into receiving pockets 342 of insulative housing 344 of a connector component. As further illustrated in FIG. 68A, conventional retention features are typically configured with a symmetrical geometry, so that when a contact 340 is inserted into a connector housing 344, tips 340*a* of each bump or barb are typically aligned with bump or barb tips 340*a* of a neighboring contact element. As a result, a reduced distance or clearance 336 typically exists between neighboring elements at a point between opposing retention feature tips 340*a,* as shown in FIG. 68A. When the connector housing material between conventional retention feature tips 340*a* is subjected to stress induced by the mechanical interference between a contact 340 and insulative housing 344, undesired cracks may be induced through insulating housing 344. Such cracks often occur in a comer region due to stress concentration factors and possible knit line area.

Figure 69:
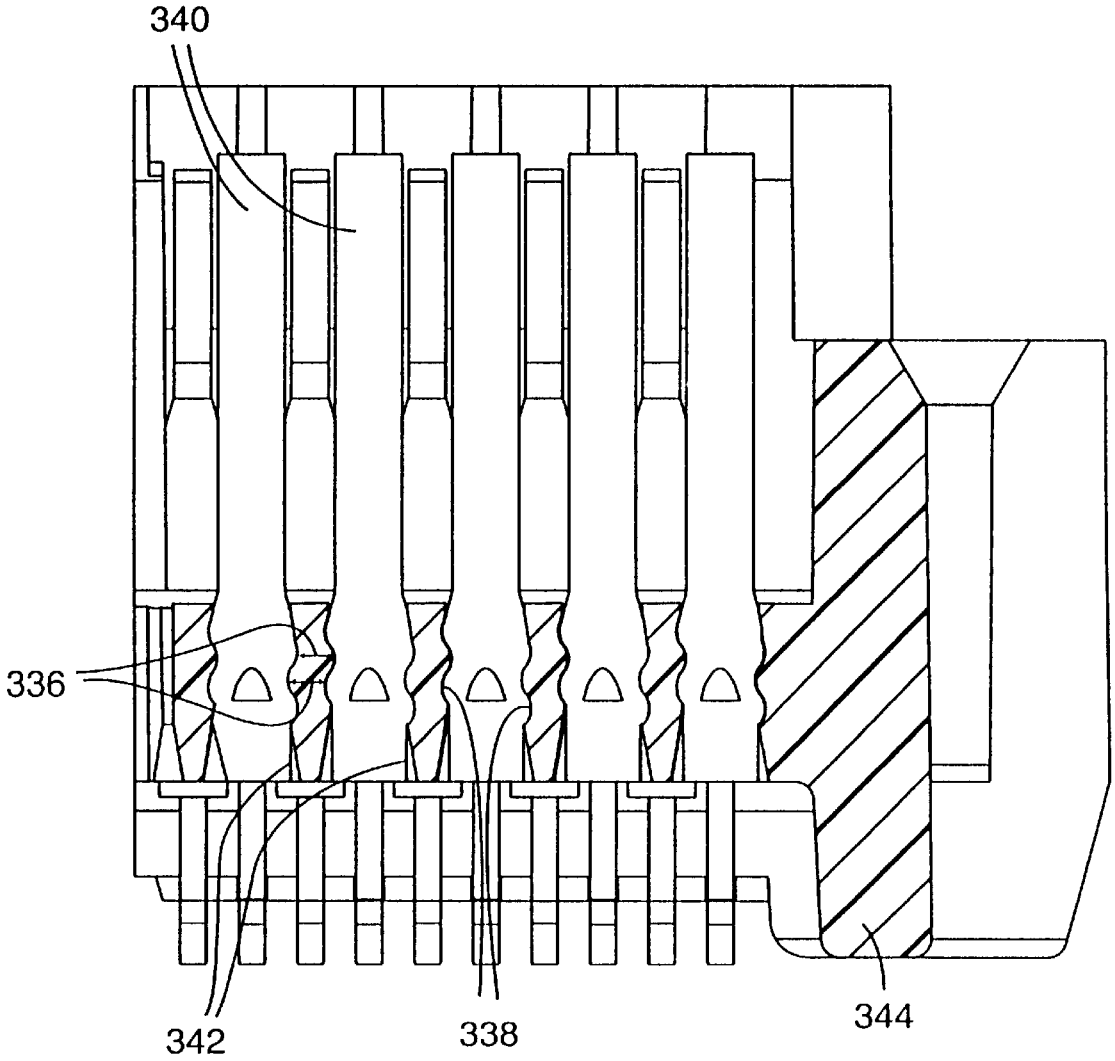
FIG. 69 is a vertical cross sectional view of a connector housing having contact elements with alternating contact retention features according to one embodiment of the disclosed method and apparatus.

In a further embodiment of the disclosed method and apparatus illustrated in FIG. 67, location of retention bump features 330 on one side of a conducting element 334 may be altered so that they are not in a symmetrical position and/or directly opposing condition with respect to corresponding features 332 on an opposite edge of conducting element 334 (such a contact retention feature geometry may be referred to as "non-aligned"). FIG. 67 illustrates just one example of such a configuration and may be referred to as a "staggered two bump" embodiment. As shown in FIGS. 68 and 69, by so altering retention bump features, a larger and a more uniform distance 336 between pairs of conducting element edges 338 may be achieved. In some cases, the larger and more uniform spacing between contacts 340 provided by a non-aligned contact retention feature geometry may be used to achieve a reduction in "cross talk" between separate contact elements 340 of a product. In addition, non-aligned retention feature designs of the present embodiment may serve to minimize the occurrence of cracking in receiving pockets 342 of insulative housing 344 by distributing stress induced with the intentional interference condition created when a conducting contact element is inserted. Absence of cracking directly improves the retention of conducting elements to the insulative housing since three dimensional constraints are maintained.

In addition to those features described above, a non-aligned retention feature embodiment provides superior retention of conducting elements to an insulative housing due to an increased spring function created in the total design. For example, in the case of a polymer based connector housing, not only is some of the deformed polymer material in the elastic region, but there is also an additional spring function created by the beam segment deflected between the features or bumps on neighboring contacts. This deflection changes the stress state in the polymer material so that the resultant interaction force between the insulative housing and the retention bump area of the conducting elements exists for a longer period of time given the same stress and temperature exposure. This enables the use of a larger projection or multiple projections for the features or bumps on conducting elements which will increase the retention force between conducting elements and an insulative housing. Retention forces may also be increased by displacement of insulative housing material by a bump retention feature into a neighboring and corresponding recess.

Rotated Contacts

Figure 70:
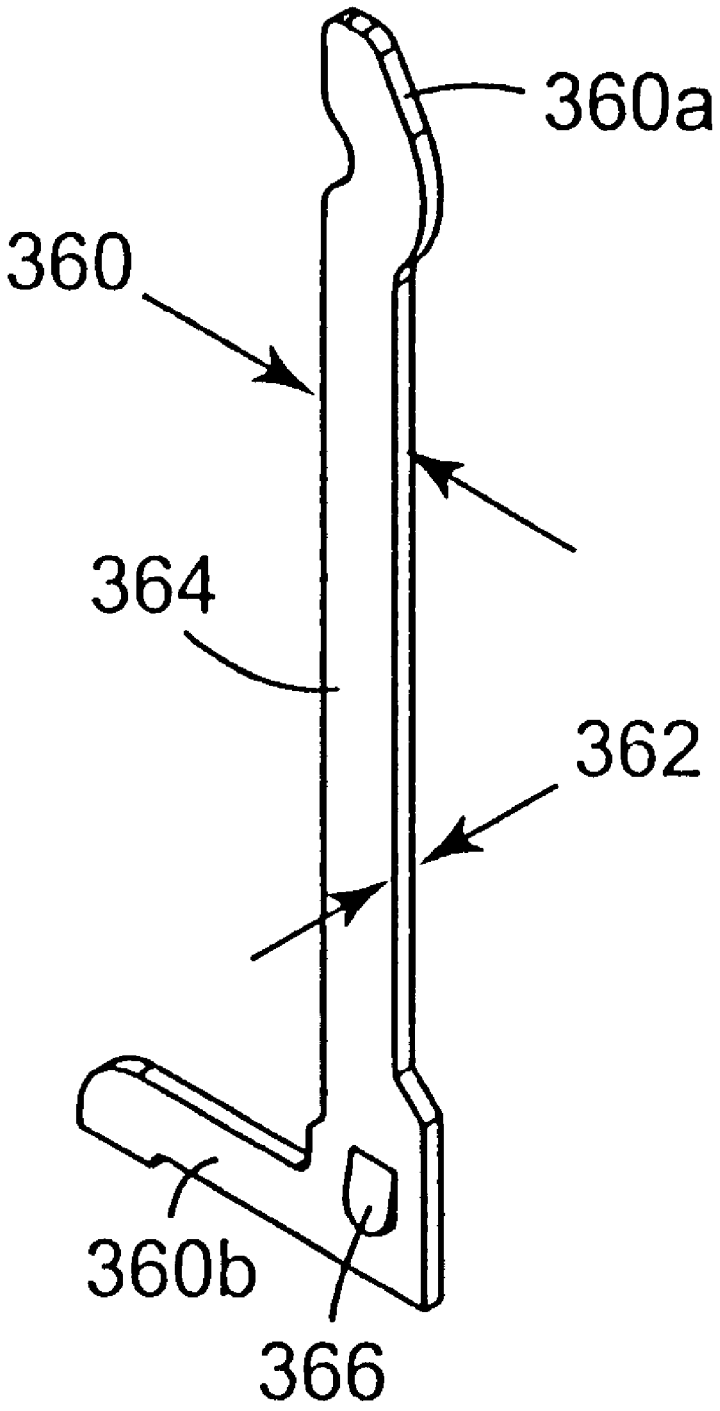
FIG. 70 is a perspective view of a rotated contact element according to one embodiment of the disclosed method and apparatus.
Figure 71:
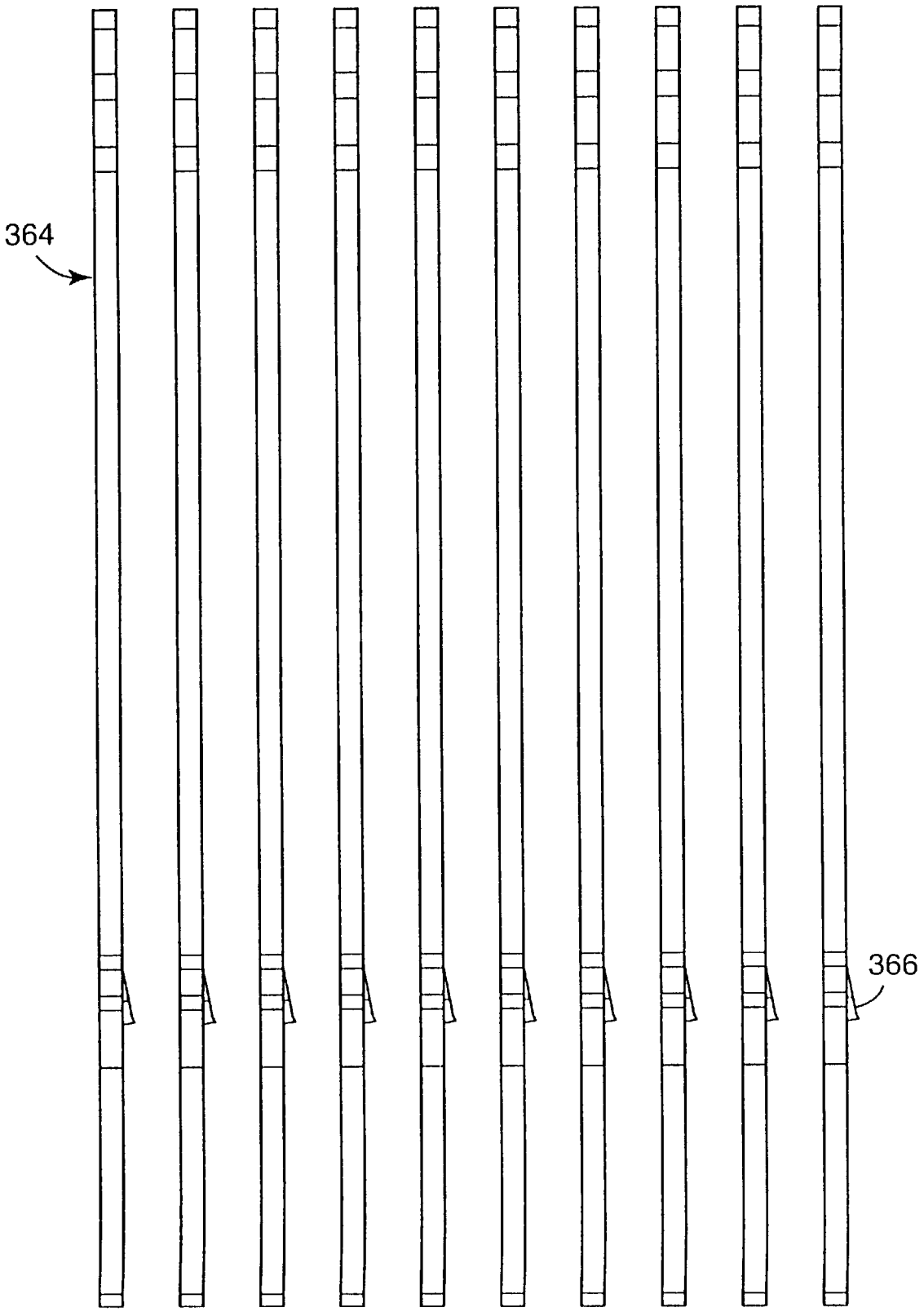
FIG. 71 is a side view showing spatial positioning of rotated contacts according to one embodiment of the disclosed method and apparatus.

As shown in FIGS. 70 and 71, a contact configuration may be rotated 90 degrees from a typical ribbon contact configuration, such as that shown in FIG. 67. As shown in FIG. 70, a contact may also be configured to have a free end 360*a* and a tail 360*b*. As shown in FIG. 70, in this embodiment, thickness 360 of a contact 364 is typically many times that of the contact width 362. This is because a rotated contact structure 364 is typically stamped or blanked out of a sheet of material, such that the thickness of the sheet becomes the width of the contact. Advantageously, then, a contact structure may have its entire configuration defined or determined by a blanking or stamping operation rather than a bending operation, as typically employed with conventional contacts. In the embodiment of FIGS. 70 and 71, there exists a retention feature or bump 366 projecting from a base portion of each contact 364 which may be incorporated for securing a contact 364 of the present embodiment to an insulating housing. In this capacity, retention feature 366 is designed to serve to maintain retention of relatively thin rotated contacts within a connector housing contact cavity that is typically relatively wider than the rotated contact due to typical connector housing manufacturing tolerance ranges. These manufacturing ranges may produce a connector receiving pocket or cavity wider than a thin contact body portion in some cases, due to molding operations limitations. In this case, retention feature 366 is designed to push or deflect a contact against the cavity wall to secure the contact within the cavity.

Figure 72:
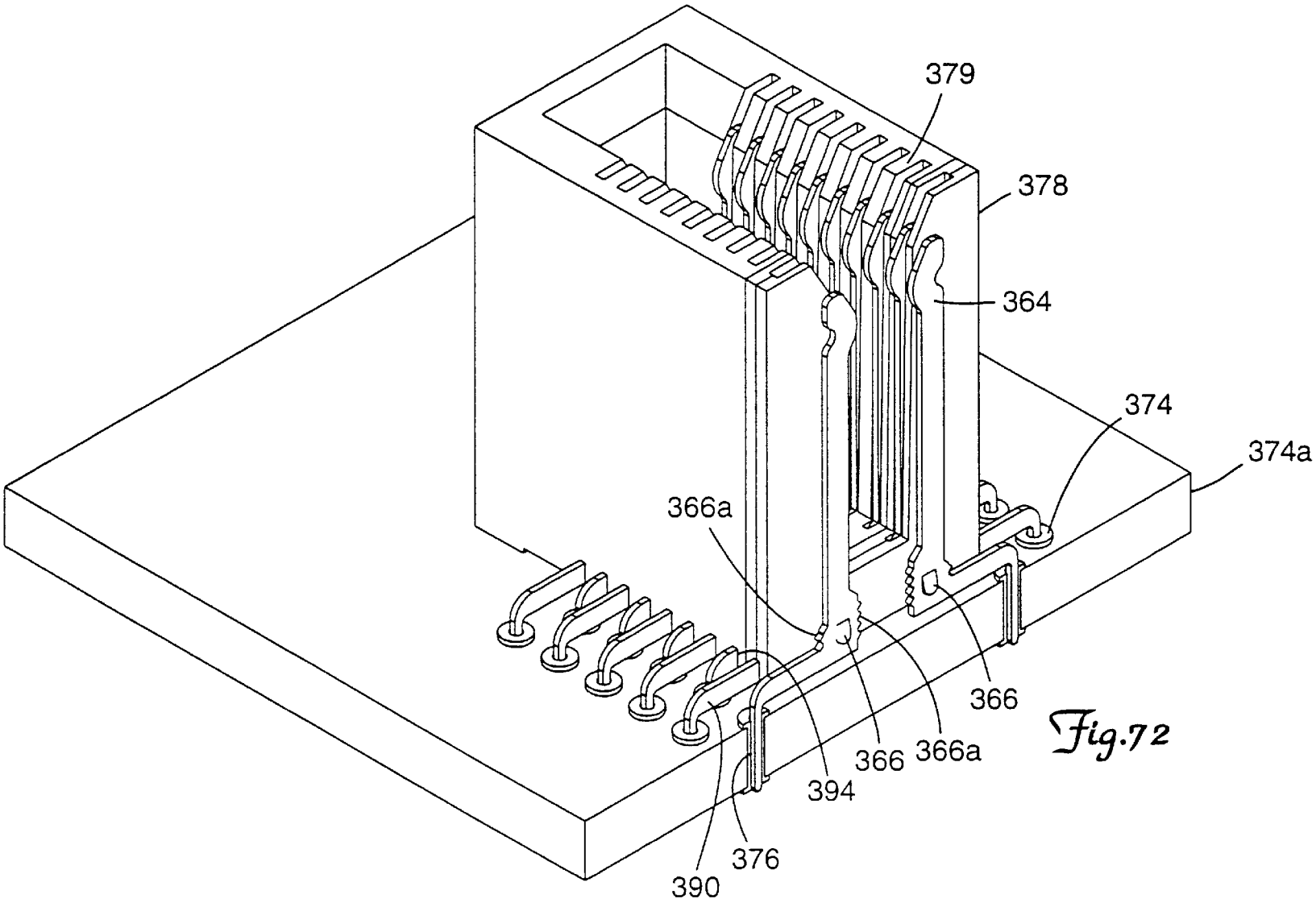
FIG. 72 is a perspective cross sectional view of a connector housing having rotated contacts and disposed on a printed circuit board according to one plated through hole embodiment of the disclosed method and apparatus.

In the practice of this embodiment, alternating or conventional retention features or bumps may be employed on one or more edges. FIG. 72 illustrates contacts 364 of this embodiment used in one of many possible plated through hole configurations and having retention features 366. Also provided are edge retention features 366*a* which provide a mechanical interference with the receiving pocket of connection housing 378. Because of a relatively large thickness/width ratio, rotated contacts 364 of the present embodiment are typically mechanically stronger than conventional ribbon contacts used in a similar application. Therefore, reaction forces due to contact mating are typically absorbed and transferred through a rotated contact body rather than being transferred to a connector housing primarily at a single point (a contact base), as is typical with conventional ribbon contacts. Such a force is typically transferred by a rotated contact to substantially all adjacent areas of a connector housing, as well as to other components, such as a circuit board 374*a* to which a rotated contact may be connected. As a result, potential for connector housing "creep" as described above may be greatly reduced.

In addition, a rotated contact provides increased resilience and strength per unit length over a conventional ribbon contact, characteristics particularly advantageous for miniaturized components. A rotated contact may allow an increase in connector configuration linear pitch over conventional contacts due to its relatively thin width. This may allow an increase in connector density without decreasing width of connector contact separation walls 379. This is advantageous because practical limitations in connector molding technology dictates a minimum contact separation wall thickness (i.e.—from about 5 mils to about 10 mils), and therefore limits connector density increases achievable by reducing separation wall thickness. Therefore benefits of a rotated contact embodiment of the disclosed method and apparatus may be realized with or without a contact support structure.

Figure 73:
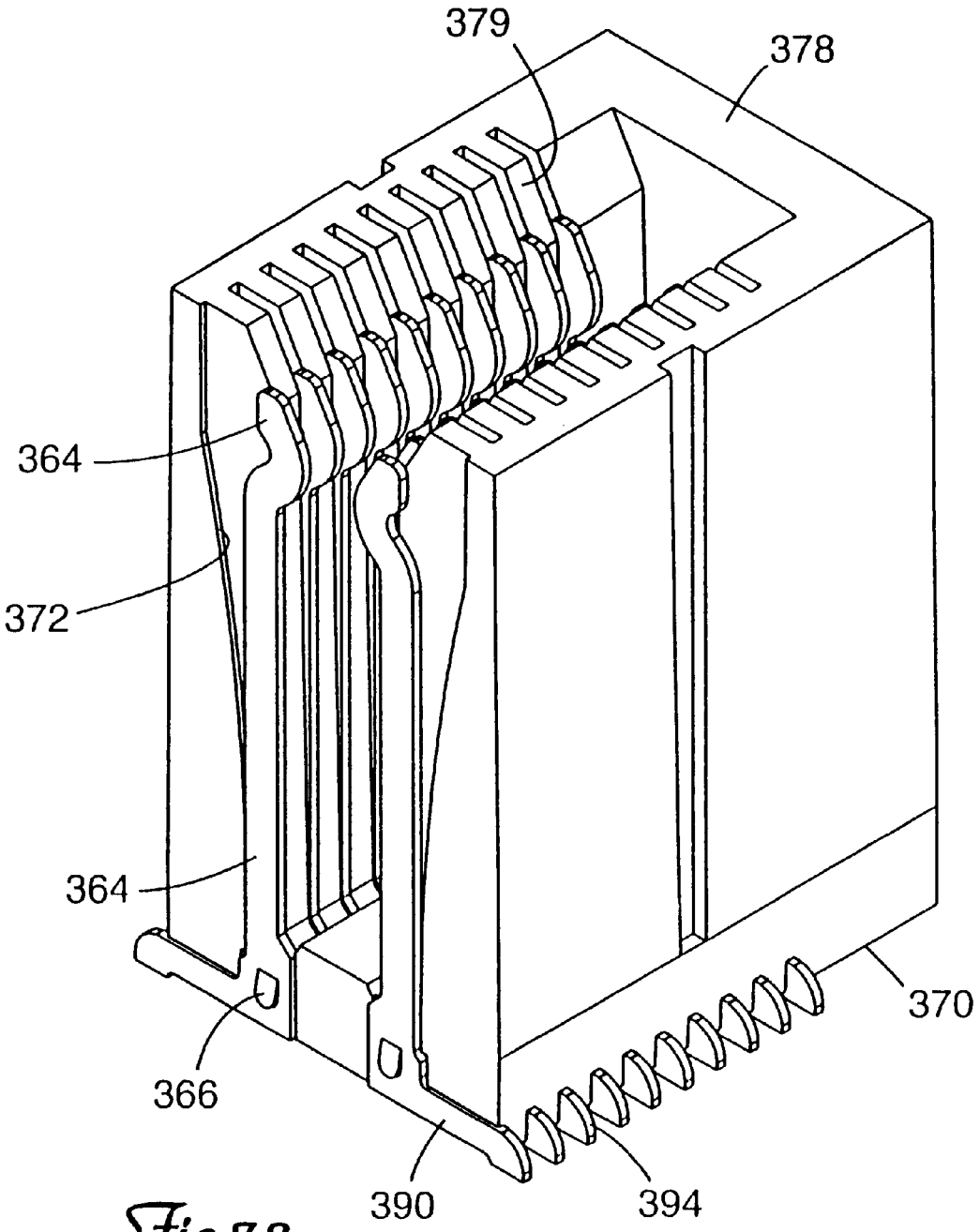
FIG. 73 is a perspective cross sectional view of a connector housing having rotated contacts according to one embodiment of the disclosed method and apparatus.

Referring now to FIG. 73, a rotated contact 364 as illustrated in FIG. 70 is shown inserted into a connector housing 370 having an optional support structure 372 as previously described, as well as contact separation walls 379, supporting rotated contacts 364 on three sides. This three sided support prevents a contact 364 from bending or twisting in its weaker width direction. In this and similar embodiments, a support structure interacts and operates with a rotated contact in a substantially similar manner as described above for ribbon-type contacts. However, an additional advantage may be realized when a support structure is employed with a rotated contact used in the card edge and two piece connector systems previously discussed. For example, as shown in FIG. 12 and 72, a rotated contact structure 364 produces a reaction force on a corresponding surface mount 374 of plated through hole portions 376 when the contact structure 364 is deflected during connector mating. This reaction force creates additional security and protection of solder joints, and protects contact retention area in the housing. When a rotated contact structure is deflected, for example against a contact support structure 378*a* of a connector housing 378, the housing may be deflected outward. This deflection of the housing will typically force notch portions 394 of connector housing 378 downward against rotated contact tails 390, in turn causing contact tails 390 to exert a downward force on printed circuit board connection features 374. Thus solder connections are placed in compression, and contact with solder pads is reinforced. In addition, increased resilience of a rotated contacts coupled with transfer of force through a rotated contact to compressional force at solder contacts may reduce forces acting on sides of a connector housing and therefore allow a more narrow connector housing. Also shown is a plated through hole version of a connector having rotated contact structures 364 in FIG. 72.

It should be noted that due to increased resilience of rotated contact elements, and the resulting relatively large contact normal force produced when rotated contacts are employed with a contact support structure, it may be desirable to employ vertically staggered rotated contacts with contact support structure embodiments in order to reduce insertion forces as previously described. Such an embodiment is shown in FIGS. 10–12.

In the practice of the present embodiment, when contacts are deflected, it is desirable, but not necessary to have each contact completely insulated by a connector housing so that no contact is exposed to its neighboring contacts or to any contact within the row on the separable end of the contacts.

Figure 74:
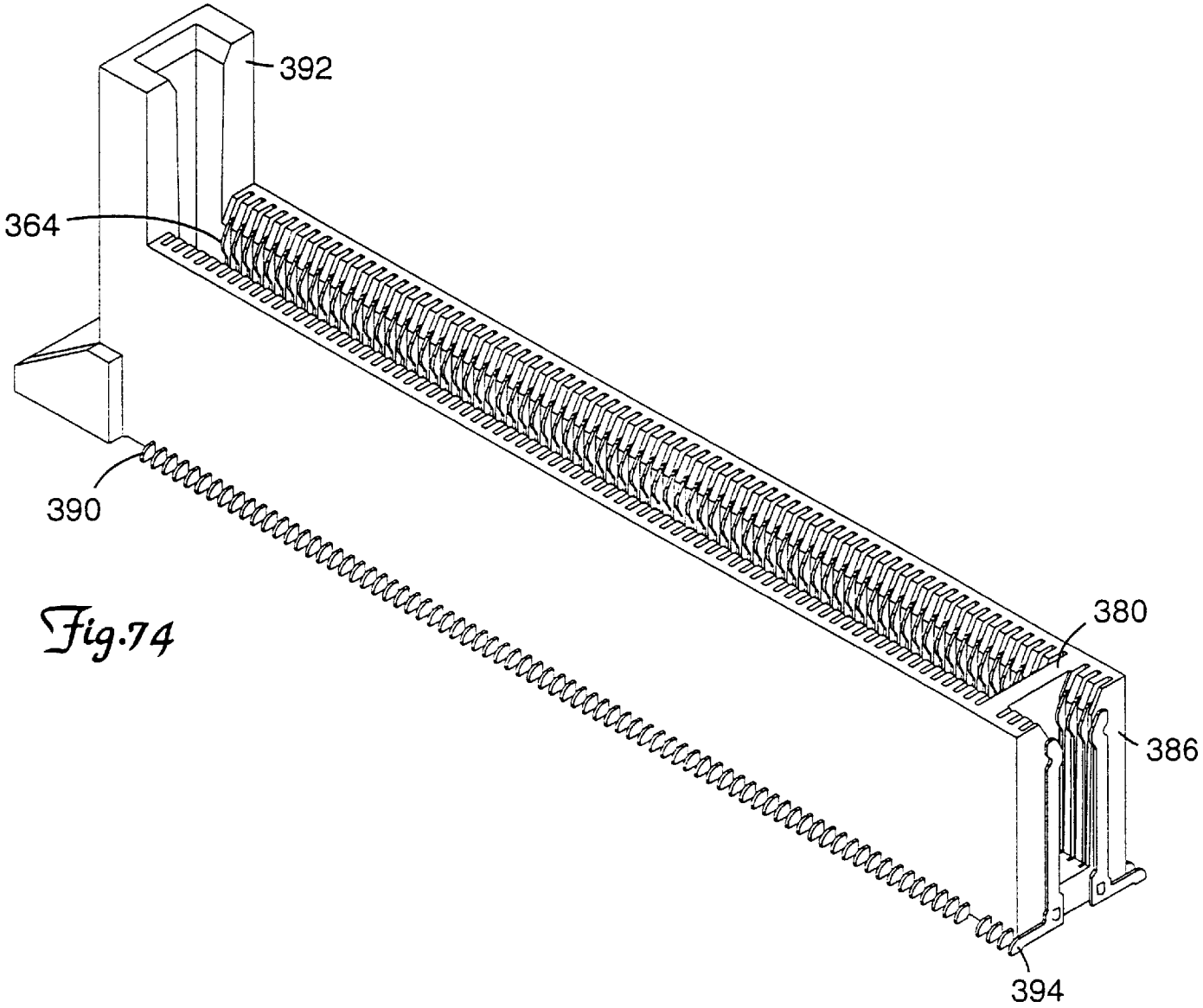
FIG. 74 is a perspective cross sectional view of a card edge connector housing having rotated contacts according to one embodiment of the disclosed method and apparatus.
Figure 75:
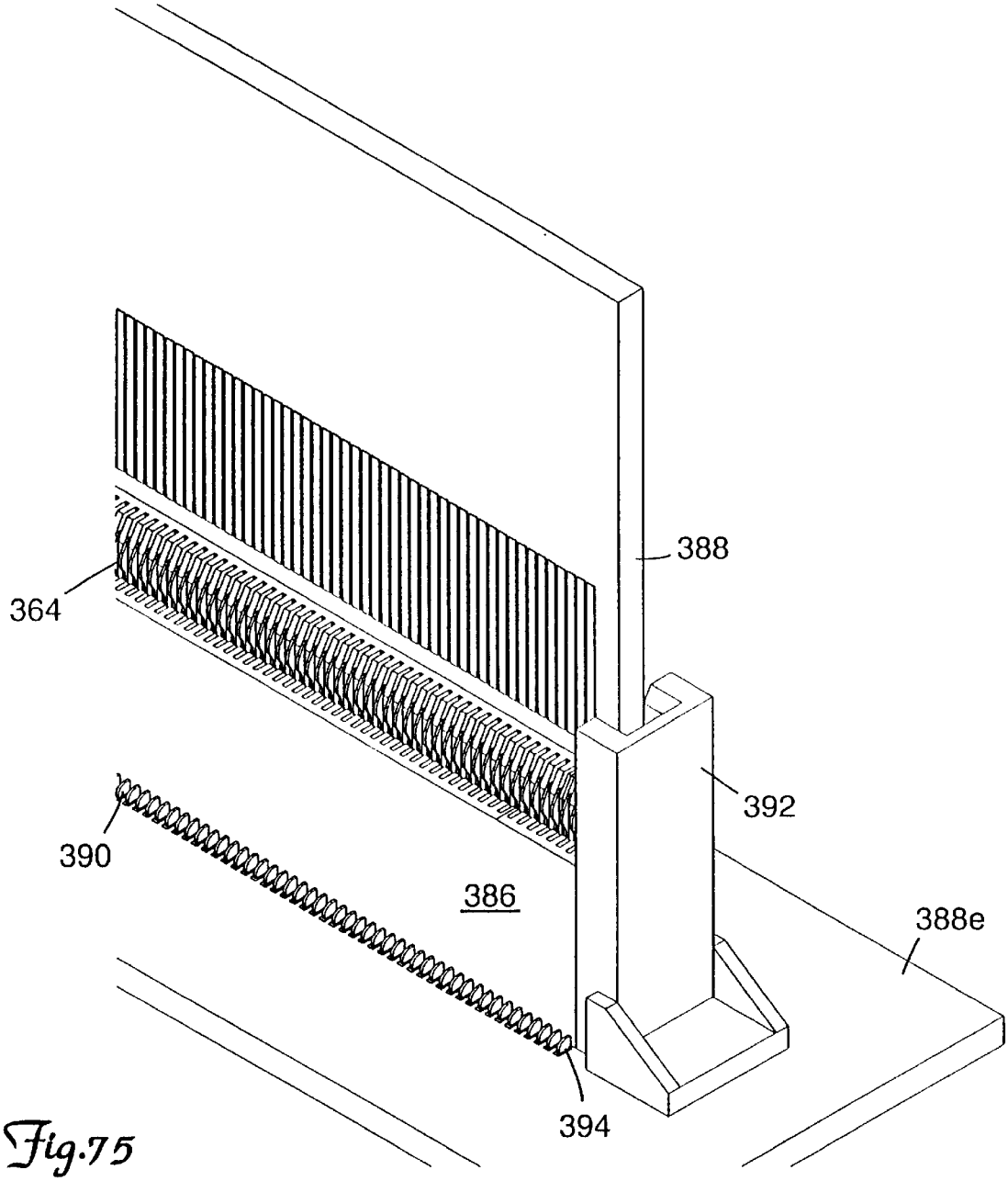
FIG. 75 is a perspective view of a card edge connector component having rotated contacts and a card edge according to one embodiment of the disclosed method and apparatus with the same disposed in position for interconnection.

In the illustrated embodiments, a card edge configuration is presented, however it will be understood with benefit of the present disclosure that the system described herein may also be used with two piece connector configurations as well. In addition, it will also be understood that there is no requirement that circuit boards in a card edge configuration be perpendicular to each other. For example, boards may be configured at any suitable angle including, but not limited to, at 45 degrees or parallel to one another. In other embodiments of the disclosed method and apparatus, card edge tail portions 38 and 40 could be staggered in a surface mount configuration as shown in FIGS. 10–12. Although not required, a connector housing of a card edge embodiment will typically have a center latch or polarization portion 380 as shown in FIG. 74. A card edge will also typically have an ear portion 392 for retention of a housing 386 to a printed circuit board 388 as shown in FIG. 75. This feature may also serve for identification of a seating plane for tail portions 390 and for card guide/stabilization purposes as shown in FIGS. 73–75. FIG. 75 also shows a printed circuit board 388*e* for solder attachment and a separating board 388 used in card edge systems.

FIGS. 72–75 also show notches 394 to which contact tail portion 390 is retained in alignment. Positioning of a rotated contact in notch portion 394 is somewhat different than positioning of ribbon type contacts into the notch portion embodiments discussed previously. "Planarization" of contact tails relates to uniformity of tail positioning in respect to a connector housing. Typically, contact tails are "planarized" to a position between about 0 and about 4 mils below a connector housing seating plane. Advantageously, in the case of rotated contacts planarization may be accomplished by simultaneously seating all rotated contact structures 364 at one time with a flat plate configuration, rather than on an individual contact by contact basis, as is typically done when seating conventional ribbon type contacts. In this way, a gap (similar to that discussed with reference to FIGS. 36A–D) is typically created in each notch area between each rotated contact 364 and insulated housing 386. This gap may exist because rigidity of rotated contact structures typically create or supply uniform contact tail planarization, while differences or inconsistencies in notch dimensions due to molding techniques may cause formation of gaps between the substantially uniform contact tails and the non-uniform notch surfaces. Advantageously, the increased rigidity of a rotated contact coupled with its stamped tail geometry allows more uniform seating with solder pads over conventional ribbon contact tails which may rely on several bending operations to produce a tail geometry necessary for mating with solder pads. These conventional contact bending operations may induce variations from contact to contact, producing contact tails that do not mate uniformly with solder pads.

Finally, due to increased resilience, it should be noted that rotated contacts may need to be "sized down", tapered, lengthened, or otherwise altered geometrically or compositionally to achieve a similar deflection force as a conventional ribbon contacts.

Power Contacts

Figure 76:
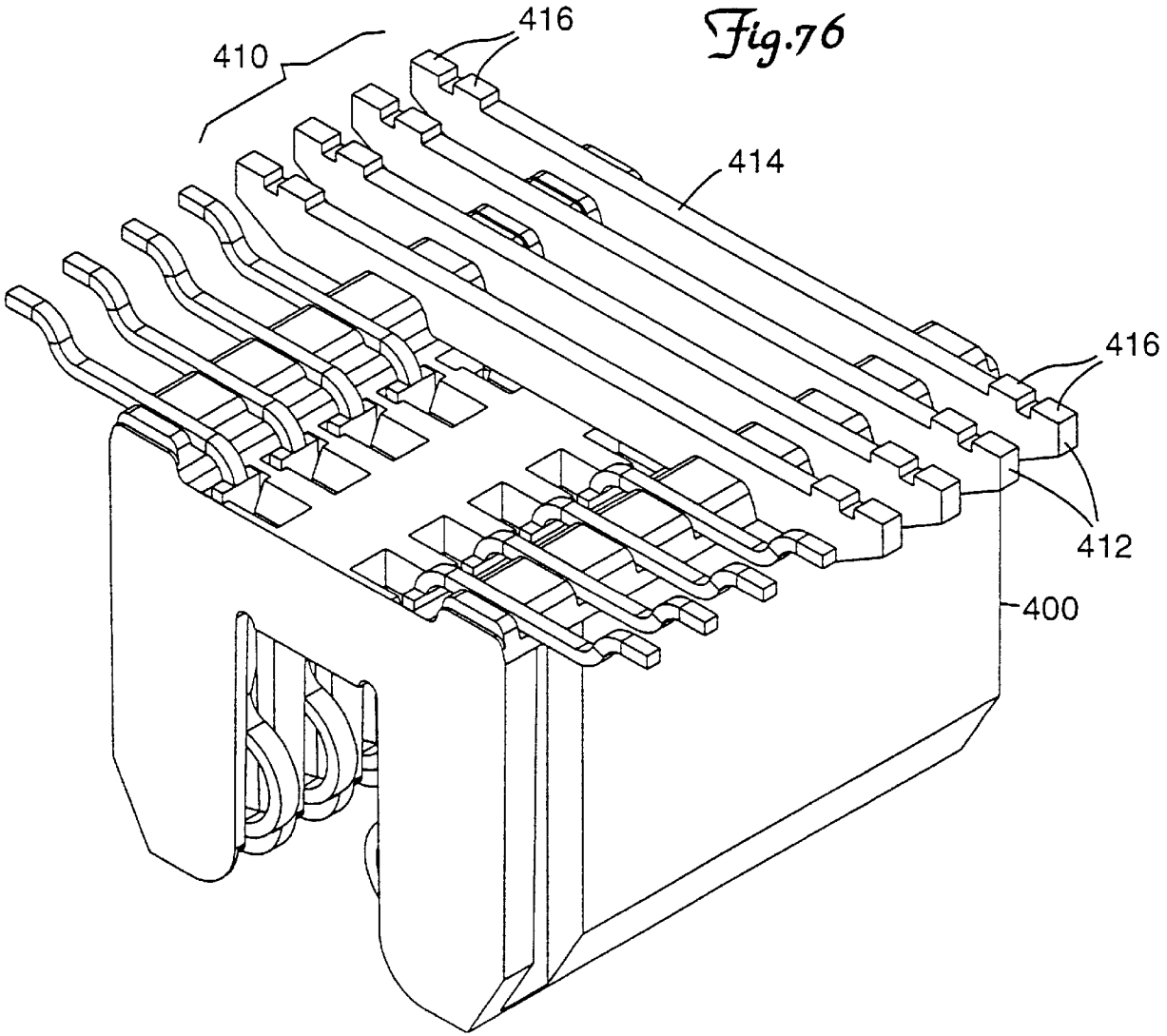
FIG. 76 is a perspective cross sectional view of a connector housing having power contacts with a "T-shaped" based and surface mount foot portions according to one embodiment of the disclosed method and apparatus.

In accordance with a further embodiment of the disclosed method and apparatus, FIG. 76 shows a bottom view of a card edge connector 400 having an included power contact portion 410. In this embodiment, each power contact 412 has a "T-shaped" base 414 and surface mount foot portions 416. Among other things, this embodiment is designed to provide an integrated low inductance means of power delivery to allow a dense transfer of power integral to a signal portion of an interconnection system in both card edge and two piece embodiments. In the practice of this embodiment, this configuration helps minimize metal stress relaxation phenomena and/or polymer/plastic creep which occur with stress, temperature, and time. It also provides a substantial cross section for transfer of electrical power with low inductance.

As shown in FIG. 76, one power contact embodiment has a separated and stepped surface mount foot portion 416 on each side of its T-shaped base 414. These separate steps 416 provide an increased heel area which enables a stronger and more reliable solder connection. The multiple steps 416 provide for multiple solder joints, thereby providing joint redundancy should one or more joints fail. Although not illustrated, other foot portion configurations may be employed with the T-shaped contact of the present embodiment including, but not limited to, those having fewer, greater, or no separate step sections, and those providing a single or multiple contact areas across an entire base of a power contact. In addition, a T-shaped contact of the present embodiment may be used in a plated through hole configuration, which is not shown.

Figure 77:
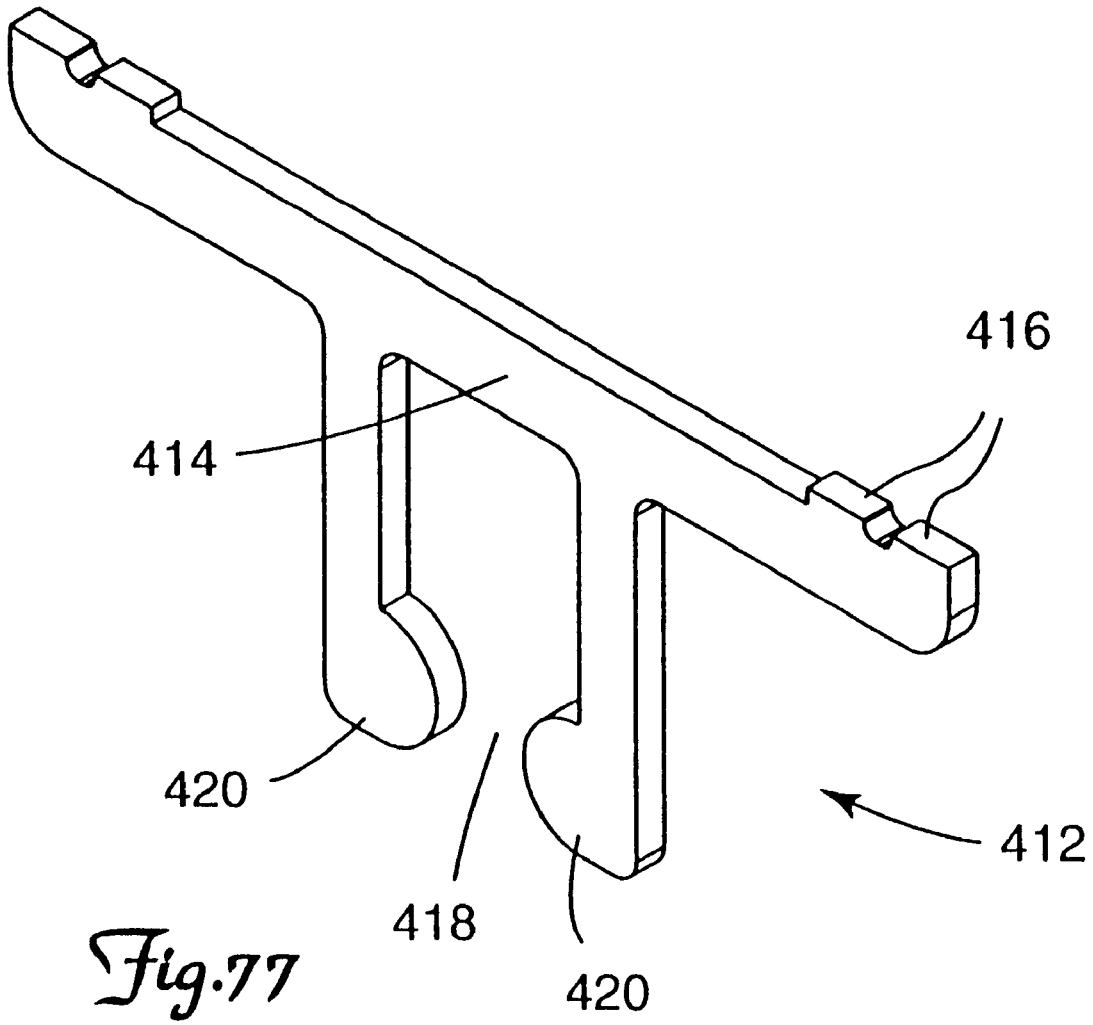
FIG. 77 is a perspective view of a "T-shaped" contact according to one embodiment of the disclosed method and apparatus.

FIG. 77 illustrates one embodiment of a T-shaped contact 412 of the disclosed method and apparatus having a "U-shaped" or tuning fork type channel 418 on a separable mating side of the contact for mating with a printed circuit board. U-shaped channel 418 is defined by spring fingers 420. Because spring fingers 420 are typically stamped from one piece of material, a card receiving gap or channel 418 of more precise dimensions than conventional two piece contacts may be created. In addition, as with rotated contact embodiments, typical thickness/width ratios provided by a stamped T-shaped contact of the disclosed method and apparatus absorbs substantially all contact mating stress, thereby limiting stress relaxation phenomenon to the contact material, rather than less rigid and resilient connector housing material.

Figure 78:
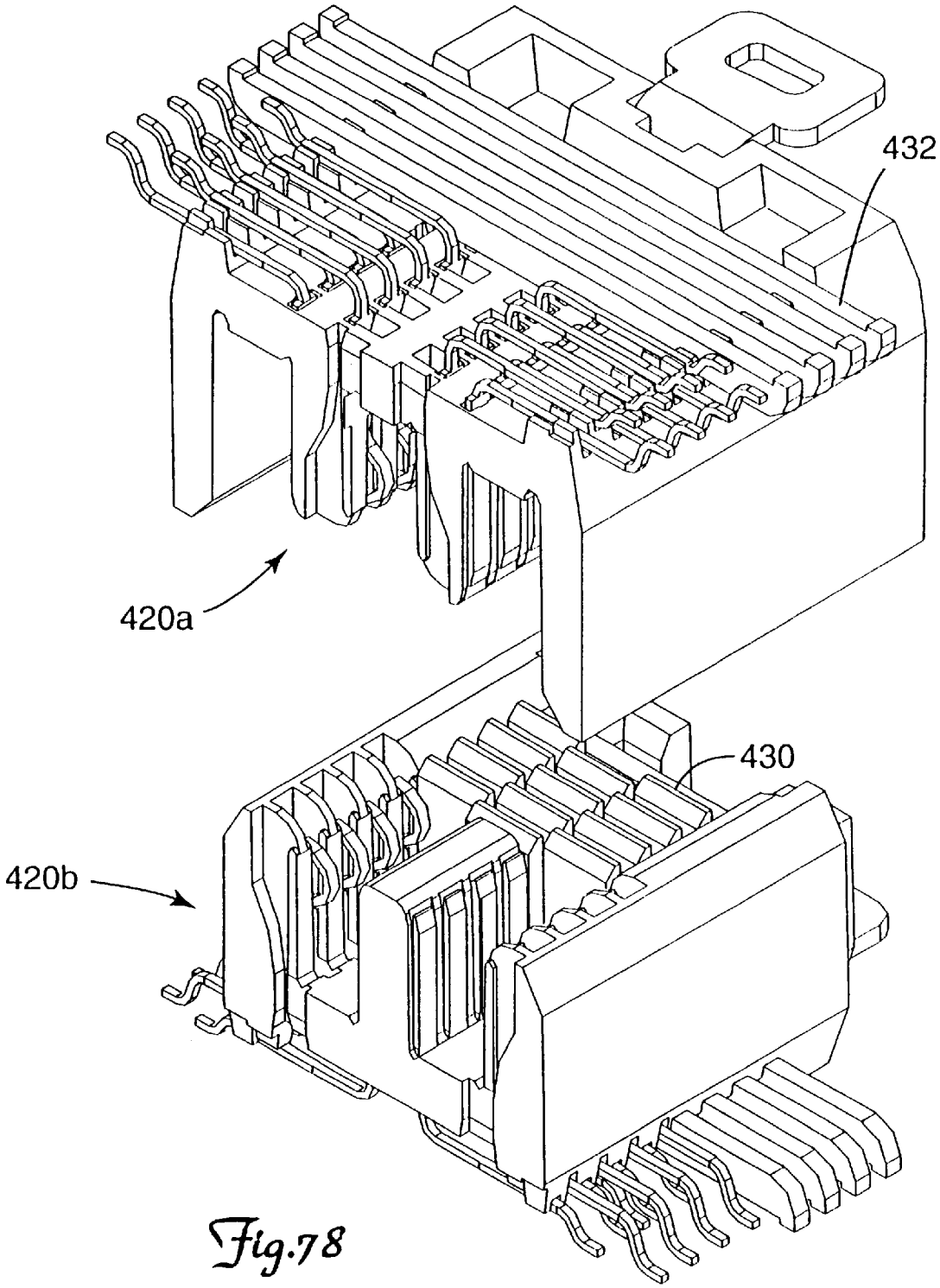
FIG. 78 is a perspective cross sectional view of a two piece electrical interconnection having a plug and socket with "T-shaped" power contacts according to one embodiment of the disclosed method and apparatus with the same disposed in position for interconnection.
Figure 79:
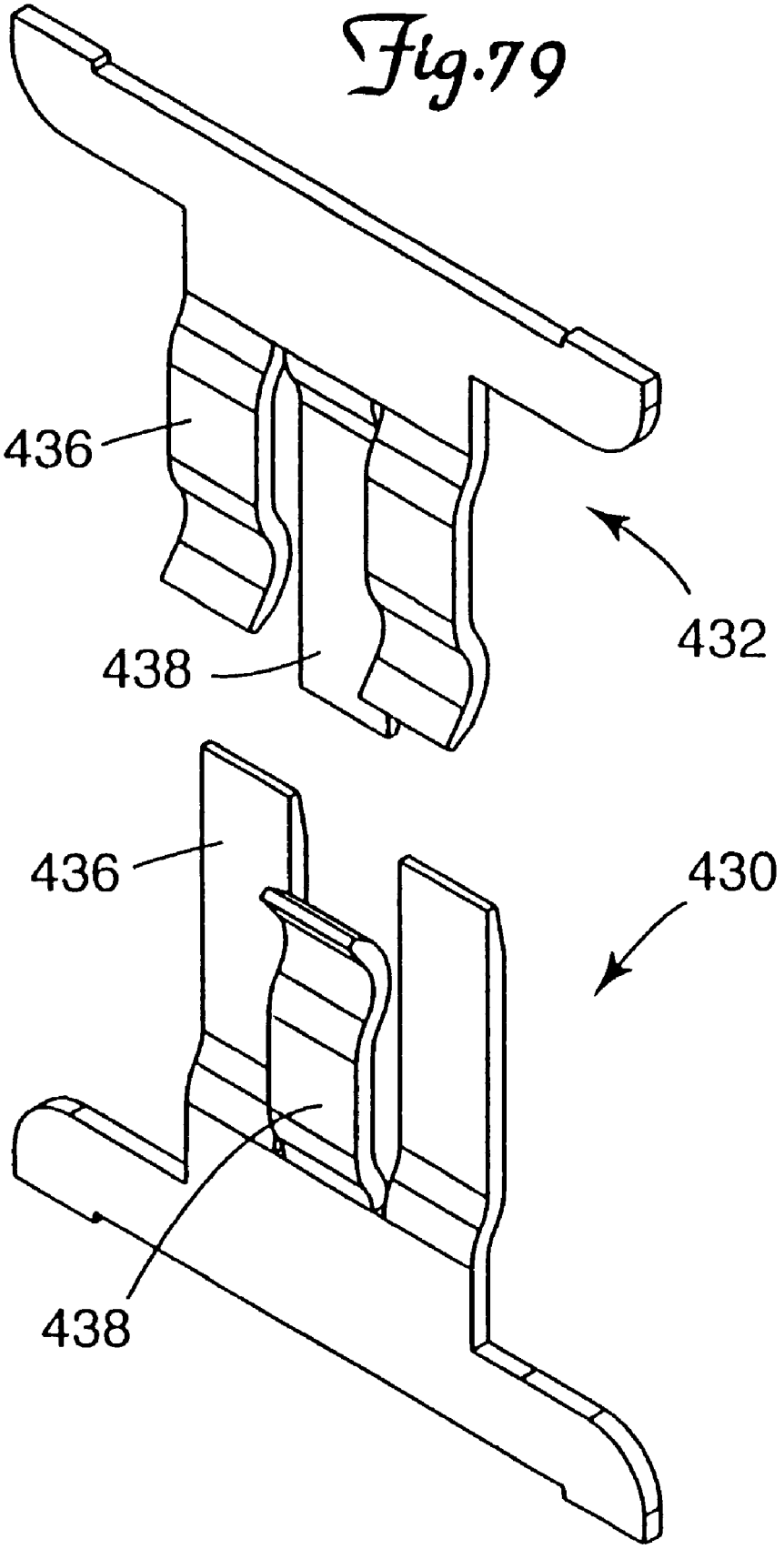
FIG. 79 is a perspective view showing mating "T-shaped" power contacts of the embodiment of FIG. 78 with the same shown disposed in position for interconnection.
Figure 80:
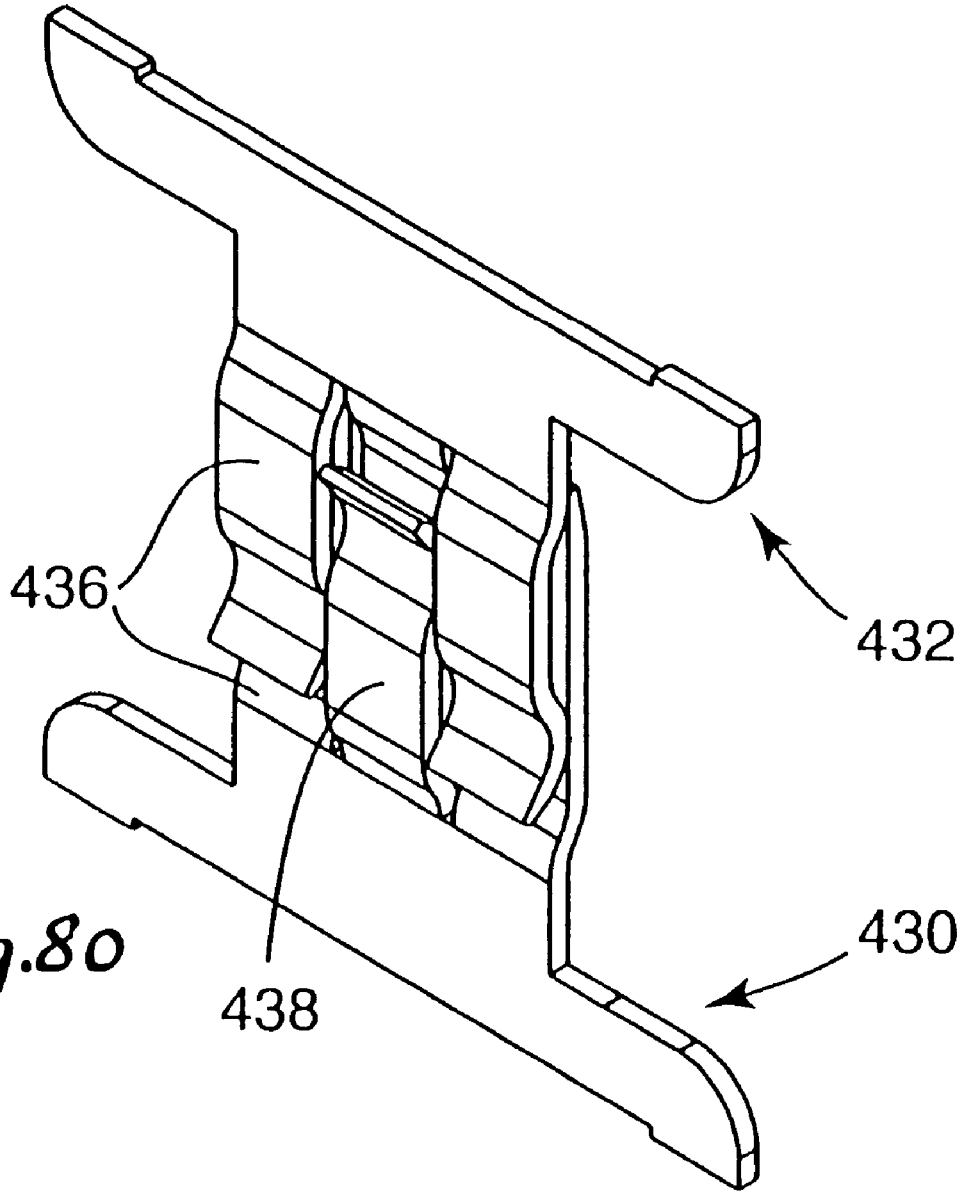
FIG. 80 is a perspective view of "T-shaped" power contacts of the embodiment of FIG. 78 with the same disposed in mated condition.
Figure 81:
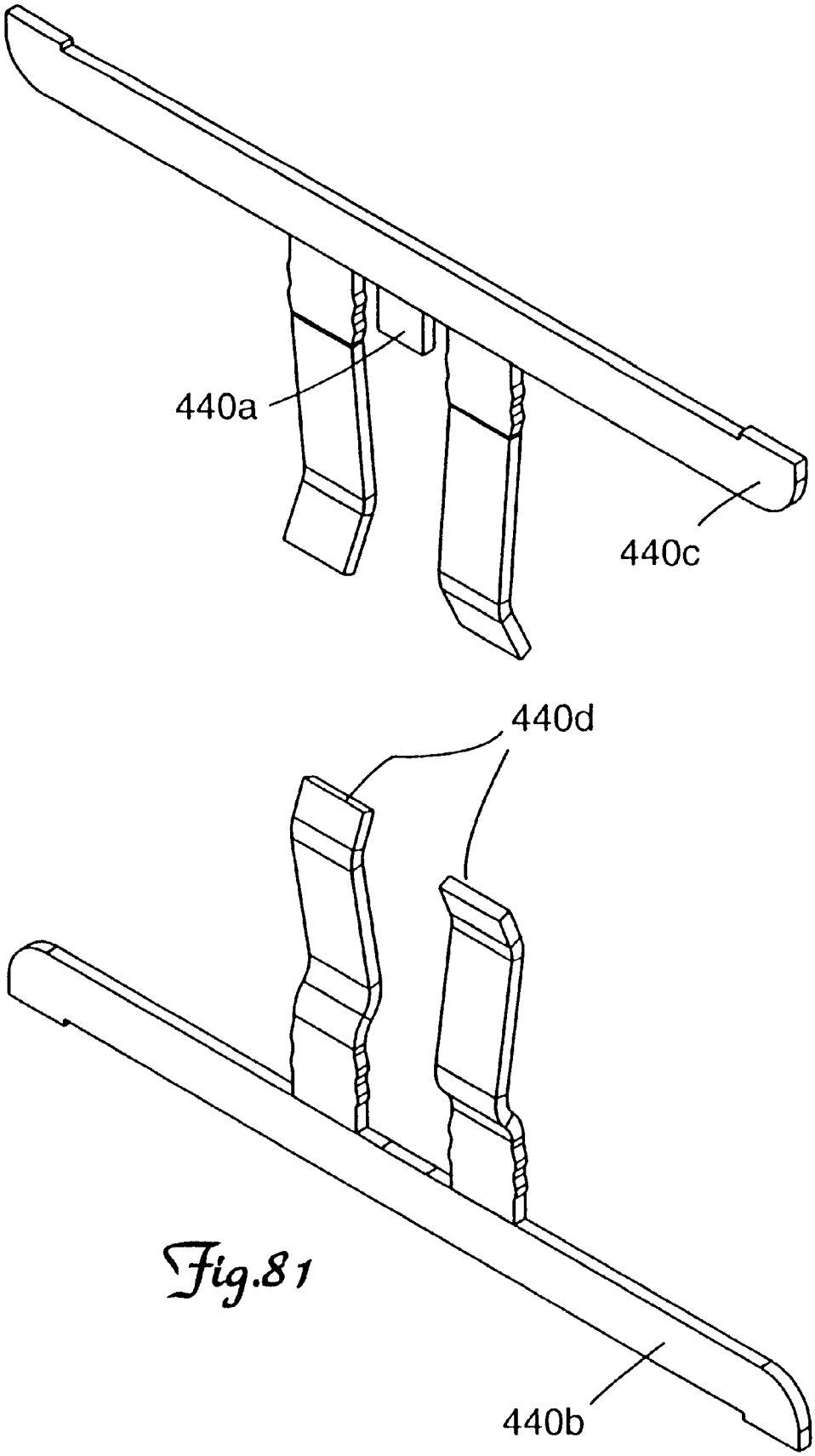
FIG. 81 is a perspective view of "T-shaped" contact structures having two conducting fingers according to one embodiment of the disclosed method and apparatus with the same disposed in position for interconnection.
Figure 82:
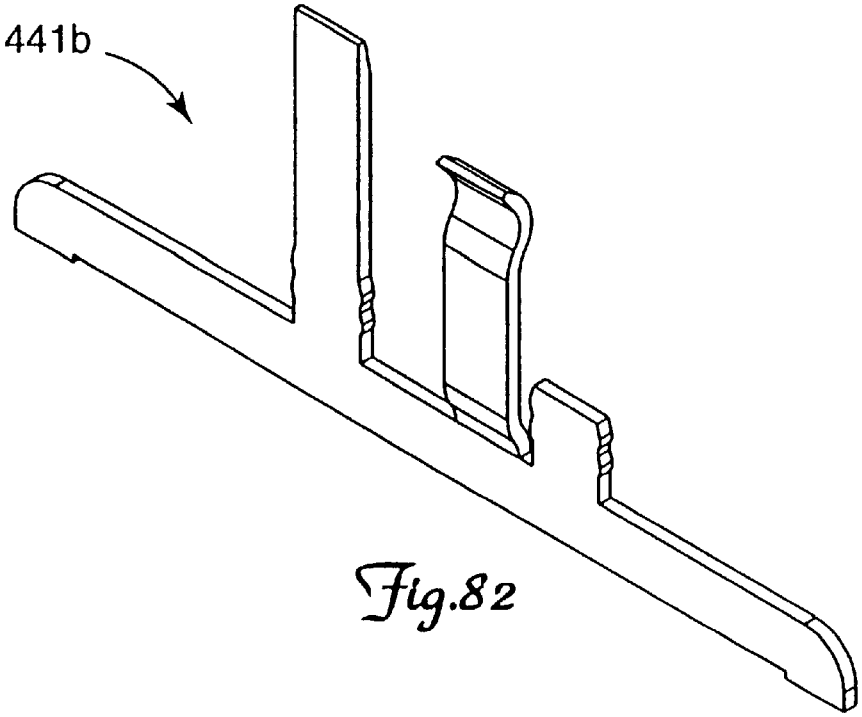
FIG. 82 is a perspective view of a "T-shaped" power connector having three conducting fingers according to one embodiment of the disclosed method and apparatus.
Figure 83:
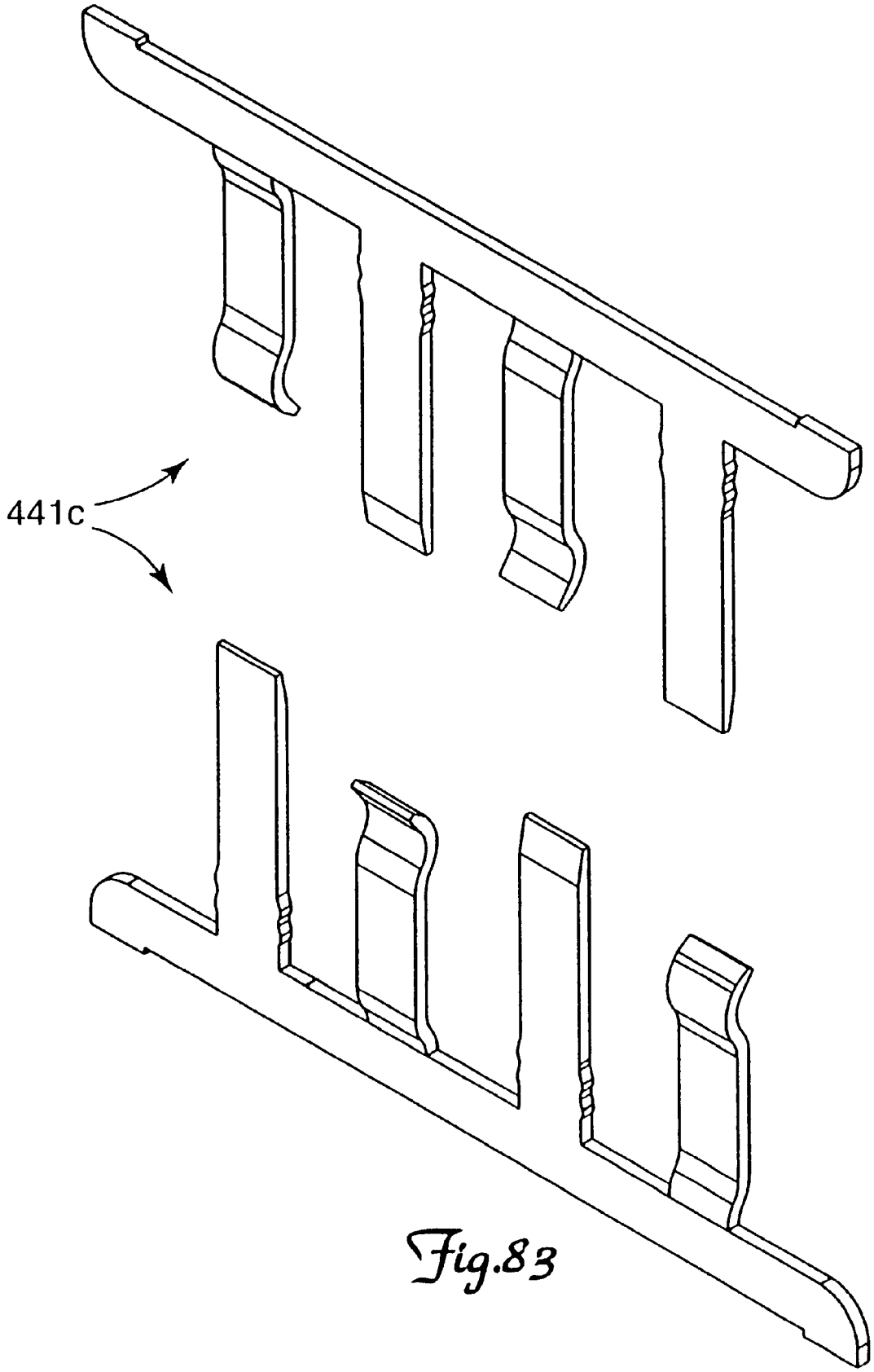
FIG. 83 is a perspective cross sectional view of "T-shaped" power contacts having four conducting fingers according to one embodiment of the disclosed method and apparatus with the same disposed in position for interconnection.

FIG. 78 shows one embodiment of a T-shaped structure for a power contact integral to a two piece embodiment (a socket 420*b* and a plug 420*a*) in a parallel board (or mezzanine) configuration. The socket includes power contacts 430 and the plug includes power contacts 432. FIG. 79 illustrates two individual mating three finger power contacts 430 and 432 similar to the of the embodiment of FIG. 78 in an unmated condition. These contacts have active and passive conducting spring fingers 436 and 438, respectively, disposed in an alternating arrangement, such that the spring fingers will mate and engage when configured in an inverse relationship in the separate connector housings, as shown. FIG. 80 illustrates these same power contacts 430 and 432, in a mated condition with the active and passive conducting spring fingers 436 and 438 engaged, thereby providing redundant contact interface connection and relatively large total cross sectional contact area. It will be understood with benefit of this disclosure that other embodiments having different numbers and types of active and passive spring fingers may be employed, including those having fewer or greater numbers of fingers, and/or those in which the active and passive spring contacts are disposed in different or non-alternating relationship. In addition, other suitable conducting spring finger shapes may also be employed. For example, FIGS. 81, 82, and 83 each show T-shaped contact structures 441i a, 441*b,* 441*c* having two, three, and four conducting fingers disposed on a separable portion of each contact, respectively. FIG. 81 also illustrates a stabilizing element 440*a* positioned on contact base 440*c* for engaging the contact base 440*b* during contact mating to prevent or resist twisting of contacts 440*b* and 440*c* due to torque generated by contact tips 440*d* during mating.

Figure 84:
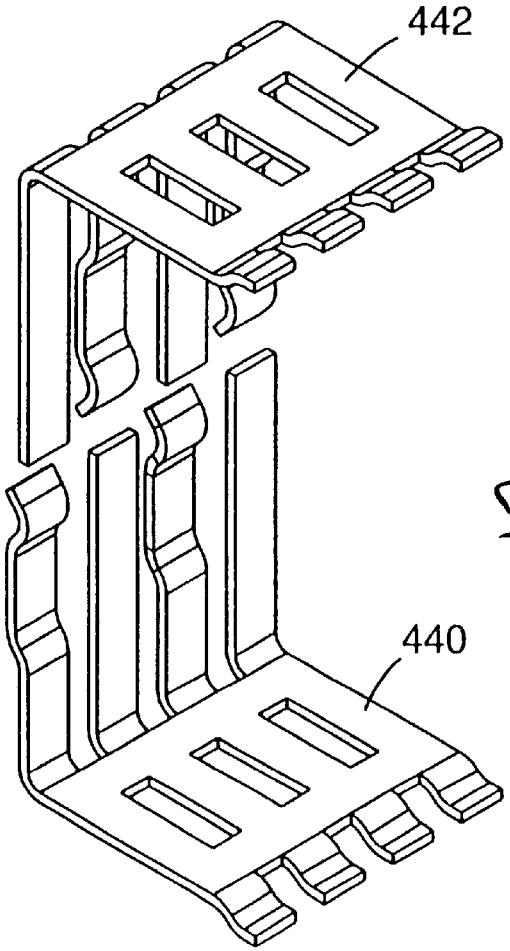
FIG. 84 is a perspective view of power contacts having four conductor fingers according to one embodiment of the disclosed method and apparatus with the same disposed in position for interconnection.

Illustrating just one of many other possible power conductor embodiments, FIG. 84 shows a four conductor finger contact configuration without a T-shaped base portion and for "side by side" card mating. This embodiment has base portions 440 and 442 that are connected in providing one substantial contact (i.e., having low inductance, redundant solder joints and spring fingers, etc.). As shown in the illustrated embodiments, contact redundancy is provided by the presence of multiple separable spring conductor fingers and multiple solder foot portions, whether in a T-shaped configuration or not. It will be understood with benefit of the present disclosure that having such redundancy in both separable spring finger portions and contact foot solder joint portions of a power contact is typically desirable since a contact may fail in either area.

Figure 84A:
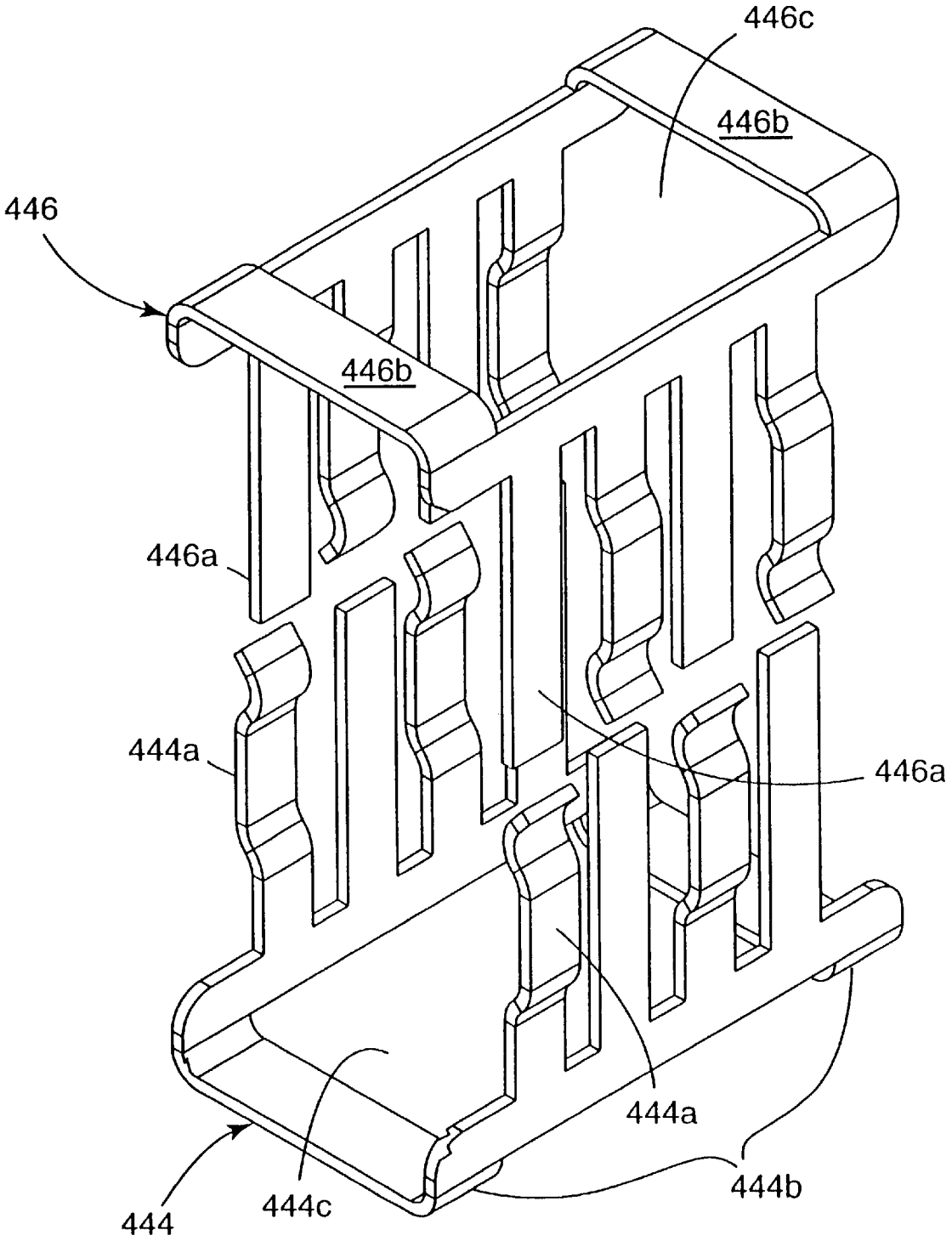
FIG. 84A is a perspective view of power contacts having two rows of four conductor fingers according to one embodiment of the disclosed method and apparatus with the same disposed in position for interconnection.
Figure 84B:
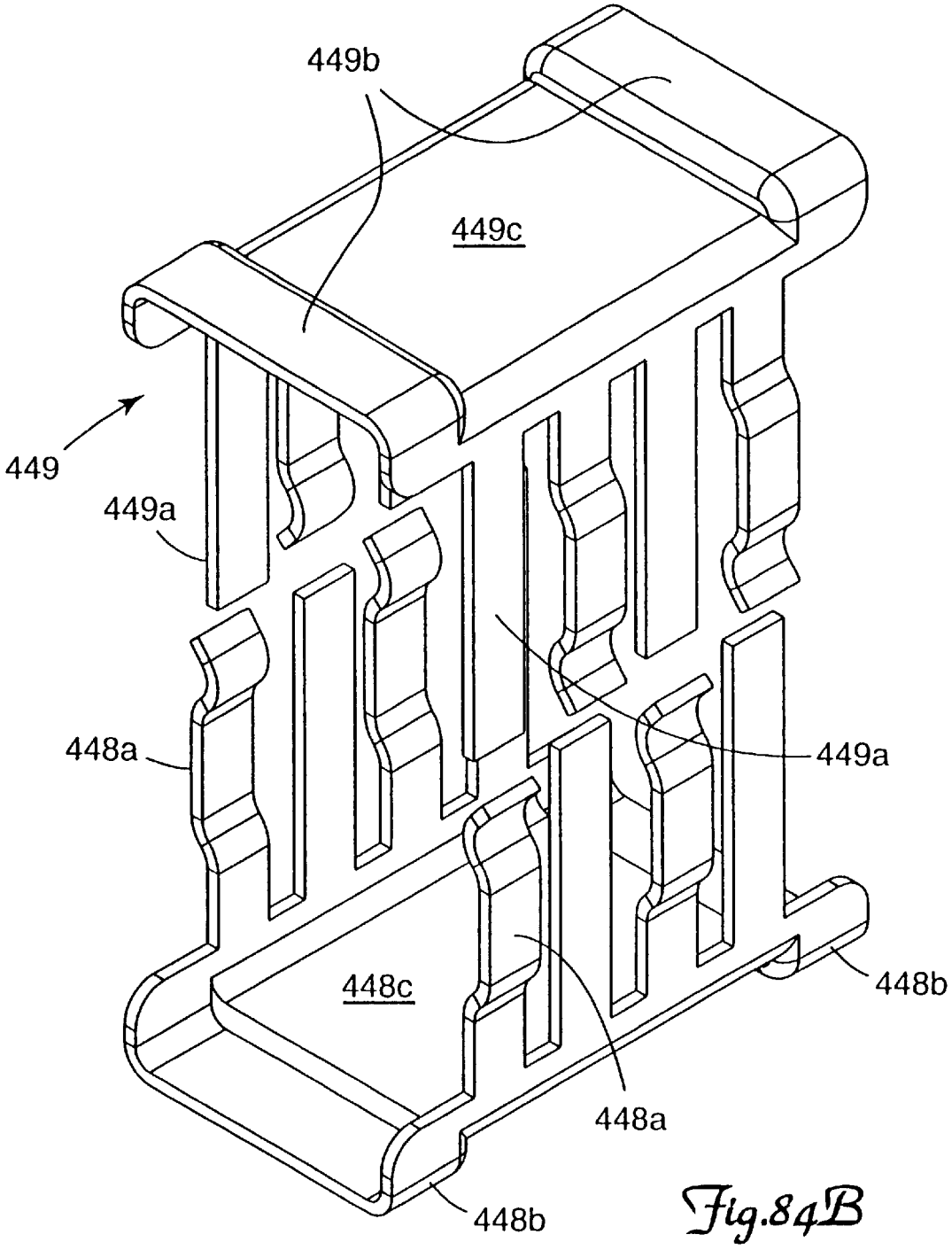
FIG. 84B is a perspective view of power contacts having two rows of four conductor fingers according to another embodiment of the disclosed method and apparatus with the same disposed in position for interconnection.

Power contact embodiments may also have multiple conductor row configurations including two or more rows of conductor elements. For example, FIGS. 84A and 84B show mating "U-shaped" power contact embodiments having two rows of spring conductor fingers. In FIG. 84A, base portions 444 and 446 are shown with each having two rows of four conductor fingers, 444*a* and 446*a*, respectively. Contact surfaces 444*b* and 446*b*, each having a relatively large surface area for electrical contact, are provided on opposite ends of each base portion 444 and 446, respectively. Open base areas 444*c* and 446*c* are defined between each respective set of contact surfaces 444*b* and 446*b*. Advantageously, multiple rows of conductor fingers provides additional redundancy, as does dual contact elements.

In FIG. 84B, base portions 448 and 449 are shown with each having two rows of four conductor fingers 448*a* and 449*a* and two contact surfaces, 448*c* and 449*c*, in a manner similar to the embodiment of FIG. 84A. However, in this embodiment solid base areas 448*c* and 449*c* are provided for absorbing connector stresses, thereby minimizing stress relaxation and creep phenomenon. It will be understood with benefit of the present disclosure that power contact embodiments may also utilize more than two rows of conductor fingers having more or less than four conductors per row. It will also be understood that a base area may be partially open, as opposed to completely solid or open, as illustrated.

Figure 85:
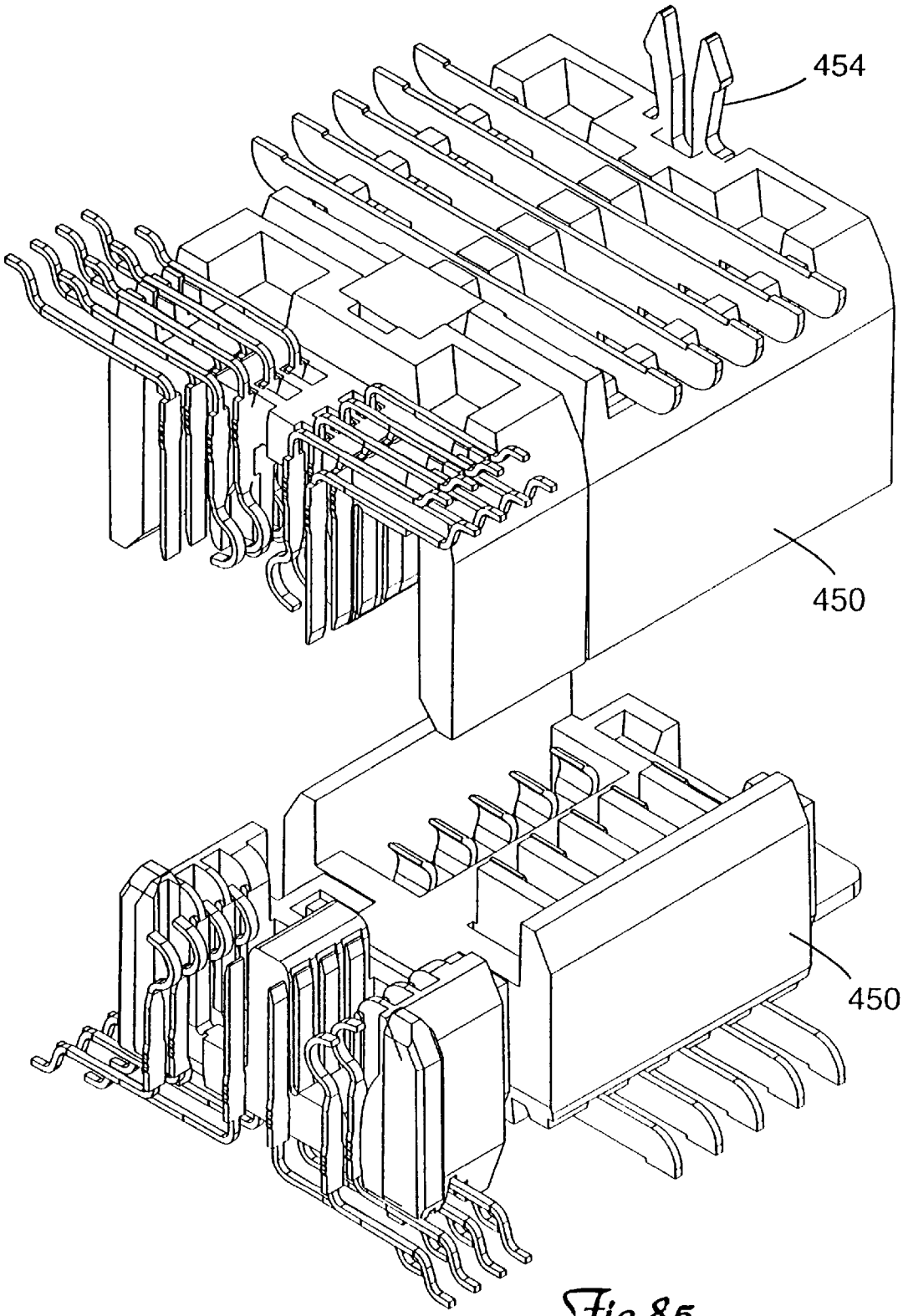
FIG. 85 is a perspective cross sectional view of a plug and socket having separate power modules according to one mezzanine embodiment of the disclosed meihod and apparatus.
Figure 86:
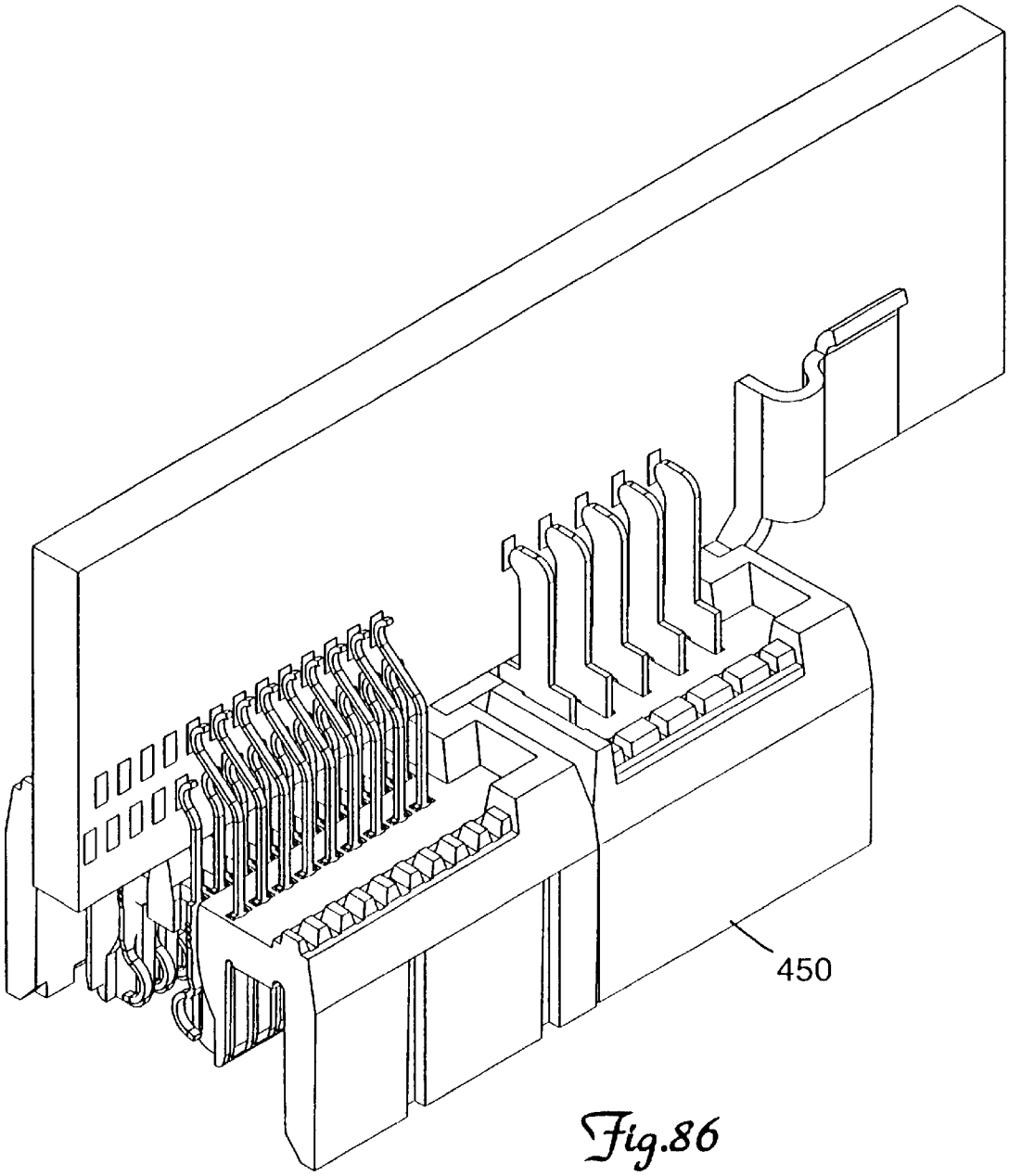
FIG. 86 is a perspective cross sectional view of a connector housing having a separate power module and a printed circuit board according to one straddlemount embodiment of the disclosed method and apparatus with the same disposed in mated condition.

In embodiments of the disclosed method and apparatus it is typically desirable to provide power contact structures that are integral in a single housing both for purposes of alignment at the separating and board attachment interfaces, as well as for purposes of density. However, in some cases, product cost concerns may dictate the use of separate modules. Accordingly, FIGS. 85 and 86 show separate power modules 450 for mezzanine and straddlemount configurations of a two piece product, respectively. In both illustrated embodiments, the power modules 450 are positioned in an area in which a board attachment clip 454 is inserted. Advantageously, these power modules may be used to provide a power connection to the same connector housings used with previous embodiments. Attachment of power modules to a connector housing may be accomplished using the same attachment ears described earlier for straddlemount attachment clips and other mounting devices.

Figure 87:
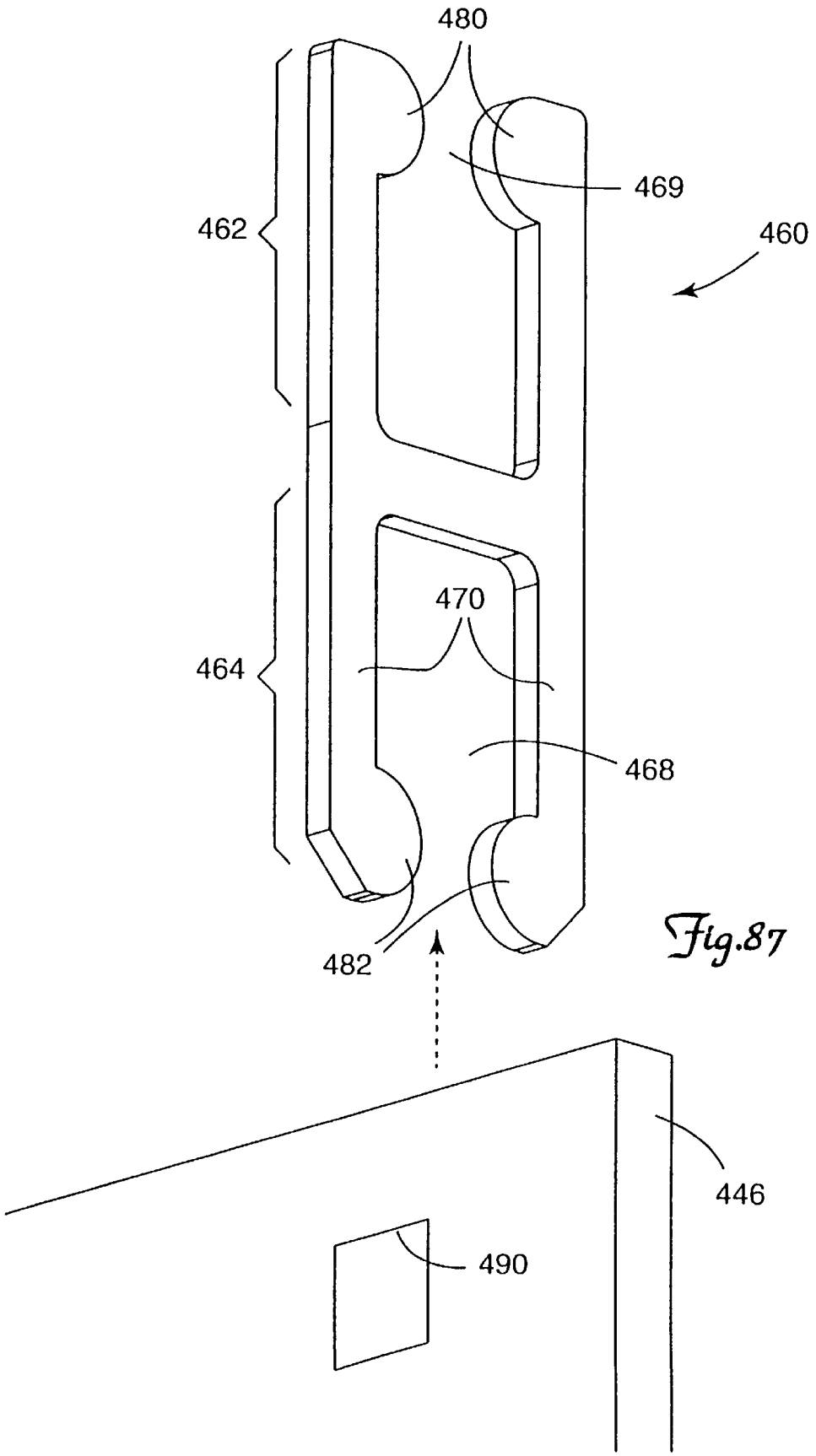
FIG. 87 is a perspective view of a "U-shaped" power contact and a printed circuit board according to one straddlemount embodiment of the disclosed method and apparatus with the same disposed in position for interconnection.

FIG. 87 illustrates a double U-shaped power contact 460 in accordance with the embodiment of FIG. 86 of the disclosed method and apparatus. This power contact embodiment has a straddlemount configuration that offers similar advantages to power contacts previously described, including providing a more precise straddlemount gap and limitations of stress relaxation to the contact material, rather than connector housing material. It will be understood with benefit of the present disclosure that this straddlemount configuration is designed to enable centerline attachment to a mating connector as well as a printed circuit board to which it is attached. In this embodiment, Board mount portion 464 of power contact 460 is constructed with a U-shape as shown in FIG. 87. U-shaped portion 464 is designed to be engaged with a printed circuit board 466 such that printed circuit board 466 penetrates a channel 468 of the "U" formed between spring fingers 470. As with other embodiments, when engagement occurs, spring fingers 470 provide a spring force normal to board 466 which will retain the connector position on the board until, for example, a soldering process is completed. This spring normal force also serves to improve contact between power contact 460 and pad area 490 of circuit board 466, decreasing electrical resistance and heat generation. Connector mount portion 462 is also configured in a U-shape. U-shaped portion 462 is designed to be engaged with a blade of a connector such that the blade penetrates a channel 469 of the "U" formed between spring fingers 480, thereby creating a spring normal force to the blade as described previously. Advantageously, this embodiment eliminates need for relatively large power lugs connected to a printed circuit board. It will be understood with the present disclosure that this and similar embodiments may also be used to connect two card edges, rather than a card edge to a connector.

Advantageously, U-shaped spring fingers 470 also absorb differences in board thickness, which are currently prevalent in the industry both within lots, between lots, and between different circuit board designs and manufacturers. Although not shown, a lead in for a power contact to facilitate and/or enable deflection of the U-shaped spring fingers is typically provided by a routed edge of printed circuit board 466 as previously described. However, a suitable lead in may also be provided on tips 472 of each spring finger 470, as shown in FIG. 87.

In the practice of the disclosed method and apparatus, power contacts are typically constructed from a base material with high electrical conductivity, most typically a copper alloy. Typically, separable interfaces 480 are plated with gold and board attachment interfaces 482 with a tin/lead composition, both over a nickel base. However, any other materials and construction suitable for conducting power may be employed, for example, either of the above mentioned interfaces may be plated entirely with gold or entirely with a tin/lead composition. Other possible materials suitable for either interface include, but are not limited to, palladium/nickel with a gold "flash," aluminum, aluminum alloys, or mixtures thereof.

Advantageously, in a manner similar to rotated contact embodiments described previously, stamped power contacts embodiments of the disclosed method and apparatus offer increased rigidity and resilience over conventional contacts. Due to greater rigidity, any stress relaxation effects due to heat generation or other causes are primarily due to metal stress relaxation in the power contact rather than in a plastic connector housing. Therefore problems associated with stress relaxation are minimized.

It will be understood with benefit of the present disclosure that power contact embodiments of the disclosed method and apparatus may be practiced using any of the contact embodiments previously disclosed for non-power contacts. Although power contacts of the disclosed method and apparatus are typically not practiced with contact support structure embodiments described earlier due to their relatively high rigidity, a contact support structure may be employed with power contact embodiments if so desired. This is especially true for power contact embodiments having relatively thin widths. As with all mating contact embodiments of the disclosed method and apparatus, it is desirable that a mating power contact of the present embodiment have larger contact cross sectional area in contact mating areas than in its soldered tail connections. This is because mating contact surfaces are actually microscopically rough in nature, and therefore only create electrically conductive contact areas that are a fraction of the total contact surface area.

As an alternative to the surface mount configurations illustrated and previously described, power contact embodiments of the disclosed method and apparatus having similar features may also be utilized in plated through hole configurations having one or more plated through hole contact pins or protrusions in place of surface mount features.

Placement Cap for Board Assembly

During the assembly of a printed circuit board utilizing the interconnection systems disclosed herein, the plug and socket are generally soldered to a printed circuit board. Placement of the plug or socket onto the printed circuit board may be performed manually or automatically. FIG. 1G illustrates the use of placement caps, which may be inserted into the plugs and sockets to aid the board assembly process. In particular, prior to placing a plug 26 onto a circuit board, a placement cap 26P may be inserted into the plug 26 as shown by the direction of the arrows in FIG. 1G. Likewise, a placement cap 16P may be inserted within a socket 16. In either case, the placement caps will be engaged by the active springs of the plug or socket and be held within the connector piece.

The placement cap 26P has a relatively large surface area 26S and, likewise, the placement cap 16P has a relatively large surface area, 16S. The surface areas 26S and 16S provide a location that the user may utilize to pick up the socket or plug. For example, a user may utilize a vacuum mechanism to pick up and place the plugs or sockets and the vacuum pick-up mechanism may engage the surface areas 16S and 26S for such placement. Alternatively, the surfaces 16S or 26S may be formed so as to engage a mechanical or even magnetic pick-up mechanisms. After the user has placed the socket or plug on the printed circuit board and disengaged the pick up mechanism, the user may then solder the contact tails of the plug or socket to the printed circuit board. After the soldering process has been completed, the placement caps 26P and 16S may then be removed prior to mating of the connector pieces. Preferably, the placement caps may be formed of aluminum or plastics similar to that of the socket and plug housings. In this fashion, a relatively large surface area is provided so that a user may place and move the plugs or sockets relatively easy during the manufacturing process. The large surface areas may be subsequently removed so that the connector area may be more fully utilized for dense connections without having to provide a dedicated surface area for pick up and placement. Though not shown, a similar placement cap may be utilized with card-edge connection sockets.

EXAMPLES

The following examples are illustrative and should not be construed as limiting the scope of the invention or claims thereof.

In the following examples, two piece connector embodiments of the disclosed method and apparatus are disclosed. It will be understood with benefit of the present disclosure that the various contact element features disclosed in these examples may also be employed in card edge embodiments of the disclosed method and apparatus as illustrated in FIG. 2B.

Example 1

Example 1 represents one embodiment of the disclosed method and apparatus having some of the features described above. The embodiment disclosed in Example 1 provides an improved high density, fine pitch, electrical interconnection for use in board stacking, vertical to vertical, mother to daughter, vertical to right angle and/or straddle. This embodiment allows a 0.4 mm spacing between solder bonds connecting the contact elements of the interconnection to a circuit on the PCB if the solder feet form two single lines, or at a spacing of 0.8 mm when alternate solder pads are staggered and placed in four rows as illustrated.

Figure 88:
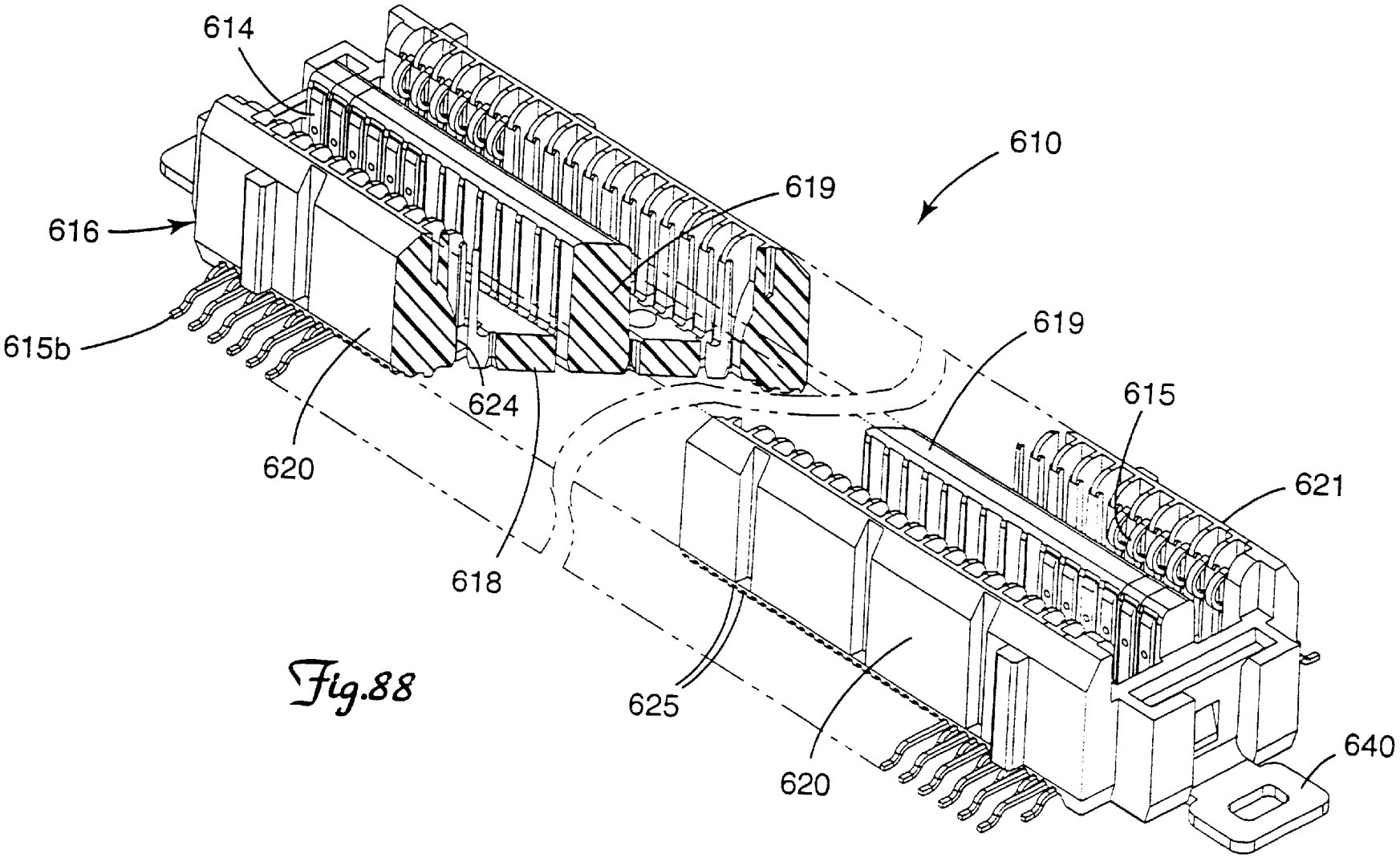
FIG. 88 is a perspective view of the socket of an electrical interconnection according to the present invention.
Figure 89:
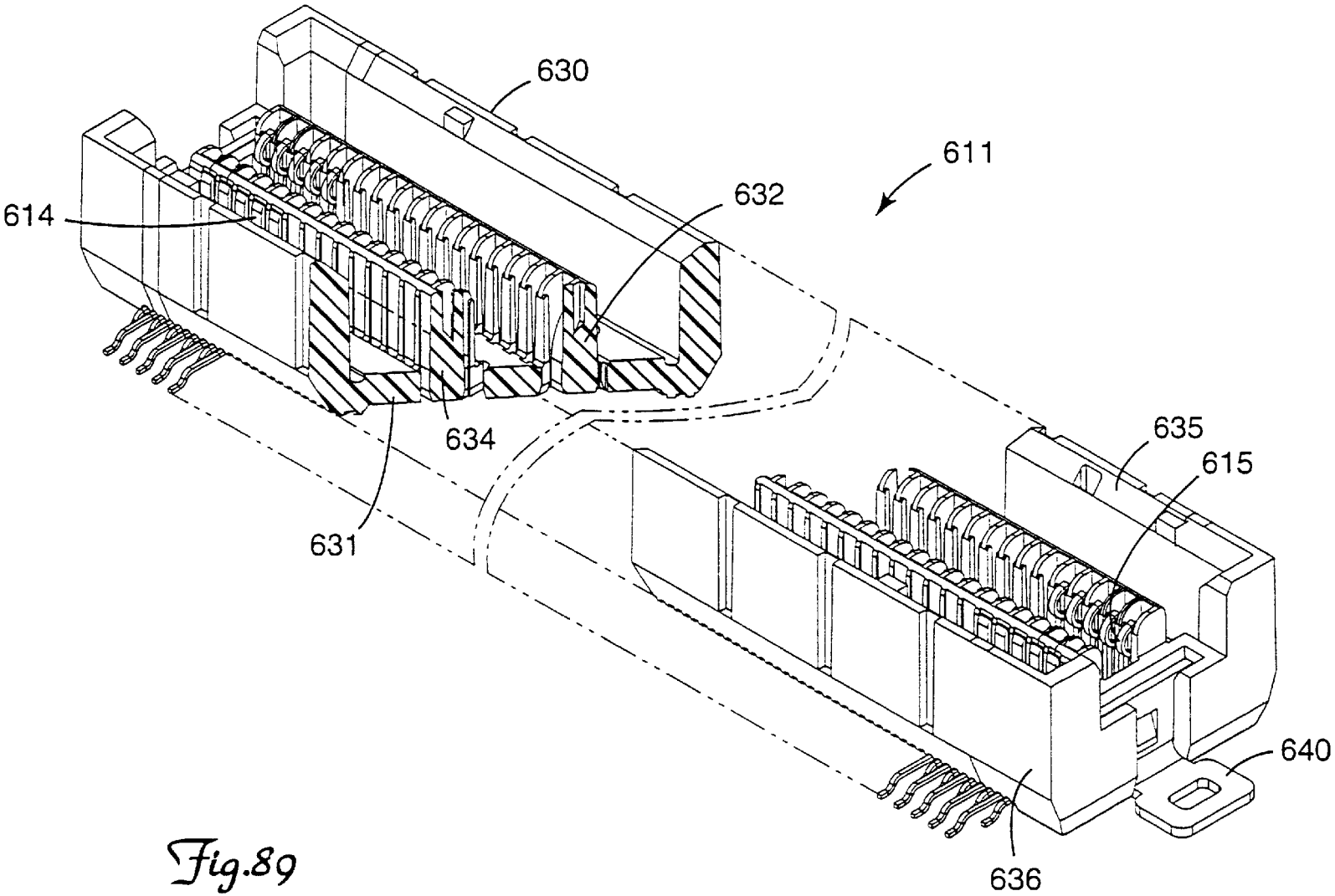
Figure 90:
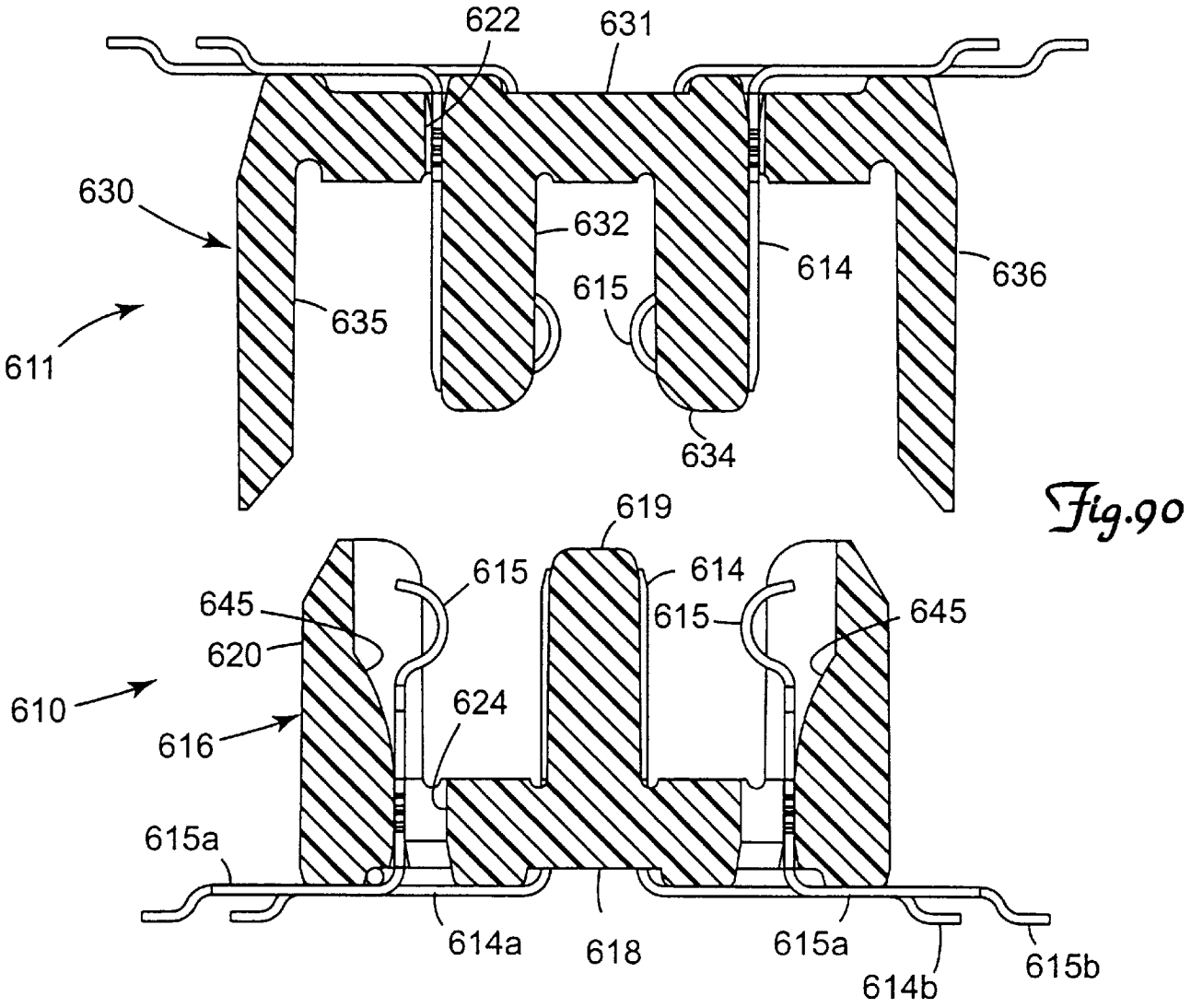
Figure 94:
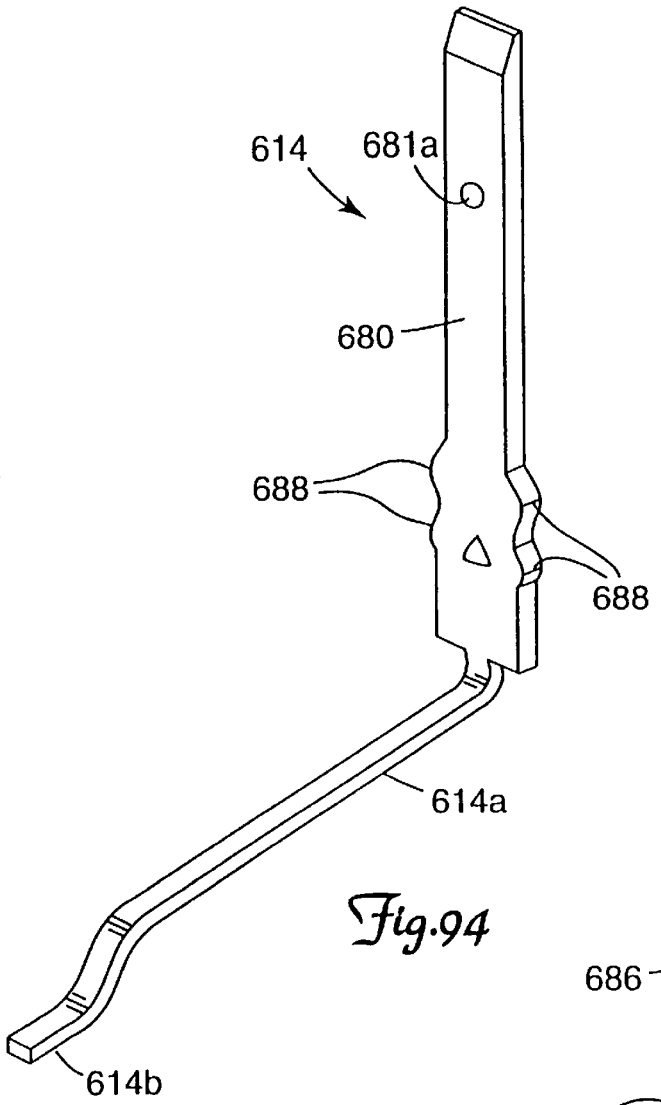
Figure 95:
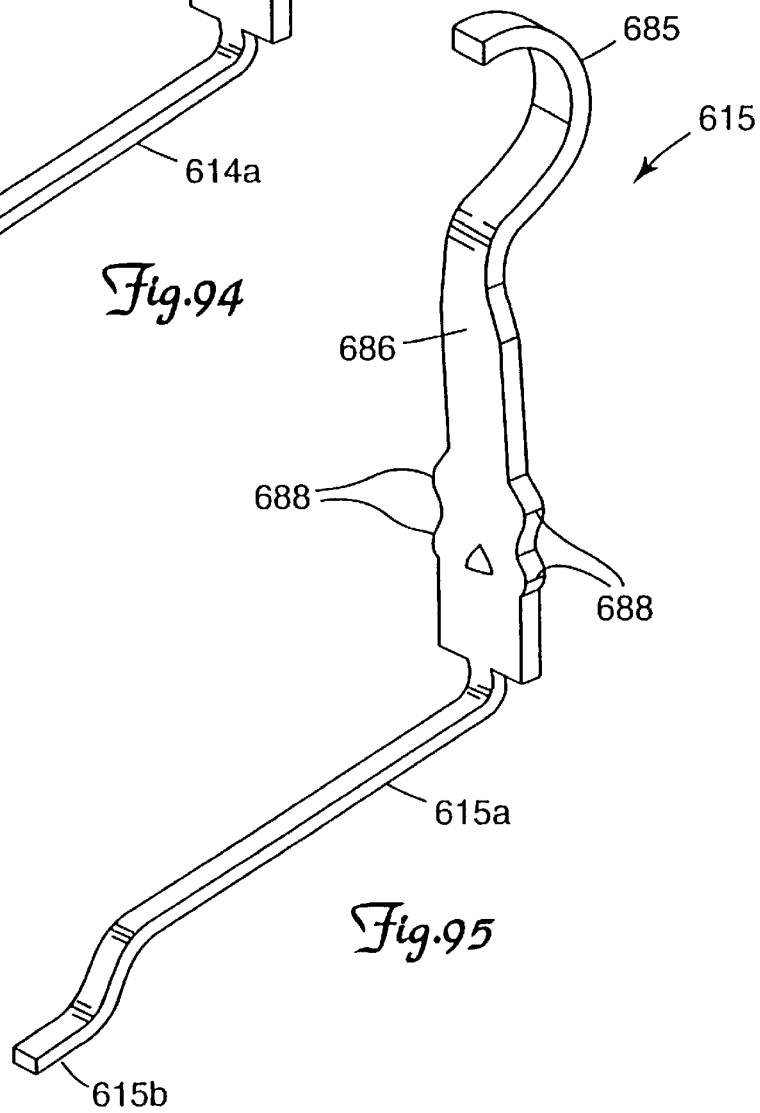

In accompanying drawing, FIGS. 88, 89 and 90 illustrate an interconnection according to the present invention similar to that shown in FIGS. 1A and 1B, comprising a socket 610 and a plug 611, each of which utilize passive contact elements 614 as illustrated in FIG. 94 and active contact elements 615 as illustrated in FIG. 95. The socket 610 has a body 616 comprising a base 618 and three spaced parallel wall members positioned on one side of the base 618. The three parallel wall members form a central wall member 619, having opposite surfaces, and opposed identical side wall members 620 and 621, that are positioned on the base as mirror images of each other in opposed relationship to each other and in opposed relationship to the central wall 619. Two rows of identical active contact elements 615 are supported on the wall members 620 and 621 and two rows of identical passive contact elements 614 are supported on the opposite surfaces of the central wall member 619 of the socket body 616. The rows of active and passive contact elements are positioned in offset relationship with respect to each other. The contact elements 614 and 615 have a mating portion positioned within the socket 610. They may be connected to the PCB or other circuit carrying member any number of ways, but as illustrated the contact elements have and solder tails of a reduced dimension extending through the base 618 to an offset solder foot adjacent the end thereof. The solder tails 614*a* and 615*a*, as illustrated, are positioned through openings 622 and 624 respectively in the base 618 and are bent to form an included angle in relationship to the contact portion of about 85° to direct the solder tails outward of the socket and between stabilizing notches 625 formed in the base 618 on the side opposite the side wall members 620 and 621. It should be noted the solder tails 614*a* of the passive contact elements 614 do not extend as far to the foot 614*b* as the solder tails 615*a* on the active contact elements 615. The solder tails 614*a* and 615*a* are of substantially equal length on the passive and the active contact elements to control impedance.

The plug 611 has a body 630 and two rows of passive contact elements 614 and two rows of active contact elements 615. The body 630 has a wall 631 forming a top wall and depending side walls 632 and 634 positioned centrally of the body 630 in spaced parallel position to receive the central wall 619 and the passive contact elements 614 of the socket there between. Positioned in outwardly spaced relationship to the walls 632 and 634, are walls 635 and 636 which form outside covering members for the interconnection. The walls 635 and 636 have beveled or tapered edges to form guides to receive the side walls 620 and 621 there between. These walls 635 and 636 are enclosures and are not necessary to the operation of the interconnection. On the walls 632 and 634 are positioned two opposed rows of active contact elements 615 and on the opposite sides of the wall members 632 and 634 are passive contact elements 614 positioned for engagement by the active contact elements 615 in the socket 610. The plug 611 is adapted to mate with the socket and the wall members 632 and 634 support two rows of spaced active contact elements 615 affording engagement with the two rows of passive contact elements on the central wall 619 of the socket, and the wall members 632 and 634 of the plug have outside wall surfaces supporting contact elements 614 affording electrical engagement with the active contact elements 615 on socket side wall members 620 and 621. The contact elements on the plug can be joined to a PCB in a number of ways, but as illustrated have solder tail portions extending an equal distance through the openings in the top wall 631 to a stepped solder foot adapted to bond to a circuit. The solder tails are in a plane and held in notches along the sides of the body 630. The solder feet 614*a* and 615*a* form four rows of contact points. The four rows of solder feet of the plug corresponding to the four rows of solder feet on the socket form staggered rows of solder pads adjacent the respective plug and socket. The solder feet from the contact elements 614 supported from the central wall member of the socket 610 are disposed inward and in adjacent offset or stepped relationship to the solder feet 615*b* from the contact elements 615 supported by the side wall members 620 and 621 of the socket 610. The same relationship is true for the plug, but reversed.

The socket 610 and the plug 611 have a corresponding number of contact elements on each side of a mid-plane dividing the socket and plug vertically. The tail portions 614*a* of the contact elements 614 on the central wall form two rows of contact bonds 646 and 648, see FIG. 91, positioned within the two rows 649 and 647 of contact bonds formed by the contact tails 615*a* of the contact elements 615 positioned on opposed sides of the side wall members 620 and 621 of the socket. In the embodiment of FIGS. 88–90, the socket 610 and the plug 611 form mirror images about a plane forming a longitudinal section of the socket and plug. Further, in a preferred embodiment the active contact elements of the socket and plug are supported and each are formed with a arcuate end portion forming the contact portion which interferes with and contacts the passive contact elements upon mating the socket with the plug. This relationship will be discussed below and with reference to FIG. 95.

The ends of the socket 610 and the plug 611 are formed to support an attaching bracket 640. The brackets 640 are affixed to the socket and plug to hold the socket and plug respectively to the PCB to which they are mounted. The strength of the socket 610 is improved by having a greater number of passive contact elements on the central wall member 619 to extend the central wall from end wall to end wall of the socket. Also, it is desired to have the wall members 632 and 634 extend between end wall and end wall of the plug.

As best shown in FIG. 90, the active contacts 615 are positioned adjacent to a wall surface 645 of the side wall members 620 and 621 and the wall members 632 and 634 which is formed with an arcuate configuration of a given radius. This construction provides an extended life for the contact element and an increase in the spring force in the active contact elements 615 as the plug is inserted into the socket. Further, the bending stress on the active contact elements is placed along the length of the contact element body in the socket or plug, as opposed to being isolated at exit point of the contact element from the base 618 or top wall 631. In an illustrated embodiment, the radius of the wall surface 645 may be between 1.27 mm and 33 mm (0.05 in. and 1.3 in.) with contact elements having a length, i.e. the length of the elements being the length of the cantilever beam of the active contact element from the position free of the curved surface to the contact portion, between 2.17 mm and 6.35 mm (0.085 in. and 0.25 in.). In the illustrated interconnector, the radius is between 3.2 mm (0.125 in.) and 8.9 mm (0.35 in.) and the length of the cantilever beam of the active contact element is between 2.17 mm (0.085 in.) and 2.9 mm (0.115 in.). The use of this contact support design for the active contact elements 615 allows the use of shorter contact elements, thinner material in the contact element, and narrower contact elements. This reduces the height and length of the interconnection, but maintains the desired contact force between the contact elements. Thus the stack height for the PCB's or the spacing between boards is reduced. This design with the curved support for the contact elements also reduces the insertion force, reduces the deleterious effect of shock and vibration, and reduces stress relaxation as compared to a cantilever mounted spring loaded contact without the wall support. The shape of the contact elements 615 also improves surface contact, reduces cross talk by increasing spacing, and the small cross-section provides a better impedance match with plated circuitry on the PCB or flexible circuitry. The electrical length from the solder joint through the interconnection to the corresponding solder joint should be of equal length for all the interconnections between contact elements.

Example 2

Figure 92:
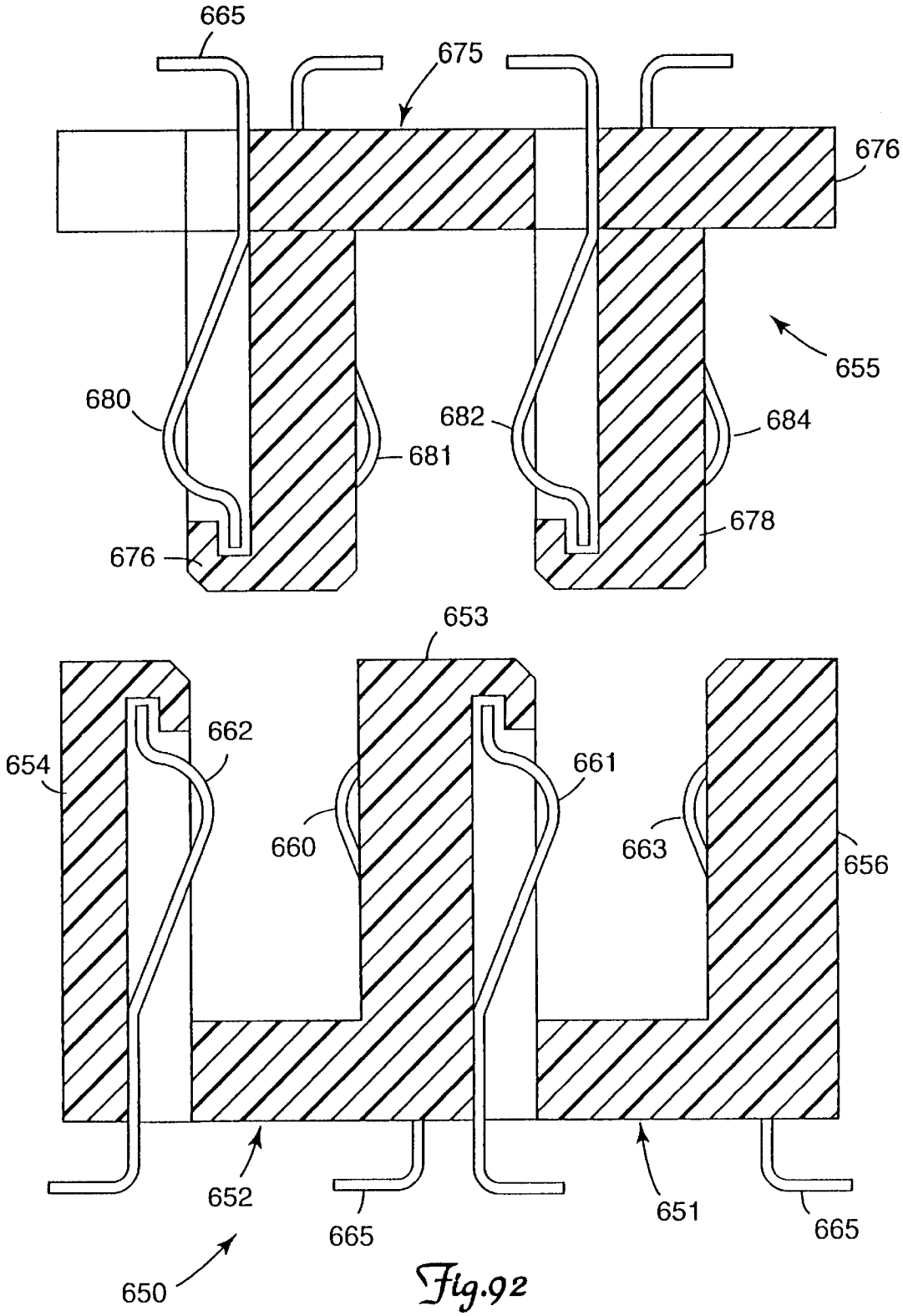

Example 2 is illustrated in FIG. 92 and represents a further embodiment of an interconnection according to the present invention. In this embodiment, the socket 650 and the plug 655 each have a body as described above. The socket body 651 comprises a base 652 and three parallel wall members 653, 654 and 656 positioned on one side of the base 652 forming a central wall member 653 and opposed identical side wall members 654 and 656. The central wall member 653 has opposite surfaces and the side wall members have surfaces opposed to the opposite surfaces of the central wall member 653. Electrical contact elements 660 and 661 are positioned along the opposite surfaces of the central wall member 653 forming two rows of contact elements and electrical contact elements 662 and 663 are positioned along the opposed surfaces of the side wall members 654 and 656, respectively, forming two additional rows of contact elements. The contact elements 661 and 662 are aligned transversely of the socket 650 and they are staggered in relationship to the contact elements 660 and 663 along the rows formed by the solder tails 665 of the contact elements. This staggered pattern of the solder tails 665 in the four rows is shown in FIG. 93.

Figure 91:
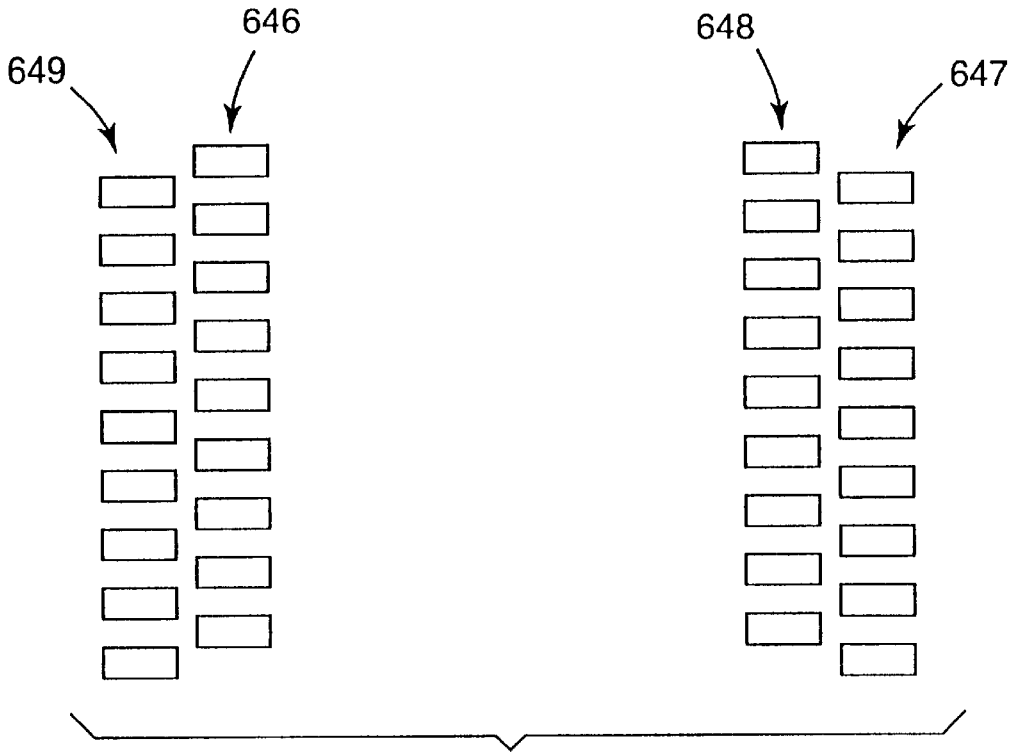

The plug 655 comprises a body 675 having a top wall 676 and at least two depending spaced parallel wall members 676 and 678, each wall member having opposite surfaces. The wall members 676 and 678 are adapted to be disposed one on each side of the central wall member 653 of the socket 650. Electrical contact elements 680 and 681 are positioned along the opposite surfaces of the parallel wall member 676 and electrical contact elements 682 and 684 are positioned along the opposite surfaces of the wall member 678. The contact elements 680 and 681 are offset longitudinally of the plug 655 and elements 680 and 682 are transversely aligned, thus forming four rows of contact elements in staggered relationship for electrical contact with the electrical contact elements 662, 660, 661 and 663 of the socket. The contacts 681 and 682, mate with the electrical contacts 660 and 661 positioned along the opposite surfaces of the central wall member 653 and the electrical contact elements 680 and 684 are positioned to make electrical contact with contact elements 662 and 663 along said side wall members 654 and 656. All the contact elements are illustrated as identical, however modifications may be made to the contacts to provide a foot print that has the solder feet in two single lines or in the staggered format as illustrated in FIG. 91 and as illustrated in the foot print of the socket in FIG. 93.

Figure 93:
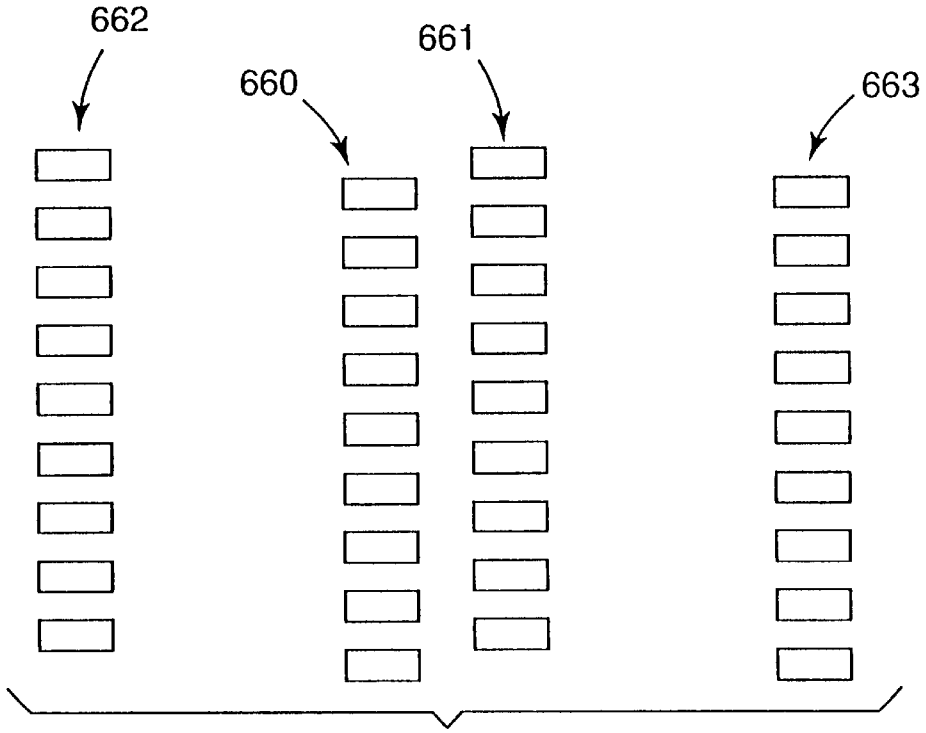

FIG. 93 illustrates the foot print of the solder tails to the PCB from the socket 650. A first row of foot prints designates the respective position of the contacts for the contact elements 662, the second row illustrates the row of contact elements 660, the third row illustrates the row of contact elements 661, and the fourth row illustrates the row contact elements 663. The staggered form of these contact elements is staggered in a manner different from the pattern of the interconnection of FIG. 90. The patterns could be made similar on both devices without change to the invention.

Referring now to FIG. 94, a passive contact element 614 is illustrated, comprising a contact portion 680 of generally uniform dimension, and provided with a beveled free end to guide the mating contact element, a button 681*a* extending from the face provides a lock with the mating contact element, and projections are 682 formed on opposite edges near the base for making frictionally locking engagement with the walls of the opening 622 in the base or top wall to hold the contact element 614 in the base or top wall of the socket and plug. As referenced above the contact element 614 has a solder tail 614*a* of a reduced width and bent at an angle of about 85° to the contact portion 680. This included angle is less than 90° to place the solder tails in a plane. The solder tail 614*a* extends outward to an offset solder foot 614*b* which makes contact with the pad on a plated circuit.

FIG. 95 illustrates the active contact 615 and it is formed with an arcuate contact portion 685 formed adjacent the free end of the element where the width is the narrowest at about 0.45 nm (0.018 in.). The contact portion 685 is tapered from the body 686 having a width of 0.5 mm (0.02 in.). At the base of the body 686 are projections 688 for making frictional contact at opposite sides of openings 624 in the base 618 of the socket or in the top wall 631 of the plug to hold the element 615 in place. At the projections 688, the element 615 is 0.55 mm (0.022 in.) wide. The thickness of the material is 0.16 mm (0.0062 in.). The openings 624 are shaped to allow the contact portion 685 to pass into the body and then the wider body portion 686 enters a longer slotted portion of the opening (not shown) where the projections engage the ends of this slotted portion. The contact element 615 has a solder tail 615*a* formed at an angle to the body 686, with the included angle being at or near 85° to force the solder tail 615*a* against the outside surface of the base or top wall in the notches and to hold the body of the contact element 615 against the wall surfaces 645. The solder tails terminate at an offset solder foot 615*b* which makes electrical contact with the circuit pad. The reduced thickness and width of the contact element, together with the support wall 645, maintains the contact force, permits a flattening of the contact portion 685, provides good inductance, improved impedance, and reduces stress relaxation.

An alternative to the use of an angle of less than 90°, or about 85°, as the included angle between the contact element and the solder tails is to have the angle exceed 90°, for example 92°, such that when the retention devices 640 are fixed to the socket and to the board, the solder tails are spring loaded toward the circuit pads. This resilient mounting of the feet on the solder tails levels the solder tails at the time of assembly.

The material for the contact elements 614 and 615 maybe a brass alloy, No. C7025 from Olin Corporation of East Alton, Ill. The material is about 96.2% copper, about 3% nickel, about 0.65% silicon and about 0.15% magnesium.

In the practice of the disclosed method and apparatus, connector housing components typically are constructed from injection molded glass filled polymer including, but not limited to, "DUPONT ZENITE" and "HOEREST-CELENESE VECTRA." Housings may also be manufactured of other suitable materials, such as other plastics, ceramics, metals, rubbers, or mixtures thereof. Contacts may be manufactured of any suitable conducting material including, but not limited to, metals, metal alloys, conductive metal oxides, and mixtures thereof. Most typically contacts are manufactured of a copper alloy (such as "OLIN 7025") plated over entirely with a nickel base layer, and selectively plated with a thin layer of gold over the separable area (or "sliding zone") of a contact where electrical and mechanical connection is made with other contacts during connector mating. Straddlemount attachment clips may be constructed of any suitably rigid material including, but not limited to metals, plastics, ceramics, or mixtures thereof. Most typically, straddlemount attachment clips are manufactured of a metal commonly known as cartridge brass, alloy 260.

As shown herein, connectors are mounted to printed circuit boards, however, connectors of the disclosed method and apparatus may also be used with many types of wiring mechanisms and substrates, such as flexible circuits, TAB tape, ceramics, discrete wire, flat ribbon cable, etc.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed structures and methods may be utilized in various combinations and/or independently. Thus the invention is not limited to only those combinations shown herein, but rather may include other combinations.

What is claimed is:

1. An electrical interconnection system comprising:

a latch mechanism comprising:

an elongated center rail having at least one side, said center rail having first and second ends defining a longitudinal axis therebetween, one or more compressible positioning profiles being disposed on said at least one side of said center rail and being compressible in a direction inward and substantially perpendicular to said longitudinal axis; and an elongated lead in rail extending longitudinally outward from said center rail, said lead in rail configured to guide said latch mechanism into said receiving slot; and a receiving channel adapted to receive said latch mechanism comprising:

an elongated receiving slot having at least one side and being adapted to slidably receive said one or more positioning profiles of said latch mechanism, and one or more profile recesses defined in said at least one side of said receiving slot, said one or more profile recesses being adapted to allow said one or more positioning profiles to expand within said one or more profile recesses to secure said one or more positioning profiles within said receiving slot;

wherein said latch mechanism and said receiving channel are coupled to respective mating components of said electrical interconnection system.

2. The electrical interconnection system as recited in claim 1, wherein said receiving slot and said lead in rail further comprise one or more corresponding polarizing geometrical features, wherein said features of said receiving slot and said lead in rail are configured to interrelate so that said latch mechanism may be received by said receiving slot in only one manner.

3. The electrical interconnection system as recited in claim 1, wherein said one or more positioning profiles have a shape which is complementary to a shape of said one or more profile recesses.

4. The electrical interconnection system as recited in claim 3, wherein said shapes of said positioning profiles and said profile recesses are configured so that said latching mechanism may be received by said receiving slot in only one manner.

5. The electrical interconnection system as recited in claim 1, wherein said center rail is at least partially conductive.

6. The electrical interconnection system as recited in claim 1, wherein said one or more positioning profiles and said one or more profile recesses are at least partially conductive, said conductive positioning profiles and profile recesses making contact and completing at least one circuit between said mating electrical interconnection components when said positioning profiles are expanded within said profile recesses.

7. The electrical interconnection system as recited in claim 6, wherein said one or more conductive positioning profiles or said one or more conductive profile recesses are electrically connected to one or more conductive layers, strips, or wires of a circuit board.

8. The electrical interconnection system as recited in claim 6, further comprising at least one contact coupled to one of said mating components of said electrical interconnection system and a conducting contact pin coupled to said center rail, said contact pin adapted to establish an electrical connection between said center rail and said contact.

* * * * *